US012778359B2

(12) United States Patent
Borke et al.

(10) Patent No.: US 12,778,359 B2
(45) Date of Patent: Nov. 3, 2026

(54) SHEET PRODUCT DISPENSER

(71) Applicant: GPCP IP Holdings LLC, Atlanta, GA (US)

(72) Inventors: Brian Scott Borke, Appleton, WI (US); Ryan Joseph Schuh, Kimberly, WI (US); Kevin Michael Swanson, Larsen, WI (US); Jacob Charles Dahl, Menasha, WI (US); Nickolas Everett Madsen, Atlanta, GA (US)

(73) Assignee: GPCP IP Holdings LLC, Atlanta, GA (US)

( * ) Notice: Subject to any disclaimer, the term of this patent is extended or adjusted under 35 U.S.C. 154(b) by 1034 days.

(21) Appl. No.: 17/869,929

(22) Filed: Jul. 21, 2022

(65) Prior Publication Data

US 2022/0354316 A1 Nov. 10, 2022

Related U.S. Application Data

(63) Continuation of application No. 15/479,656, filed on Apr. 5, 2017, now Pat. No. 11,395,566.
(Continued)

(51) Int. Cl.
*A47K 10/36* (2006.01)
*A47K 10/32* (2006.01)
*A47K 10/38* (2006.01)

(52) U.S. Cl.
CPC ..... *A47K 10/3687* (2013.01); *A47K 10/36* (2013.01); *A47K 10/3612* (2013.01);
(Continued)

(58) Field of Classification Search
CPC ..... A47K 10/3687; A47K 10/36; A47K 10/3612; A47K 10/3625; A47K 10/3626; A47K 10/3656; A47K 10/3827
(Continued)

(56) References Cited

U.S. PATENT DOCUMENTS 1,354,511 A 10/1920 Parsons
2,121,346 A 6/1938 Harvey
(Continued)

FOREIGN PATENT DOCUMENTS

CA 2838721 A1 12/2012
CN 1442356 A 9/2003
(Continued)

OTHER PUBLICATIONS

US 7,900,864 B2, 03/2011, Lewis (withdrawn)
(Continued)

*Primary Examiner* — Rakesh Kumar

(57) ABSTRACT

Some example product dispensers that accommodate two full paper towel rolls are provided herein. The product dispenser may employ separate dispensing mechanisms for each product roll and may include roll holders that articulate out from the housing to facilitate easy loading and access to replacement and loading of the other product roll. A roll partition may be utilized to separate the web paths of the two product rolls and enable rotation of front roll holders. Example funnel covers and nip covers can aid with intuitive installation. Example roll holders with retention mechanisms help prevent unintentional dropping of the installed product roll. Other beneficial features include utilizing motor operation sensing to dispense a desired sheet length, automatic/assisted loading into the dispensing mechanism, automatic switching between dispensing of product rolls, and always dispensing from the smaller product roll first. Many other features/structures of example product dispensers are also described herein.

21 Claims, 129 Drawing Sheets

Related U.S. Application Data

(60) Provisional application No. 62/453,829, filed on Feb. 2, 2017, provisional application No. 62/320,829, filed on Apr. 11, 2016.

(52) U.S. Cl.
CPC ..... *A47K 10/3625* (2013.01); *A47K 10/3656* (2013.01); *A47K 10/3827* (2013.01); *A47K 2010/3233* (2013.01); *A47K 2010/3253* (2013.01); *A47K 2010/326* (2013.01); *A47K 2010/3681* (2013.01)

(58) Field of Classification Search
USPC ..... 221/63; 34/90
See application file for complete search history.

(56) References Cited

U.S. PATENT DOCUMENTS 2,144,757 A 1/1939 Gilling et al.
2,154,440 A 4/1939 Crotts
2,295,005 A 9/1942 Peacock et al.
2,487,763 A 11/1949 Patterson et al.
2,555,885 A 6/1951 Hope
2,726,823 A 12/1955 Jespersen
2,738,934 A 3/1956 Dobkin
2,785,034 A 3/1957 Preston
2,826,373 A 3/1958 Schwartz
2,839,346 A 6/1958 Lawalin
2,905,404 A 9/1959 Simmons
2,930,664 A 3/1960 Liebisch
2,943,777 A 7/1960 Dvoracek
2,993,658 A 7/1961 Sweeney
3,007,650 A * 11/1961 Burton ..... A47K 10/36 312/34.19
3,007,652 A 11/1961 Heckman
3,050,224 A * 8/1962 Drolshammer ..... A47K 10/38 225/88
3,084,006 A 4/1963 Roemer
3,126,234 A * 3/1964 Batlas ..... A47K 10/32 242/596.7
3,167,368 A 1/1965 Matt et al.
3,276,706 A * 10/1966 House ..... A47K 10/38 226/110
3,288,387 A * 11/1966 Craven, Jr. ..... A47K 10/3687 242/560.1
3,297,269 A 1/1967 Mcgrew
3,381,909 A 5/1968 Tucker
3,610,940 A 10/1971 Dunigan
3,628,743 A * 12/1971 Bastian ..... A47K 10/32 242/560.1
3,672,552 A 6/1972 Krueger et al.
3,713,170 A 1/1973 Kaufman
3,729,145 A 4/1973 Koo et al.
3,737,087 A 6/1973 Rooklyn
3,770,222 A 11/1973 Jespersen
3,797,769 A 3/1974 Tucker
3,917,191 A * 11/1975 Graham, Jr. ..... A47K 10/36 242/596.4
4,003,527 A 1/1977 Schulze
4,010,909 A * 3/1977 Bastian ..... A47K 10/3687 226/91
4,067,509 A * 1/1978 Graham, Jr. ..... A47K 10/36 242/560.1
4,132,899 A 1/1979 Shigemasa et al.
4,137,805 A * 2/1979 DeLuca ..... A47K 10/3687 226/110
4,148,442 A * 4/1979 Baumann ..... B65H 19/10 242/560.1
4,165,138 A * 8/1979 Hedge ..... A47K 10/3656 242/564.4
4,170,390 A 10/1979 McCabe
4,191,307 A 3/1980 LeCaire, Jr. et al.
4,203,562 A 5/1980 DeLuca et al.
4,243,891 A 1/1981 Dobler et al.
4,260,117 A 4/1981 Perrin et al.
4,264,403 A * 4/1981 Emmel ..... B65C 11/00 156/154
4,307,638 A * 12/1981 DeLuca ..... A47K 10/3643 83/345
4,317,547 A * 3/1982 Graham, Jr. ..... A47K 10/3687 242/560.1
4,340,195 A 7/1982 DeLuca
4,358,169 A * 11/1982 Filipowicz ..... A47K 10/3637 225/8
4,367,666 A * 1/1983 Toth ..... B65H 35/08 83/272
4,378,912 A * 4/1983 Perrin ..... A47K 10/3637 226/91
4,383,657 A 5/1983 Suh et al.
4,403,748 A * 9/1983 Cornell ..... A47K 10/3687 226/129
4,422,585 A 12/1983 Schultz et al.
4,444,359 A 4/1984 Butler
4,487,375 A * 12/1984 Rasmussen ..... A47K 10/40 226/174
4,535,947 A 8/1985 Hidle
4,549,664 A 10/1985 Gowan et al.
4,552,315 A * 11/1985 Granger ..... A47K 10/3643 242/560.3
4,553,846 A 11/1985 Hilton et al.
4,611,768 A * 9/1986 Voss ..... A47K 10/36 242/564.2
4,634,067 A 1/1987 White
4,634,192 A 1/1987 Fielding
4,671,466 A 6/1987 Jespersen et al.
4,691,503 A * 9/1987 Frerich ..... B65B 41/12 53/118
4,712,461 A 12/1987 Rasmussen
4,716,942 A 1/1988 Jensen et al.
4,721,265 A 1/1988 Hawkins
4,738,176 A 4/1988 Cassia
4,756,485 A * 7/1988 Bastian ..... A47K 10/3687 242/560.1
4,765,555 A 8/1988 Gambino
4,803,373 A 2/1989 Imamura et al.
4,807,824 A * 2/1989 Gains ..... A47K 10/3687 242/560.1
D300,492 S 4/1989 Pearce
4,844,361 A 7/1989 Granger
4,846,412 A * 7/1989 Morand ..... A47K 10/3687 225/106
4,856,724 A 8/1989 Jespersen
4,868,402 A 9/1989 Triponez
4,916,613 A 4/1990 Lange et al.
4,944,466 A 7/1990 Jespersen
4,956,959 A 9/1990 Rumph et al.
4,956,960 A 9/1990 Anstey et al.
5,060,877 A 10/1991 Bullivant
5,075,543 A 12/1991 Courtney
5,083,765 A * 1/1992 Kringel ..... B65H 3/5238 271/118
5,158,242 A 10/1992 Honegger
5,161,723 A * 11/1992 Wirtz-Odenthal ..... A47K 10/3687 225/14
5,181,368 A 1/1993 Anstey et al.
5,207,349 A * 5/1993 Kringel ..... B65H 3/52 271/265.01
5,244,161 A * 9/1993 Wirtz-Odenthal ..... A47K 10/3687 242/563.2
5,253,818 A 10/1993 Craddock
5,257,711 A 11/1993 Wirtz-Odenthal
5,260,564 A 11/1993 Bruggeling et al.
5,262,229 A 11/1993 Lampert et al.
D342,635 S 12/1993 Carter et al.
5,271,574 A * 12/1993 Formon ..... A47K 10/36 242/560.3
5,294,192 A * 3/1994 Omdoll ..... A47K 10/3687 242/564.4

(56) References Cited

U.S. PATENT DOCUMENTS 5,302,167 A * 4/1994 Kley ..... B31F 1/07 493/400
5,305,915 A 4/1994 Kamysz et al.
5,310,129 A 5/1994 Whittington et al.
5,375,920 A 12/1994 Macchi Cassia
5,400,982 A * 3/1995 Collins ..... A47K 10/36 242/564.4
5,417,233 A 5/1995 Thomas et al.
5,420,406 A 5/1995 Izawa et al.
5,441,189 A 8/1995 Formon et al.
5,442,867 A 8/1995 Robinson
5,449,127 A 9/1995 Davis
5,456,420 A 10/1995 Frazier
5,457,319 A 10/1995 Moe et al.
5,467,194 A 11/1995 Pellinen et al.
5,514,977 A 5/1996 Agiman
5,526,973 A 6/1996 Boone et al.
5,542,487 A 8/1996 Schultz et al.
5,547,061 A 8/1996 Itako et al.
5,558,302 A 9/1996 Jesperson
5,570,938 A 11/1996 Butler
5,585,645 A 12/1996 Goto
5,604,992 A * 2/1997 Robinson ..... A47K 10/485 242/560
5,617,324 A 4/1997 Arai
5,628,474 A 5/1997 Krueger et al.
5,636,812 A 6/1997 Conner et al.
D386,025 S 11/1997 Mervar et al.
5,758,759 A 6/1998 Negishi
5,772,291 A 6/1998 Byrd et al.
5,796,486 A 8/1998 Jacob
5,852,946 A 12/1998 Cowger
5,857,393 A 1/1999 Kohiyama
5,873,542 A 2/1999 Perrin et al.
5,874,813 A 2/1999 Bode et al.
5,915,645 A 6/1999 Granger
5,924,617 A * 7/1999 LaCount ..... A47K 10/36 242/564.2
5,954,256 A * 9/1999 Niada ..... A47K 10/3836 242/598.6
5,979,821 A 11/1999 LaCount et al.
5,979,822 A 11/1999 Morand et al.
6,032,898 A 3/2000 LaCount et al.
6,044,952 A 4/2000 Haggerty et al.
6,056,233 A 5/2000 Von Schenk
6,069,354 A 5/2000 Alfano et al.
6,082,664 A 7/2000 Phelps et al.
6,089,499 A 7/2000 Robinson
6,092,758 A 7/2000 Gemmell
6,105,898 A 8/2000 Byrd et al.
6,105,954 A * 8/2000 Magee ..... B65H 3/5215 271/902
6,109,473 A 8/2000 Neveu et al.
6,112,631 A 9/2000 VanAlstine
6,138,939 A 10/2000 Phelps et al.
6,143,257 A 11/2000 Spriggs et al.
6,145,779 A * 11/2000 Johnson ..... A47K 10/3687 242/564.2
6,152,397 A * 11/2000 Purcell ..... A47K 10/3687 242/563.2
6,157,397 A 12/2000 Bogin et al.
6,161,795 A 12/2000 Skerrett et al.
6,179,243 B1 1/2001 Granger
6,189,828 B1 2/2001 Reilly
6,196,102 B1 3/2001 Granger
6,202,956 B1 3/2001 Grasso et al.
D441,231 S 5/2001 Purcell et al.
6,224,010 B1 * 5/2001 Morand ..... A47K 10/3687 242/564.2
6,226,135 B1 5/2001 Masui et al.
6,234,696 B1 5/2001 Whittaker
6,237,871 B1 5/2001 Morand et al.
6,241,118 B1 6/2001 Tramontina
6,250,530 B1 6/2001 LaCount et al.
6,262,546 B1 7/2001 Draves et al.
6,273,359 B1 8/2001 Newman et al.
6,293,486 B1 9/2001 Byrd et al.
6,310,574 B1 10/2001 Fehrenbach et al.
6,314,850 B1 11/2001 Morand
6,314,971 B1 11/2001 Schneider
6,318,821 B1 11/2001 Martin et al.
6,321,963 B1 11/2001 Gracyalny et al.
6,328,252 B1 12/2001 Neveu et al.
6,328,253 B1 12/2001 Paul
6,354,462 B1 3/2002 Conran et al.
6,354,533 B1 * 3/2002 Jespersen ..... A47K 10/36 242/564.4
6,356,735 B1 * 3/2002 Hozumi ..... B65H 9/166 271/228
6,360,181 B1 3/2002 Gemmell et al.
6,360,985 B1 3/2002 Phelps et al.
6,364,245 B1 4/2002 Paal et al.
6,386,478 B2 5/2002 Reilly
6,409,120 B1 6/2002 Tramontina et al.
6,411,920 B1 6/2002 McConnell et al.
6,412,679 B2 7/2002 Formon et al.
6,419,113 B1 7/2002 Tramontina
6,441,891 B1 8/2002 Levasseur et al.
6,443,328 B1 9/2002 Fehl et al.
6,474,209 B1 11/2002 Granger
6,474,591 B1 11/2002 Granger
6,484,965 B1 11/2002 Reaves
6,502,781 B1 1/2003 Tramontina
6,537,631 B1 3/2003 Rivera et al.
6,542,568 B1 4/2003 Howes, Jr. et al.
6,553,879 B2 4/2003 Morand
6,585,344 B2 7/2003 Kolodziej
6,588,570 B2 7/2003 Negishi
6,592,067 B2 7/2003 Denen et al.
6,598,473 B2 7/2003 Atkinson
6,607,160 B2 8/2003 Lewis et al.
6,616,088 B2 9/2003 Lintelmann et al.
6,619,504 B2 9/2003 Ozimec
6,626,395 B1 9/2003 Newman et al.
6,640,628 B2 11/2003 Lutke et al.
6,648,221 B2 11/2003 Thawley et al.
6,655,630 B2 12/2003 Newman et al.
6,659,391 B1 12/2003 Faulks et al.
6,666,364 B2 12/2003 Phelps
6,669,071 B1 12/2003 Menna
6,682,013 B1 1/2004 Newman et al.
6,684,751 B2 2/2004 Kapiloff et al.
6,685,074 B2 2/2004 Gracyalny et al.
6,695,246 B1 2/2004 Elliott et al.
6,702,225 B2 3/2004 Newman et al.
6,702,227 B1 3/2004 Newman et al.
6,704,523 B2 3/2004 Takeuchi et al.
6,705,565 B1 3/2004 Newman et al.
6,706,352 B2 3/2004 Rivera et al.
6,710,606 B2 3/2004 Morris
6,736,348 B1 * 5/2004 Formon ..... A47K 10/3687 242/563
6,742,689 B2 6/2004 Formon et al.
6,745,975 B2 6/2004 Faulks et al.
6,752,349 B2 6/2004 Moody et al.
6,758,434 B2 7/2004 Kapiloff et al.
6,772,916 B1 8/2004 Reynolds
6,785,946 B2 9/2004 Romme et al.
6,793,170 B2 9/2004 Denen et al.
6,794,633 B2 9/2004 Iwasaki
6,804,474 B2 10/2004 Morita et al.
6,820,785 B2 11/2004 Kapiloff
6,826,985 B2 * 12/2004 Broehl ..... B65H 35/08 83/13
6,826,991 B1 12/2004 Rasmussen
6,830,151 B2 12/2004 Spencer et al.
6,830,210 B2 12/2004 Formon et al.
6,837,455 B2 1/2005 Eckhard et al.
6,854,684 B2 2/2005 Byrd et al.
6,871,815 B2 3/2005 Moody et al.
6,895,848 B1 5/2005 Svensson
6,903,654 B2 6/2005 Hansen et al.
6,913,166 B2 7/2005 Cline et al.

(56) References Cited

U.S. PATENT DOCUMENTS 6,913,259 B2 7/2005 Phinney et al.
6,959,859 B2 11/2005 Saltsov et al.
6,977,588 B2 12/2005 Schotz et al.
6,988,689 B2 1/2006 Thomas et al.
6,994,408 B1 2/2006 Bunnell
6,995,358 B2 2/2006 Sano
7,004,435 B2 2/2006 Formon
7,011,272 B2 3/2006 Faulks et al.
7,017,856 B2 3/2006 Moody et al.
7,018,121 B2 3/2006 Barry et al.
7,040,566 B1 5/2006 Rodrian et al.
7,044,421 B1 5/2006 Omdoll et al.
D525,063 S 7/2006 Woods et al.
7,079,263 B2 7/2006 Sartain et al.
7,083,138 B2 8/2006 Elliott et al.
7,084,592 B2 8/2006 Rodrian
7,101,441 B2 9/2006 Kennard
7,102,366 B2 9/2006 Denen et al.
7,114,677 B2 10/2006 Formon et al.
7,178,707 B1 2/2007 Bokina
7,182,288 B2 2/2007 Denen et al.
7,182,289 B2 2/2007 Moody et al.
7,187,901 B2 3/2007 Ohashi
7,188,799 B1 3/2007 Lindsay et al.
7,191,920 B2 3/2007 Boll et al.
7,207,461 B2 4/2007 Mitchell et al.
7,222,816 B2 5/2007 Clark
D547,581 S 7/2007 Cittadino et al.
7,237,744 B2 7/2007 Morris et al.
D551,474 S 9/2007 Cittadino et al.
D551,475 S 9/2007 Cittadino et al.
7,270,292 B2 9/2007 Rasmussen
7,294,378 B2 11/2007 Rivera et al.
7,296,765 B2 11/2007 Rodrian
7,316,369 B2 1/2008 Phelps
7,325,767 B2 2/2008 Elliott et al.
7,341,170 B2 3/2008 Boone
7,354,015 B2 * 4/2008 Byrd ..... A47K 10/36 242/563
7,364,053 B2 4/2008 Ophardt
7,370,824 B1 5/2008 Osborne
7,374,066 B2 5/2008 Jackson et al.
7,387,274 B2 6/2008 Moody et al.
D572,058 S 7/2008 Cittadino et al.
7,398,944 B2 7/2008 Lewis et al.
7,401,779 B2 7/2008 Sekiya et al.
D578,328 S 10/2008 Plum et al.
7,438,257 B2 10/2008 Kennard
7,451,894 B2 11/2008 Ophardt
7,461,762 B2 12/2008 Law et al.
7,508,312 B2 3/2009 Chajec
7,527,178 B2 5/2009 Lewis
7,527,215 B1 5/2009 Siddiqui
7,530,524 B2 5/2009 Wieser et al.
7,549,814 B1 6/2009 Arrington et al.
7,554,084 B2 6/2009 Mok et al.
7,568,652 B2 8/2009 Cittadino et al.
7,570,067 B2 8/2009 Denen et al.
7,594,622 B2 9/2009 Witt et al.
7,607,662 B2 10/2009 Nireki
7,611,030 B2 11/2009 Reynolds et al.
7,621,426 B2 11/2009 Reynolds et al.
7,633,605 B1 12/2009 Kallin
7,640,876 B2 1/2010 Memory
7,644,885 B2 1/2010 Briante et al.
7,648,083 B2 1/2010 Hornsby et al.
7,654,417 B2 2/2010 Rhodenbaugh et al.
7,654,525 B2 2/2010 Wang
7,708,166 B2 5/2010 Ophardt
7,712,699 B2 5/2010 Granger
7,735,770 B2 6/2010 Conner
7,766,194 B2 8/2010 Boll et al.
7,774,096 B2 8/2010 Goerg et al.
7,783,380 B2 8/2010 York et al.
7,793,882 B2 9/2010 Reinsel et al.
7,795,584 B2 9/2010 Mok et al.
7,802,750 B2 9/2010 Takeuchi
7,841,556 B2 * 11/2010 Elliott ..... A47K 10/3687 242/564.2
7,845,593 B2 12/2010 Formon et al.
7,852,021 B2 12/2010 Yap et al.
7,861,964 B2 1/2011 Cittadino et al.
7,866,209 B2 1/2011 Tenney
7,866,593 B2 1/2011 Friesen et al.
7,874,509 B2 * 1/2011 Kenney ..... B26F 3/002 242/563.2
7,878,444 B2 * 2/2011 Friesen ..... A47K 10/3687 242/561
7,878,445 B2 2/2011 Granger et al.
7,896,196 B2 3/2011 Wegelin et al.
7,913,945 B2 3/2011 Friesen et al.
7,922,034 B2 4/2011 Neveu et al.
7,931,228 B2 4/2011 Omdoll
7,946,522 B2 5/2011 Lewis et al.
7,954,668 B2 6/2011 Mehus et al.
7,963,475 B2 6/2011 Rodrian
7,984,872 B2 7/2011 Kuehneman et al.
7,996,108 B2 8/2011 Yardley
8,044,844 B2 10/2011 Nyberg
8,079,543 B2 12/2011 Troutman et al.
8,082,827 B2 12/2011 Friesen et al.
8,084,996 B2 12/2011 Zhang et al.
8,091,886 B2 1/2012 Kato et al.
8,109,411 B2 2/2012 Yang et al.
8,160,742 B2 4/2012 Goerg et al.
8,162,252 B2 4/2012 Cittadino et al.
8,167,004 B2 5/2012 Lee et al.
8,179,528 B2 5/2012 De Vries et al.
8,186,551 B2 5/2012 Morris et al.
8,201,707 B2 6/2012 Ophardt
8,205,748 B2 6/2012 Long et al.
8,220,684 B1 7/2012 Keily et al.
8,224,480 B2 7/2012 Mok et al.
8,231,076 B2 7/2012 Troutman et al.
8,240,594 B2 8/2012 Troutman et al.
8,261,941 B2 9/2012 Woo et al.
8,273,504 B2 9/2012 Goia et al.
8,282,033 B2 * 10/2012 Achton ..... A47K 10/3687 242/560.1
8,297,160 B2 10/2012 Friesen et al.
8,302,473 B2 11/2012 Ramus et al.
8,309,904 B2 11/2012 De Coi et al.
8,336,803 B2 12/2012 Troutman et al.
8,338,811 B2 12/2012 Lang et al.
8,348,105 B2 1/2013 Wong et al.
8,356,767 B2 1/2013 Formon et al.
8,366,035 B2 2/2013 Kling et al.
8,376,260 B2 2/2013 Granger
8,382,229 B2 2/2013 Murray et al.
8,395,396 B2 3/2013 Hagleitner
8,395,784 B2 3/2013 Murray et al.
8,402,872 B2 3/2013 Friesen et al.
8,405,338 B2 3/2013 Leppa et al.
8,419,154 B2 4/2013 Igarashi et al.
8,424,431 B1 4/2013 Jackman et al.
8,434,709 B2 5/2013 Troutman et al.
8,439,293 B2 5/2013 Hagleitner
8,444,008 B2 5/2013 Al-Mahnna
8,448,890 B2 5/2013 Hagleitner
8,464,976 B2 6/2013 Mok et al.
8,465,137 B2 6/2013 Fujikawa et al.
8,474,810 B2 7/2013 Yamamoto et al.
8,490,913 B2 7/2013 Formon et al.
8,496,198 B2 7/2013 Cittadino et al.
8,511,599 B2 8/2013 Lalau et al.
8,516,883 B2 8/2013 Studer
8,525,461 B2 9/2013 Marushita et al.
8,528,787 B2 9/2013 Cittadino et al.
8,528,851 B2 9/2013 Friesen et al.
8,550,396 B2 10/2013 Marrs
8,573,715 B1 11/2013 Jackman et al.
8,579,184 B2 11/2013 Pettersson et al.
8,599,007 B2 12/2013 Larsson et al.
8,600,547 B2 12/2013 Petersen et al.

(56) References Cited

U.S. PATENT DOCUMENTS 8,608,022 B1 12/2013 Kory
8,610,536 B2 12/2013 Libby et al.
8,616,489 B2 12/2013 Goeking et al.
8,632,030 B2 1/2014 Troutman et al.
8,651,003 B1 2/2014 Vercellone
8,651,328 B2 2/2014 Cittadino
8,672,255 B2 3/2014 Granger
8,690,014 B2 4/2014 Haueter et al.
8,694,156 B2 4/2014 Nallappan et al.
8,723,504 B2 5/2014 Tanisaki
8,763,947 B2 7/2014 Keily et al.
8,763,948 B1 7/2014 Holowaty
8,769,770 B2 7/2014 Kullman et al.
8,777,149 B2 7/2014 Goeking et al.
8,789,787 B2 7/2014 Kling et al.
8,796,624 B2 8/2014 Mok et al.
8,800,415 B2 * 8/2014 Osborne ..... A47K 10/3618 83/369
8,807,475 B2 8/2014 Rodrian et al.
8,844,769 B2 9/2014 Rosenkranz et al.
8,851,331 B2 10/2014 Pelkey et al.
8,882,021 B2 11/2014 Cittadino et al.
8,899,508 B2 12/2014 Hjort et al.
8,905,263 B2 12/2014 Becherer et al.
8,905,265 B2 12/2014 Muderlak et al.
8,910,898 B2 12/2014 Hagleitner
8,925,287 B2 1/2015 Derscheid
8,931,878 B2 1/2015 Sano
8,936,179 B2 1/2015 Hsu et al.
8,950,254 B2 2/2015 Bernhardsgruetter et al.
8,955,790 B2 2/2015 Jokitalo et al.
8,960,588 B2 2/2015 Byrd et al.
8,971,786 B2 3/2015 Campanini
8,973,916 B2 3/2015 Takada
8,991,655 B2 3/2015 Pelkey
8,994,931 B2 3/2015 Mori et al.
9,010,602 B2 4/2015 Budz et al.
9,019,367 B2 4/2015 Hoffmann et al.
9,027,788 B2 5/2015 Ophardt et al.
9,044,124 B2 6/2015 Hagleitner
9,066,638 B2 6/2015 Lowery et al.
9,067,754 B2 6/2015 Petersen et al.
9,073,028 B2 7/2015 Hovinen et al.
9,077,404 B2 7/2015 Jia et al.
9,089,246 B2 7/2015 Borke
9,113,760 B2 8/2015 Knapp et al.
9,138,110 B2 9/2015 Knight et al.
9,144,352 B2 9/2015 Cittadino et al.
9,151,594 B2 10/2015 Misao
9,167,941 B2 10/2015 Cittadino et al.
9,239,361 B2 1/2016 Long
9,271,613 B2 3/2016 Rosko et al.
9,340,337 B2 5/2016 Pelkey et al.
9,370,283 B2 6/2016 Fellhoelter
9,370,284 B2 6/2016 Moller et al.
9,375,117 B2 6/2016 Granger
9,386,890 B2 7/2016 Pommer et al.
9,408,502 B2 8/2016 Pelkey
9,408,506 B2 8/2016 Hjort et al.
D767,297 S 9/2016 Madsen et al.
9,487,340 B2 11/2016 Castela et al.
D773,202 S 12/2016 Madsen et al.
9,524,604 B2 12/2016 Erb
9,604,811 B2 3/2017 Case et al.
9,681,783 B2 6/2017 Goeking et al.
9,999,326 B2 6/2018 Borke et al.
10,105,020 B2 10/2018 Carper et al.
10,149,579 B2 12/2018 Goltz et al.
10,285,545 B2 5/2019 Ruthven et al.
10,383,489 B2 * 8/2019 Case ..... B65H 45/142
10,835,086 B2 * 11/2020 Osborne, Jr. ..... A47K 10/3687
11,297,984 B2 * 4/2022 Case ..... B65H 33/18
2001/0017309 A1 * 8/2001 Formon ..... A47K 10/36 225/10
2002/0005685 A1 1/2002 Granger
2002/0109035 A1 8/2002 Denen et al.
2002/0109036 A1 8/2002 Denen et al.
2002/0181805 A1 * 12/2002 Loeb ..... H04N 1/3877 382/317
2003/0110911 A1 6/2003 Kapiloff
2003/0132261 A1 7/2003 Formon et al.
2003/0167893 A1 9/2003 Morris et al.
2003/0168489 A1 9/2003 Formon et al.
2003/0168550 A1 9/2003 Formon et al.
2003/0197086 A1 10/2003 Denen et al.
2004/0035976 A1 2/2004 Byrd et al.
2004/0041057 A1 3/2004 Byrd et al.
2004/0124202 A1 7/2004 Mitchell et al.
2004/0134924 A1 7/2004 Hansen et al.
2004/0135027 A1 7/2004 Elliott et al.
2004/0178297 A1 9/2004 Moody et al.
2005/0077419 A1 4/2005 Thomas et al.
2005/0150992 A1 7/2005 Morris et al.
2005/0171634 A1 8/2005 York et al.
2005/0224519 A1 10/2005 Law et al.
2006/0032862 A1 * 2/2006 Miller ..... B67D 7/22 222/64
2006/0054733 A1 3/2006 Moody et al.
2006/0065095 A1 3/2006 Ambrose
2006/0169827 A1 8/2006 Lewis et al.
2006/0175341 A1 8/2006 Rodrian
2006/0202080 A1 9/2006 Kennard
2006/0236836 A1 10/2006 Cassia
2006/0237579 A1 10/2006 Doubleday et al.
2006/0238626 A1 10/2006 Steiner
2006/0284001 A1 12/2006 Paradise et al.
2007/0010389 A1 * 1/2007 Cutrona ..... A47K 10/3643 83/337
2007/0079676 A1 4/2007 Friesen et al.
2007/0080255 A1 4/2007 Witt et al.
2007/0108284 A1 * 5/2007 Pankow ..... G06K 7/10851 235/462.21
2007/0145955 A1 6/2007 Ho et al.
2007/0176041 A1 8/2007 Friesen et al.
2007/0221777 A1 * 9/2007 Valot ..... A47K 10/36 242/564.2
2008/0018302 A1 1/2008 Reinsel et al.
2008/0078777 A1 4/2008 Cittadino et al.
2008/0118235 A1 * 5/2008 Bruno ..... H02K 7/102 188/137
2008/0121649 A1 5/2008 Kistner
2008/0128448 A1 6/2008 Cittadino et al.
2008/0245922 A1 10/2008 Fellhoelter
2009/0057478 A1 3/2009 Conner
2009/0066264 A1 3/2009 Huang et al.
2009/0125424 A1 5/2009 Wegelin
2009/0204256 A1 8/2009 Wegelin
2009/0230232 A1 9/2009 Zuger et al.
2009/0245912 A1 10/2009 Igarashi et al.
2009/0250484 A1 10/2009 Kling et al.
2009/0278425 A1 11/2009 Cittadino et al.
2009/0308887 A1 12/2009 Woo et al.
2010/0012675 A1 1/2010 Formon et al.
2010/0032445 A1 2/2010 Bunoz
2010/0044407 A1 * 2/2010 Yardley ..... B65H 35/0006 225/14
2010/0051642 A1 3/2010 Wong et al.
2010/0219284 A1 * 9/2010 Troutman ..... A47K 10/36 242/564.4
2010/0224647 A1 9/2010 Formon et al.
2010/0286818 A1 11/2010 Goeking et al.
2010/0314429 A1 12/2010 Troutman et al.
2010/0314820 A1 * 12/2010 Ko ..... B65H 37/00 101/45
2011/0017778 A1 1/2011 Kadiks et al.
2011/0088619 A1 4/2011 Duerrstein
2011/0095050 A1 4/2011 Hagleitner
2011/0095051 A1 4/2011 Liao et al.
2011/0114782 A1 * 5/2011 Rodrian ..... A47K 10/36 700/243
2011/0148258 A1 * 6/2011 Tanaka ..... H02K 23/66 310/68 B
2011/0253828 A1 10/2011 Kuehneman et al.

(56) References Cited

U.S. PATENT DOCUMENTS

| | | | | |
|---|---|---|---|---|
| 2011/0272488 | A1 | 11/2011 | Baughman | |
| 2011/0303699 | A1 | 12/2011 | Cittadino et al. | |
| 2012/0010673 | A1 | 1/2012 | Bowers | |
| 2012/0111979 | A1* | 5/2012 | Jensen | B02C 18/142 241/36 |
| 2012/0138625 | A1 | 6/2012 | Case et al. | |
| 2012/0138723 | A1 | 6/2012 | Lewis et al. | |
| 2012/0235351 | A1* | 9/2012 | Sakoguchi | B65H 83/02 271/265.01 |
| 2012/0239325 | A1 | 9/2012 | Sunyi et al. | |
| 2012/0256036 | A1 | 10/2012 | Osborne | |
| 2012/0261506 | A1 | 10/2012 | Buelow et al. | |
| 2012/0312853 | A1 | 12/2012 | Osborne et al. | |
| 2013/0002159 | A1 | 1/2013 | Chen et al. | |
| 2013/0099924 | A1 | 4/2013 | Larsson et al. | |
| 2013/0105614 | A1 | 5/2013 | Hjort et al. | |
| 2013/0161346 | A1 | 6/2013 | Wolme et al. | |
| 2013/0184858 | A1 | 7/2013 | Nallappan et al. | |
| 2013/0213995 | A1 | 8/2013 | Horel et al. | |
| 2013/0240554 | A1 | 9/2013 | Strahlin et al. | |
| 2013/0248644 | A1 | 9/2013 | Goeking et al. | |
| 2014/0001303 | A1 | 1/2014 | Tramontina et al. | |
| 2014/0084075 | A1 | 3/2014 | Vandelli et al. | |
| 2014/0097205 | A1 | 4/2014 | Arminak | |
| 2014/0152733 | A1 | 6/2014 | Sano | |
| 2014/0191726 | A1 | 7/2014 | Long | |
| 2014/0263811 | A1 | 9/2014 | Goeking et al. | |
| 2014/0291437 | A1 | 10/2014 | Corley et al. | |
| 2014/0312158 | A1 | 10/2014 | Hlushchenko et al. | |
| 2014/0367401 | A1 | 12/2014 | Stralin et al. | |
| 2015/0060591 | A1 | 3/2015 | Gutierrez | |
| 2015/0097068 | A1 | 4/2015 | Larson et al. | |
| 2015/0102048 | A1 | 4/2015 | Case et al. | |
| 2015/0150422 | A1 | 6/2015 | Ochoa, Sr. et al. | |
| 2015/0157177 | A1 | 6/2015 | Carper et al. | |
| 2015/0190018 | A1 | 7/2015 | Pherson et al. | |
| 2015/0196174 | A1* | 7/2015 | Goltz | B65D 83/0805 242/596 |
| 2015/0216375 | A1 | 8/2015 | Okazaki | |
| 2015/0223646 | A1 | 8/2015 | Wegelin et al. | |
| 2015/0228181 | A1 | 8/2015 | Himmelmann et al. | |
| 2015/0238056 | A1* | 8/2015 | Fellhoelter | A47K 10/3687 242/560 |
| 2015/0253173 | A1 | 9/2015 | Cedulf et al. | |
| 2015/0274375 | A1 | 10/2015 | Kling | |
| 2015/0286912 | A1 | 10/2015 | Qiyu et al. | |
| 2015/0327735 | A1 | 11/2015 | Himmelmann et al. | |
| 2015/0342423 | A1 | 12/2015 | Kling | |
| 2015/0374181 | A1 | 12/2015 | Morand | |
| 2015/0374441 | A1 | 12/2015 | Machado et al. | |
| 2016/0037979 | A1 | 2/2016 | Mattheeussen et al. | |
| 2016/0086410 | A1 | 3/2016 | Carmine | |
| 2016/0100718 | A1 | 4/2016 | Lahuerta Salas et al. | |
| 2016/0157682 | A1 | 6/2016 | Keily et al. | |
| 2016/0187484 | A1 | 6/2016 | Bloomfield et al. | |
| 2016/0215490 | A1 | 7/2016 | Keune | |
| 2016/0262580 | A1 | 9/2016 | Fellhoelter | |
| 2016/0331192 | A1 | 11/2016 | Rubenson et al. | |
| 2016/0353945 | A1 | 12/2016 | Osborne, Jr. | |
| 2016/0353946 | A1 | 12/2016 | Osborne, Jr. | |
| 2016/0353947 | A1 | 12/2016 | Osborne, Jr. | |
| 2016/0364685 | A1 | 12/2016 | Wass et al. | |
| 2016/0374519 | A1 | 12/2016 | Murphy | |
| 2017/0042390 | A1 | 2/2017 | Rubenson et al. | |
| 2017/0051481 | A1 | 2/2017 | Mercer | |
| 2017/0057775 | A1 | 3/2017 | Kobs et al. | |
| 2017/0290471 | A1 | 10/2017 | Borke et al. | |
| 2017/0290472 | A1 | 10/2017 | Borke et al. | |
| 2017/0290473 | A1 | 10/2017 | Borke et al. | |
| 2018/0064297 | A1 | 3/2018 | Goeking et al. | |
| 2018/0177348 | A1 | 6/2018 | Swanson et al. | |
| 2018/0368626 | A1 | 12/2018 | Williams, Jr. et al. | |
| 2020/0205621 | A1* | 7/2020 | Osborne, Jr. | A47K 10/36 |

FOREIGN PATENT DOCUMENTS

| | | | | | |
|---|---|---|---|---|---|
| CN | 103025219 | A | | 4/2013 | |
| CN | 103654566 | A | | 3/2014 | |
| DE | 40 20 707 | A1 | | 1/1992 | |
| DE | 4022003 | A1 | | 1/1992 | |
| DE | 19634034 | A1 | | 2/1998 | |
| EP | 0298931 | A1 | | 1/1989 | |
| EP | 0924573 | A1 | | 6/1999 | |
| EP | 1230886 | A1 | | 8/2002 | |
| EP | 2586348 | A1 | | 5/2013 | |
| EP | 2718213 | B1 | | 11/2016 | |
| FR | 2251202 | A5 | | 6/1975 | |
| FR | 2539293 | A1 | | 7/1984 | |
| FR | 2761252 | A1 | | 10/1998 | |
| GB | 1022712 | A | | 3/1966 | |
| GB | 1180183 | A | | 2/1970 | |
| GB | 2058014 | A | | 4/1981 | |
| GB | 2063213 | A | | 6/1981 | |
| JP | S59-17444 | A | | 1/1984 | |
| JP | H04-265699 | A | | 9/1992 | |
| JP | H06150092 | A | * | 10/1994 | G07B 11/00 |
| JP | H09-75258 | A | | 3/1997 | |
| JP | 2000199572 | A | | 7/2000 | |
| JP | 2010-233971 | A | | 10/2010 | |
| WO | 2003/078286 | A1 | | 9/2003 | |
| WO | 2006/095899 | A1 | | 9/2006 | |
| WO | 2007/057537 | A1 | | 5/2007 | |
| WO | 2008/042961 | A2 | | 4/2008 | |
| WO | 2008/042969 | A2 | | 4/2008 | |
| WO | 2008/056628 | A1 | | 5/2008 | |
| WO | 2008/129572 | A1 | | 10/2008 | |
| WO | 2009/103931 | A1 | | 8/2009 | |
| WO | 2010/129741 | A2 | | 11/2010 | |
| WO | 2012/047357 | A1 | | 4/2012 | |
| WO | 2012/065635 | A1 | | 5/2012 | |
| WO | 2013/020573 | A1 | | 2/2013 | |
| WO | 2013/060381 | A1 | | 5/2013 | |
| WO | 2014/001944 | A1 | | 1/2014 | |
| WO | 2014/098672 | A1 | | 6/2014 | |
| WO | 2014/118483 | A1 | | 8/2014 | |
| WO | 2015/066644 | A2 | | 5/2015 | |
| WO | 2015/086055 | A1 | | 6/2015 | |
| WO | 2015/163802 | A1 | | 10/2015 | |
| WO | 2016/022949 | A1 | | 2/2016 | |
| WO | 2016/041583 | A1 | | 3/2016 | |
| WO | 2016/066220 | A1 | | 5/2016 | |
| WO | 2016/066221 | A1 | | 5/2016 | |
| WO | 2016/089508 | A1 | | 6/2016 | |
| WO | 2016/089589 | A1 | | 6/2016 | |
| WO | 2016/122624 | A1 | | 8/2016 | |
| WO | 2016/137450 | A1 | | 9/2016 | |
| WO | 2017/105464 | A1 | | 6/2017 | |

OTHER PUBLICATIONS

Moore, E., Unilad; "The Real Story Behind Xbox 360's Red Ring of Death" retreived from <http://www.unilad.co.uk/gaming/the-real-story-behind-xbox-360s-red-ring-of-death/>.

QuackMasterDan., "Xbox 360 Wireless Controller Ring of Light" retreived from < http://www.instructables.com/id/Xbox-360-Wireless-Controller-Ring-of-Light/>.

International Search Report and Written Opinion of the International Searching Authority for PCT/US2007/080308.

International Preliminary Report on Patentability of PCT/2007/080308.

European Search Report and Opinion for EP Application No. 11005731.2.

International Search Report and Written Opinion of the International Search Authority for PCT/US2007/080322.

Translation of the International Search Report and Written Opinion of the International Searching Authority for PCT/FR2006/02473.

International Search Report and Written Opinion for PCT/FR2006/02473.

International Search Report and Written Opinion of the International Searching Authority for PCT/US2015/011168.

(56) References Cited

OTHER PUBLICATIONS

Alliance® High-Capacity Electronic Dispenser 79000 ; retrieved from <http://www.wausaupaper.com/product/alliance-high-capacity-electronic-dispenser-7900/>.
GP Max 3000® Black Max 3000 Double Roll Towel Dispenser (X-Series); retrieved from <http://catalog.gppro.com/catalog/6359/15298?filter=FULL.>.
U.S. Appl. No. 13/998,753, filed Dec. 2, 2013, entitled "System and method for reducing waste using a sheet product dispenser".
International Search Report and Written Opinion of the International Searching Authority for corresponding International Application No. PCT/2017/026646 mailed Jun. 29, 2017.
U.S. Appl. No. 61/731,812, filed Nov. 30, 2011, entitled "System and Method for Reducing Waste Using a Sheet Product Dispenser".

* cited by examiner

SHEET PRODUCT DISPENSER

CROSS-REFERENCE TO RELATED APPLICATION(S)

This application is a continuation of and claims priority to U.S. Nonprovisional patent application Ser. No. 15/479,656, filed Apr. 5, 2017, entitled "Sheet Product Dispenser", which claims priority to U.S. provisional Patent Application No. 62/453,829, filed Feb. 2, 2017, entitled "Sheet Product Dispenser", and U.S. provisional Patent Application No. 62/320,829, filed Apr. 11, 2016, entitled "Dual Roll Dispenser With Movable Towel Roll Holder", each of which is hereby incorporated by reference in its entirety.

FIELD OF THE INVENTION

Example embodiments of the present invention generally relate to dispensers and, more particularly to, sheet product dispensers.

BACKGROUND

Hand towel dispensers (e.g., sheet product dispensers or product dispensers) are useful in many environments for providing on demand paper towels for users. Due to their compact nature, it is difficult to provide a large, long standing supply of paper towels. Thus, janitors or other maintenance personnel (e.g., maintainers) are often required to replace empty paper towels. The variable nature of use, however, makes it difficult for a maintainer to predict when a replacement will be needed. Moreover, schedule demands of a maintainer and the desire to avoid wasting paper left on a roll leads to the situation where the maintainer may be unsure whether or not to replace a towel roll. In this regard, the situation of having no paper towels in the dispenser (a completely empty scenario) may arise.

BRIEF SUMMARY

Some example embodiments of the present invention include a dispenser that can accommodate two full paper towel rolls. This gives the greatest opportunity to avoid a completely empty scenario and also allows a maintainer to wait to replace a roll until it is completely used (since a full second roll is available), which helps reduce waste by avoiding a maintainer discarding a partially used sheet product roll.

Further, some example embodiments of the present invention provide two separate dispensing mechanisms, one for each roll. This avoids the need for a transfer mechanism, enables easy switching between dispensing from each roll, and can simplify management of the webbing from each paper towel roll within the dispenser.

Additionally, however, another goal of some example dispensers described herein is to provide for quick and easy/intuitive loading. In this regard, some example embodiments of the present invention provide a configuration that makes each dispensing mechanism and roll holder easily accessible for loading (as either product roll may need to be replaced and loaded into the corresponding dispensing mechanism). For example, various described embodiments herein enable the bottom roll holders to move away from their storage position within the dispenser. This movement enables a maintainer to manipulate the web path leading from the top product roll to the corresponding dispensing mechanism and/or the web path leading from the bottom product roll to the corresponding dispensing mechanism—offering flexibility in loading. Further, some example embodiments separate the movable bottom roll holders from the cover, enabling more flexibility in positioning of the bottom roll holders with the cover open. Many concepts utilizing this general configuration are described herein.

A further goal of some embodiments of the present invention includes providing a dispenser that avoids jamming or other complications through effective web management. In this regard, some embodiments of the present invention seek to separate the two web paths from the two product rolls to avoid undesired interaction that may lead to a jamming scenario. To accomplish this, some example embodiments of the present invention provide web guide structures that separate the web paths and product rolls. In some embodiments, the web guide structures move out of the dispenser housing when the cover opens to facilitate easy loading of new product rolls. Many concepts utilizing web guide structures are described herein.

In some embodiments, a roll partition is provided to achieve many of the above noted desired benefits. In this regard, the roll partition may separate the web paths for each product roll and aid in intuitive loading of each product roll. In some embodiments, the roll partition may articulate out of the dispenser housing separately from the cover to enable a user full access to a second product roll for replacement and loading into a back/rear dispensing mechanism. Various features such as funnel covers and nip covers can be utilized to further aid with intuitive installation. Roll holders with retention mechanisms can be utilized to prevent unintentional dropping of the installed product roll, such as when the roll partition is rotated forward.

Some embodiments of the present invention provide software related features that enable efficient operation of the product dispenser. For example, some embodiments of the present invention employ motor operation sensing to aid in dispensing a product according to a desired sheet length. Some embodiments of the present invention provide for automatic or assisted loading of the leading edge of the product roll into the dispensing mechanism. Other beneficial features include automatic switching between product rolls for dispensing when one of the product rolls is depleted, always dispensing from the smaller (e.g., more depleted) product roll first, and many others described herein.

An example embodiment of the present invention provides a sheet product dispenser comprising a first roll holder configured to support a first product roll and a second roll holder configured to support a second product roll. The sheet product dispenser further includes a housing including a base portion and a cover. The cover is movable relative to the base portion to define an open position and a closed position. The housing is sized such that a full size first product roll and a full size second product roll fit within the housing when the cover is in the closed position. The sheet product dispenser further includes a first dispensing mechanism configured to receive sheet product of the first product roll and dispense a portion of the sheet product of the first product roll. The sheet product dispenser further includes a second dispensing mechanism configured to receive sheet product of the second product roll and dispense a portion of the sheet product of the second product roll. The second roll holder is movable between a first position and a second position spaced from the first position. The second roll holder is configured to move separately from the cover.

In some embodiments, movement of the second roll holder to the second position may enable a user to at least one of load the first product roll into the first roll holder, load the sheet product of the first product roll into the first dispensing mechanism, load the second product roll into the second roll holder, or load the sheet product of the second product roll into the second dispensing mechanism.

In some embodiments, movement of the second roll holder to the second position may enable a user to at least one of load the first product roll into the first roll holder or load the sheet product of the first product roll into the first dispensing mechanism.

In some embodiments, movement of the second roll holder to the second position may prevent a user from being able to load the sheet product of the second product roll into the second dispensing mechanism.

In some embodiments, the sheet product dispenser may further include a roll partition pivotally attached to the base portion and movable between a first roll partition position within the base portion and a second roll partition position spaced from the first roll partition position. The second roll holder is connected to the roll partition and movable with the roll partition. The roll partition is movable independent of the cover. When the roll partition is in the second roll partition position, a user is able to at least one of load the first product roll into the first roll holder or load the sheet product of the first product roll into the first dispensing mechanism.

In some embodiments, the sheet product dispenser may further include a nip cover movable between a first nip cover position and a second nip cover position. The nip cover may be configured to move between the first nip cover position and the second nip cover position with movement of the roll partition from the first roll partition position to the second roll partition position. The nip cover may be configured to prevent access to the first dispensing mechanism by the user when in the first nip cover position. The nip cover may be configured to prevent access to the second dispensing mechanism by the user when in the second nip cover position.

In some embodiments, the second roll holder may comprise a retention mechanism configured to prevent removal of an installed second product roll when the roll partition rotates to the second roll partition position.

In some embodiments, the roll partition may separate a first web path from a second web path. The first web path leads from the first product roll to the first dispensing mechanism, and the second web path leads from the second product roll to the second dispensing mechanism.

In some embodiments, the roll partition may comprise side wall portions that are configured to fit between the base portion and the cover when the cover is in the closed position. The side wall portions may each form a portion of an exterior of the sheet product dispenser.

In some embodiments, the sheet product dispenser may further comprise at least one dampener configured to dampen rotation of the roll partition between the first roll partition position and the second roll partition position.

In some embodiments, the roll partition may be configured to removably attach to the base portion of the housing when in the first roll partition position. In some embodiments, the roll partition and the base portion of the housing may be configured such that attachment of the roll partition to the base portion of the housing or detachment of the roll partition from the base portion of the housing creates an audible noise to indicate occurrence of attachment or detachment. In some embodiments, the second roll holder may comprise an attachment linkage. The base portion of the housing may comprise an attachment feature that receives the attachment linkage of the second roll holder when the roll partition is in the first roll partition position.

In some embodiments, the second roll holder is configured to move to the second position with movement of the cover to the open position.

In some embodiments, movement of the second roll holder to the second position may be independently actuable from movement of the cover to the open position.

In some embodiments, the housing may define a first web path leading from the first product roll to the first dispensing mechanism and a second web path leading from the second product roll to the second dispensing mechanism. The dispenser may further comprise at least one web guide structure configured to separate at least one of the first web path or the first product roll from at least one of the second product roll or the second web path. The at least one web guide structure may be attached to the cover such that the web guide structure is removed from the base portion when the cover is in the open position to enable a user to load the sheet product of the first product roll into the first dispensing mechanism without having to route the sheet product of the first product roll around any structure.

In some embodiments, the sheet product dispenser may further comprise at least one motor configured to actuate at least one of the first dispensing mechanism or the second dispensing mechanism.

In some embodiments, the sheet product dispenser may further comprise a first sensor positioned proximate the first dispensing mechanism and configured to sense the presence of a portion of the first product roll. The sheet product dispenser may further comprises a second sensor positioned proximate the second dispensing mechanism and configured to sense the presence of a portion of the second product roll. The sheet product dispenser may further comprise a controller. The controller may be configured to cause actuation of the first dispensing mechanism in an instance in which the first sensor senses the presence of the portion of the first product roll to load the first dispensing mechanism with the portion of the first product roll. The controller may be further configured to cause actuation of the second dispensing mechanism in an instance in which the second sensor senses the presence of the portion of the second product roll to load the second dispensing mechanism with the portion of the second product roll.

In some embodiments, the sheet product dispenser may further comprise a first chute sensor positioned within a first chute associated with the first dispensing mechanism. The first chute sensor may be configured to sense the presence of the portion of the first product roll. The sheet product dispenser may further comprise a second chute sensor positioned within a second chute associated with the second dispensing mechanism. The second chute sensor may be configured to sense the presence of the portion of the second product roll. The controller may be configured to cause the first dispensing mechanism to cease operation in an instance in which the first chute sensor senses the presence of the portion of the first product roll within the first chute. The controller may be further configured to cause the second dispensing mechanism to cease operation in an instance in which the second chute sensor senses the presence of the portion of the second product roll within the second chute.

In some embodiments, the cover may be pivotally mounted to the base portion around a first axis. The second roll holder may be pivotally mounted to the base portion around a second axis. The first axis may be different than the second axis.

In some embodiments, the first roll holder and the first dispensing mechanism may be color coded a first color and the second roll holder and the second dispensing mechanism may be color coded a second color to enable intuitive loading by a user.

In some embodiments, the sheet product dispenser may further comprise a controller that is configured to operate the first dispensing mechanism to dispense the portion of the first product roll. The controller may be further configured to automatically switch from operating the first dispensing mechanism to dispense from the first product roll to operating the second dispensing mechanism to dispense from the second product roll in an instance in which the first product roll becomes unavailable or empty.

In some embodiments, the controller may be further configured to determine which of the first product roll or second product roll has less product remaining and operate the first dispensing mechanism in an instance in which the first product roll has less product remaining than the second product roll or operate the second dispensing mechanism in an instance in which the second product roll has less product remaining than the first product roll.

In some embodiments, the sheet product dispenser may further comprise a first product level sensor configured to sense an amount of product remaining on the first product roll and a second product level sensor configured to sense an amount of product remaining on the second product roll.

In some embodiments, at least one of the first product level sensor or the second product level sensor may be an infrared product level sensor.

In some embodiments, the sheet product dispenser may further comprise a chassis that includes the first dispensing mechanism and the second dispensing mechanism. The chassis may be configured to removably attach to the base portion of the housing. The cover may be configured such that the chassis may be removed from attachment with the base portion while the cover is in the closed position.

In some embodiments, the first dispensing mechanism may include a first drivetrain comprising a first gear and a second gear. The first gear and the second gear may form a first gear ratio. The second dispensing mechanism may include a second drivetrain comprising a third gear and a fourth gear. The third gear and the fourth gear may form a second gear ratio. Each of the first gear ratio and the second gear ratio may be optimized based on one or more factors including feed roller diameter, resistance to motion, and motor performance.

In some embodiments, the second roll holder may be pivotally attached to the base portion.

In another example embodiment, a sheet product dispenser is provided. The sheet product dispenser comprises a first roll holder configured to support a first product roll and a second roll holder configured to support a second product roll. The sheet product dispenser further includes a housing including a base portion and a cover. The cover is movable relative to the base portion to define an open position and a closed position. The housing is sized such that a full size first product roll and a full size second product roll fit within the housing when the cover is in the closed position. The sheet product dispenser further includes a first dispensing mechanism configured to receive sheet product of the first product roll and dispense a portion of the sheet product of the first product roll. The sheet product dispenser further includes a second dispensing mechanism configured to receive sheet product of the second product roll and dispense a portion of the sheet product of the second product roll. The second roll holder is movable between a first position and a second position spaced from the first position. The second roll holder is configured to enable a user to load the sheet product of the second product roll into the second dispensing mechanism when in the first position. The second roll holder is configured to enable the user to load the sheet product of the first product roll into the first dispensing mechanism when in the second position.

In some embodiments, the second roll holder may be configured to prevent the user from loading the sheet product of the first product roll into the first dispensing mechanism when in the first position. The second roll holder may be configured to prevent the user from loading the sheet product of the second product roll into the second dispensing mechanism when in the second position.

In some embodiments, the second roll holder may be configured to prevent the user from loading the sheet product of the first product roll into the second dispensing mechanism or the sheet product of the second product roll into the first dispensing mechanism when in either the first position or the second position.

In some embodiments, the sheet product dispenser may further comprise a roll partition pivotally attached to the base portion and movable between a first roll partition position within the base portion and a second roll partition position spaced from the first roll partition position. The second roll holder is connected to the roll partition and movable with the roll partition. The roll partition is movable independent of the cover.

In some embodiments, the sheet product dispenser may further comprise a nip cover movable between a first nip cover position and a second nip cover position. The nip cover may be configured to move between the first nip cover position and the second nip cover position with movement of the roll partition from the first roll partition position to the second roll partition position. The nip cover may be configured to prevent access to the first dispensing mechanism by the user when in the first nip cover position. The nip cover may be configured to prevent access to the second dispensing mechanism by the user when in the second nip cover position.

In yet another example embodiment, a sheet product dispenser is provided. The sheet product dispenser comprises a first roll holder configured to support a first product roll and a second roll holder configured to support a second product roll. The sheet product dispenser further includes a housing including a base portion and a cover. The cover is movable relative to the base portion to define an open position and a closed position. The base portion defines a top and a bottom. The housing is sized such that a full size first product roll and a full size second product roll fit within the housing when the cover is in the closed position. The sheet product further includes a partition movable relative to the base portion between a stowed position and an unstowed position. The second roll holder is attached to the partition. The partition is positioned proximate the base portion when in the stowed position. The sheet product dispenser further includes a first dispensing mechanism. The first dispensing mechanism comprises a first nip roller and a first drive roller. The first dispensing mechanism is configured to receive sheet product of the first product roll between the first nip roller and the first drive roller. The sheet product dispenser further includes a second dispensing mechanism. The second dispensing mechanism comprises a second nip roller and a second drive roller. The second dispensing mechanism is configured to receive sheet product of the second product roll between the second nip roller and the second drive roller. The sheet product dispenser further includes at least one motor configured to perform at least one of the following: rotate the first drive roller to cause a portion of the sheet product of the first product roll to dispense from the sheet product dispenser, rotate the second drive roller to cause a portion of the sheet product of the second product roll to dispense from the sheet product dispenser, or selectively rotate the first drive roller or the second drive roller to cause the portion of the sheet product of the first product roll or the portion of the sheet product of the second product roll to dispense from the sheet product dispenser. The sheet product dispenser further includes a controller configured to operate the at least one motor to cause the portion of the sheet product of the first product roll or the portion of the sheet product of the second product roll to dispense. When the first product roll is supported by the first roll holder and sheet product of the first product roll is received in the first dispensing mechanism, a first web path is formed from the first product roll to the first dispensing mechanism. When the second product roll is supported by the second roll holder and sheet product of the second product roll is received in the second dispensing mechanism, a second web path is formed from the second product roll to the second dispensing mechanism. The partition is configured to separate the first web path from the second web path when the partition is in the stowed position.

In some embodiments, the partition may be configured to be moved to the unstowed position to enable a user to load the first product roll into the first roll holder and the sheet product of the first product roll into the first dispensing mechanism.

In some embodiments, when the partition is in the stowed position, a user is able to load the second product roll into the second roll holder and the sheet product of the second product roll into the second dispensing mechanism. When the partition is in the unstowed position, the user is able to load the first product roll into the first roll holder and the sheet product of the first product roll into the first dispensing mechanism.

In some embodiments, when the partition is in the stowed position, the user is unable to load the first product roll into the first roll holder or the sheet product of the first product roll into the first dispensing mechanism. When the partition is in the unstowed position, the user is unable to load the second product roll into the second roll holder or the sheet product of the second product roll into the second dispensing mechanism.

In some embodiments, the sheet product dispenser further comprises a nip cover movable between a first nip cover position and a second nip cover position. The nip cover may be configured to move between the first nip cover position and the second nip cover position with movement of the partition between the stowed position and the unstowed position. The nip cover may be configured to prevent access to the first dispensing mechanism by a user when in the first nip cover position. The nip cover may be configured to prevent access to the second dispensing mechanism by the user when in the second nip cover position.

In some embodiments, the second roll holder may comprise a retention mechanism that is configured to prevent removal of an installed second product roll when the partition rotates to the unstowed position.

In some embodiments, the retention mechanism may comprise an engagement portion of the second roll holder that is configured to rotate to maintain a generally upward orientation as the partition rotates to the unstowed position such that the installed second product roll is maintained within the second roll holder.

In some embodiments, the base portion may define a receptacle feature. The retention mechanism may further comprise a linkage that includes a first pin and a second pin. The first pin is connected to the engagement portion. The receptacle feature is configured to receive the second pin when the partition is in the stowed position. As the partition rotates toward the unstowed position, connection of the second pin of the linkage within the receptacle feature may cause the engagement portion to rotate with respect to the partition so that the engagement feature maintains the generally upward orientation.

In some embodiments, the sheet product dispenser may further include a first chute positioned proximate the bottom of the base portion and a second chute positioned proximate the bottom of the base portion and proximate the first chute.

In some embodiments, the first dispensing mechanism may be positioned proximate the bottom of the base portion and adjacent to the second dispensing mechanism and closer to a rear wall of the base portion than the second dispensing mechanism. The first chute may define a first dispense surface that extends downwardly and outwardly from the first dispensing mechanism. The second chute may define a second dispense surface that extends downwardly and outwardly from the second dispensing mechanism. The first dispense surface is longer than the second dispense surface such that, when the portion of the first product roll is dispensed, the portion of the first product roll is positioned proximate to where the portion of the second product roll is positioned when the portion of the second product roll is dispensed.

In some embodiments, the partition may comprise an attachment feature that is configured to removably attach to the base portion of the housing when the partition is in the stowed position.

In some embodiments, the partition and the base portion of the housing may be configured such that attachment of the attachment feature to the base portion of the housing or detachment of the attachment feature from the base portion of the housing creates an audible noise to indicate occurrence of attachment or detachment.

In some embodiments, the sheet product dispenser may further include at least one nip sensor positioned proximate at least one of a first nip of the first dispensing mechanism or a second nip of the second dispensing mechanism. The at least one nip sensor may be configured to sense the presence of the sheet product of the first product roll proximate the first nip or sense the presence of the sheet product of the second product roll proximate the second nip. The controller may be configured to cause actuation of the at least one motor to cause rotation of the first drive roller in an instance in which the nip sensor senses the presence of the sheet product of the first product roll to assist a user with loading the first dispensing mechanism with the sheet product of the first product roll. The controller may be further configured to cause actuation of the at least one motor to cause rotation of the second drive roller in an instance in which the nip sensor senses the presence of the sheet product of the second product roll to assist the user with loading the second dispensing mechanism with the sheet product of the second product roll.

In some embodiments, the sheet product dispenser may further include at least one chute sensor positioned within at least one of a first chute or a second chute. The at least one chute sensor is configured to sense the presence of the sheet product of the first product roll within the first chute or sense the presence of the sheet product of the second product roll within the second chute. The controller may be configured to cause the at least one motor to cease operation in an instance in which the chute sensor senses the presence of the sheet product of the first product roll within the first chute or senses the presence of the sheet product of the second product roll within the second chute.

In some embodiments, the controller may be configured to automatically switch from operating the at least one motor to cause dispense from the first product roll to operating the at least one motor to cause dispense from the second product roll in an instance in which the first product roll becomes unavailable or empty.

In some embodiments, the controller may be configured to determine which of the first product roll or second product roll has less product remaining and operate, in an instance in which the first product roll has less product remaining than the second product roll, the at least one motor to cause dispense from the first product roll or operate, in an instance in which the second product roll has less product remaining than the first product roll, the at least one motor to cause dispense from the second product roll.

In some embodiments, the sheet product dispenser may further include a first product level sensor configured to sense an amount of product remaining on the first product roll and a second product level sensor configured to sense an amount of product remaining on the second product roll. In some embodiments, at least one of the first product level sensor or the second product level sensor is an infrared product level sensor.

In some embodiments, the at least one motor may comprises a first motor and a second motor. The first motor may be configured to rotate the first drive roller to cause the portion of the sheet product of the first product roll to dispense from the sheet product dispenser. The second motor may be configured to rotate the second drive roller to cause the portion of the sheet product of the second product roll to dispense from the sheet product dispenser.

In some embodiments, the partition and the second roll holder may be configured to be movable separately from the cover.

In yet another example embodiment, a sheet product dispenser is provided. The sheet product dispenser comprises a housing including a base portion and a cover. The cover is movable relative to the base portion to define an open position and a closed position. The sheet product dispenser further includes a first roll holder configured to support a first product roll and a second roll holder configured to support a second product roll. The sheet product dispenser includes a partition movable relative to the base portion between a stowed position and an unstowed position. The second roll holder is attached to the partition. The sheet product dispenser includes a first dispensing mechanism that is configured to receive sheet product of the first product roll. The first dispensing mechanism is configured to operate to cause a portion of the sheet product of the first product roll to dispense from the sheet product dispenser. The sheet product dispenser further includes a second dispensing mechanism that is configured to receive sheet product of the second product roll. The second dispensing mechanism is configured to operate to cause a portion of the sheet product of the second product roll to dispense from the sheet product dispenser. The sheet product dispenser further includes an actuation sensor configured to sense presence of a user. The sheet product dispenser includes a controller configured to, in response to the actuation sensor sensing the presence of the user, operate either the first dispensing mechanism to cause the portion of the sheet product of the first product roll to dispense or the second dispensing mechanism to cause the portion of the sheet product of the second product roll to dispense. When the first product roll is supported by the first roll holder and the sheet product of the first product roll is received in the first dispensing mechanism, a first web path is formed from the first product roll to the first dispensing mechanism. When the second product roll is supported by the second roll holder and the sheet product of the second product roll is received in the second dispensing mechanism, a second web path is formed from the second product roll to the second dispensing mechanism. The partition is configured to separate at least a portion of the first web path from at least a portion of the second web path when the partition is in the stowed position.

In some embodiments, the partition may be configured to be moved to the unstowed position to enable the user to load the first product roll into the first roll holder and the sheet product of the first product roll into the first dispensing mechanism.

In some embodiments, the sheet product dispenser may further include a nip cover movable between a first nip cover position and a second nip cover position. The nip cover may be configured to move between the first nip cover position and the second nip cover position with movement of the partition between the stowed position and the unstowed position. The nip cover may be configured to prevent access to the first dispensing mechanism by the user when in the first nip cover position. The nip cover may be configured to prevent access to the second dispensing mechanism by the user when in the second nip cover position.

In some embodiments, the second roll holder may comprise a retention mechanism that is configured to prevent removal of an installed second product roll when the partition rotates to the unstowed position.

In some embodiments, the controller may be configured to automatically switch from operating the first dispensing mechanism to dispense from the first product roll to operating the second dispensing mechanism to dispense from the second product roll in an instance in which the first product roll becomes unavailable or empty.

In yet another example embodiment, a sheet product dispenser is provided. The sheet product dispenser comprises a housing including a base portion and a cover. The cover is movable relative to the base portion to define an open position and a closed position. The sheet product dispenser includes a first roll holder configured to support a first product roll and a second roll holder configured to support a second product roll. The sheet product dispenser further includes a partition movable relative to the base portion between a stowed position and an unstowed position. The second roll holder is attached to the partition. The sheet product dispenser further includes a first dispensing mechanism that is configured to receive sheet product of the first product roll. The first dispensing mechanism is configured to operate to cause a portion of the sheet product of the first product roll to dispense from the sheet product dispenser. The sheet product dispenser further includes a second dispensing mechanism that is configured to receive sheet product of the second product roll. The second dispensing mechanism is configured to operate to cause a portion of the sheet product of the second product roll to dispense from the sheet product dispenser. The sheet product dispenser further includes an actuation sensor configured to sense presence of a user. The sheet product dispenser further includes a controller configured to, in response to the actuation sensor sensing the presence of the user, operate either the first dispensing mechanism to cause the portion of the sheet product of the first product roll to dispense or the second dispensing mechanism to cause the portion of the sheet product of the second product roll to dispense. When the partition is in the stowed position, the user is able to load the second product roll into the second roll holder and the sheet product from the second product roll into the second dispensing mechanism. When the partition is in the unstowed position, the user is able to load the first product roll into the first roll holder and the sheet product of the first product roll into the first dispensing mechanism.

In some embodiments, the partition may be configured to be moved to the unstowed position to enable the user to load the first product roll into the first roll holder and the sheet product of the first product roll into the first dispensing mechanism.

In some embodiments, the sheet product dispenser may further include a nip cover movable between a first nip cover position and a second nip cover position. The nip cover may be configured to move between the first nip cover position and the second nip cover position with movement of the partition between the stowed position and the unstowed position. The nip cover may be configured to prevent access to the first dispensing mechanism by the user when in the first nip cover position. The nip cover may be configured to prevent access to the second dispensing mechanism by the user when in the second nip cover position.

In some embodiments, the second roll holder may comprise a retention mechanism that is configured to prevent removal of an installed second product roll when the partition rotates to the unstowed position.

In some embodiments, the controller may be configured to automatically switch from operating the first dispensing mechanism to dispense from the first product roll to operating the second dispensing mechanism to dispense from the second product roll in an instance in which the first product roll becomes unavailable or empty.

In yet another example embodiment, a sheet product dispenser is provided. The sheet product dispenser comprises a housing including a base portion and a cover. The cover is movable relative to the base portion to define an open position and a closed position. The sheet product dispenser includes a first roll holder configured to support a first product roll and a second roll holder configured to support a second product roll. The sheet product dispenser further includes a first dispensing mechanism configured to receive sheet product of the first product roll and dispense a portion of the sheet product of the first product roll. The sheet product dispenser further includes a second dispensing mechanism configured to receive sheet product of the second product roll and dispense a portion of the sheet product of the second product roll. The sheet product dispenser further includes a controller that is configured to determine which of the first product roll or second product roll has less product remaining and operate, in an instance in which the first product roll has less product remaining than the second product roll, the first dispensing mechanism to dispense the portion of the sheet product of the first product roll or operate, in an instance in which the second product roll has less product remaining than the first product roll, the second dispensing mechanism to dispense the portion of the sheet product of the second product roll.

In some embodiments, the controller may be configured to automatically switch from operating the first dispensing mechanism to dispense from the first product roll to operating the second dispensing mechanism to dispense from the second product roll in an instance in which the first product roll becomes unavailable or empty.

In some embodiments, the sheet product dispenser may further include a first product level sensor configured to sense an amount of product remaining on the first product roll. In some embodiments, the first product level sensor may be an infrared product level sensor. In some embodiments, the first product level sensor may be a mechanical-based product level sensor that is configured to contact an outer circumference of the corresponding first product roll.

In some embodiments, the sheet product dispenser may further include a first product roll rotational sensor configured to sense rotation of the first product roll and a second product roll rotational sensor configured to sense rotation of the second product roll. The controller may be configured to determine which of the first product roll or the second product roll has less sheet product remaining based on a comparison of rotational data received from the first product roll rotational sensor and the second product roll rotational sensor.

In some embodiments, the sheet product dispenser may further include a first drive roller rotational sensor configured to sense rotation of a first drive roller of the first dispensing mechanism. Rotation of the first drive roller may cause dispensing of sheet product from the first product roll. The sheet product dispenser may further include a second drive roller rotational sensor configured to sense rotation of a second drive roller of the second dispensing mechanism. Rotation of the second drive roller may cause dispensing of sheet product from the second product roll. The controller may be configured to determine which of the first product roll or the second product roll has less sheet product remaining based on a comparison of rotational data received from the first product roll rotational sensor, the first drive roller rotational sensor, the second product roll rotational sensor, and the second drive roller rotational sensor.

In some embodiments, the controller may be configured to determine which of the first product roll or the second product roll has less sheet product remaining based on a comparison of a first rotational ratio with a second rotational ratio. The first rotational ratio may comprise a time period for a rotation cycle of the first product roll over a time period for a rotation cycle of the first drive roller. The second rotational ratio may comprise a time period for a rotation cycle of the second product roll over a time period for a rotation cycle of the second drive roller.

In some embodiments, the controller may be configured to determine an amount of product remaining on the first product roll based on a comparison of rotational data received from the first product roll rotational sensor and the first drive roller rotational sensor. The controller may be further configured to determine an amount of product remaining on the second product roll based on a comparison of rotational data received from the second product roll rotational sensor and the second drive roller rotational sensor.

In some embodiments, the controller may be configured to determine, in an instance in which the first product roll and the second product roll have substantially the same amount of product remaining, which of the first product roll or the second product roll has been installed for a longer period of time. The controller may be further configured to operate the first dispensing mechanism in an instance in which the first product roll has been installed for a longer period of time than the second product roll or operate the second dispensing mechanism in an instance in which the second product roll has been installed for a longer period of time than the first product roll.

In some embodiments, the sheet product dispenser may further include a chute configured to direct the portion of the first product roll being dispensed. The sheet product dispenser may further include a first sensor positioned within the chute and configured to sense the presence of the sheet product of the first product roll within the chute. The controller may be configured to cause operation of the first dispensing mechanism to cease and operation of the second dispensing mechanism to begin in an instance in which the chute sensor does not sense the presence of the sheet product of the first product roll within the chute and the controller determines that that the first dispensing mechanism is operating. In some embodiments, the first sensor is an infrared sensor. In some embodiments, the first sensor is reflective.

In some embodiments, the sheet product dispenser may further include a first sensor positioned proximate a nip of the first dispensing mechanism and configured to sense the presence of the sheet product of the first product roll. In some embodiments, the sheet product dispenser may further include a light pipe positioned on a first side of the nip of the first dispensing mechanism. The first sensor may comprise an emitter and at least one receiver. The emitter may be positioned on a second side of the nip of the first dispensing mechanism and aimed to emit light across the nip toward the light pipe at a first position. The light pipe may be configured to receive the emitted light and redirect the light across the nip at a second position. The receiver may be positioned on the second side of the nip of the first dispensing mechanism and configured to receive the redirected light from the light pipe. The first position is spaced apart from the second position. The first sensor may sense the presence of sheet product in an instance in which the receiver does not receive the redirected light.

In some embodiments, the light pipe may be further configured to split the light received from the emitter. The light pipe may be further configured to redirect a first portion of the light across the nip at the second position and redirect a second portion of the light across the nip at a third position. The third position is spaced apart from the second position and the at least one receiver is a first receiver. The first sensor may comprise a second receiver that is positioned on the second side of the nip of the first dispensing mechanism and configured to receive the second portion of the redirected light from the light pipe. The first sensor may sense the presence of sheet product in an instance in which at least one of the first receiver or the second receiver do not receive the redirected light.

In yet another example embodiment, a sheet product dispenser is provided. The sheet product dispenser comprises a housing including a base portion and a cover. The cover is movable relative to the base portion to define an open position and a closed position. The sheet product dispenser further includes a first roll holder configured to support a first product roll and a second roll holder configured to support a second product roll. The sheet product dispenser further includes a first dispensing mechanism configured to receive sheet product of the first product roll and dispense a portion of the sheet product of the first product roll. The sheet product dispenser further includes a second dispensing mechanism configured to receive sheet product of the second product roll and dispense a portion of the sheet product of the second product roll. The sheet product dispenser further includes a first product roll rotational sensor configured to sense rotation of the first product roll and a second product roll rotational sensor configured to sense rotation of the second product roll. The sheet product dispenser further includes a controller that is configured to determine which of the first product roll or second product roll has less product remaining based on a comparison of rotational data received from the first product roll rotational sensor and the second product roll rotational sensor and operate, in an instance in which the first product roll has less product remaining than the second product roll, the first dispensing mechanism to dispense the portion of sheet product of the first product roll or operate, in an instance in which the second product roll has less product remaining than the first product roll, the second dispensing mechanism to dispense the portion of the sheet product of the second product roll.

In some embodiments, the sheet product dispenser may further include a first drive roller rotational sensor configured to sense rotation of a first drive roller of the first dispensing mechanism. Rotation of the first drive roller may cause dispensing of sheet product from the first product roll. The sheet product dispenser may further include a second drive roller rotational sensor configured to sense rotation of a second drive roller of the second dispensing mechanism. Rotation of the second drive roller may cause dispensing of sheet product from the second product roll. The controller may be configured to determine which of the first product roll or the second product roll has less sheet product remaining based on a comparison of rotational data received from the first product roll rotational sensor, the first drive roller rotational sensor, the second product roll rotational sensor, and the second drive roller rotational sensor.

In some embodiments, the controller is configured to determine which of the first product roll or the second product roll has less sheet product remaining based on a comparison of a first rotational ratio with a second rotational ratio. The first rotational ratio may comprise a time period for a rotation cycle of the first product roll over a time period for a rotation cycle of the first drive roller. The second rotational ratio may comprise a time period for a rotation cycle of the second product roll over a time period for a rotation cycle of the second drive roller.

In some embodiments, the controller may be configured to determine an amount of product remaining on the first product roll based on a comparison of rotational data received from the first product roll rotational sensor and the first drive roller rotational sensor.

In yet another example embodiment, a sheet product dispenser is provided. The sheet product dispenser comprises a housing including a base portion and a cover. The cover is movable relative to the base portion to define an open position and a closed position. The sheet product dispenser further includes a first roll holder configured to support a first product roll and a second roll holder configured to support a second product roll. The sheet product dispenser further includes a first dispensing mechanism configured to receive sheet product of the first product roll and dispense a portion of the sheet product of the first product roll. The sheet product dispenser further includes a second dispensing mechanism configured to receive sheet product of the second product roll and dispense a portion of the sheet product of the second product roll. The sheet product dispenser further includes a chute configured to direct the portion of the first product roll being dispensed. The sheet product dispenser further includes a chute sensor positioned within the chute and configured to sense the presence of the sheet product of the first product roll within the chute. The sheet product dispenser further includes a controller that is configured to operate the first dispensing mechanism and automatically switch from operating the first dispensing mechanism to dispense from the first product roll to operating the second dispensing mechanism to dispense from the second product roll in an instance in which the chute sensor does not sense the presence of the sheet product of the first product roll within the chute and the controller determines that that the first dispensing mechanism is operating.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 42:
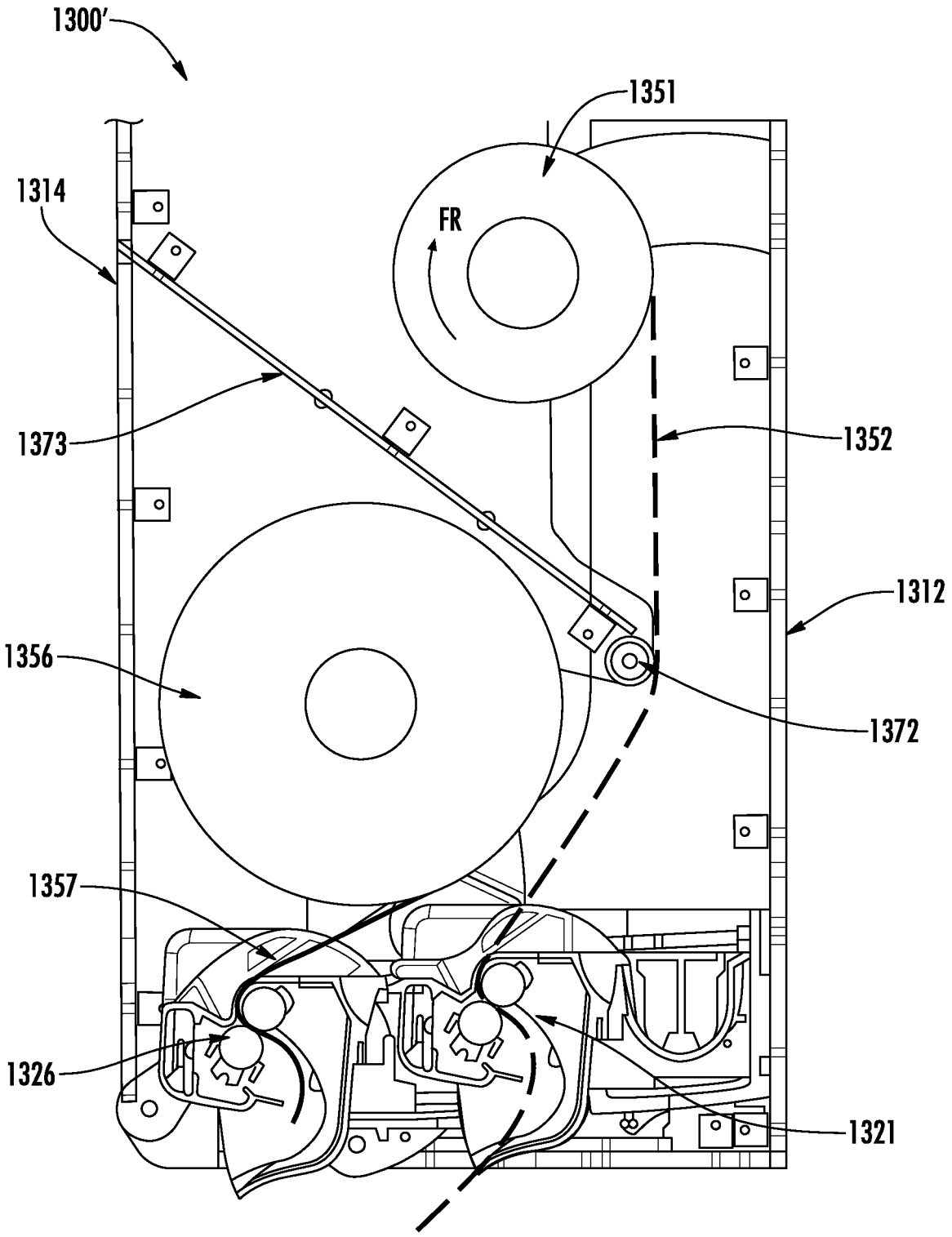
Figure 44:
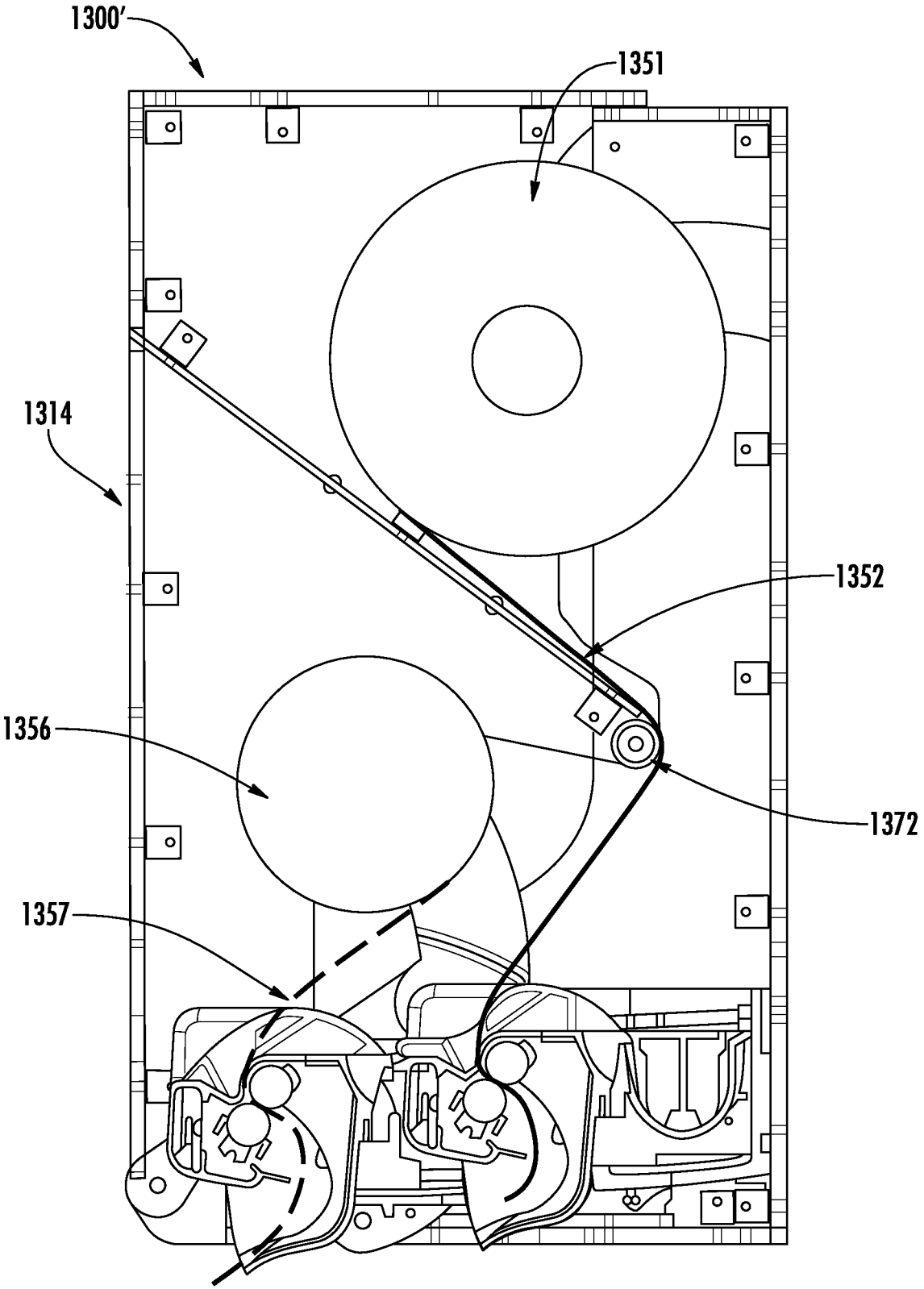
Figure 45:
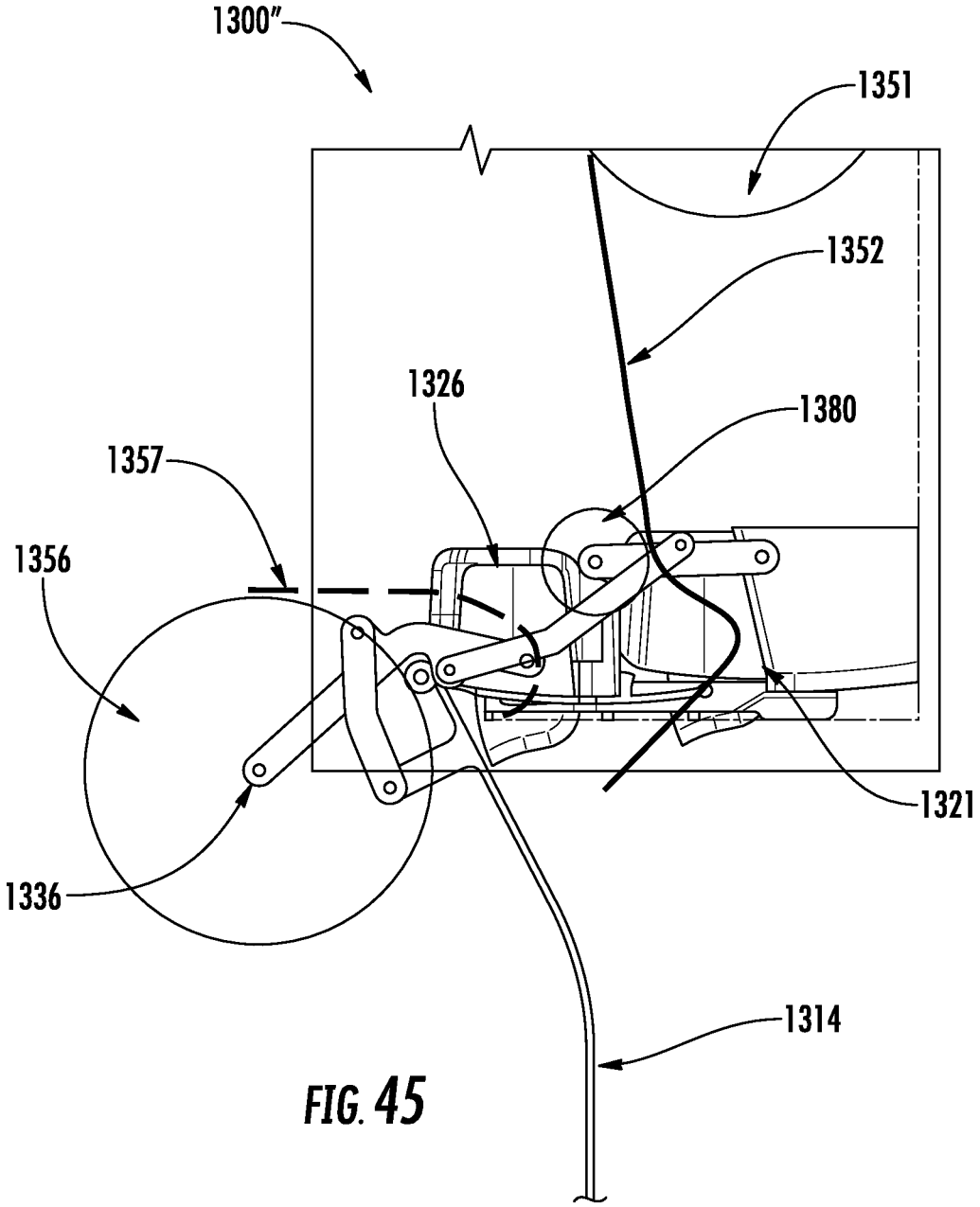
Figure 46:
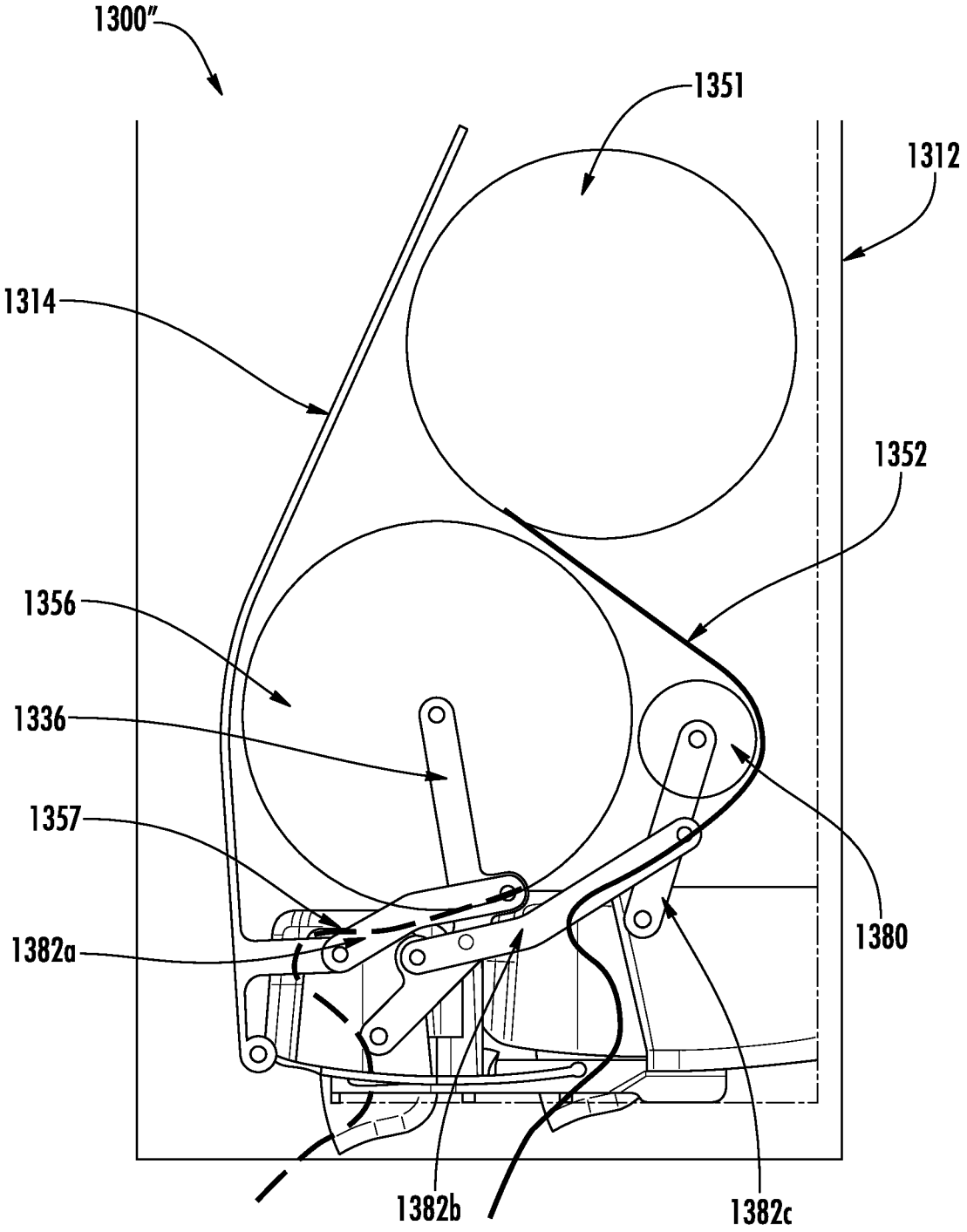
Figure 47:
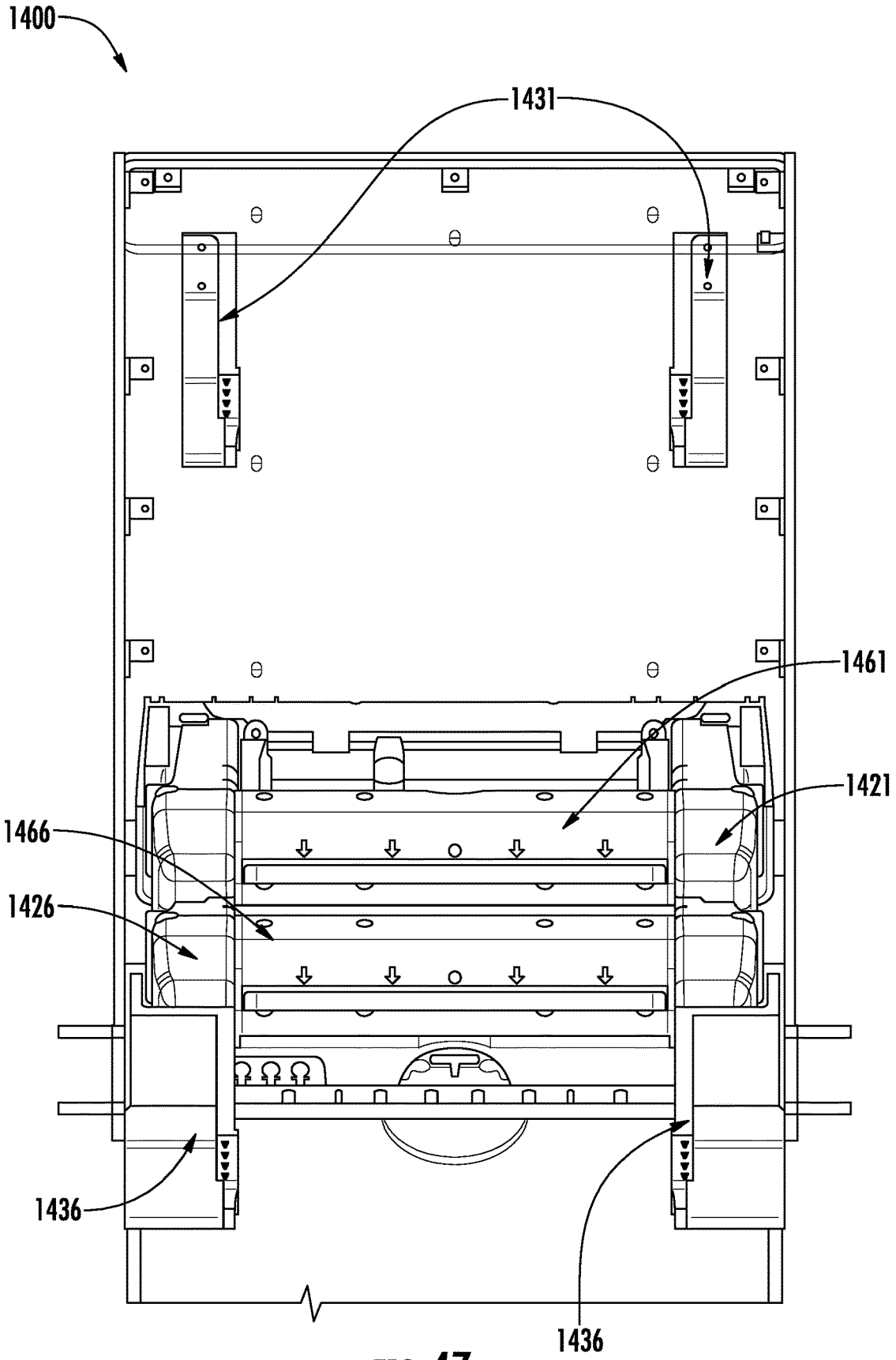
Figure 48:
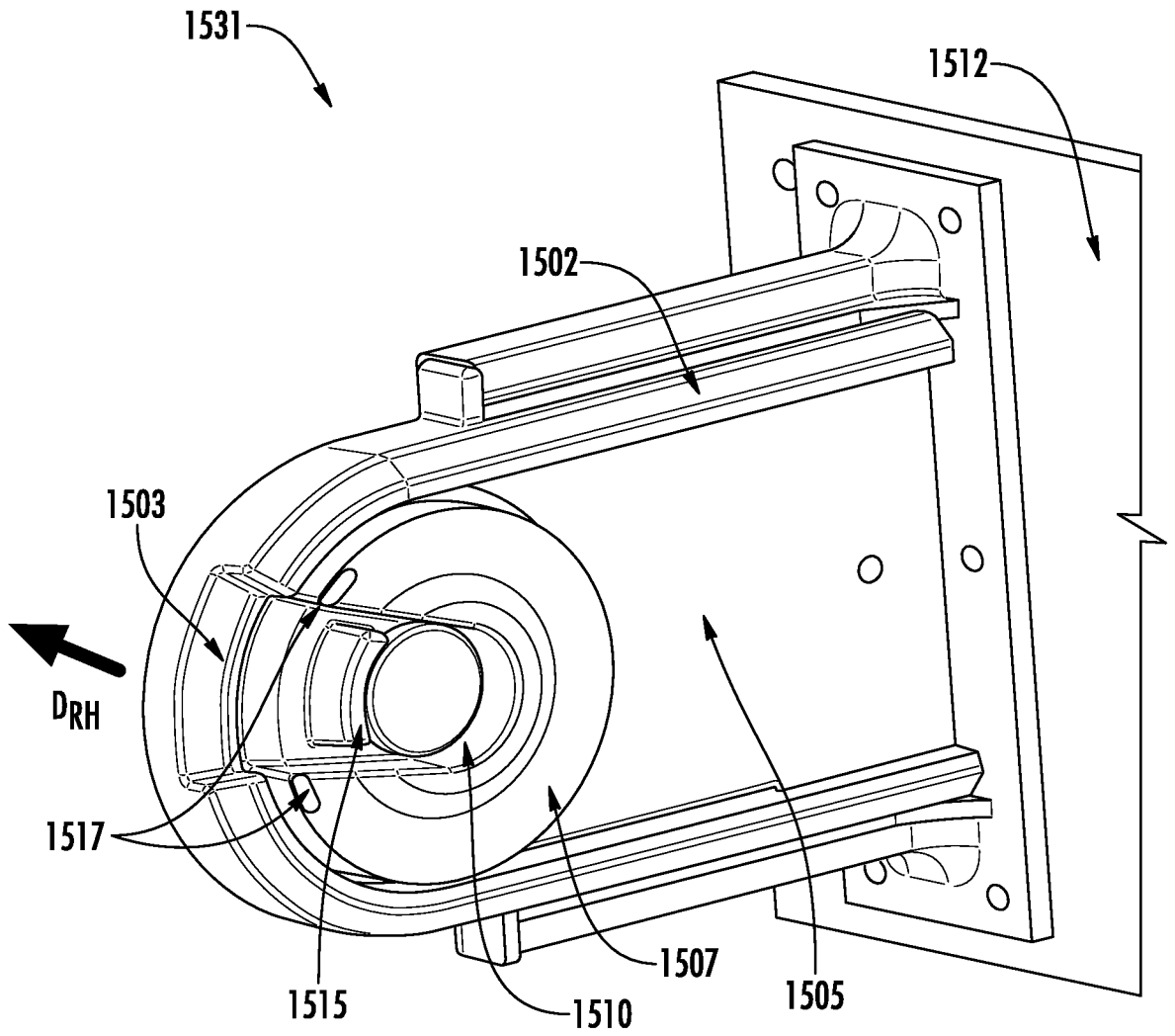
Figure 49:
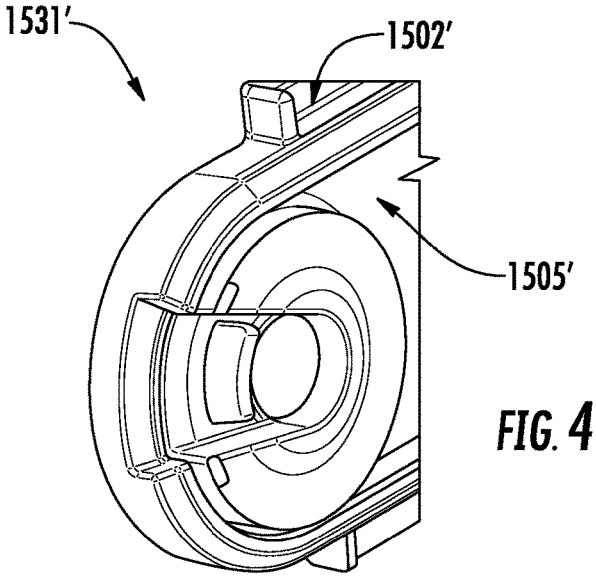
Figure 50A:
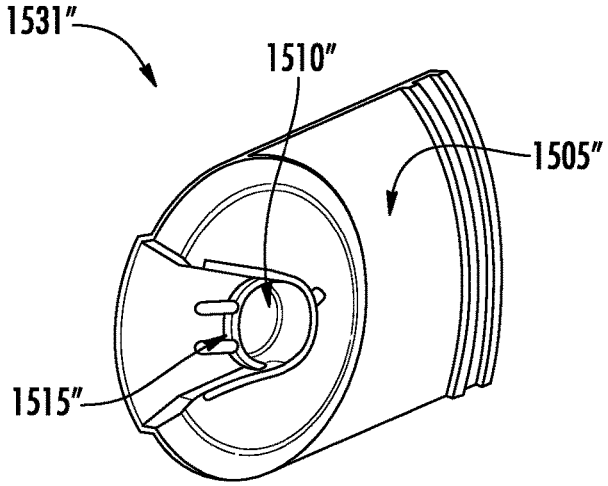
Figure 50B:
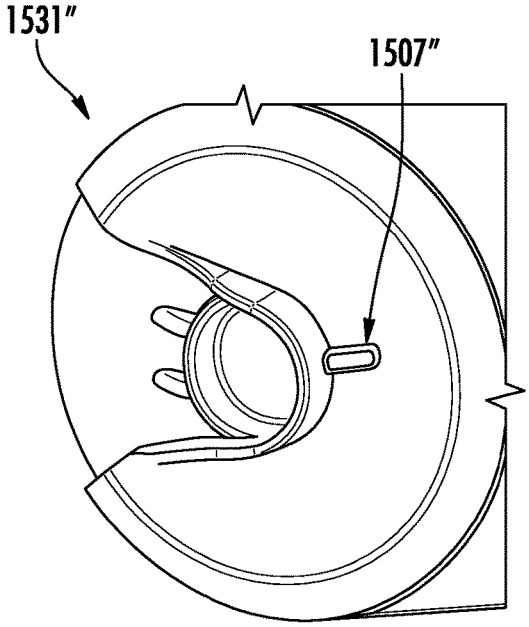
Figure 51A:
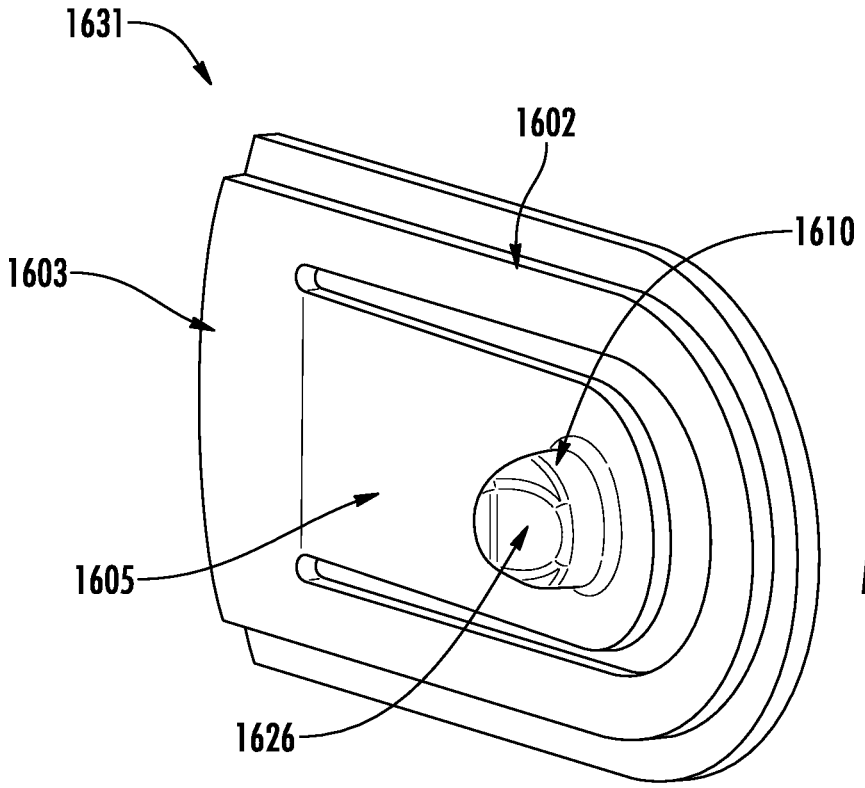
Figure 51B:
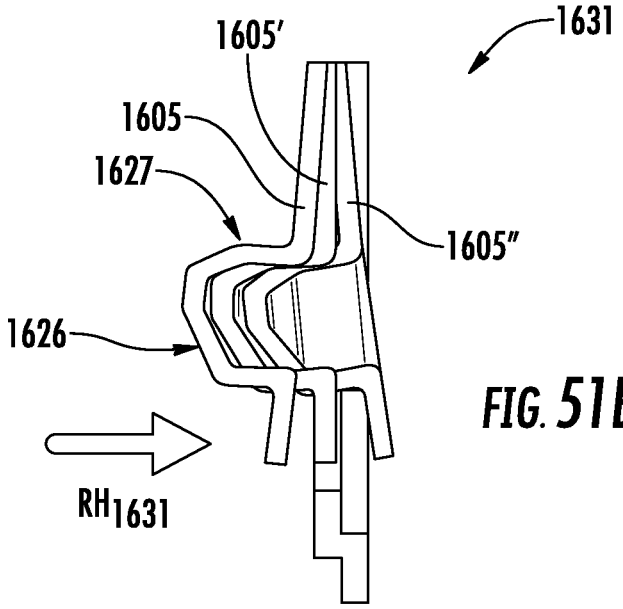
Figure 52A:
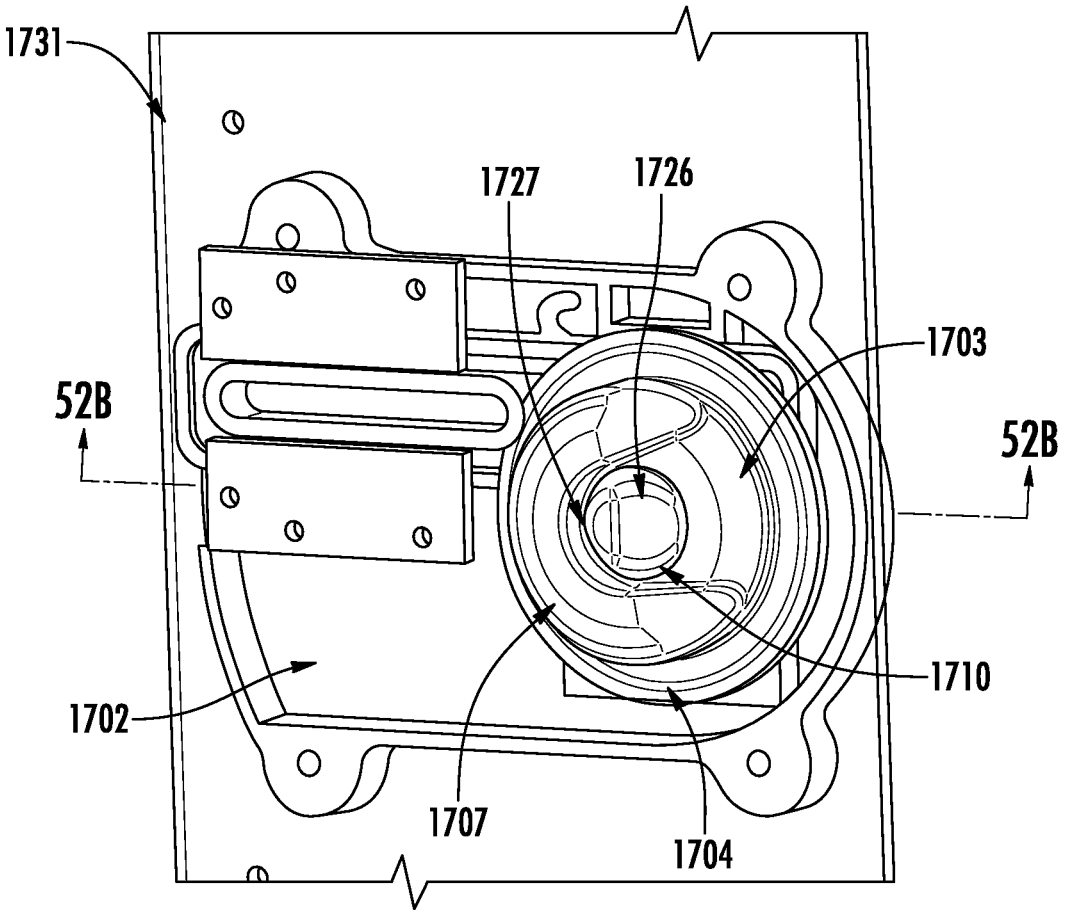
Figure 52B:
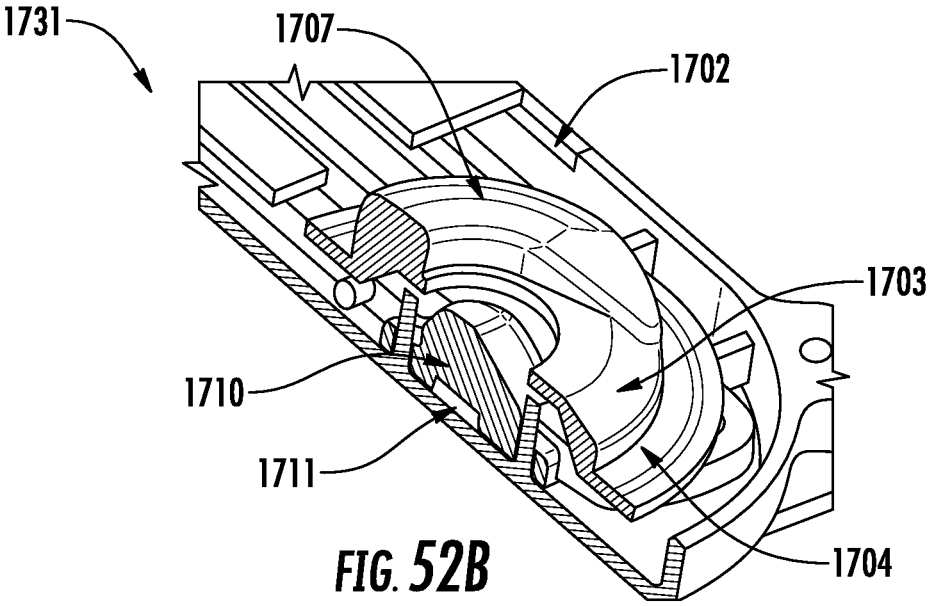
Figure 53A:
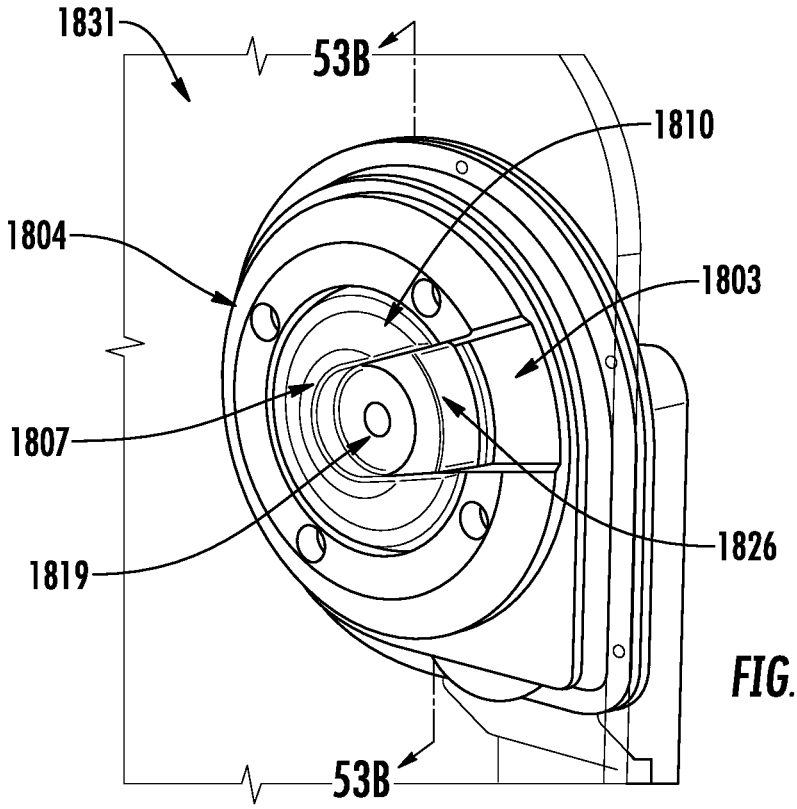
Figure 53B:
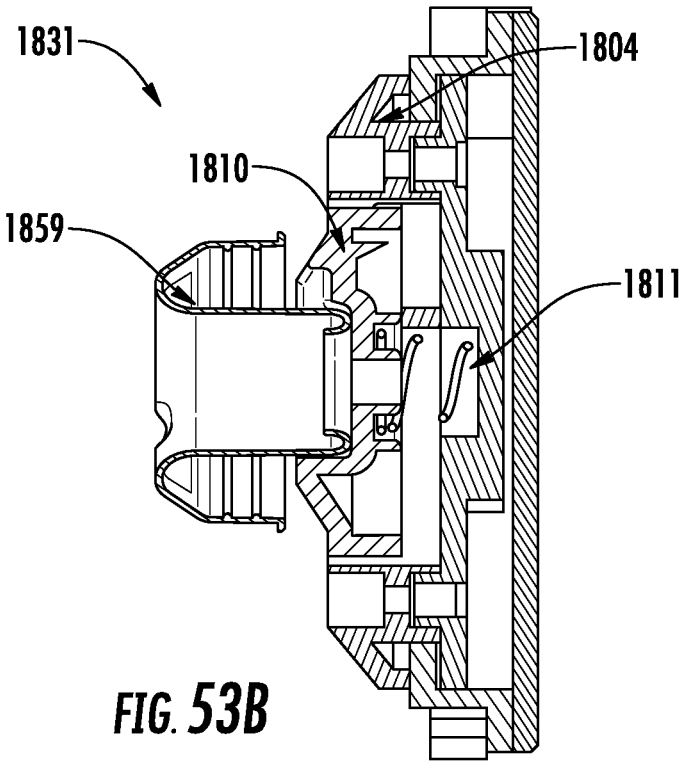
Figure 54A:
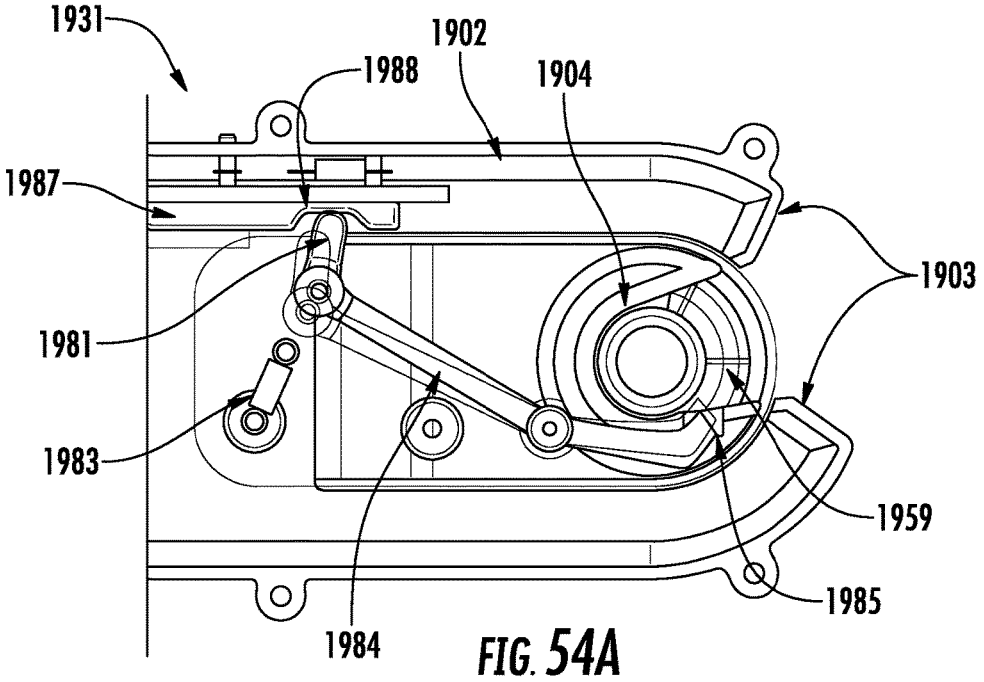
Figure 54B:
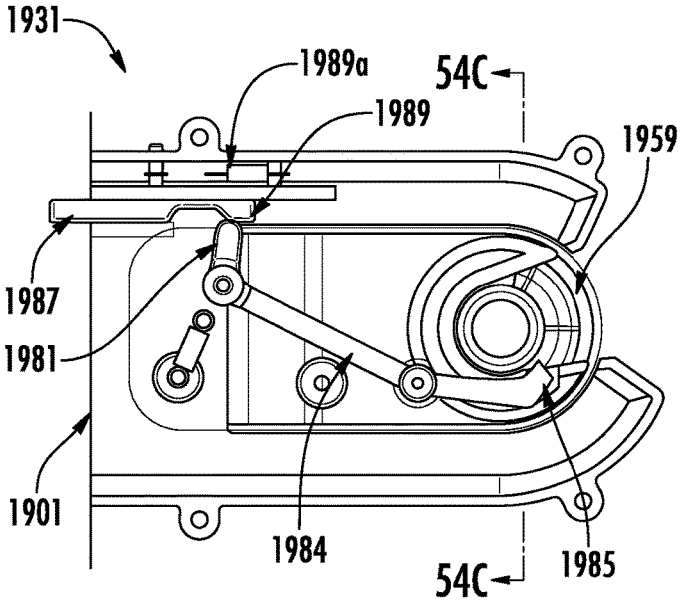
Figure 54C:
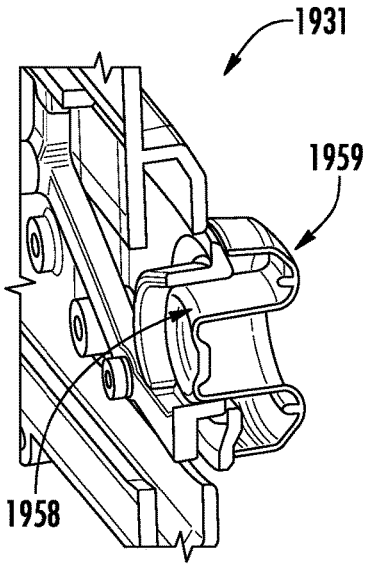
Figure 55A:
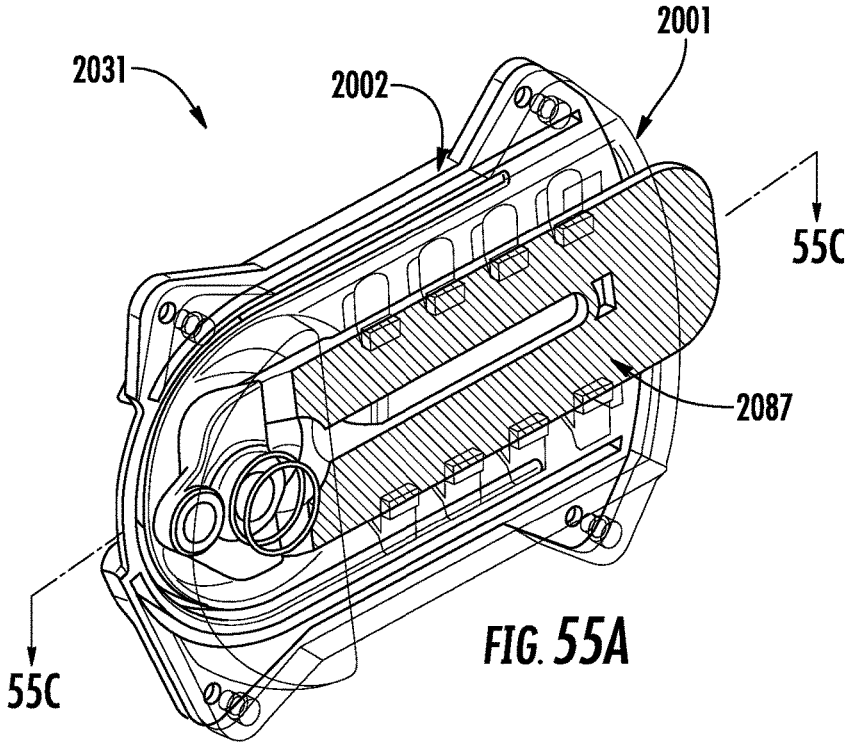
Figure 55B:
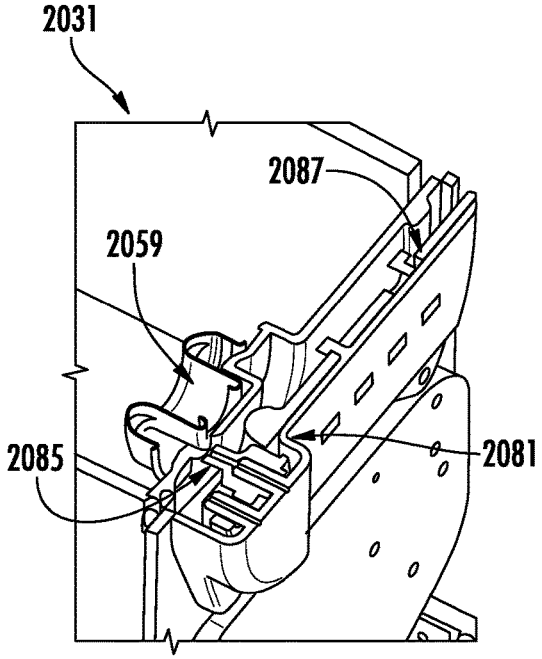
Figure 55C:
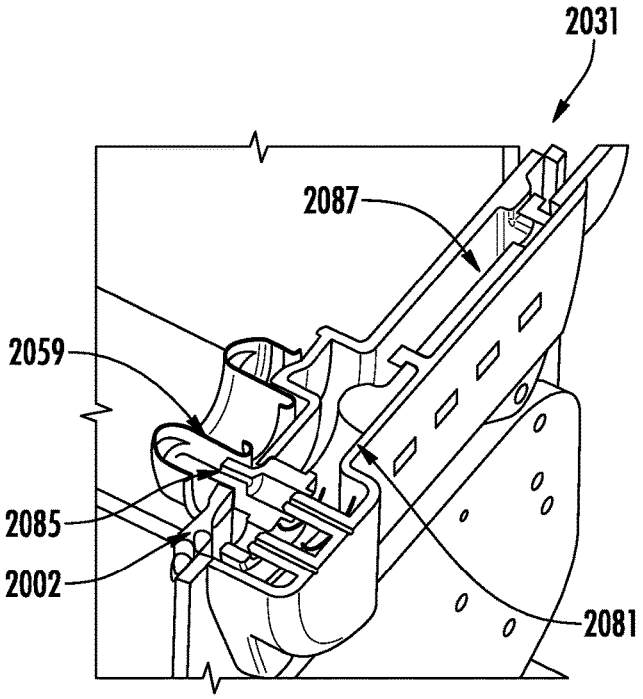
Figure 56A:
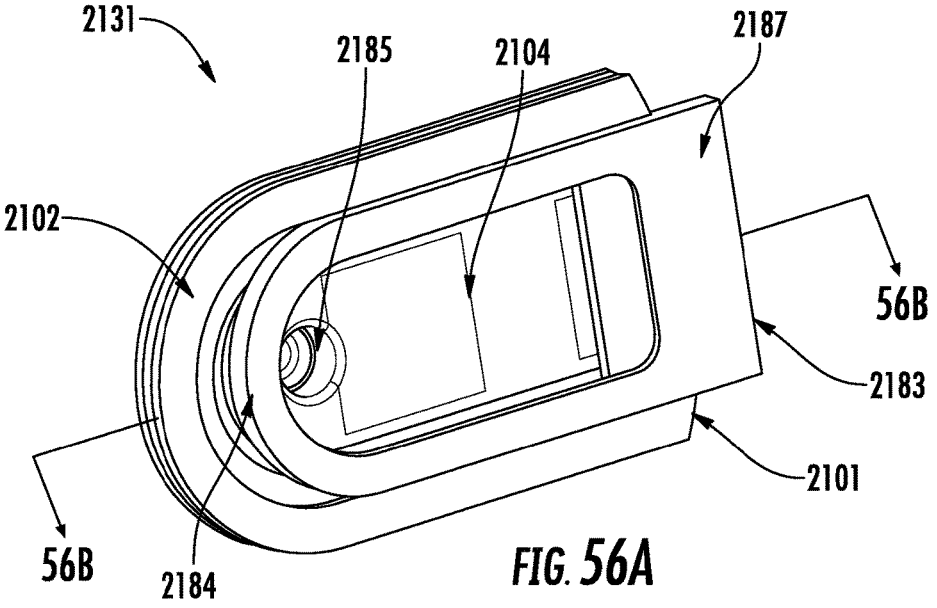
Figure 56B:
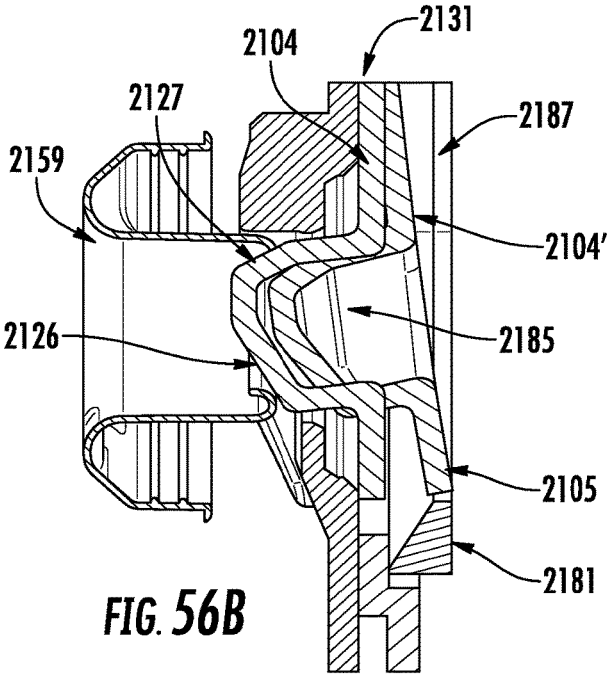
Figure 56C:
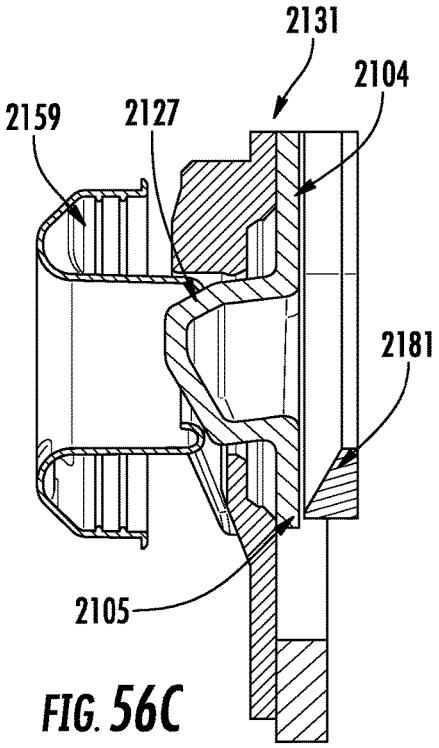
Figure 57A:
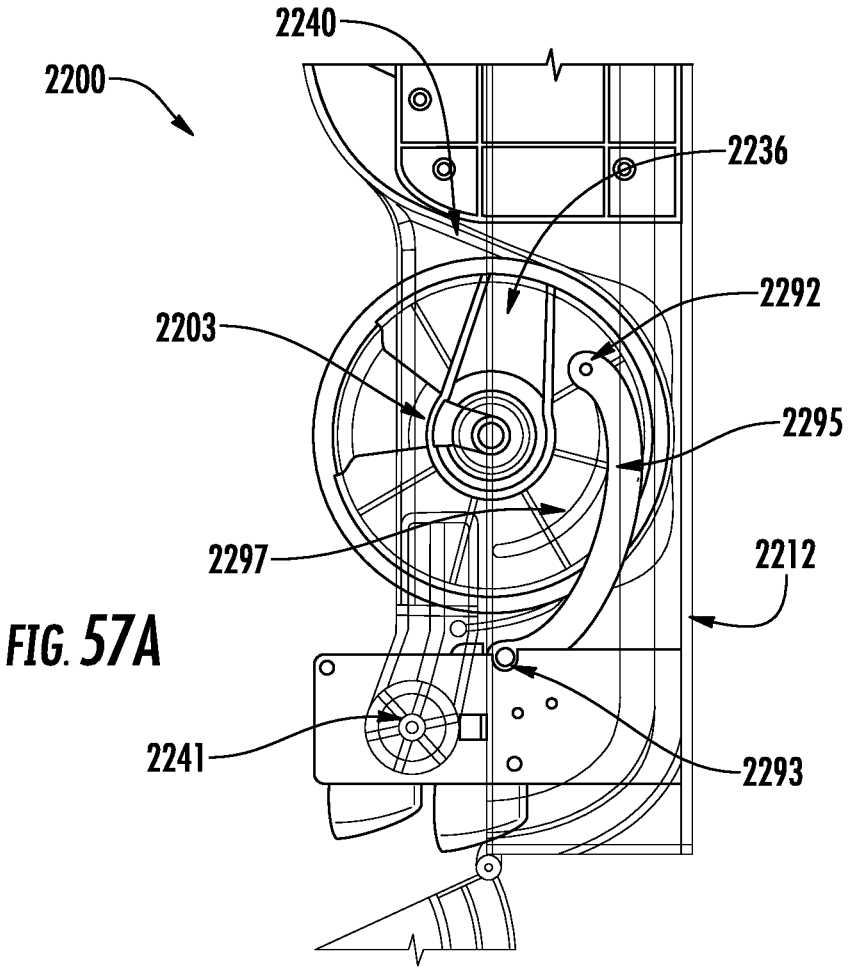
Figure 57B:
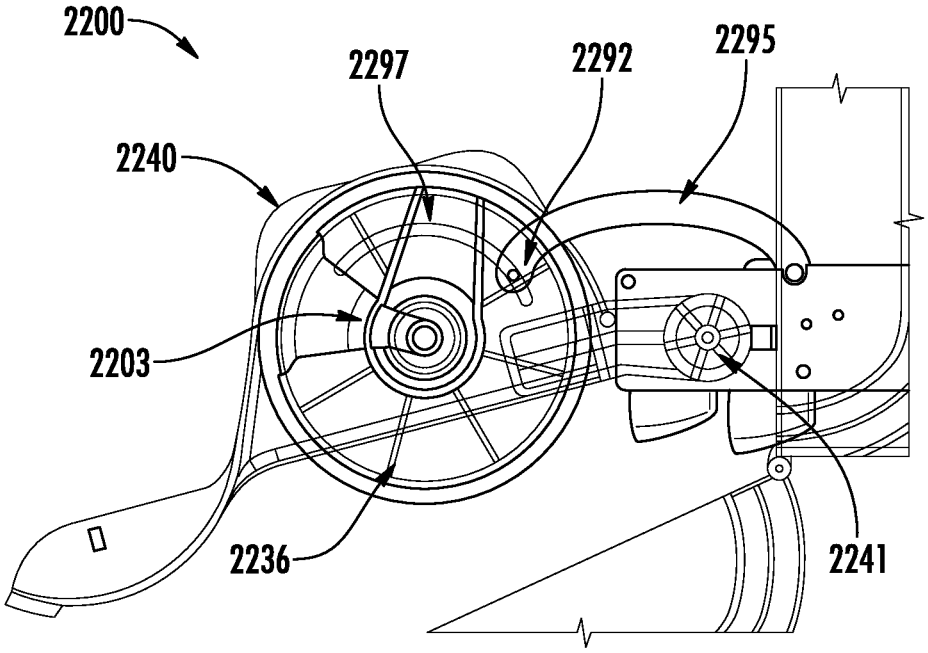
Figure 59A:
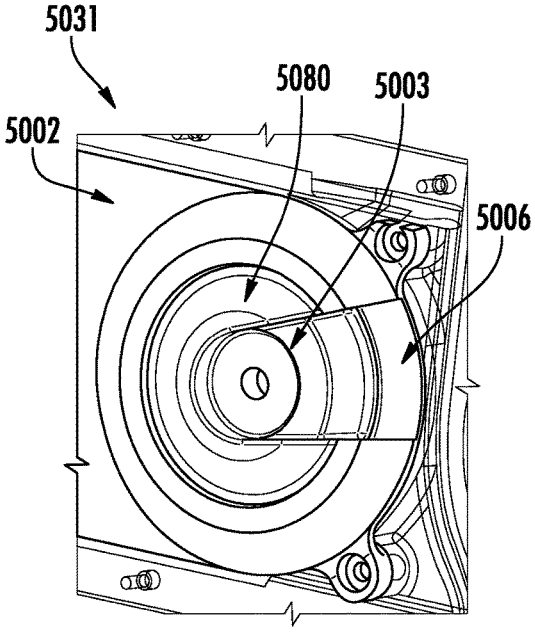
Figure 59B:
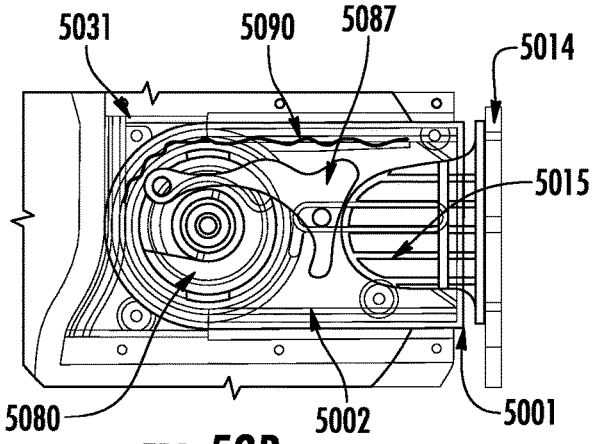
Figure 59C:
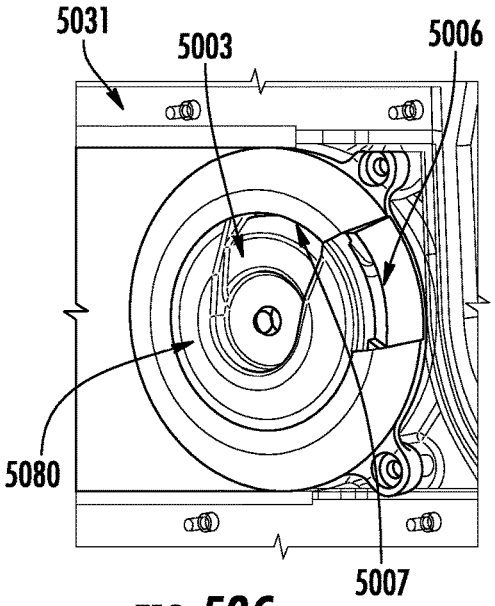
Figure 59D:
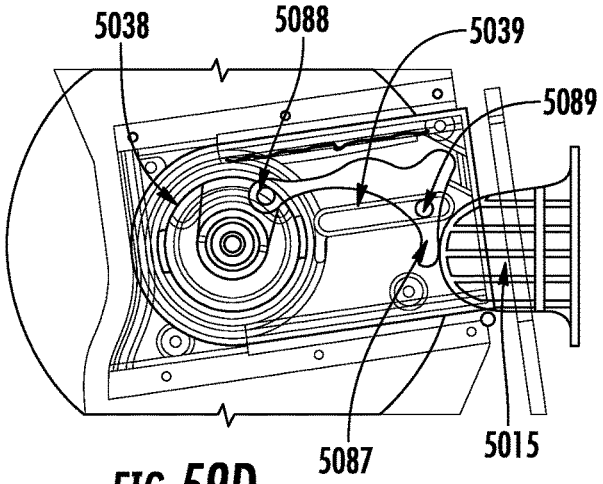
Figure 59E:
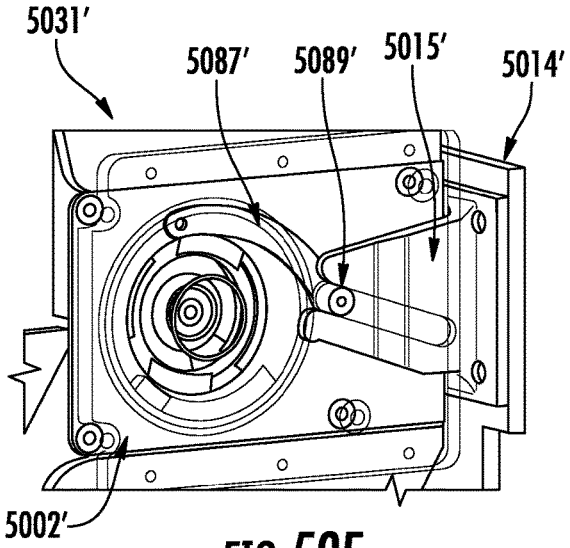
Figure 59F:
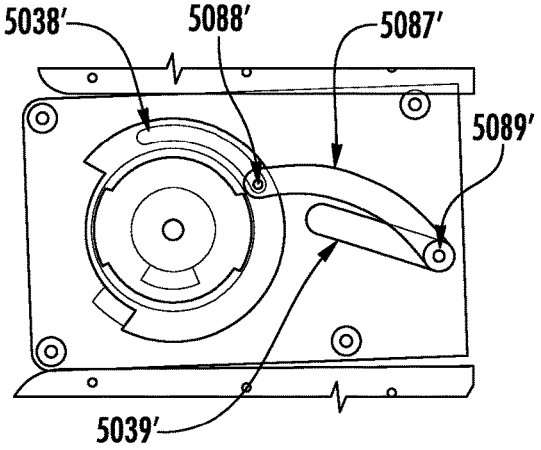
Figure 59G:
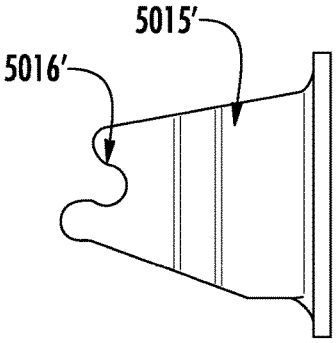
Figure 59H:
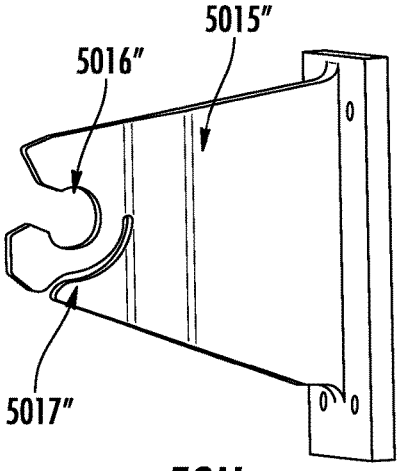
Figure 59I:
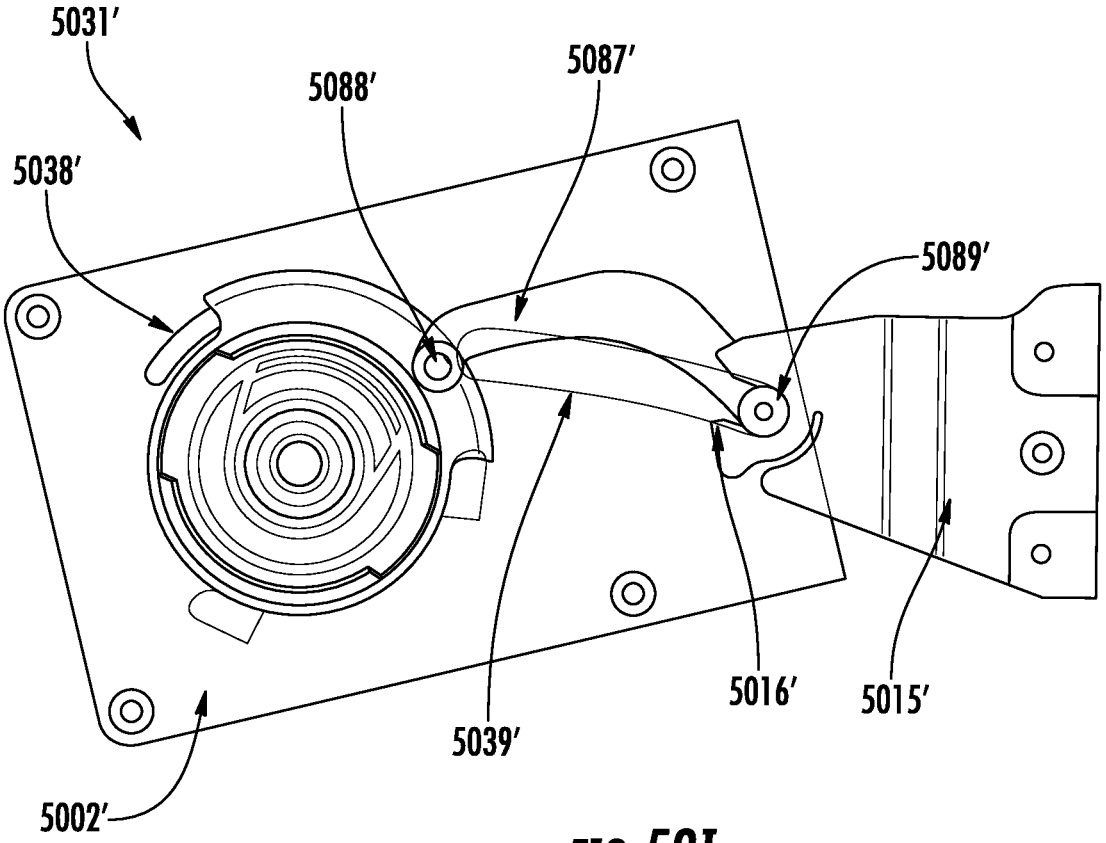
Figure 59K:
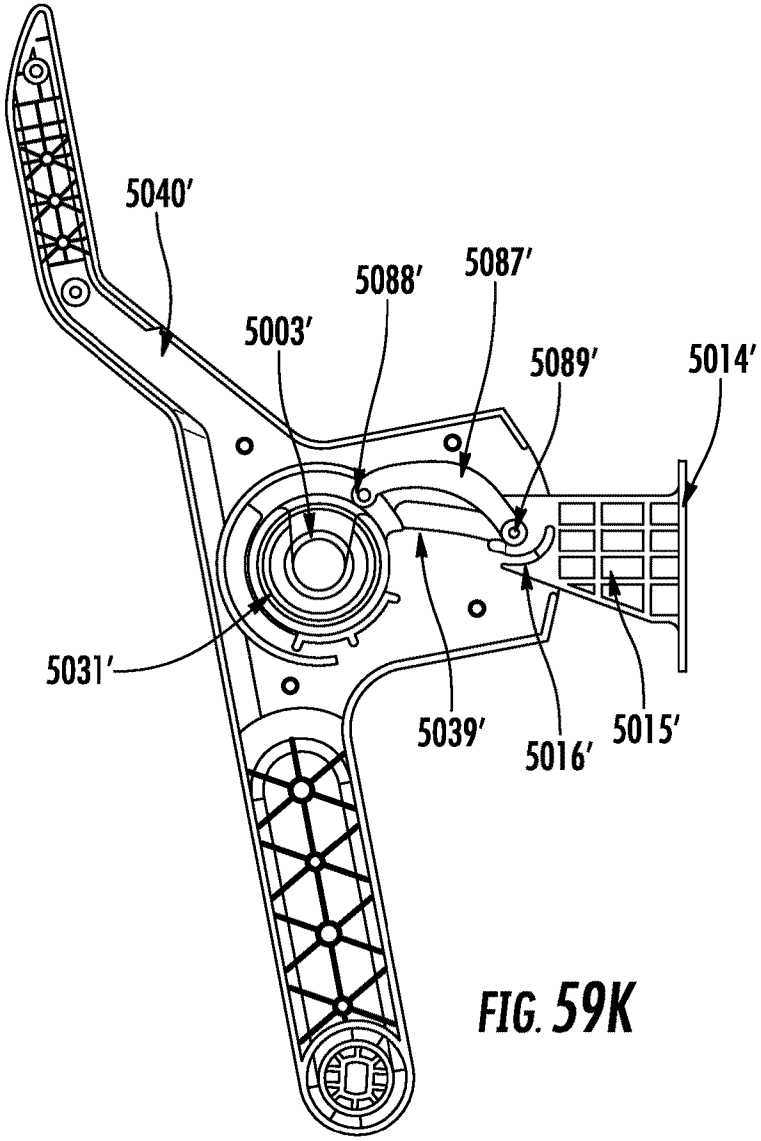
Figure 59J:
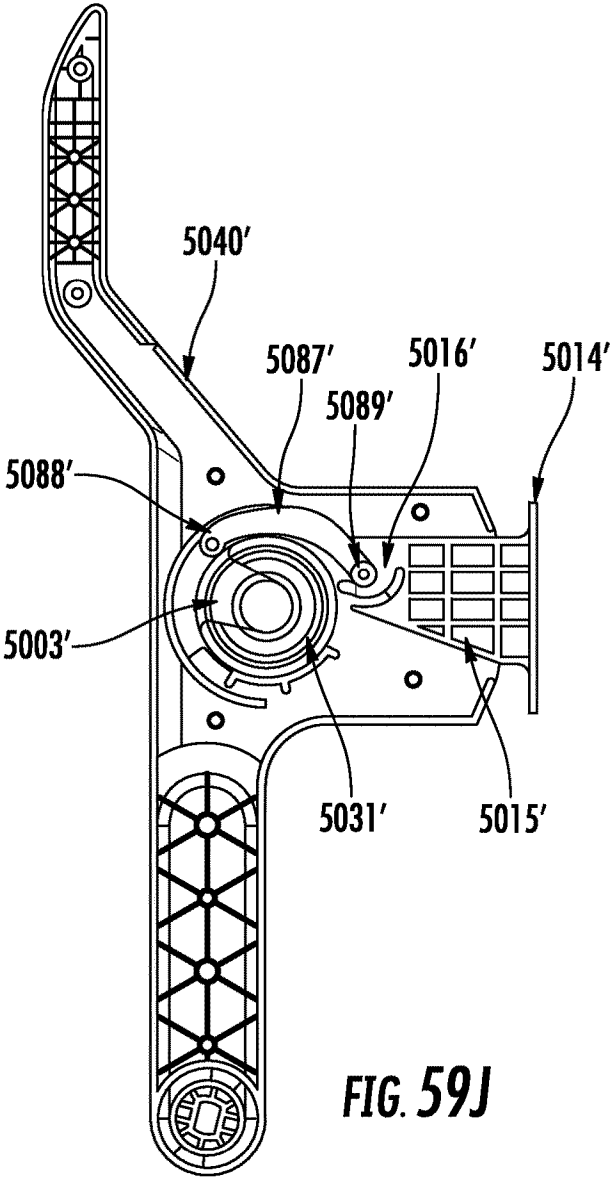
Figure 61:
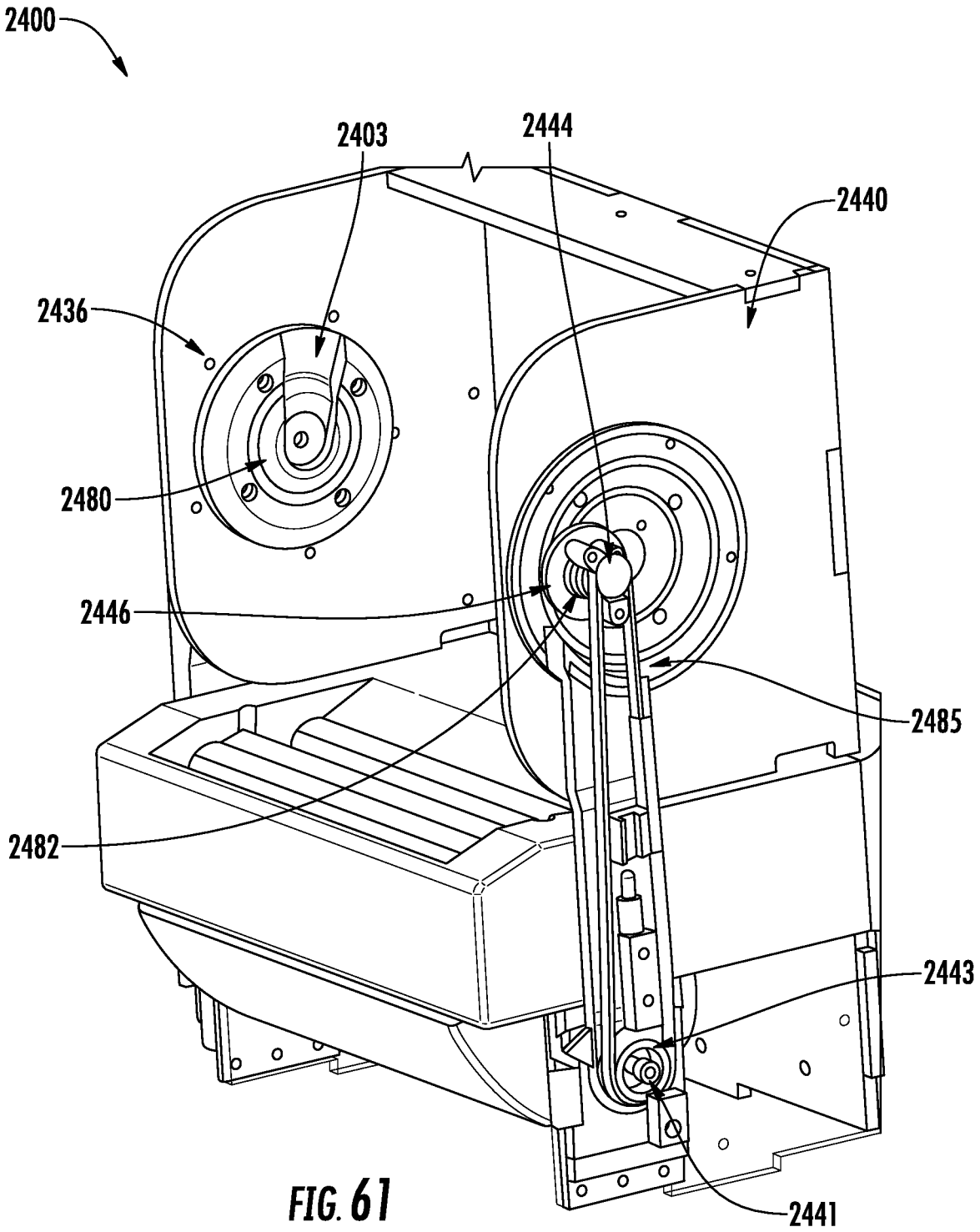
Figure 63A:
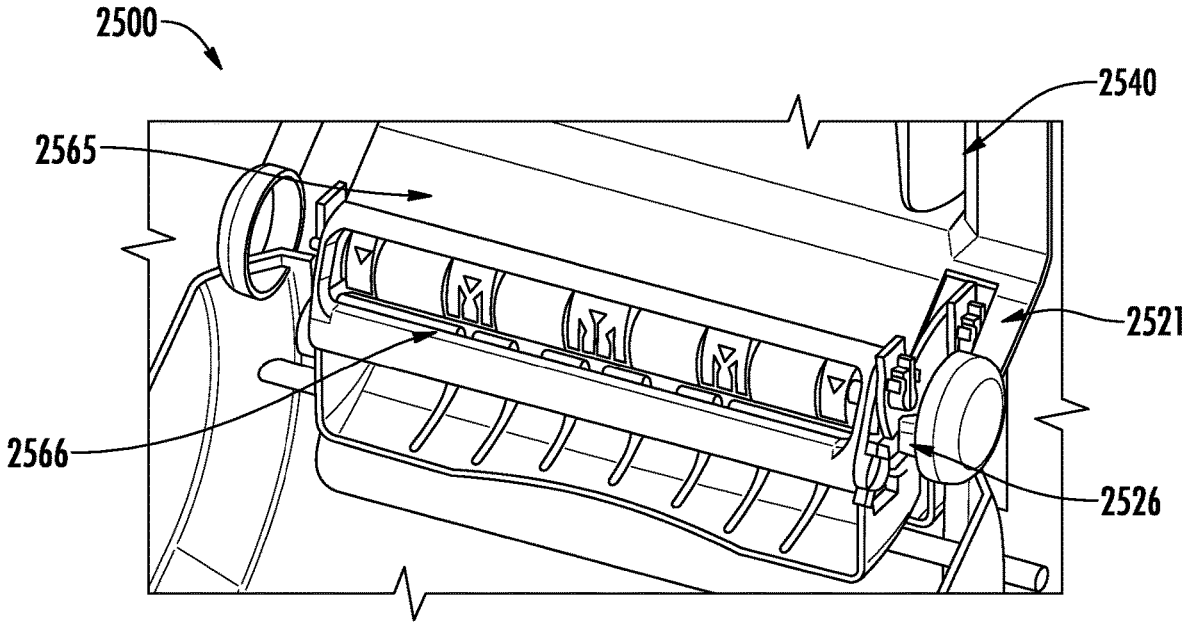
Figure 63B:
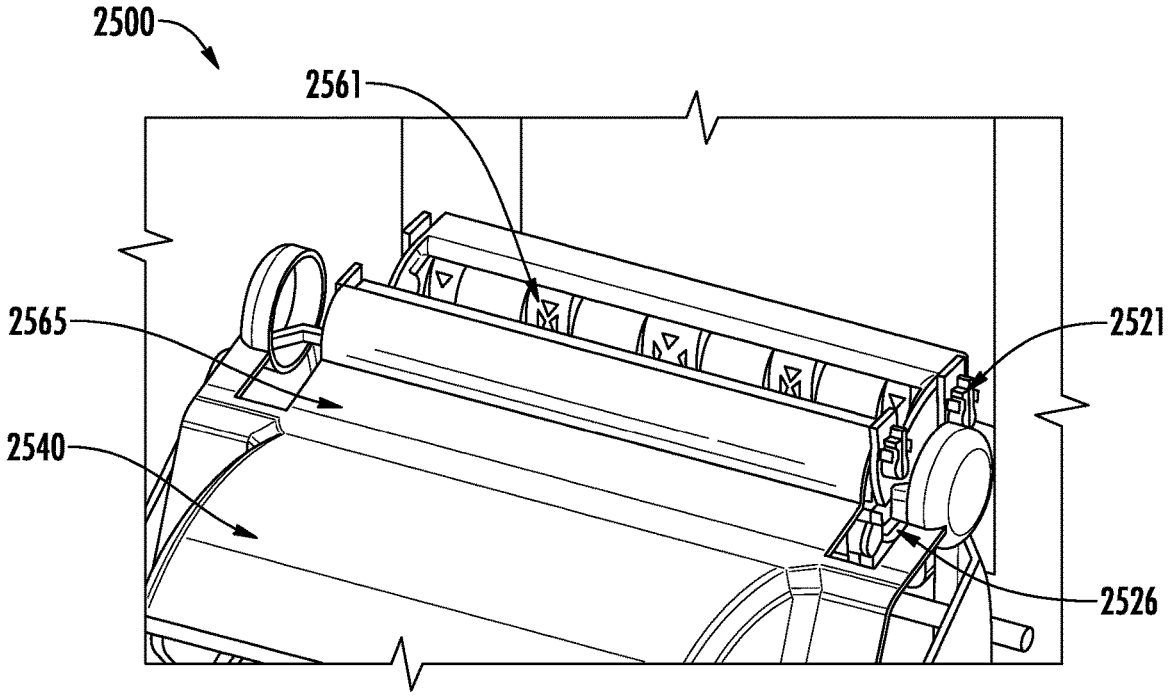
Figure 63C:
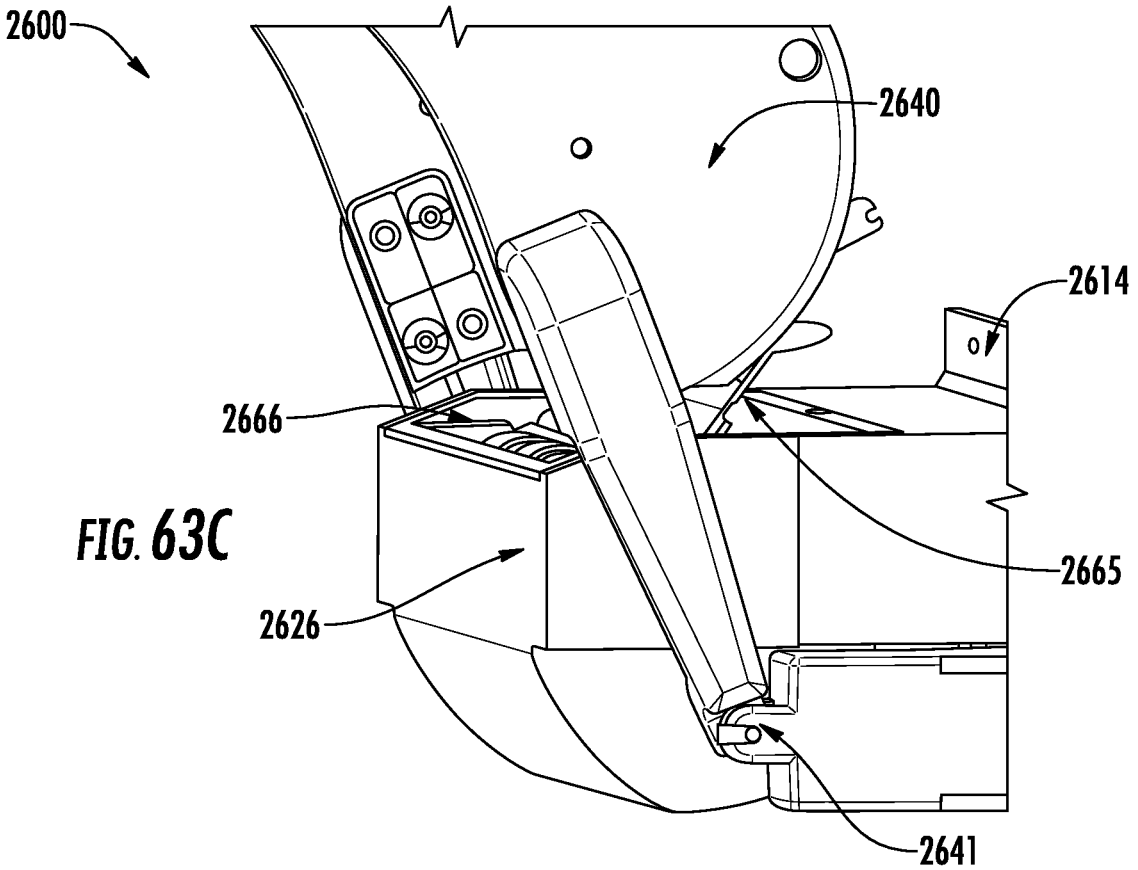
Figure 63D:
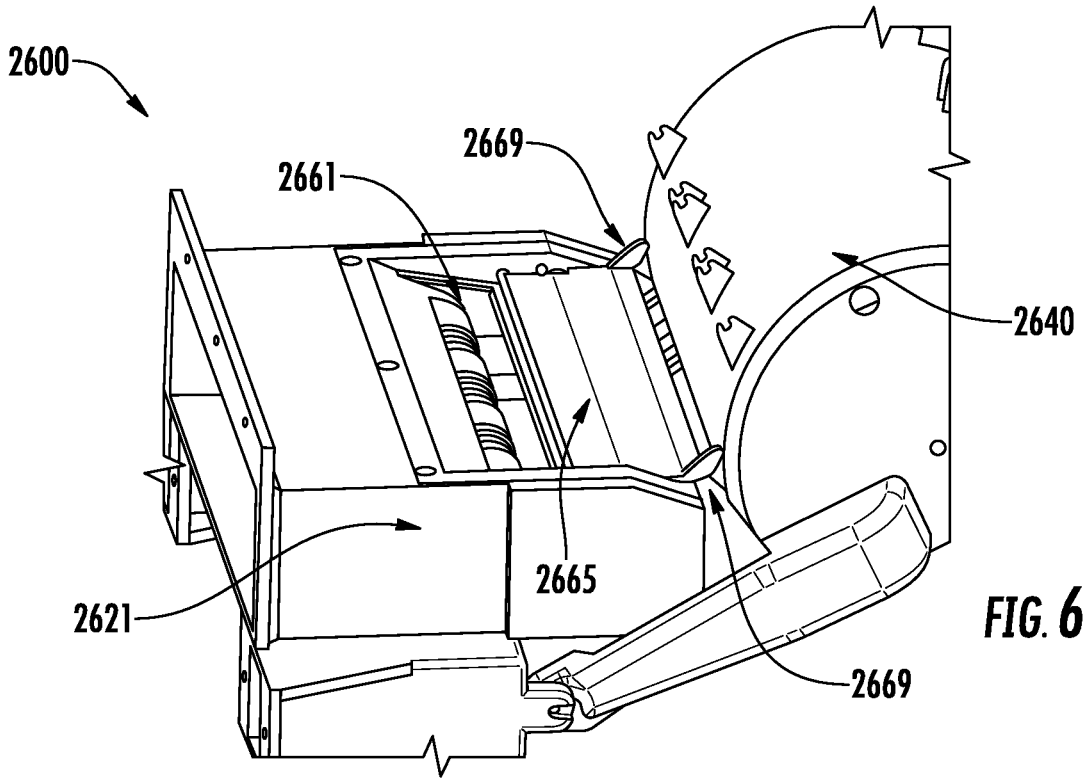
Figure 64A:
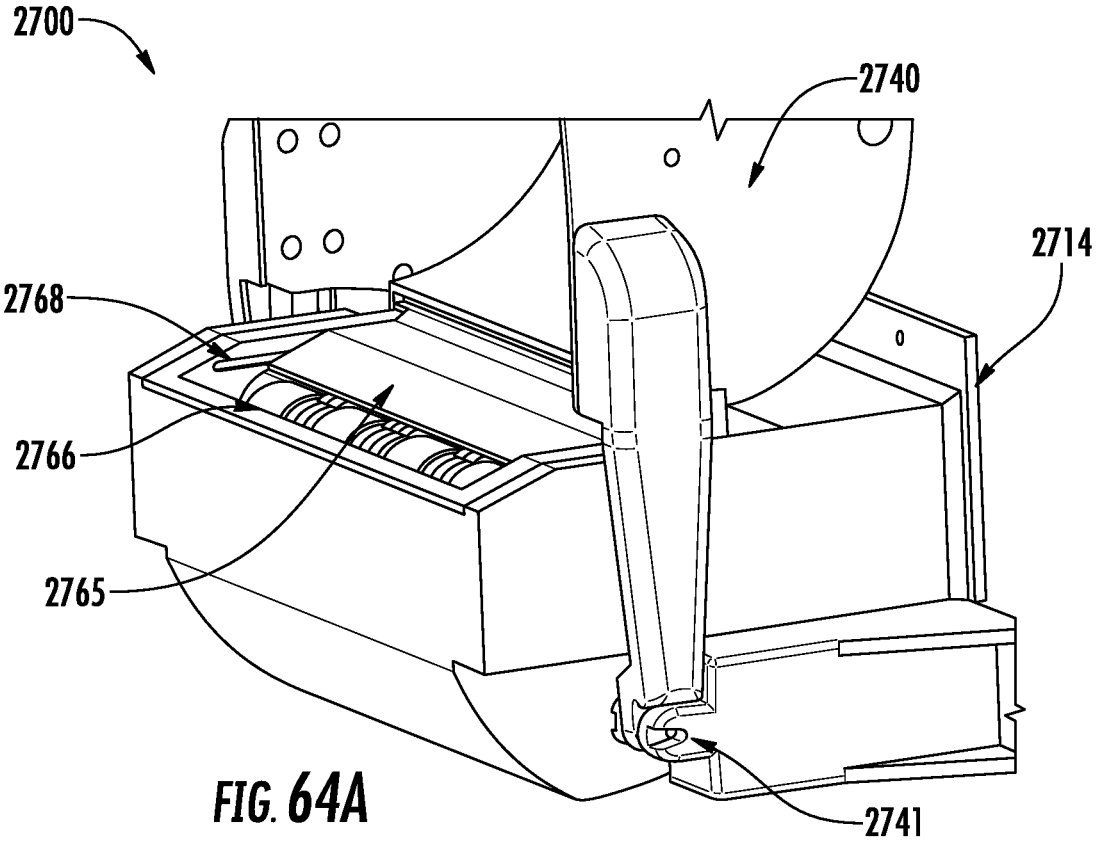
Figure 64B:
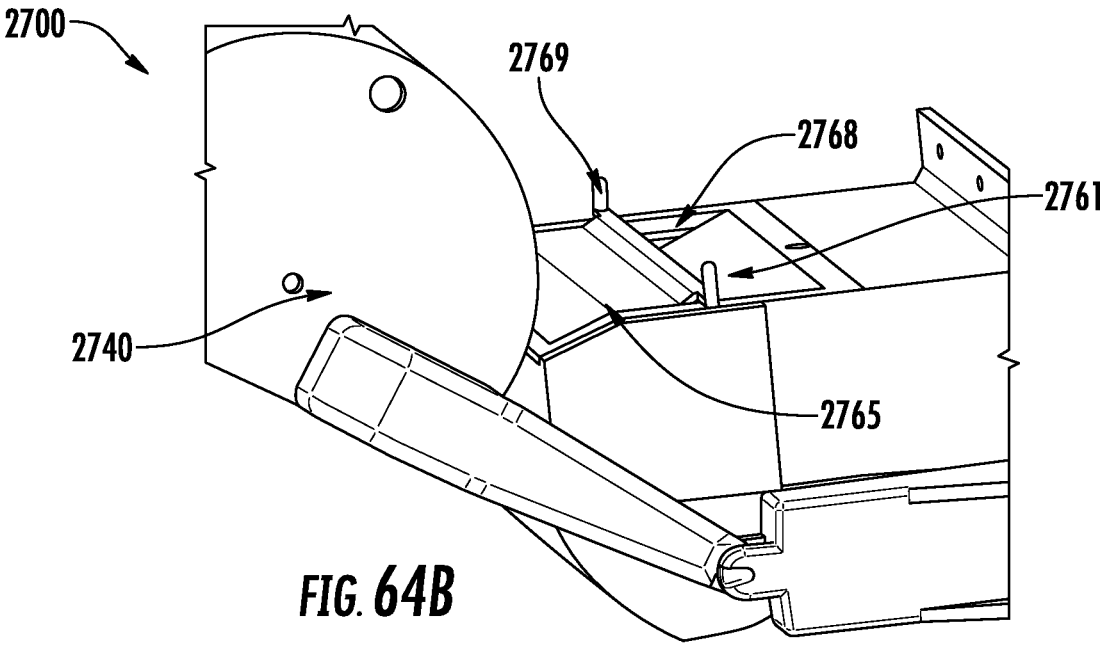
Figure 65A:
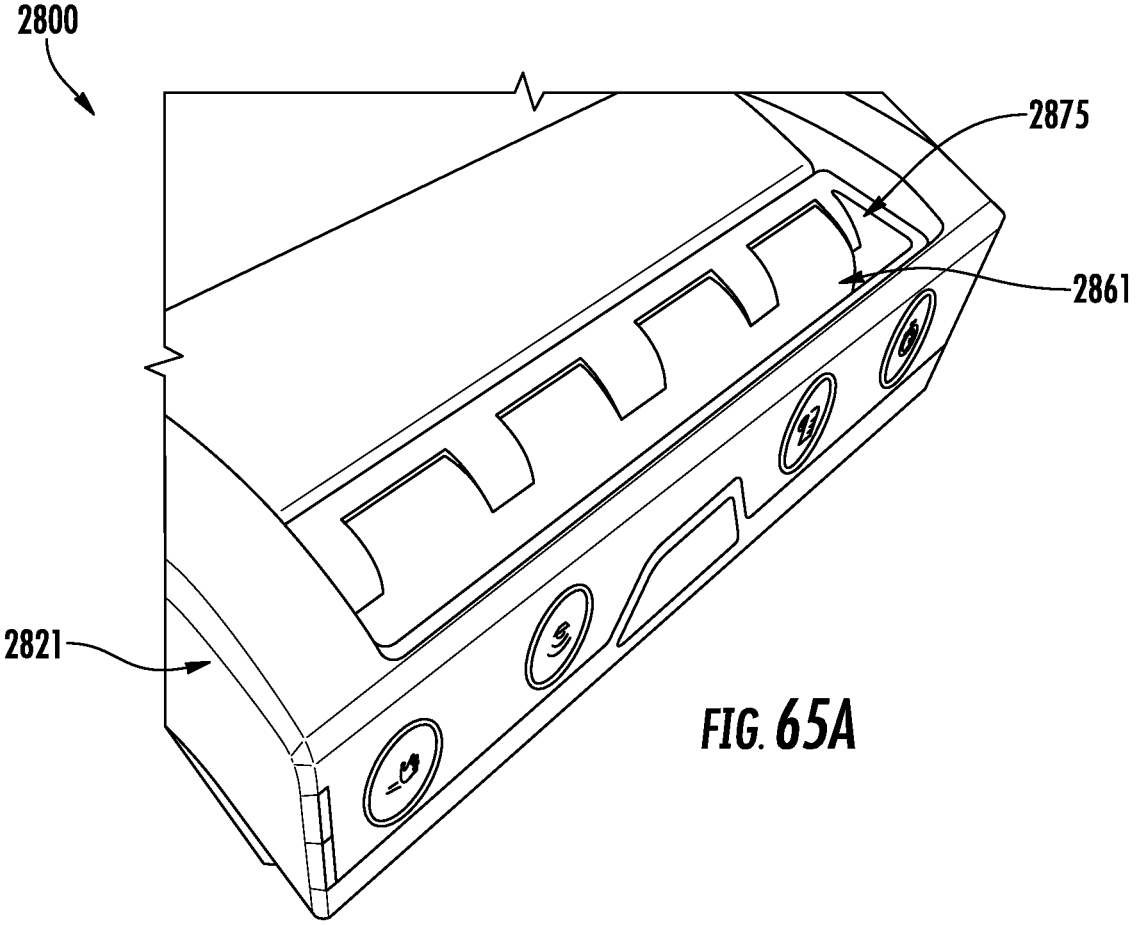
Figure 65B:
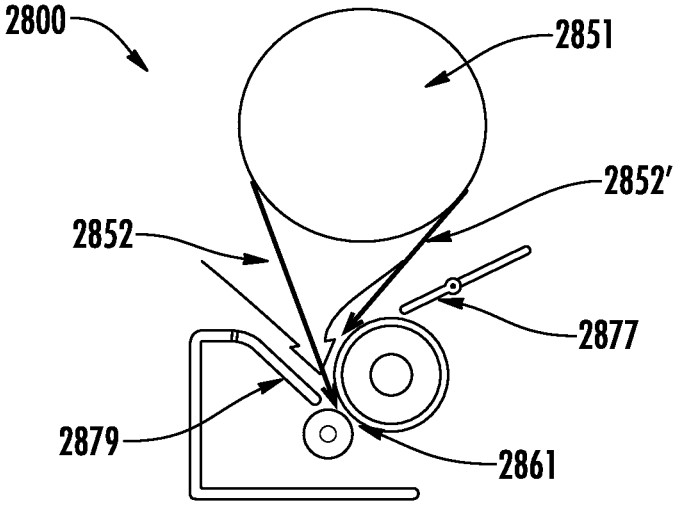
Figure 65C:
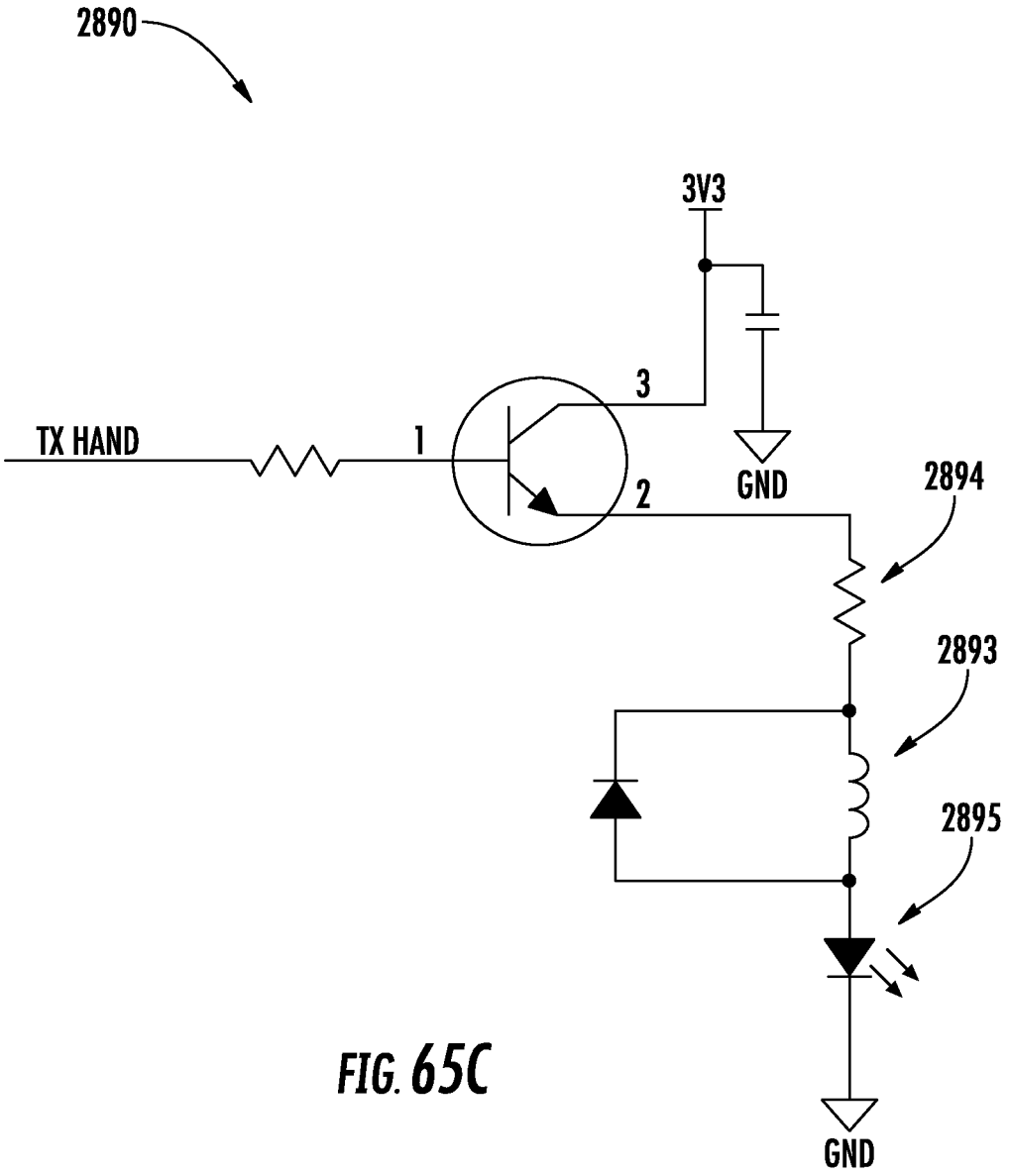
Figure 66A:
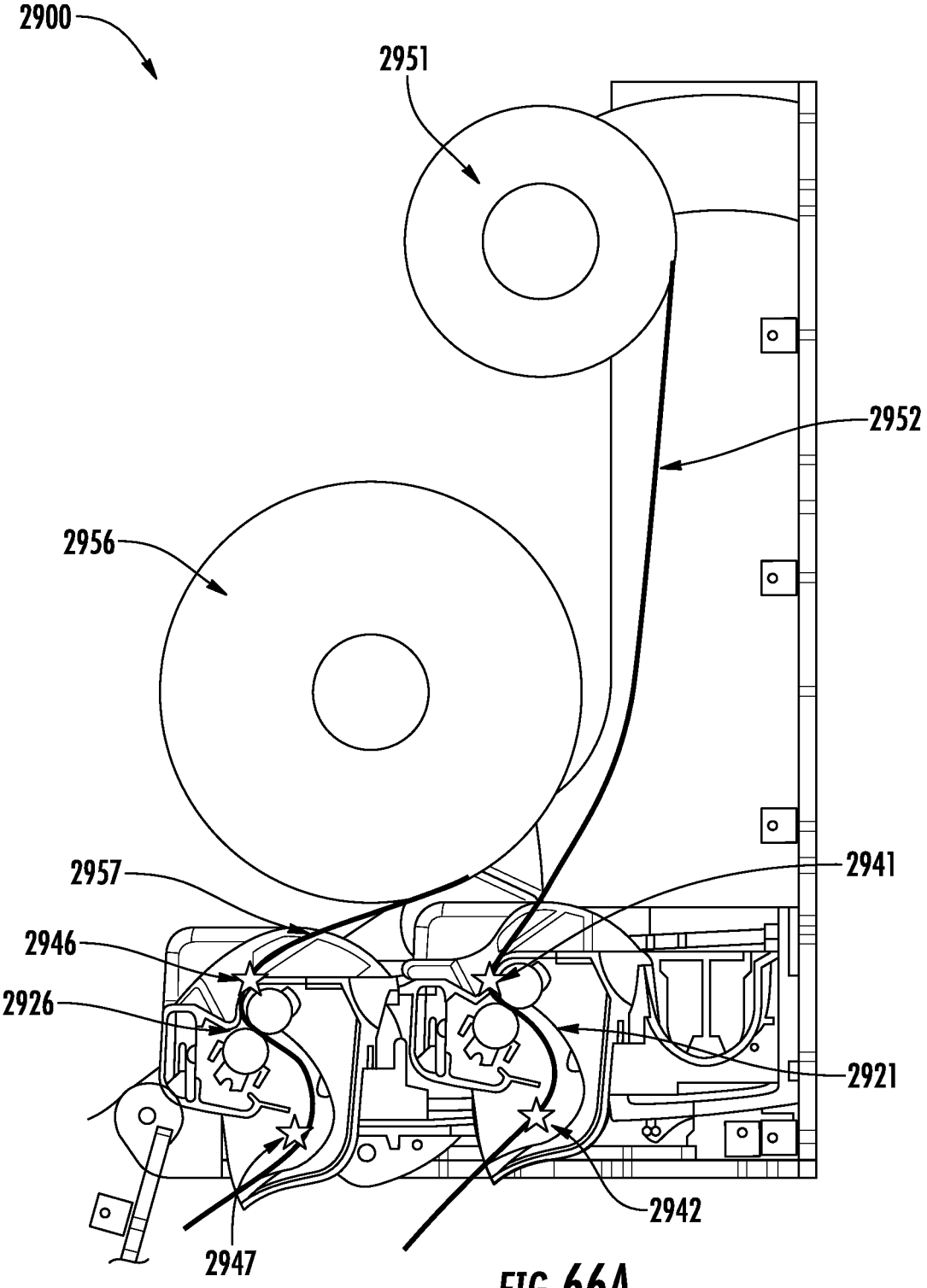
Figure 66B:
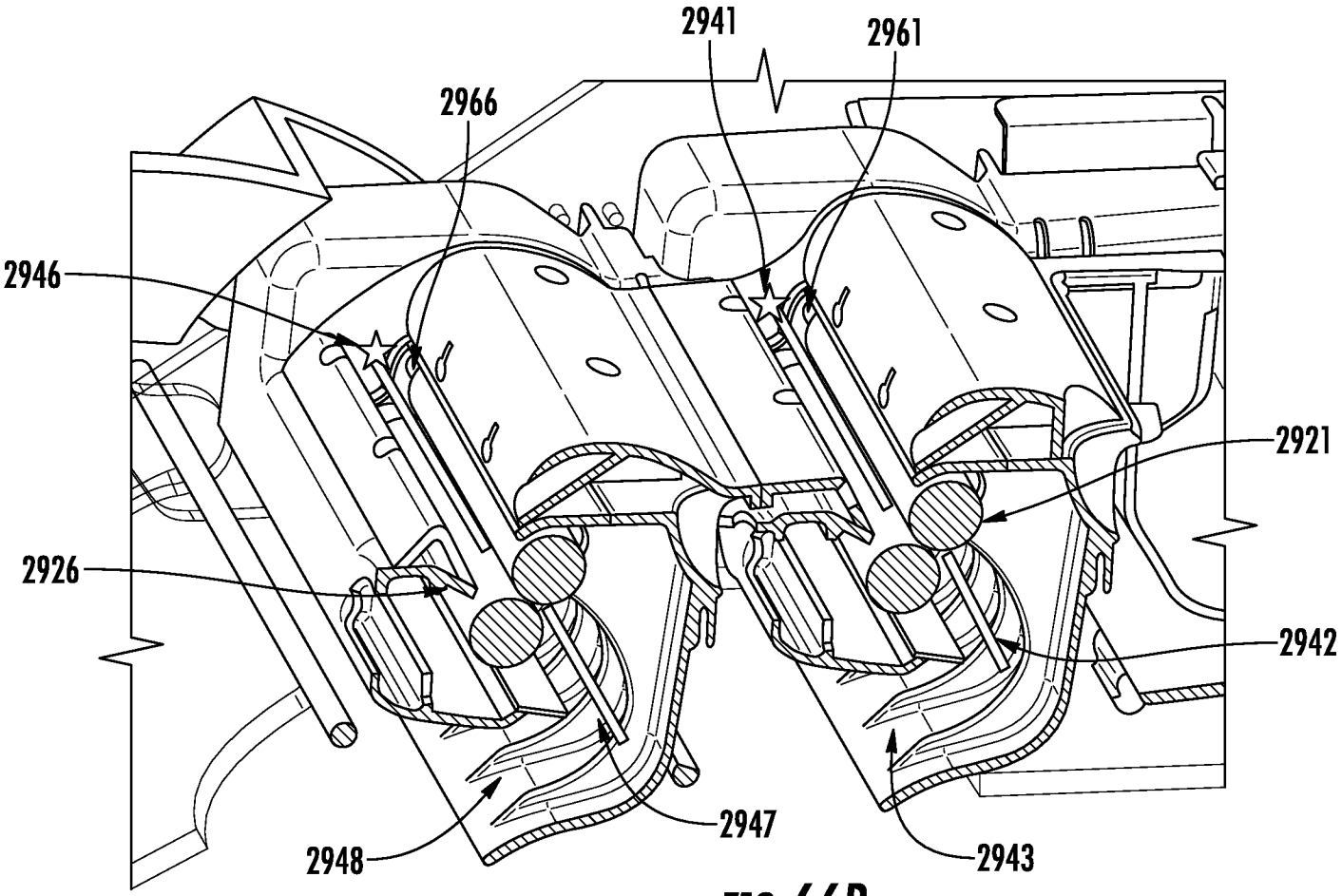
Figure 66C:
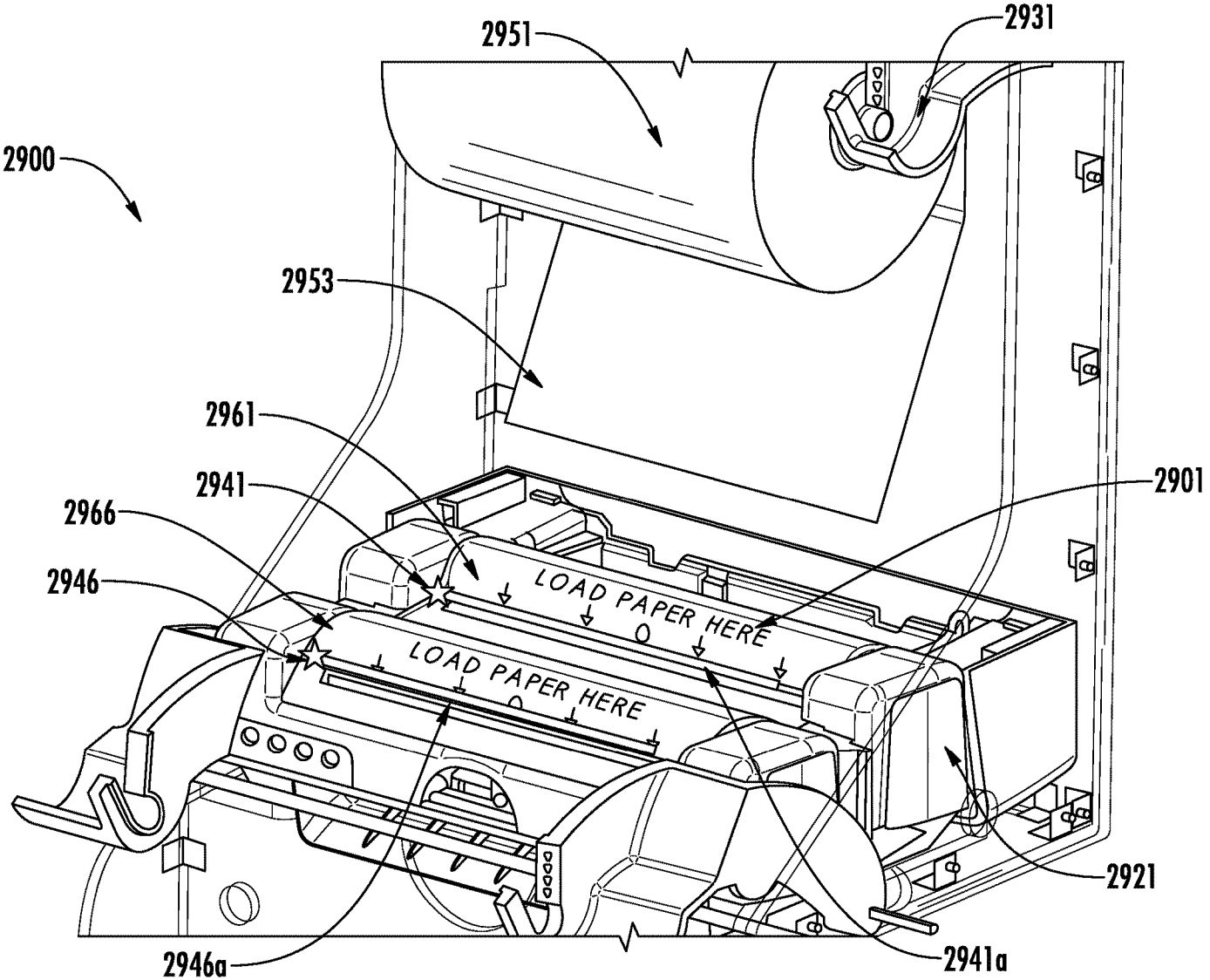
Figure 67A:
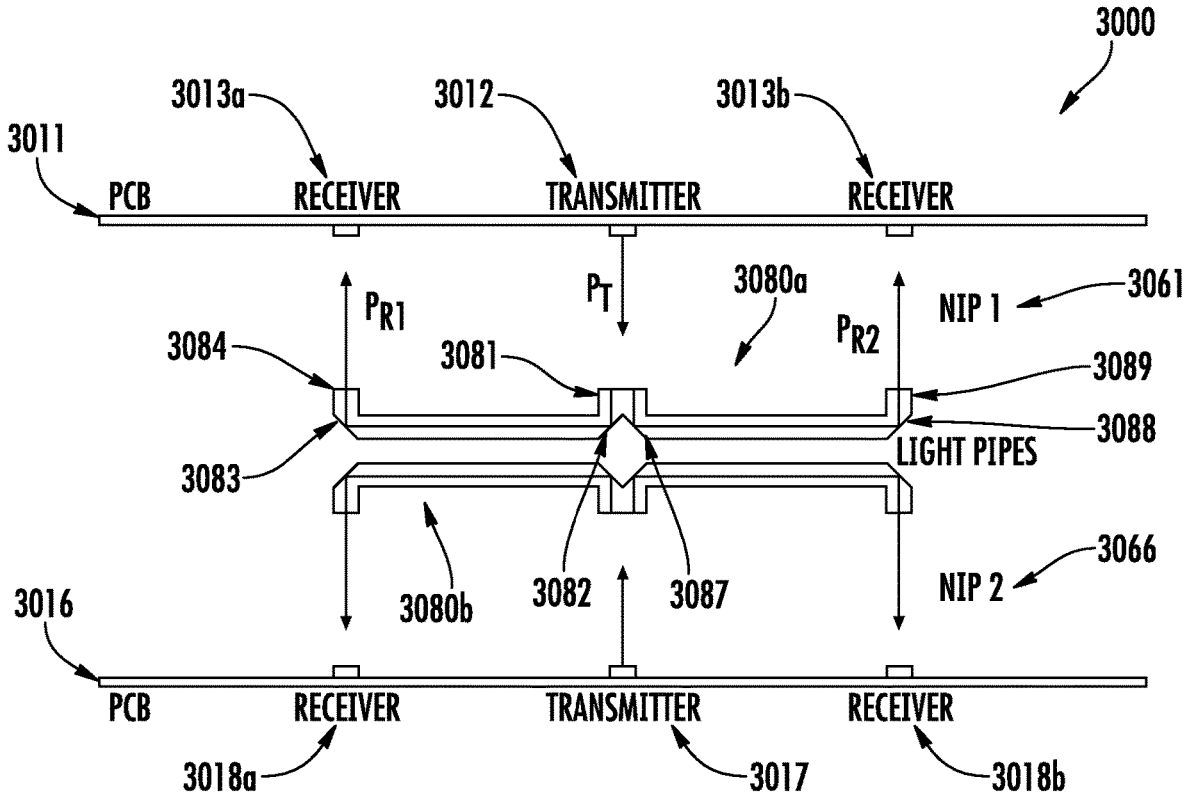
Figure 67B:
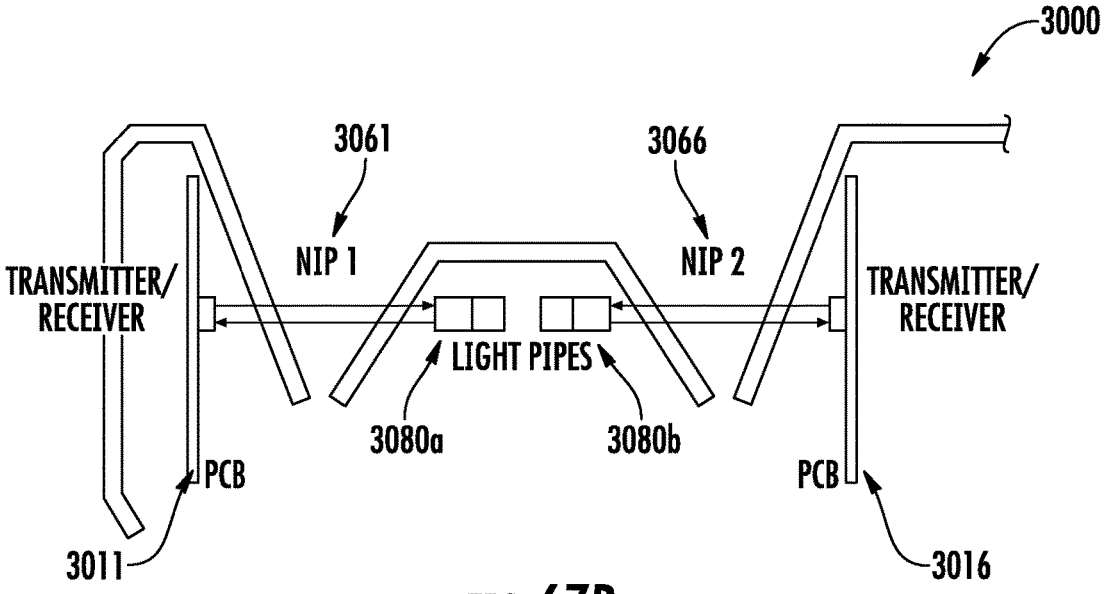
Figure 67C:
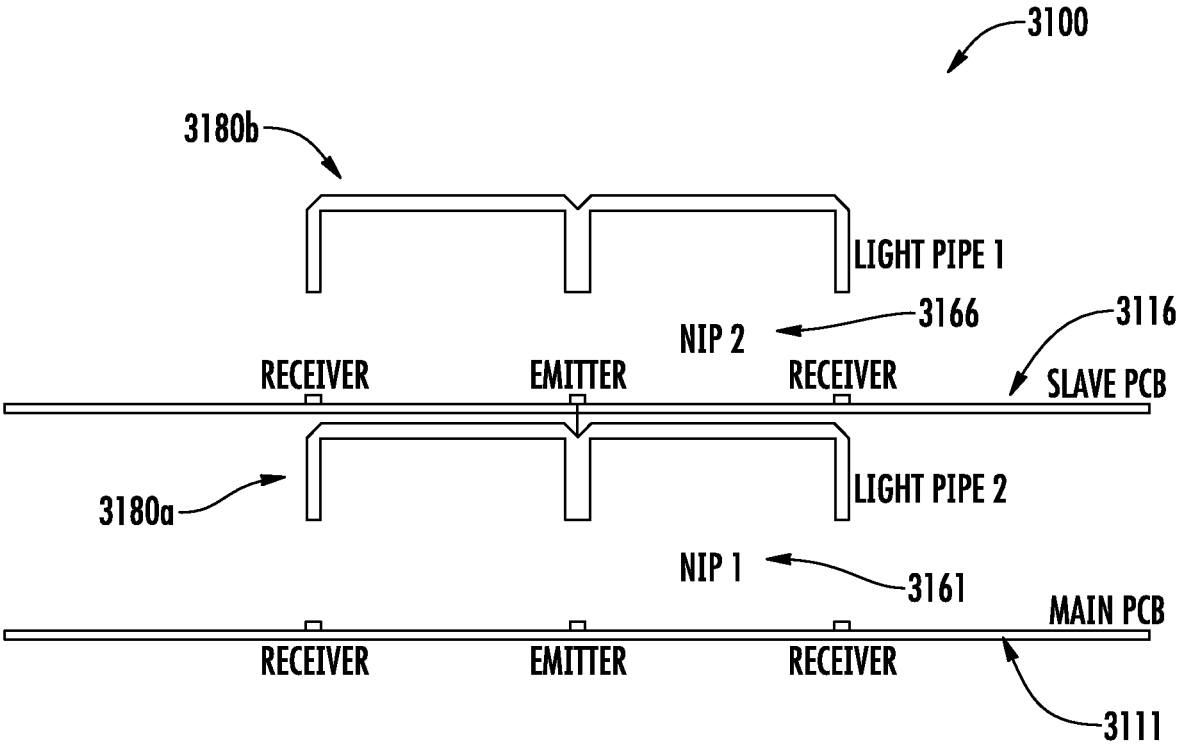
Figure 68A:
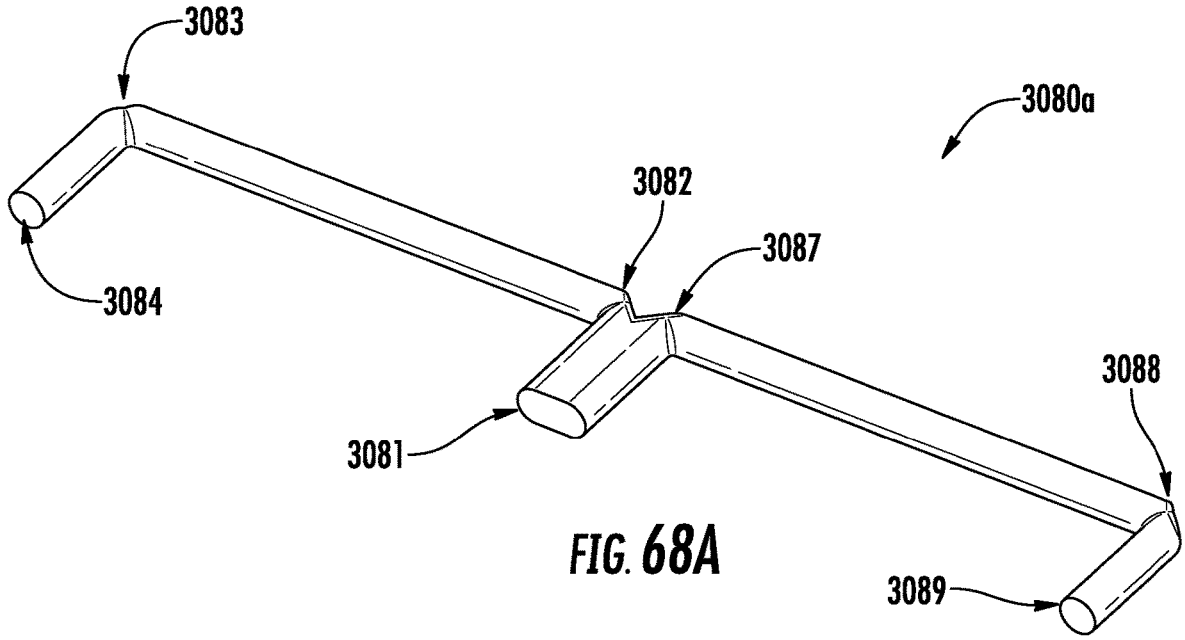
Figure 68B:
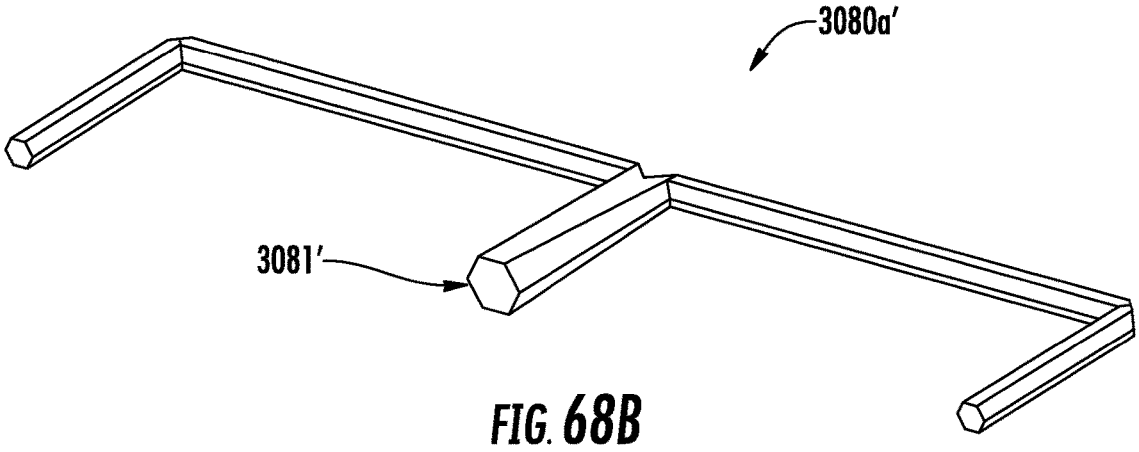
Figure 69A:
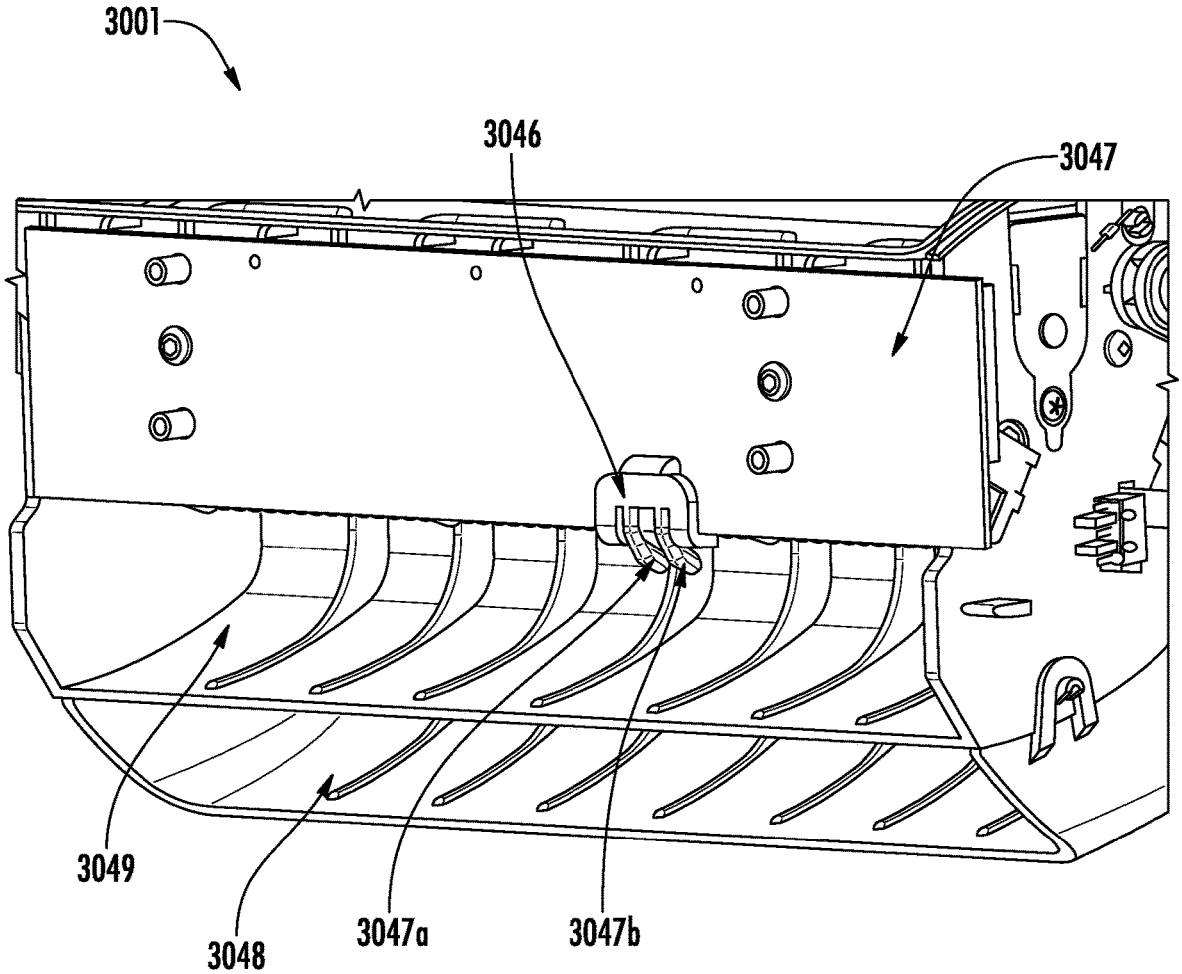
Figure 69B:
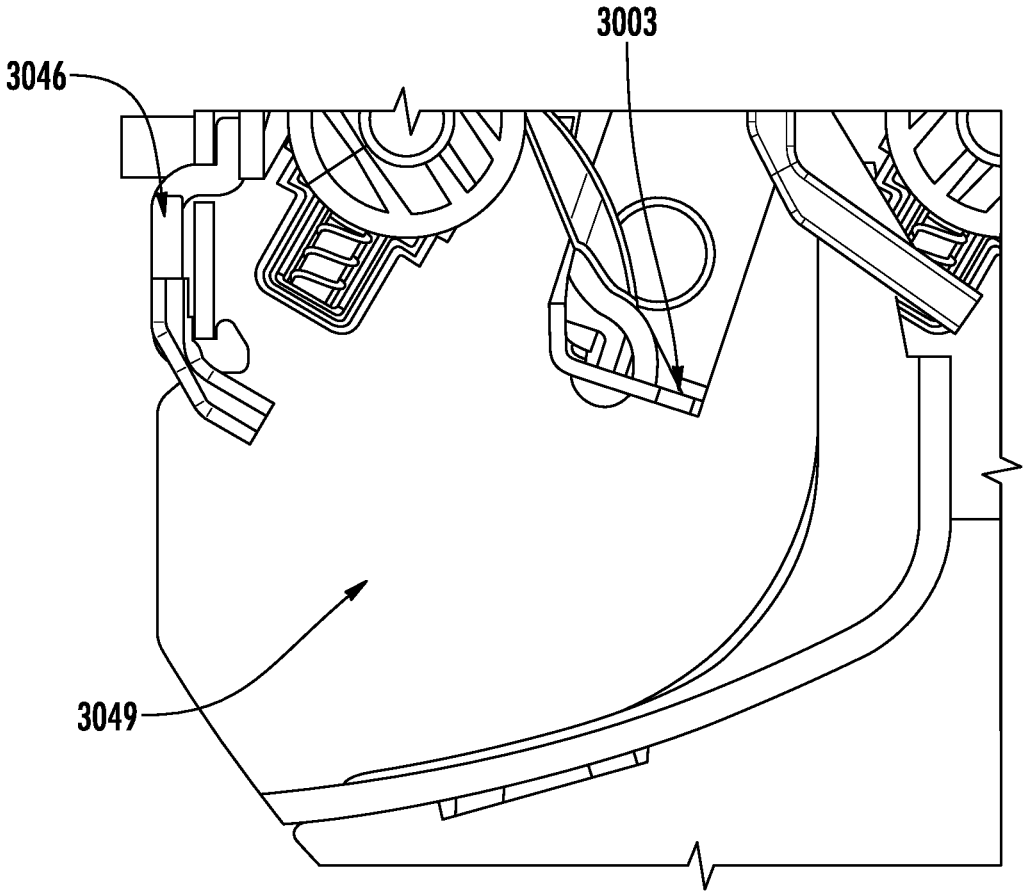
Figure 69C:
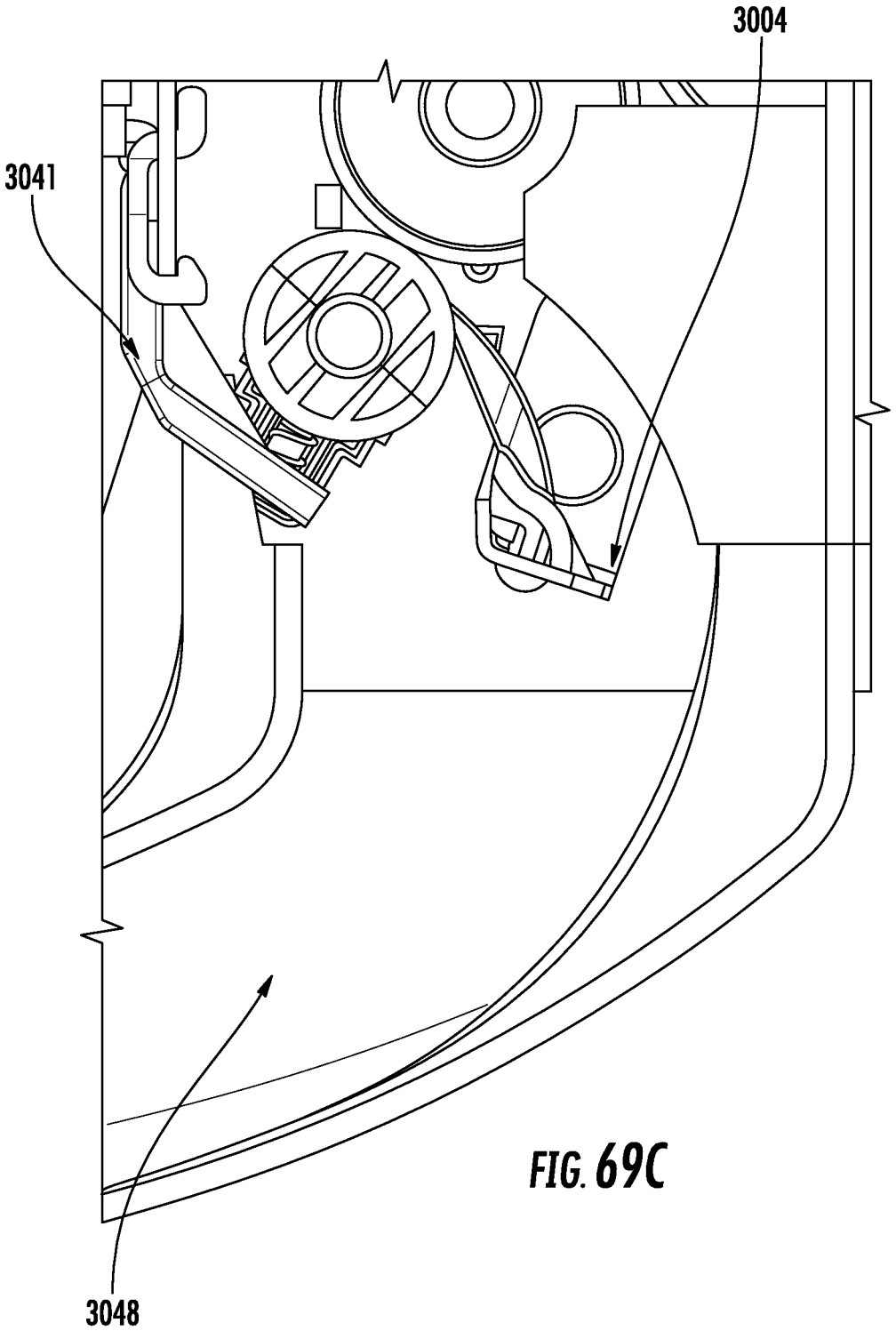
Figure 70A:
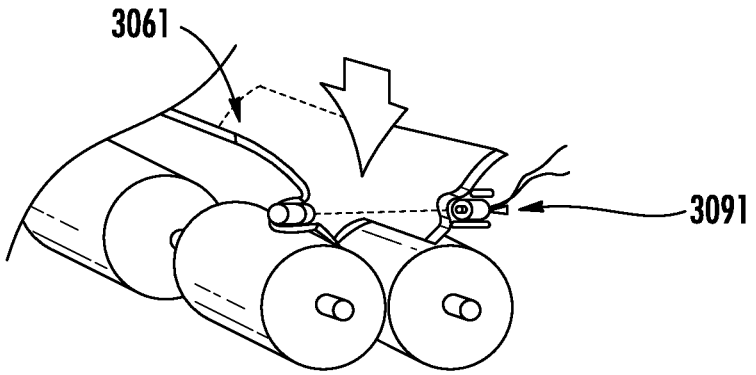
Figure 70B:
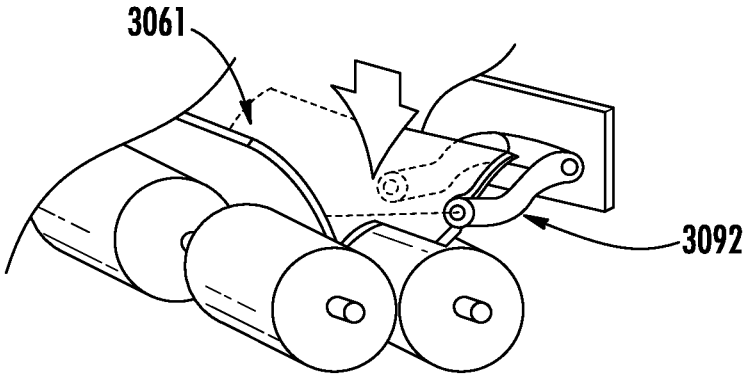
Figure 70C:
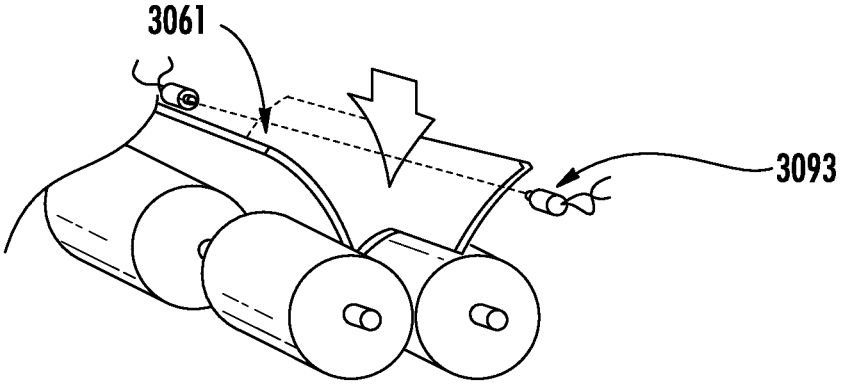
Figure 70D:
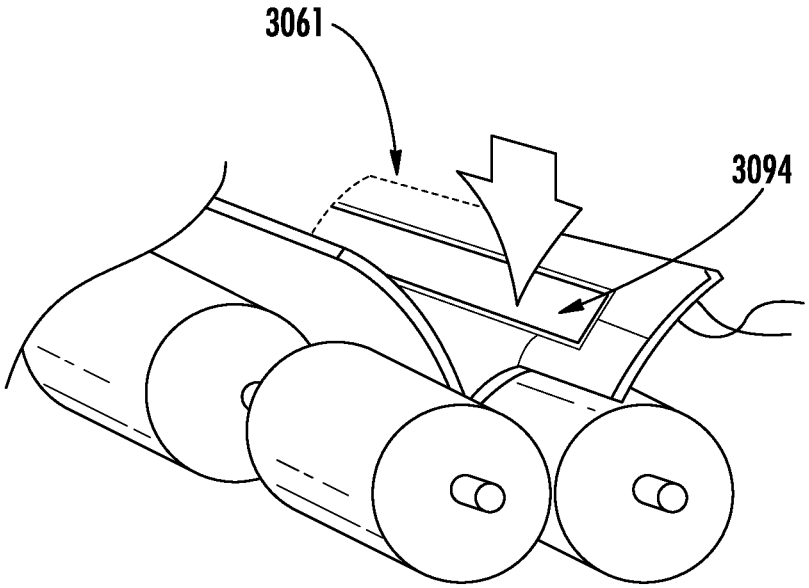
Figure 70E:
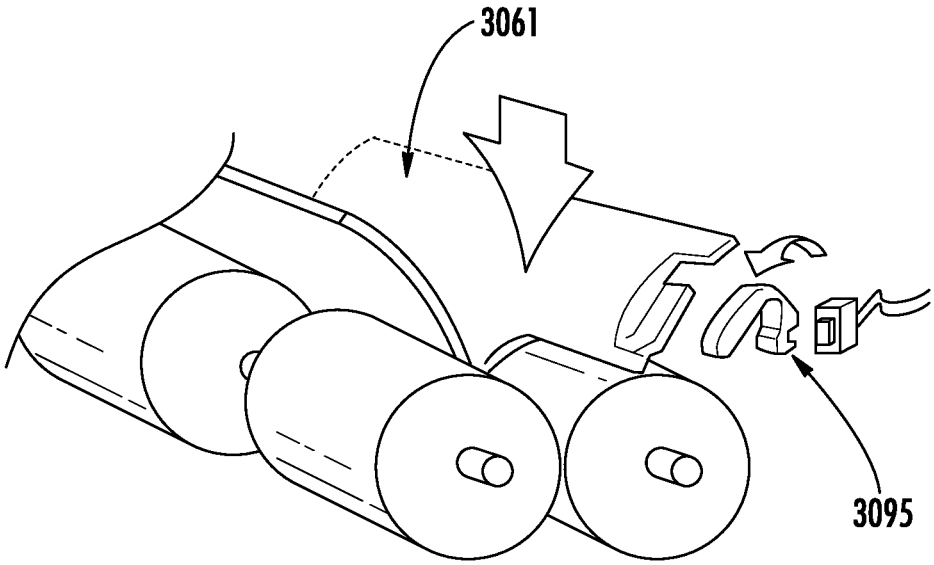
Figure 72:
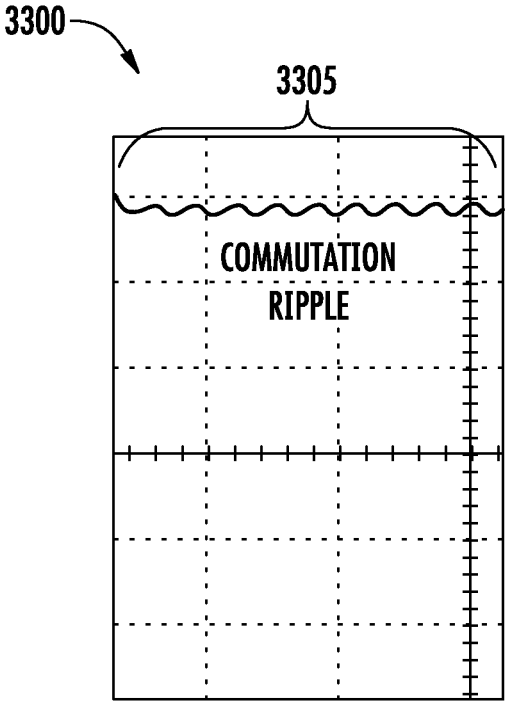
Figure 73:
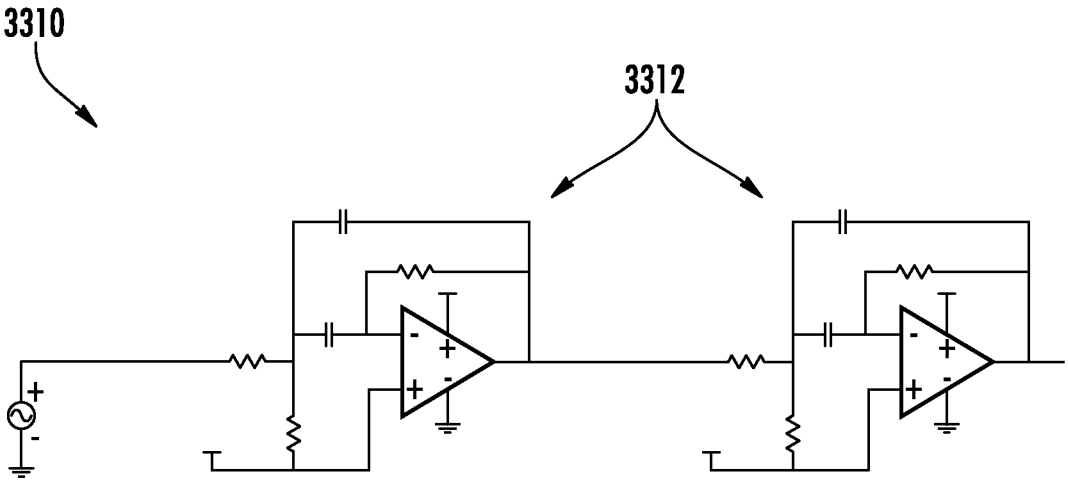
Figure 74:
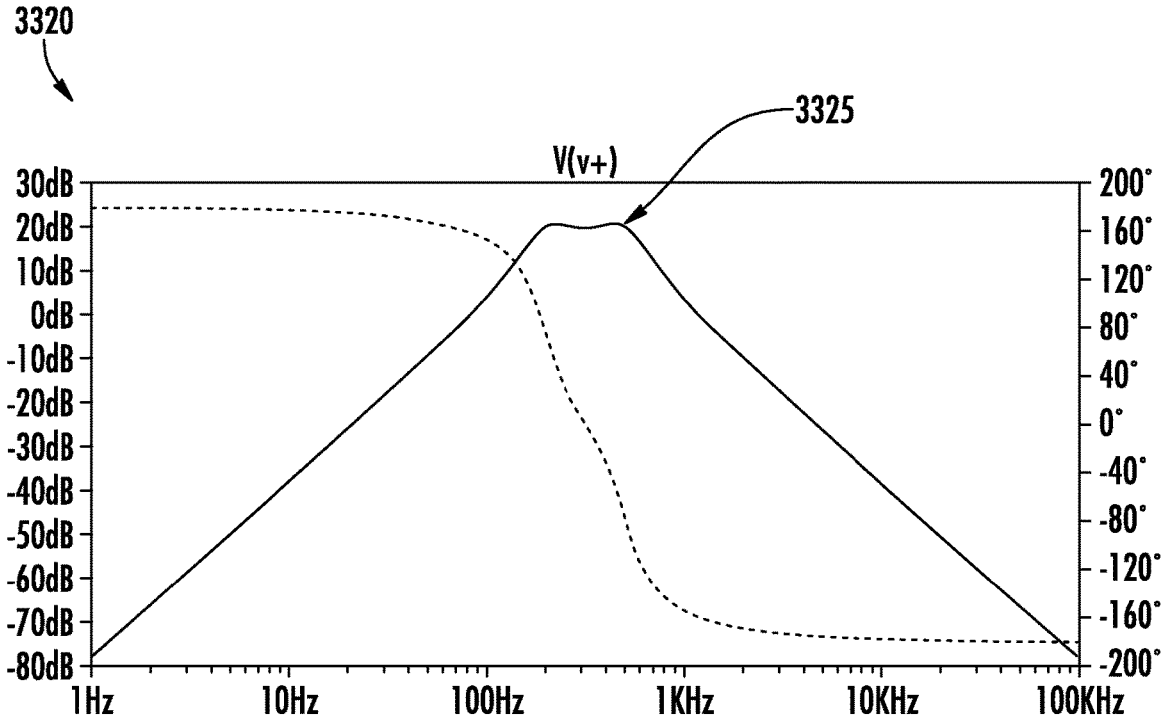
Figure 75A:
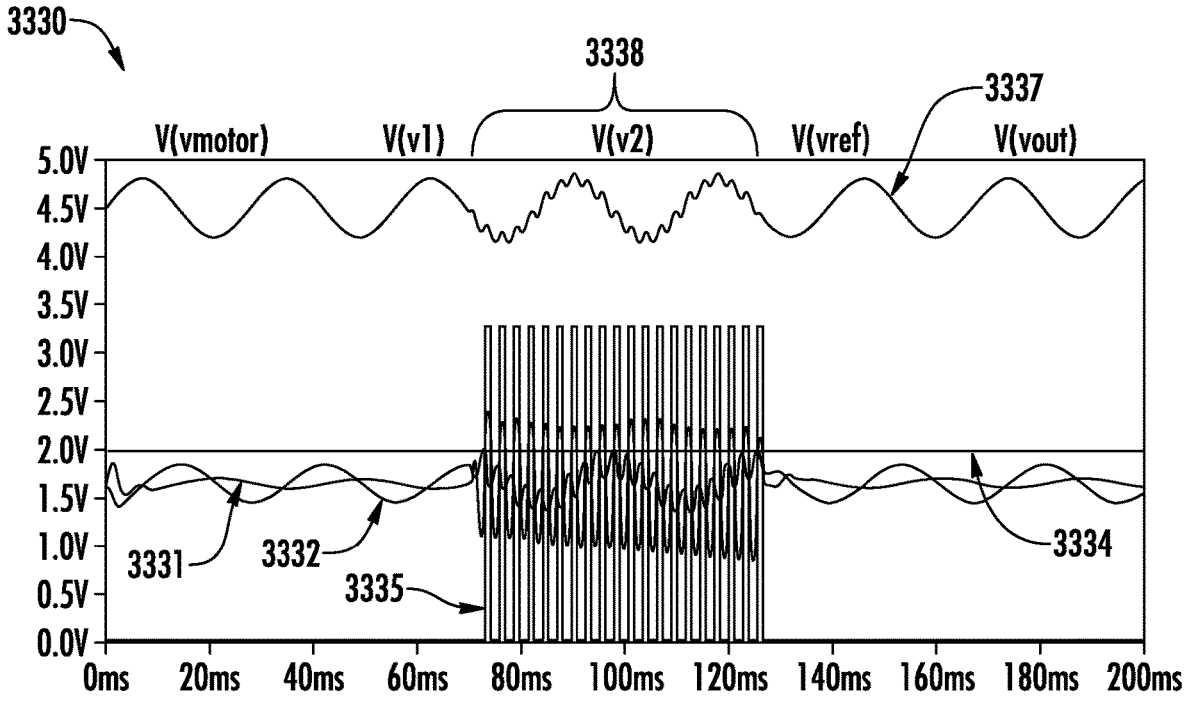
Figure 75B:
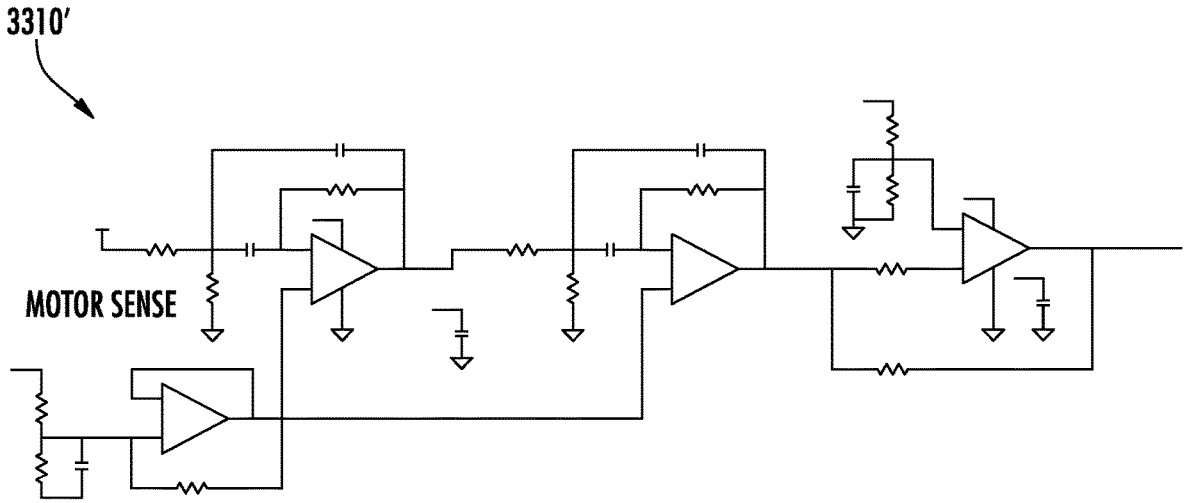
Figure 76A:
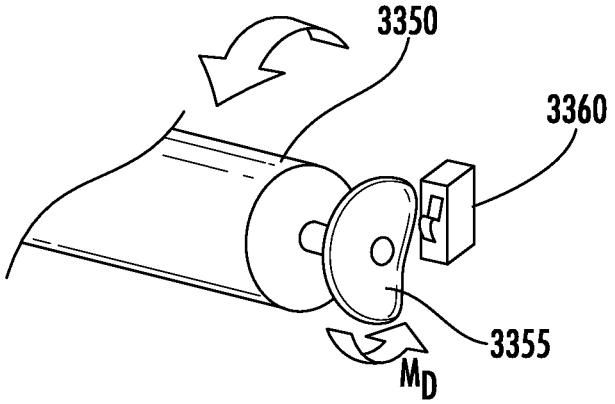
Figure 76B:
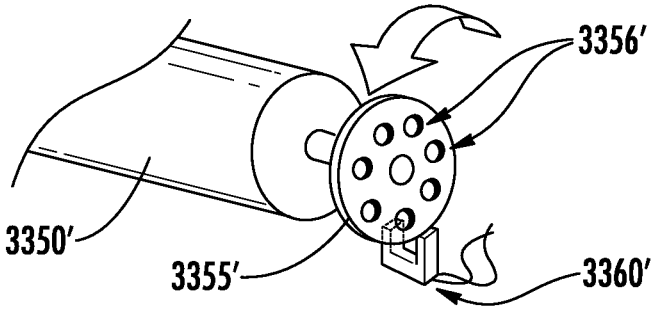
Figure 76C:
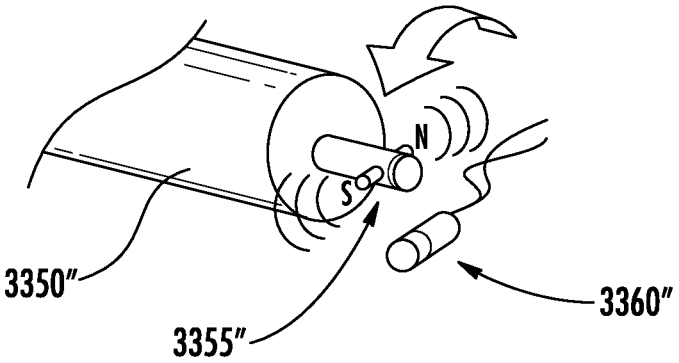
Figure 77:
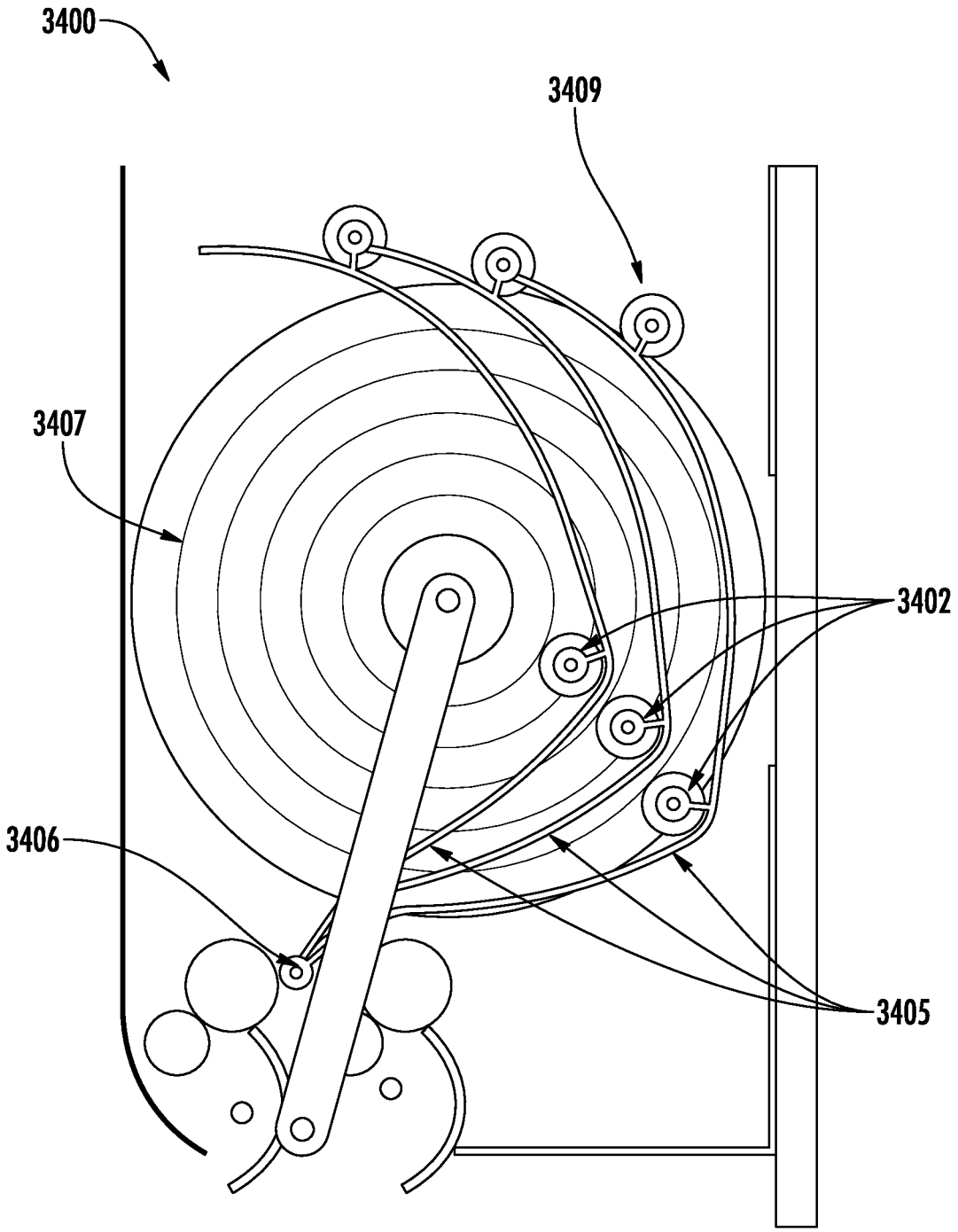
Figure 78:
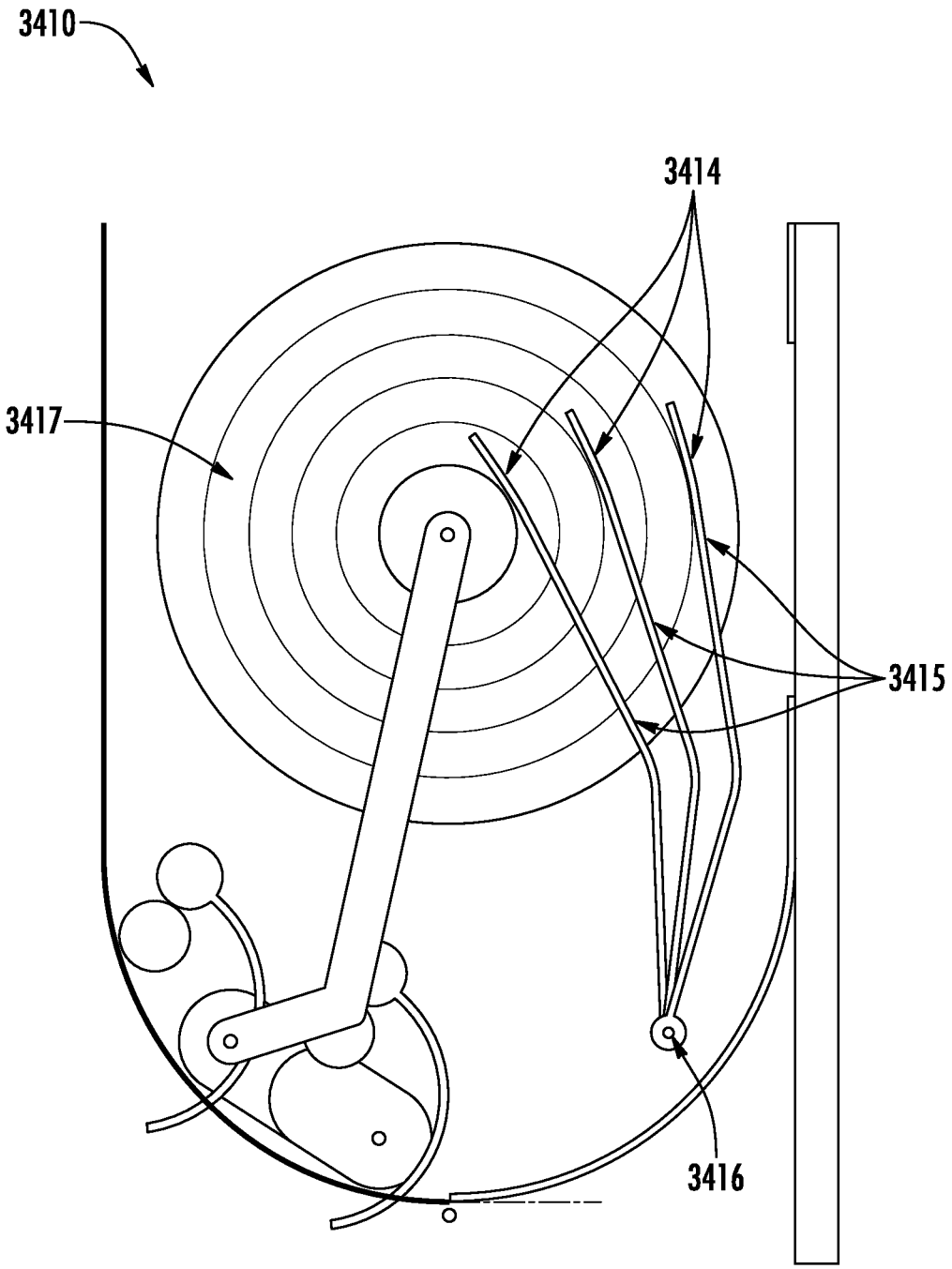
Figure 79:
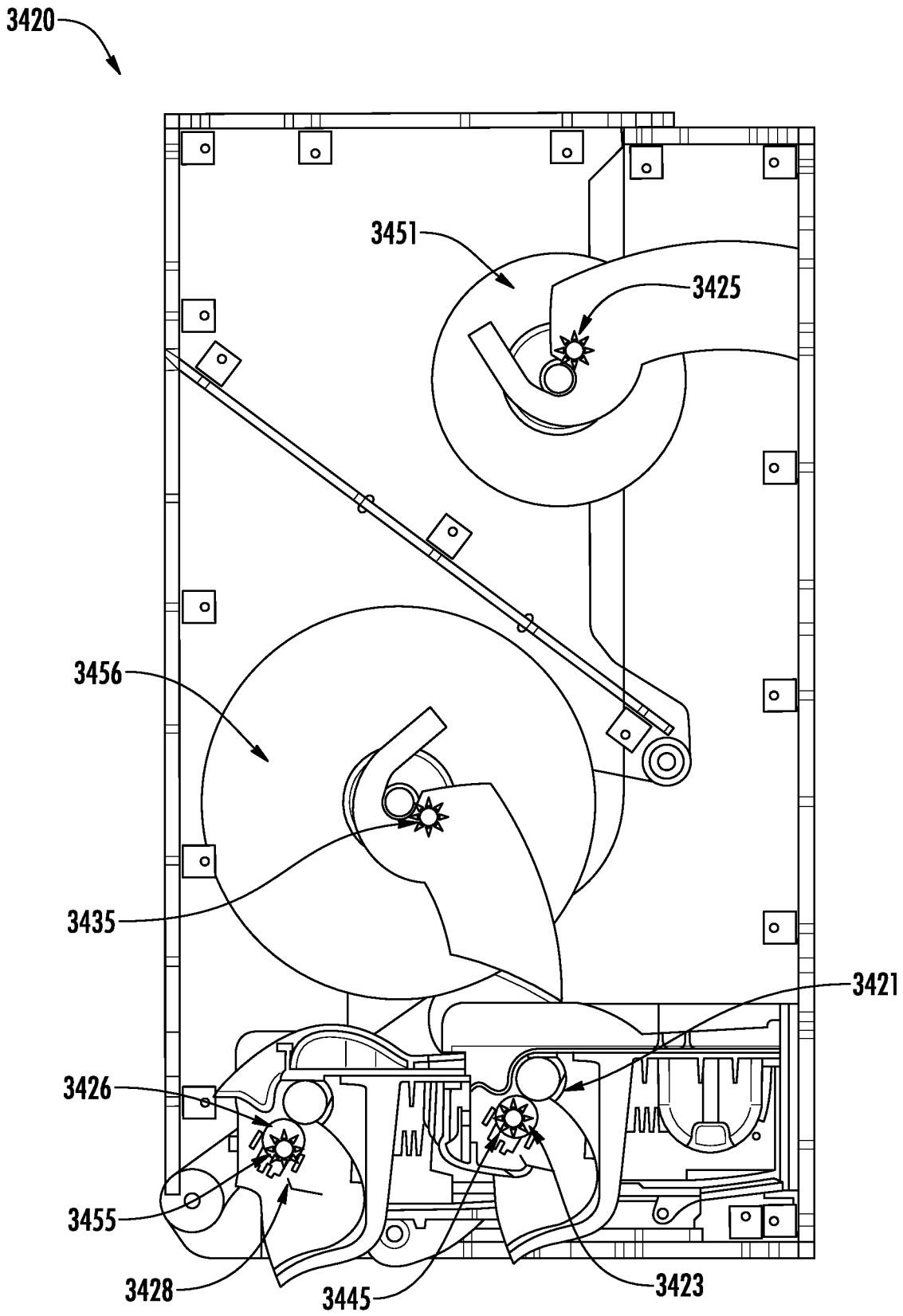
Figure 80A:
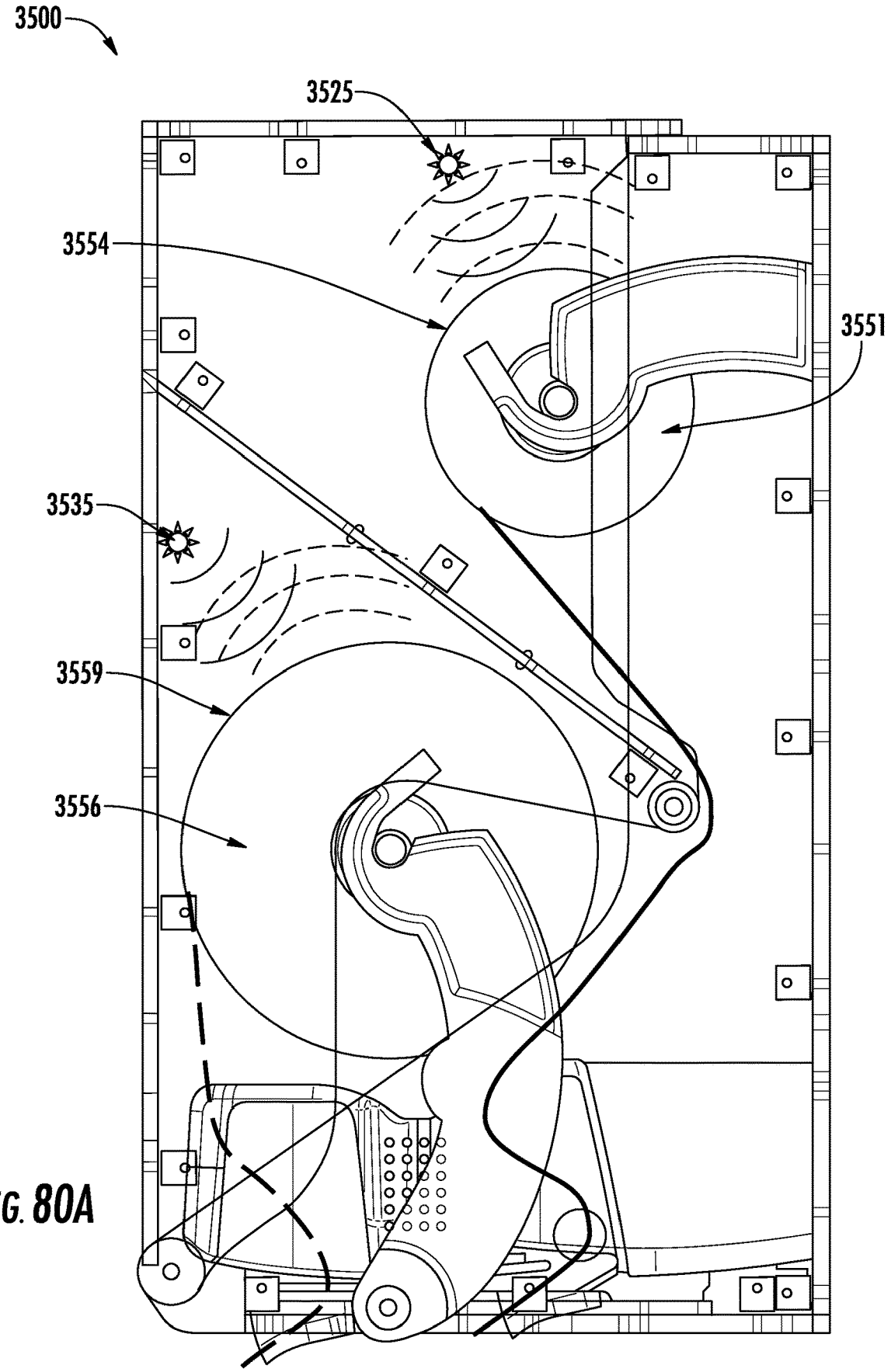
Figure 80C:
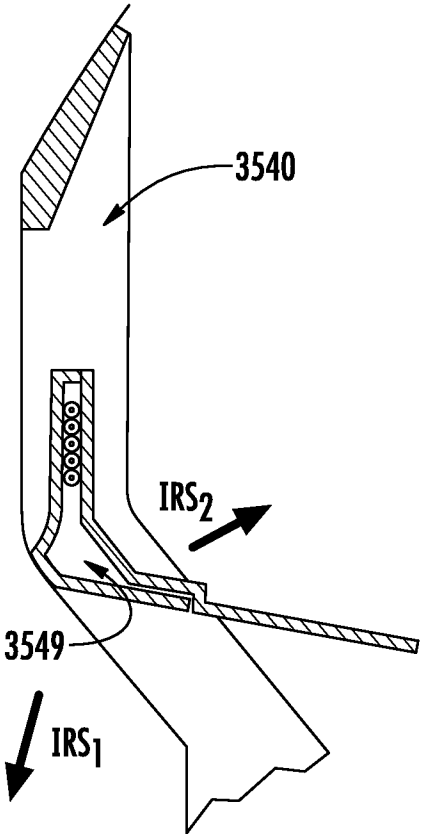
Figure 80B:
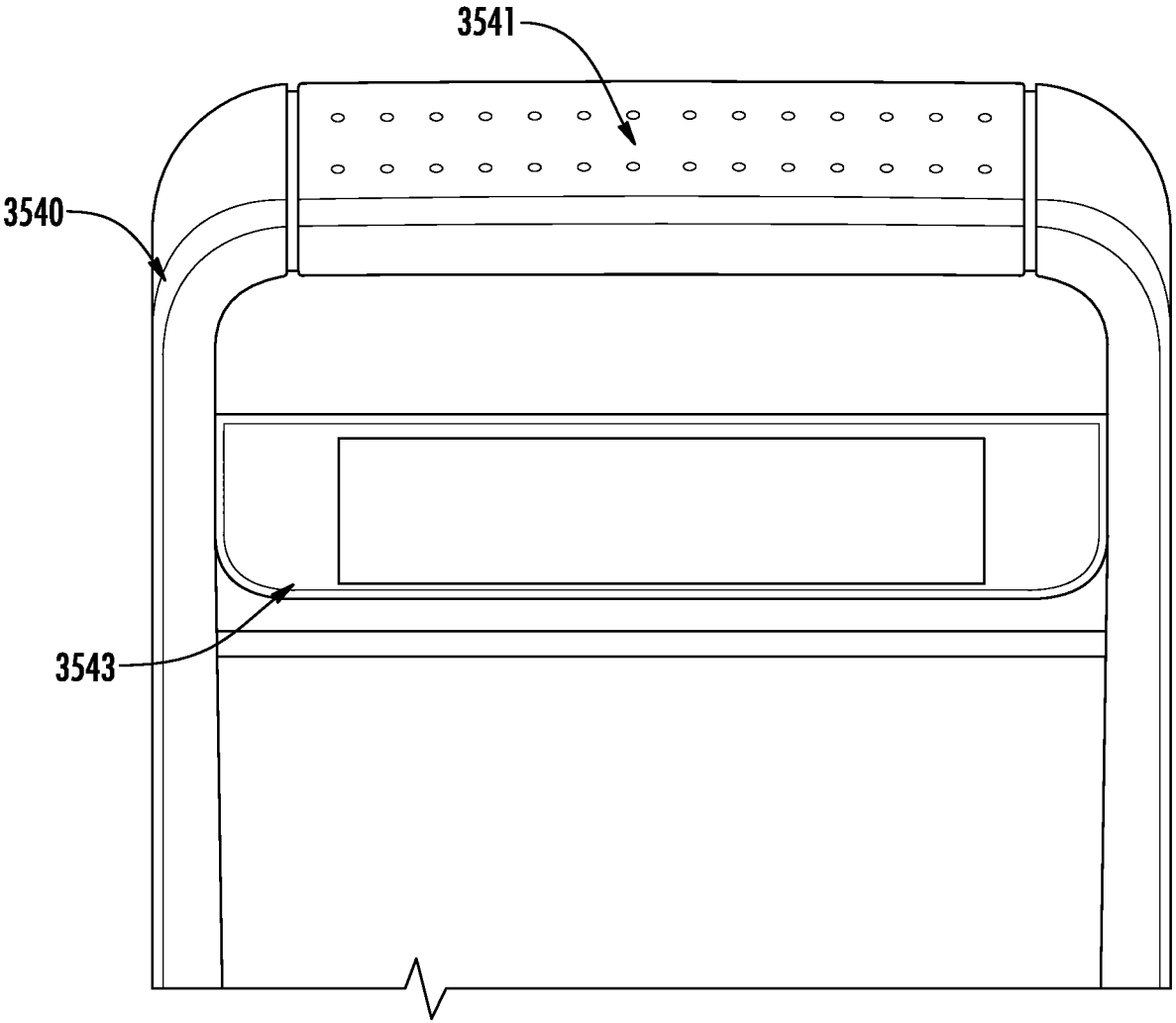
Figure 81A:
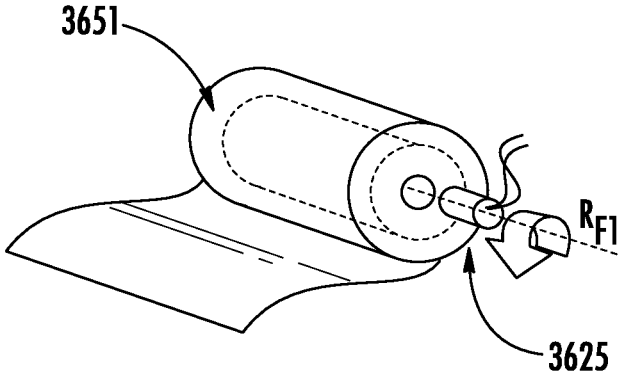
Figure 81B:
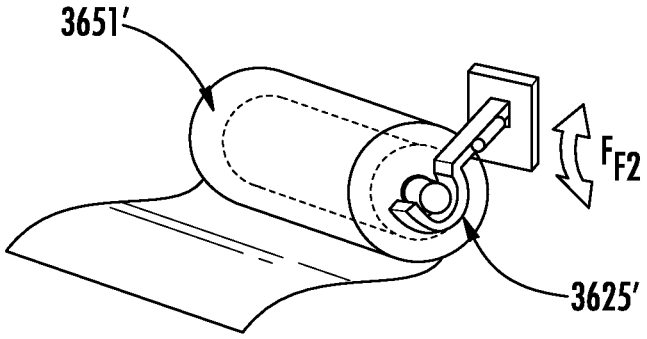
Figure 82:
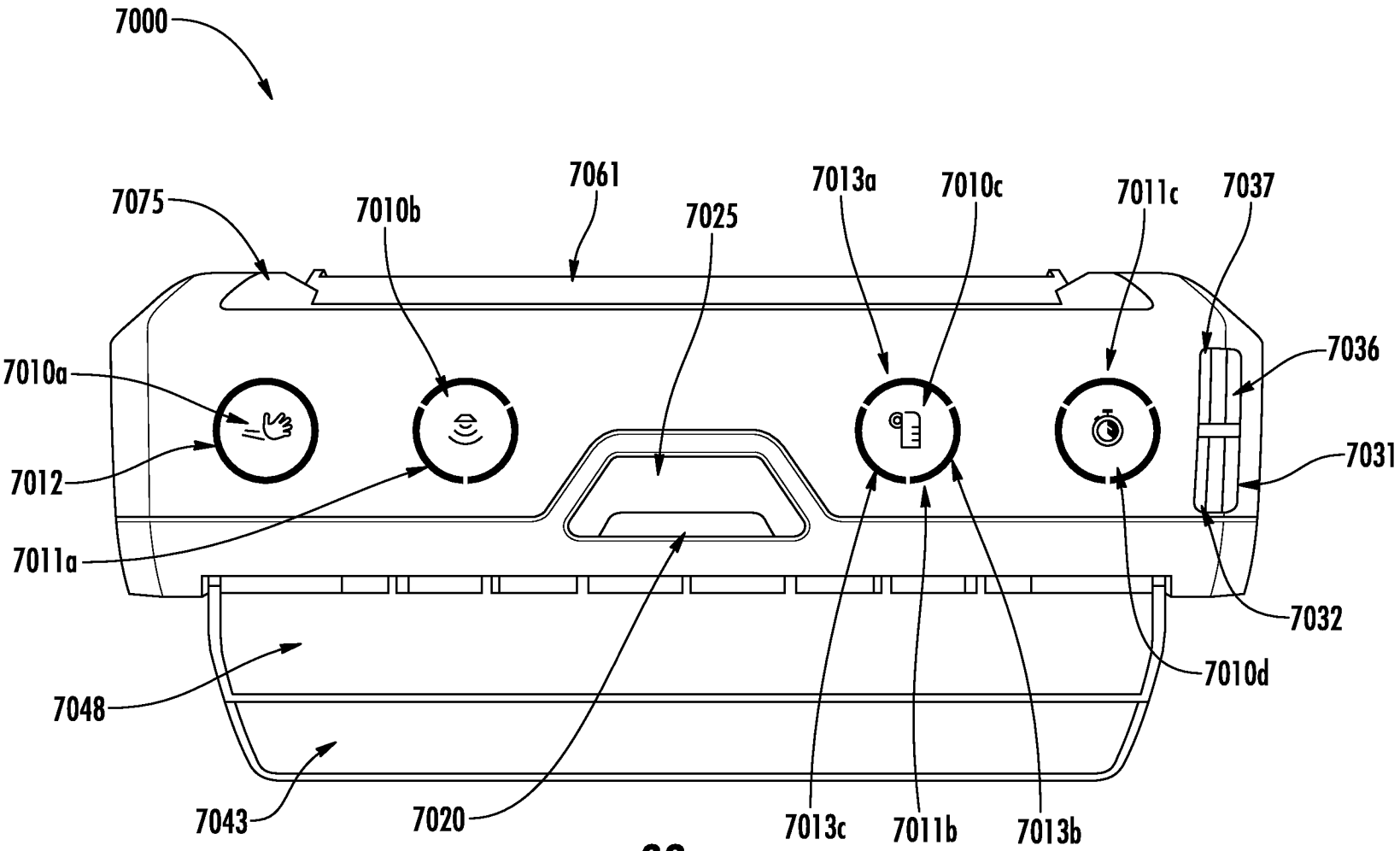
Figure 82A:
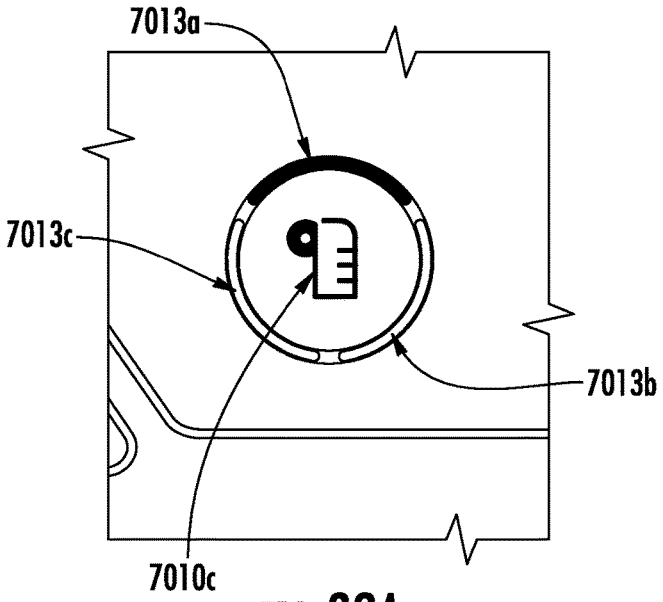
Figure 82B:
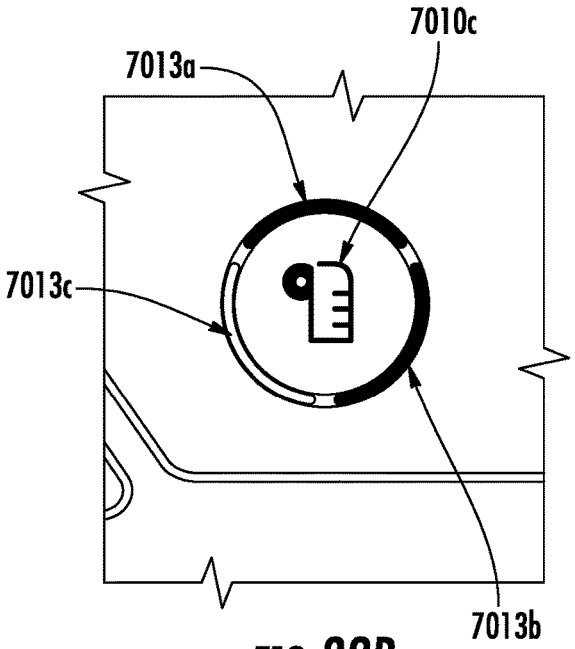
Figure 82C:
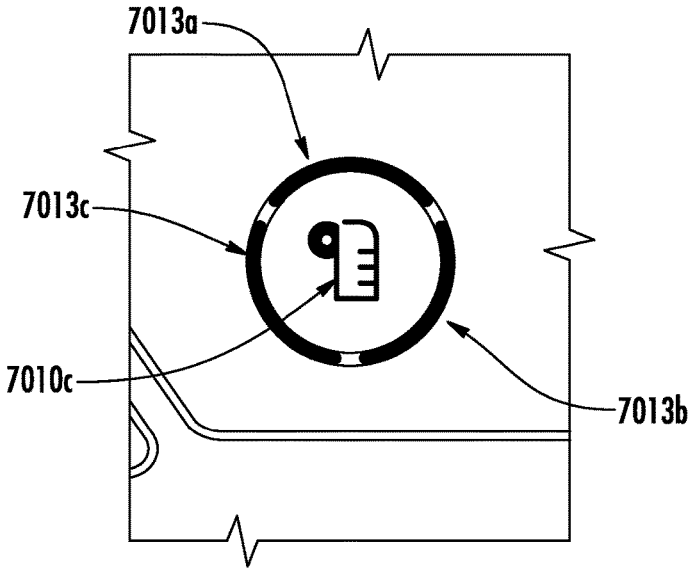
Figure 83A:
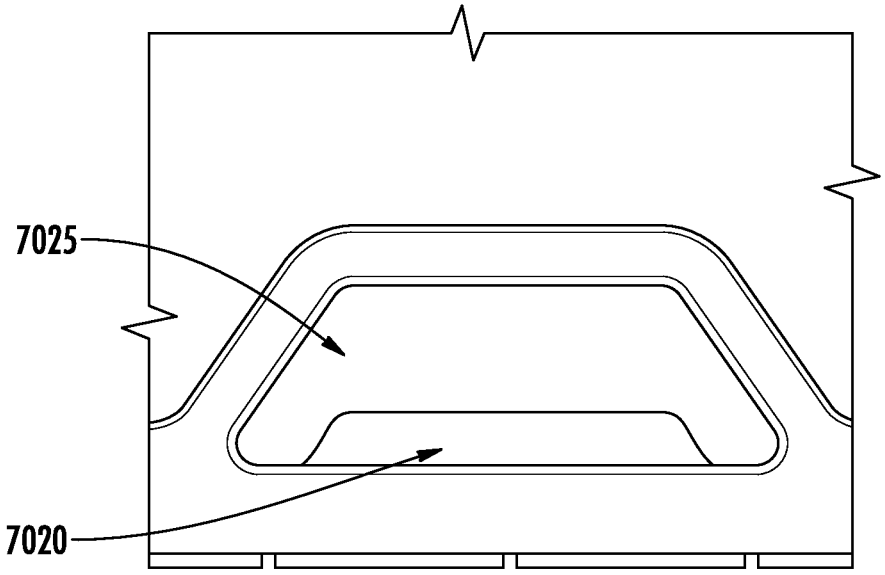
Figure 83B:
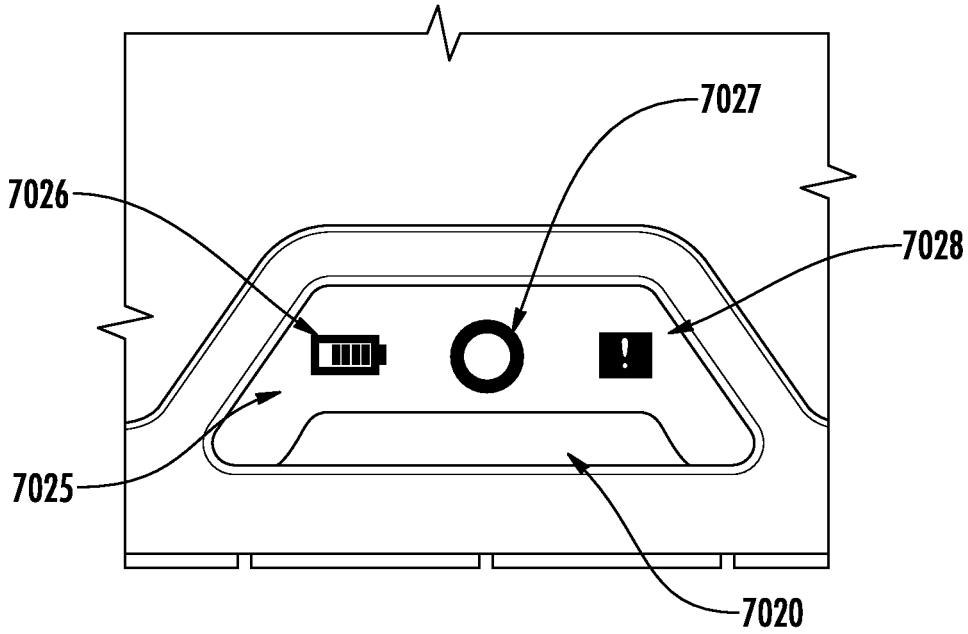
Figure 84A:
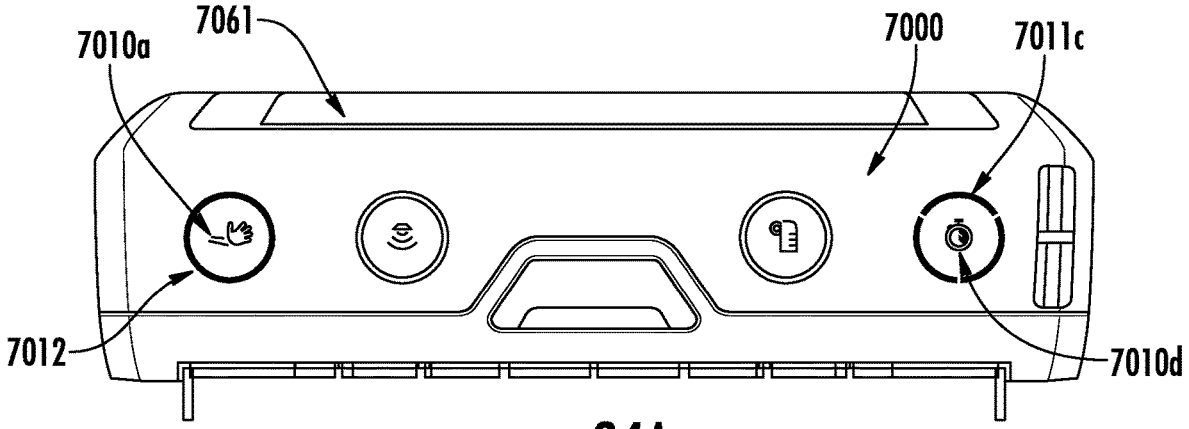
Figure 84B:
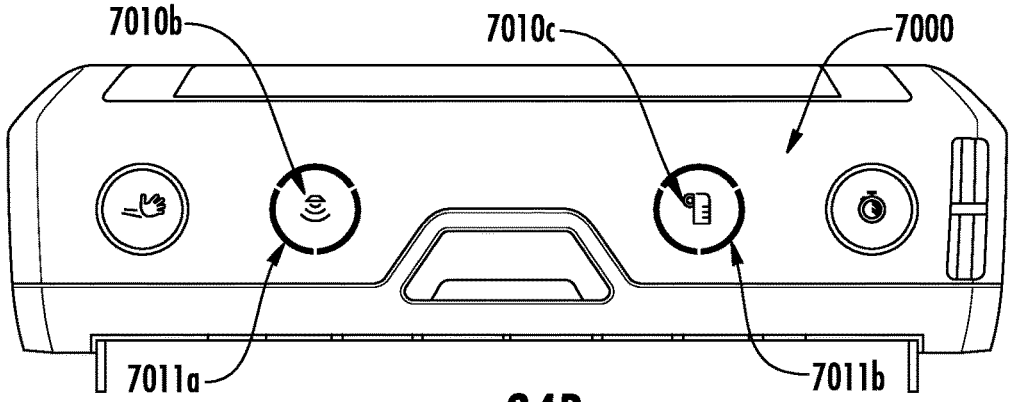
Figure 84C:
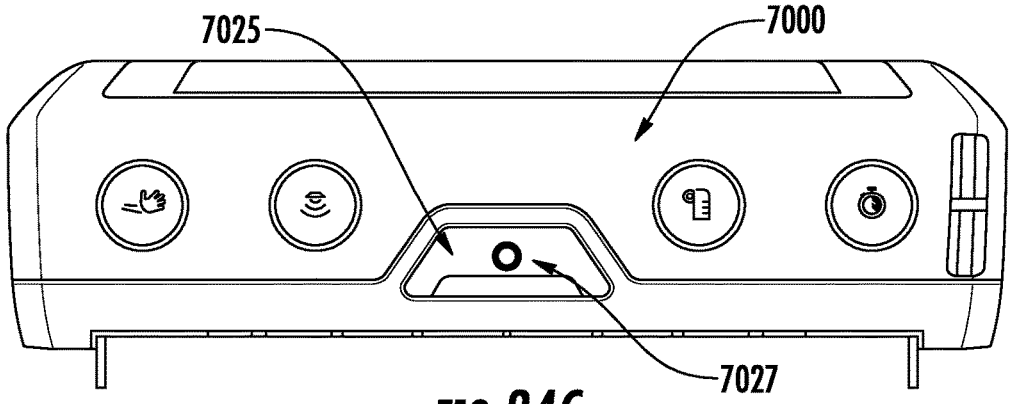
Figure 85A:
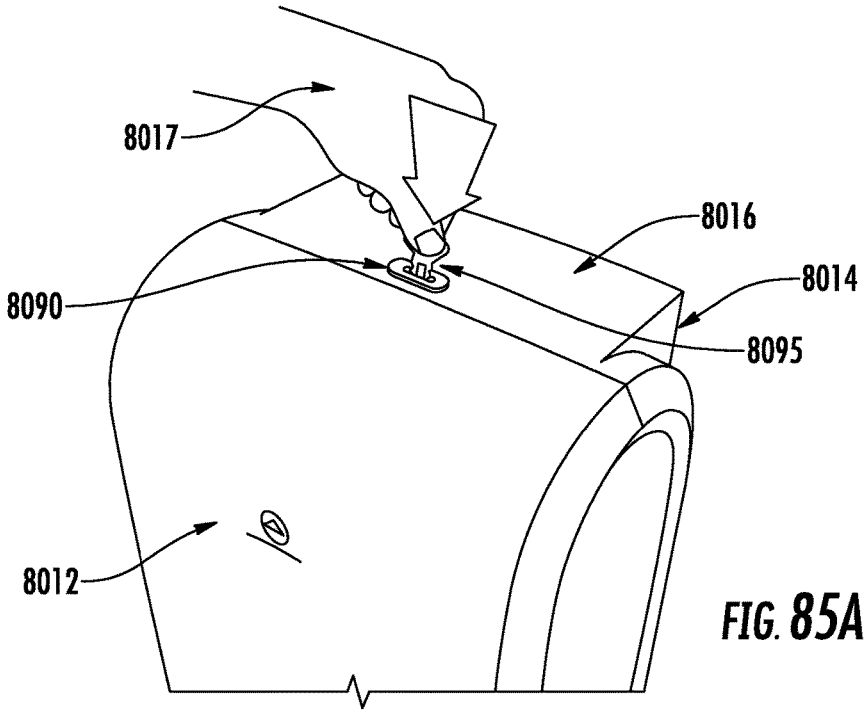
Figure 85B:
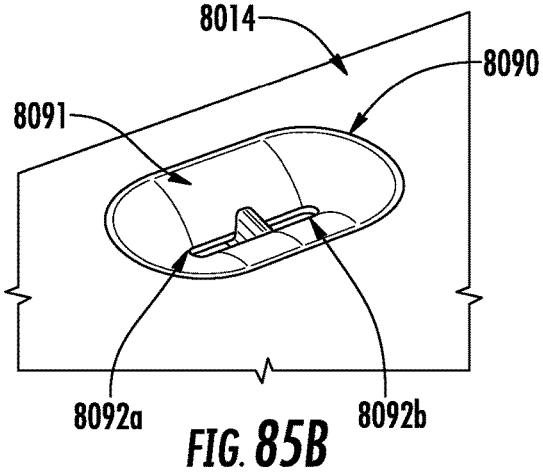
Figure 85C:
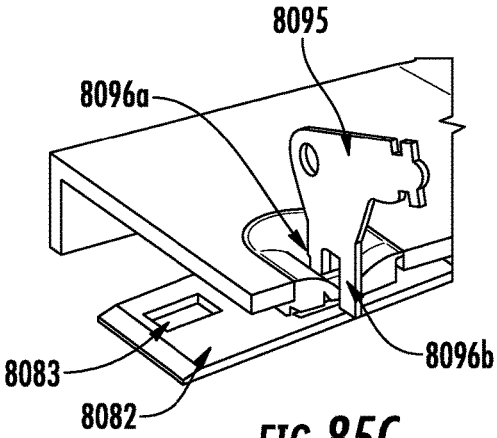
Figure 85D:
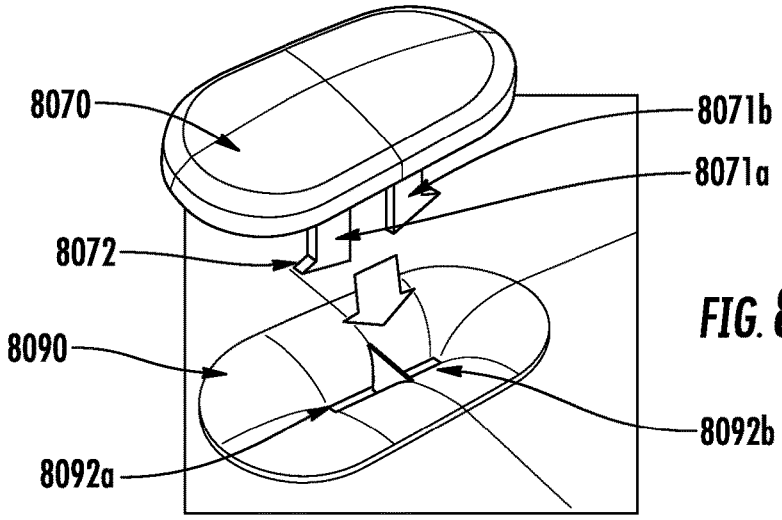
Figure 85E:
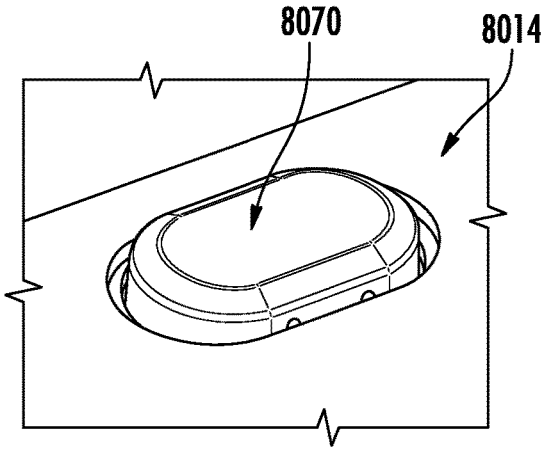
Figure 85F:
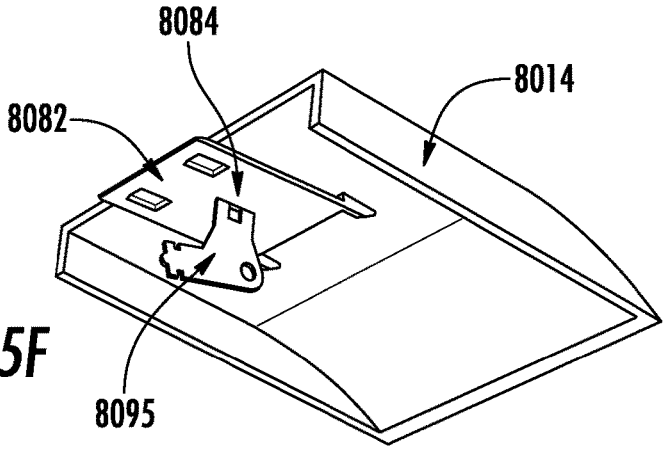
Figure 86:
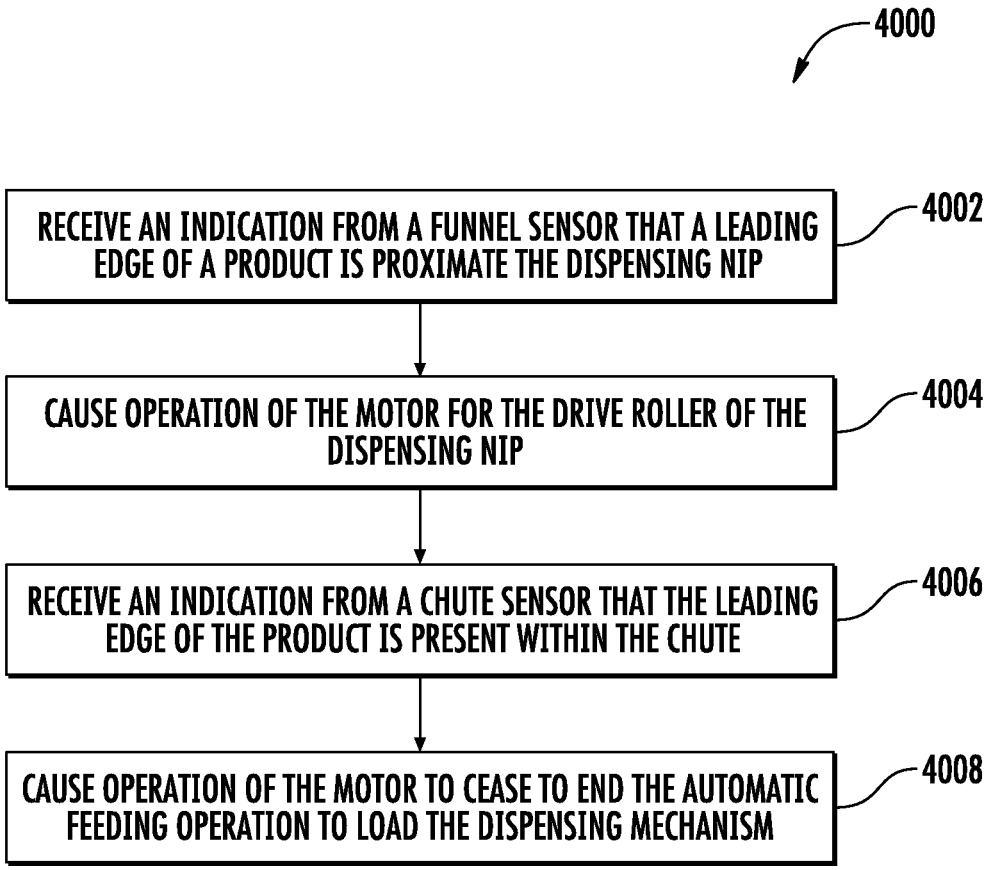
Figure 87:
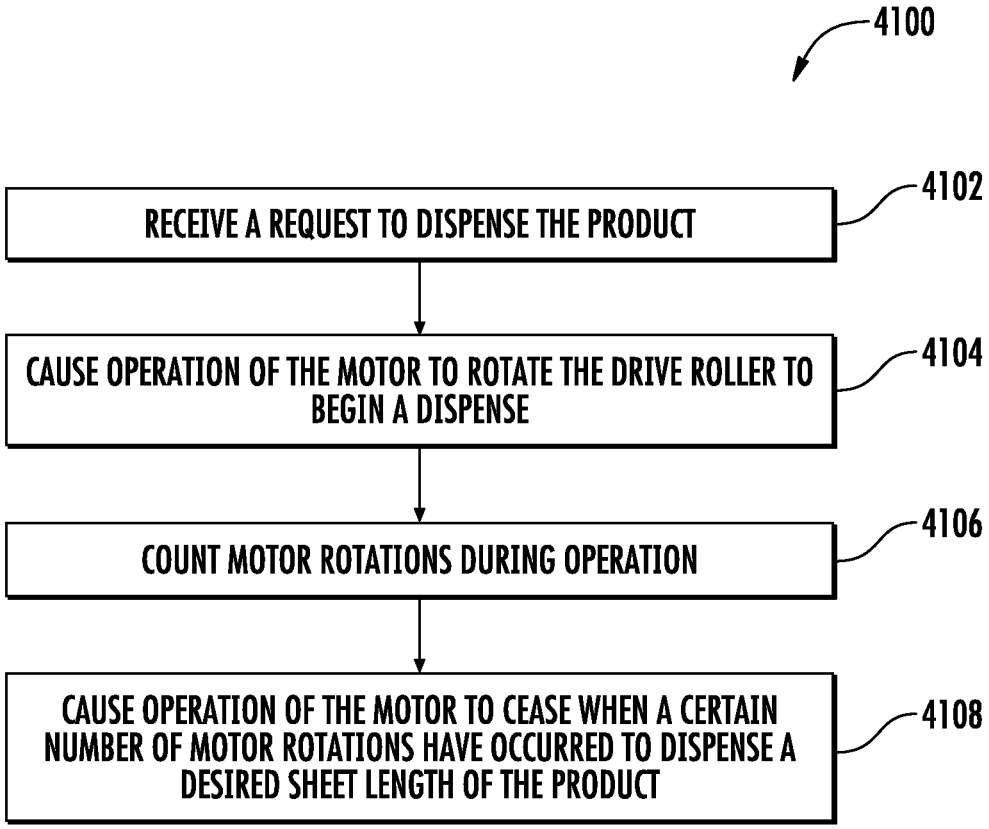
Figure 88:
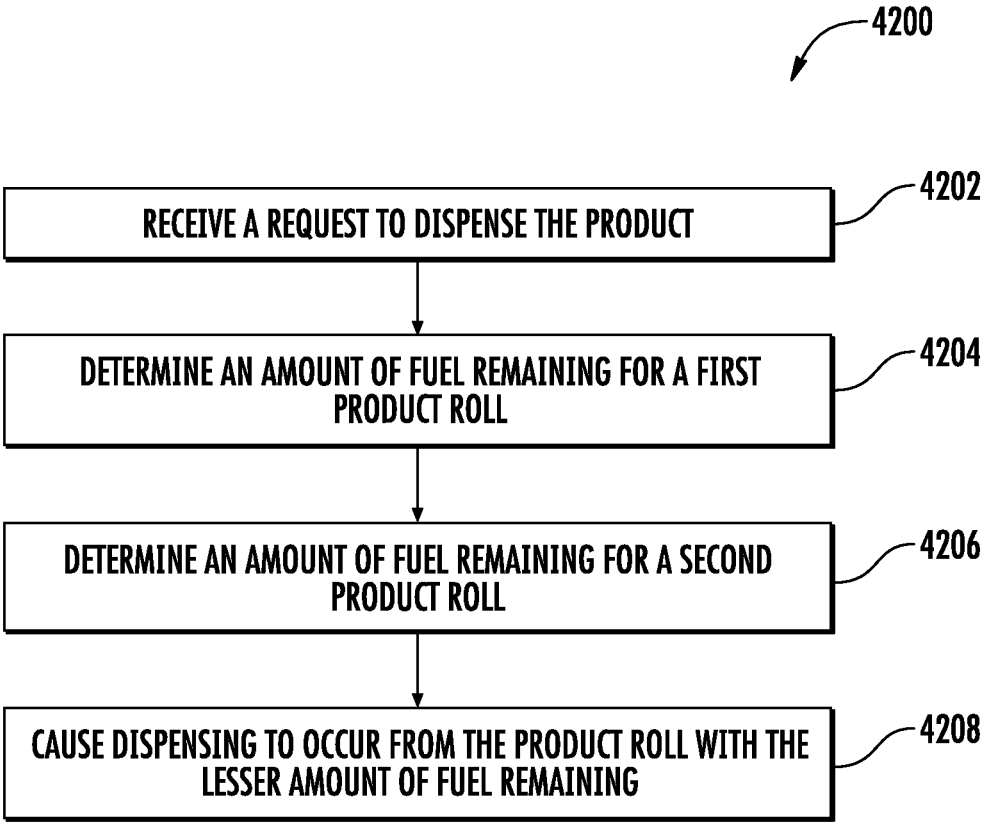
Figure 89:
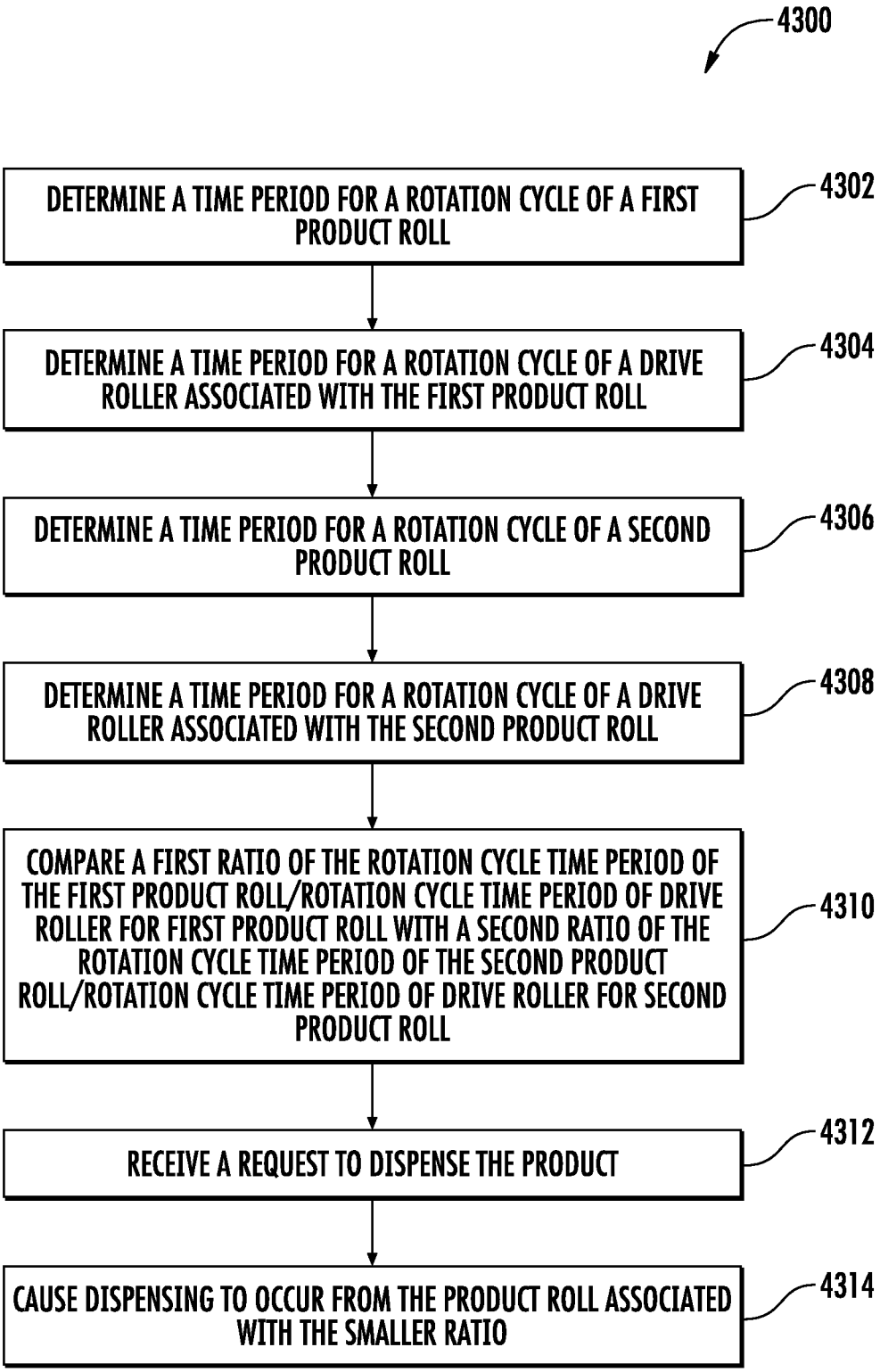
Figure 90:
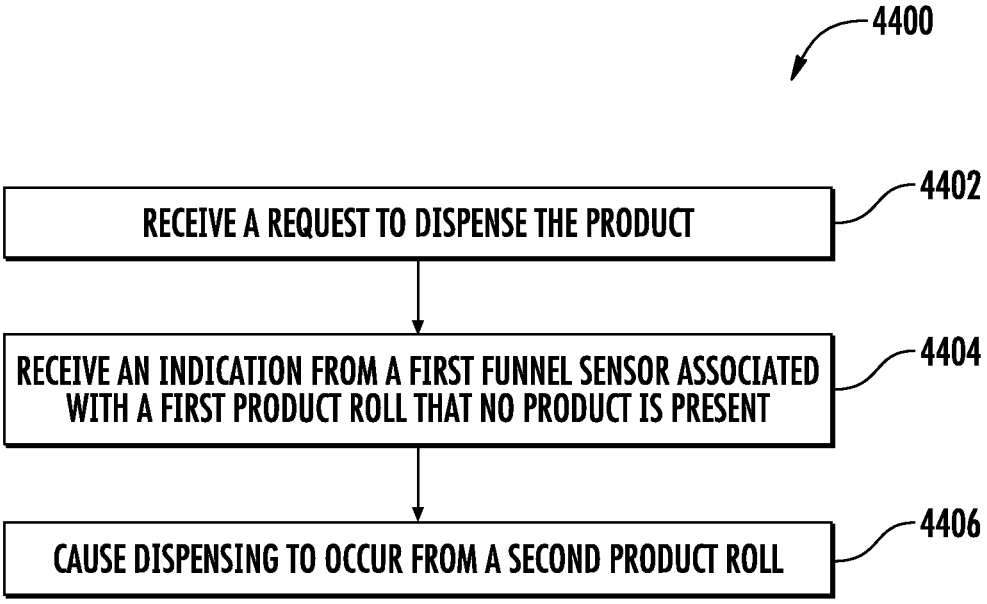

FIGS. 40A, 40B, 41, and 43 illustrate potential jamming and other complications that could be encountered without proper web management for some example product dispensers, in accordance with example embodiments described herein;

FIGS. 42 and 44 show an example product dispenser with web guide structures to achieve proper web management, in accordance with example embodiments described herein;

FIGS. 45-46 show another example product dispenser with a pivoting roller being used for web management, in accordance with example embodiments described herein;

FIG. 47 illustrates a front view of an example product dispenser with color coding to provide for intuitive loading, in accordance with example embodiments described herein;

FIG. 48 illustrates an example roll holder for a product roll, in accordance with example embodiments described herein;

FIG. 49 illustrates another example roll holder for a product roll, in accordance with example embodiments described herein;

FIGS. 50A-50B illustrate yet another example roll holder for a product roll, in accordance with example embodiments described herein;

FIGS. 51A-51B illustrate another example roll holder for a product roll, in accordance with example embodiments described herein;

FIGS. 52A-52B illustrate another example roll holder for a product roll, in accordance with example embodiments described herein;

FIGS. 53A-53B illustrate another example roll holder for a product roll, in accordance with example embodiments described herein;

FIGS. 54A-54C illustrate another example roll holder for a product roll, wherein the roll holder includes a retention mechanism, in accordance with example embodiments described herein;

FIGS. 55A-55C illustrate another example roll holder for a product roll, wherein the roll holder includes a retention mechanism, in accordance with example embodiments described herein;

FIGS. 56A-56C illustrate another example roll holder for a product roll, wherein the roll holder includes a retention mechanism, in accordance with example embodiments described herein;

FIGS. 57A-57B illustrate an example roll partition, wherein the roll partition includes a retention mechanism, in accordance with example embodiments described herein;

FIGS. 58A-58D illustrate another example roll holder for a product roll, wherein the roll holder includes a retention mechanism, in accordance with example embodiments described herein;

FIGS. 59A-59D illustrate another example roll holder for a product roll, wherein the roll holder includes a retention mechanism, in accordance with example embodiments described herein;

FIGS. 59E, 59F, and 59I illustrate another example roll holder for a product roll, wherein the roll holder includes a retention mechanism, in accordance with example embodiments described herein;

FIGS. 59G-59H illustrate example protrusions for a retention mechanism system for a roll holder for a product roll, in accordance with example embodiments described herein;

FIGS. 59J-590 illustrate interaction between an example roll partition and the rear dispenser housing as the roll partition rotates from a stowed position to an unstowed position and back again, in accordance with example embodiments described herein;

FIGS. 60A-60E illustrate another example roll holder for a product roll, wherein the roll holder includes a retention mechanism, in accordance with example embodiments described herein;

FIG. 61 illustrates another example roll partition with a retention mechanism, in accordance with example embodiments described herein;

FIGS. 62A-62D illustrate further example roll holders that are designed to retain an installed product roll, in accordance with example embodiments described herein;

FIGS. 63A-63B illustrate an example nip cover in two positions, in accordance with example embodiments described herein;

FIGS. 63C-63D illustrate an example product dispenser with a roll partition and a nip cover, wherein the roll partition and nip cover are shown in two positions, in accordance with example embodiments described herein;

FIGS. 64A-64B illustrate another example product dispenser with a roll partition and a nip cover, wherein the roll partition and nip cover are shown in two positions, in accordance with example embodiments described herein;

FIGS. 65A-65B illustrate a funnel cover concept, in accordance with example embodiments described herein;

FIG. 65C illustrates an example circuit diagram for an infrared activation transmitter, in accordance with example embodiments described herein;

FIGS. 66A-66B illustrate an example product dispenser with funnel and chute sensors, in accordance with example embodiments described herein;

FIG. 66C illustrates an example product dispenser configured for automatic or assisted feeding, in accordance with example embodiments described herein;

FIGS. 67A-67C illustrate example light pipe systems used for example funnel sensors, in accordance with example embodiments described herein;

FIGS. 68A-68B illustrate example light pipes, in accordance with example embodiments described herein;

FIGS. 69A-69C illustrate example light pipe systems for example chute sensors, in accordance with example embodiments described herein;

FIGS. 70A-70E illustrate example funnel sensor configurations, in accordance with example embodiments described herein;

FIGS. 71A-71F illustrate example tear bar detection mechanisms, in accordance with example embodiments described herein;

FIGS. 72-74 illustrate graphs and circuit board schematics related to motor operation sensing, in accordance with example embodiments described herein;

FIG. 75A illustrates an example simulation of a filtered signal for use in motor operation sensing, in accordance with example embodiments described herein;

FIG. 75B illustrates an example circuit board schematic for example motor operation sensing, in accordance with example embodiments described herein;

FIGS. 76A-76C illustrate example motor operation sensors, in accordance with example embodiments described herein;

FIGS. 77-78 illustrate example product level (e.g., fuel gauge) systems, wherein the product level systems are in the form of pivoting arms, in accordance with example embodiments described herein;

FIG. 79 illustrates an example rotation sensor system for a product dispenser, in accordance with example embodiments described herein;

FIG. 80A illustrates an example product level (e.g., fuel gauge) system that utilizes infrared technology, in accordance with example embodiments described herein;

FIG. 80B illustrates a portion of an example roll partition, in accordance with example embodiments described herein;

FIG. 80C illustrates a partial cross section view of the example roll partition of FIG. 80B, in accordance with example embodiments described herein;

FIGS. 81A-81B illustrate other example product level (e.g., fuel gauge) systems, in accordance with example embodiments described herein;

FIG. 82 illustrates an example maintainer user interface for a product dispenser, in accordance with example embodiments described herein;

FIGS. 82A-82C illustrate an animation of LED indication of a selected option for the maintainer user interface, in accordance with example embodiments described herein;

FIGS. 83A-83B illustrate example indication options for a consumer (e.g., maintainer or user) of the product dispenser, in accordance with example embodiments described herein;

FIGS. 84A-84C illustrate an example animation routine that can be performed by the user interface to indicate a circumstance to a user, such as proper loading of the sheet product into one of the dispensing mechanisms, in accordance with example embodiments described herein;

FIGS. 85A-85C illustrate an example lock for enabling access to the inside of the product dispenser, in accordance with example embodiments described herein;

FIGS. 85D-85E illustrate an example button for enabling access to the inside of the product dispenser, in accordance with example embodiments described herein;

FIG. 85F illustrates use of a key to change between the button and the lock for controlling access to the inside of the product dispenser, in accordance with example embodiments described herein;

FIG. 86 illustrates a flowchart of an example method of controlling and operating an example sheet product dispenser for providing automatic or assisted loading, in accordance with some embodiments discussed herein;

FIG. 87 illustrates a flowchart of an example method of controlling and operating an example sheet product dispenser for dispensing according to a desired sheet length, in accordance with some embodiments discussed herein;

FIG. 88 illustrates a flowchart of an example method of controlling and operating an example sheet product dispenser for dispensing from the smaller product roll, in accordance with some embodiments discussed herein;

FIG. 89 illustrates a flowchart of another example method of controlling and operating an example sheet product dispenser for dispensing from the smaller product roll, in accordance with some embodiments discussed herein; and FIG. 90 illustrates a flowchart of an example method of controlling and operating an example sheet product dispenser for auto switching between product rolls during dispensing, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example product dispensers may be a maintainer (e.g., a maintenance person, a janitor, a facility manager, etc.) or a consumer (e.g., a person receiving a dispensed portion of the product).

Overview

Some embodiments of the present invention described herein are designed to maximize efficiency of maintenance, usage, and operation for product dispensers. In this regard, some of the embodiments are designed to provide for easy and intuitive loading of sheet product (e.g., paper towel) to aid a maintainer during loading. Additionally, some embodiments of the present invention seek to avoid a completely empty scenario and maximize usage of the sheet product, such as by avoiding the scenario where the maintainer throws away unused sheet product. Further, some embodiments of the present invention seek to provide easy-to-use operation of the sheet product dispenser that seamlessly switches to dispensing from a second, full paper towel roll upon depletion of the first paper towel roll. Additional benefits sought by various embodiments of the present invention include avoidance of jamming scenarios, providing automatic or assisted loading through the dispensing mechanism, efficient management of web paths of the sheet product within the dispenser, among many other benefits that are evident to one of ordinary skill in the art based on the disclosure herein.

General Structure

Figure 1:
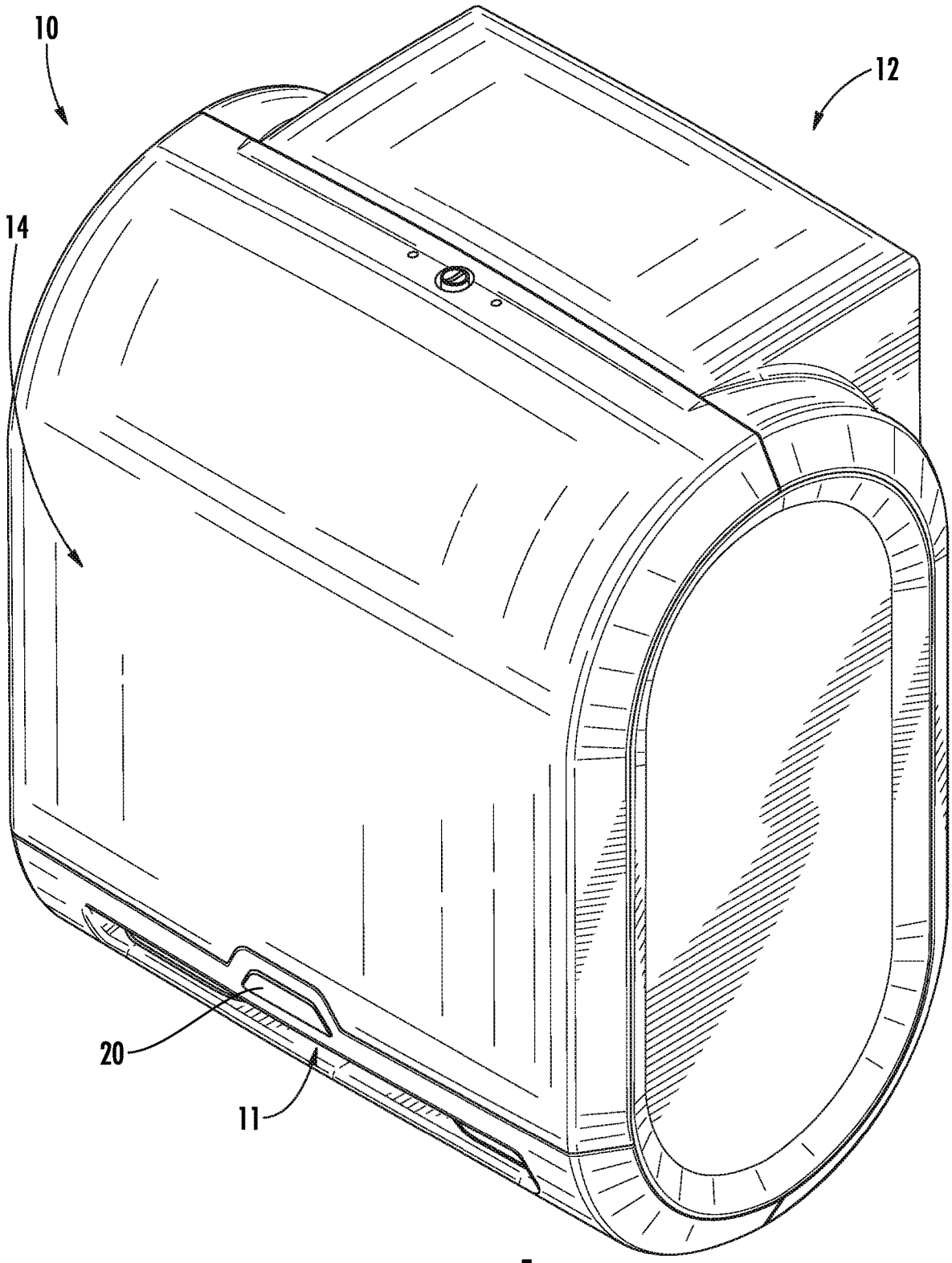
FIG. 1 shows a perspective view of an example sheet product dispenser, in accordance with some embodiments discussed herein.
Figure 2:
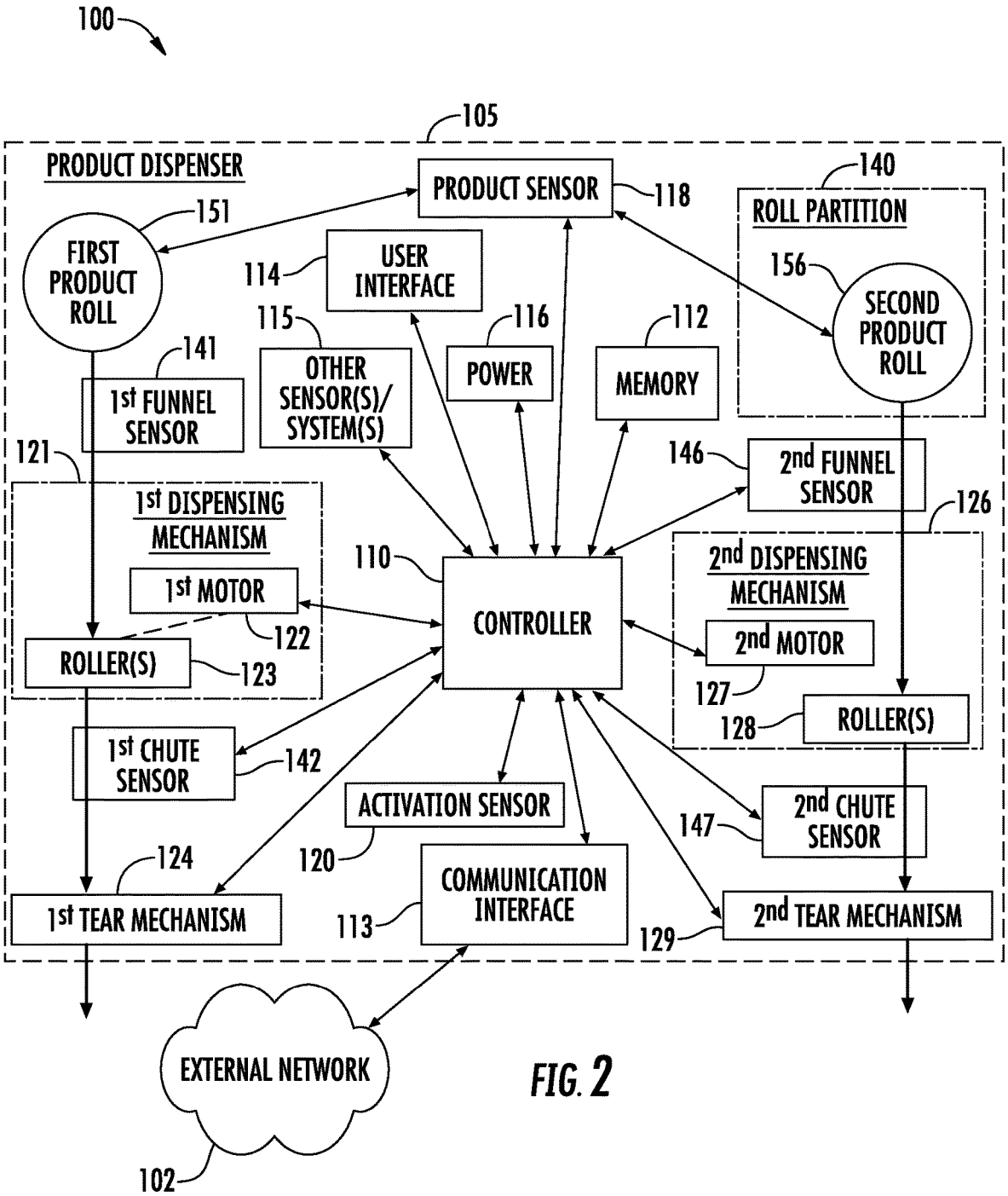
FIG. 2 shows a block diagram illustrating an example system for controlling and operating an example sheet product dispenser, in accordance with some embodiments discussed herein.

FIG. 1 illustrates an example sheet product dispenser 10 according to some embodiments of the present invention, such as in accordance with the sheet product dispenser 105 and its corresponding components described with respect to FIG. 2. The sheet product dispenser 10 includes a housing defined by a base portion 12 and a cover 14. The sheet product dispenser 10 includes at least one dispensing slot 11 where the sheet product (e.g., paper towel) is provided to the user. Such sheet product may, such as described herein, be dispensed in response to user input being provided to an activation sensor 20 (e.g., in the circumstance where the sheet product dispenser is automated).

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

Figure 3:
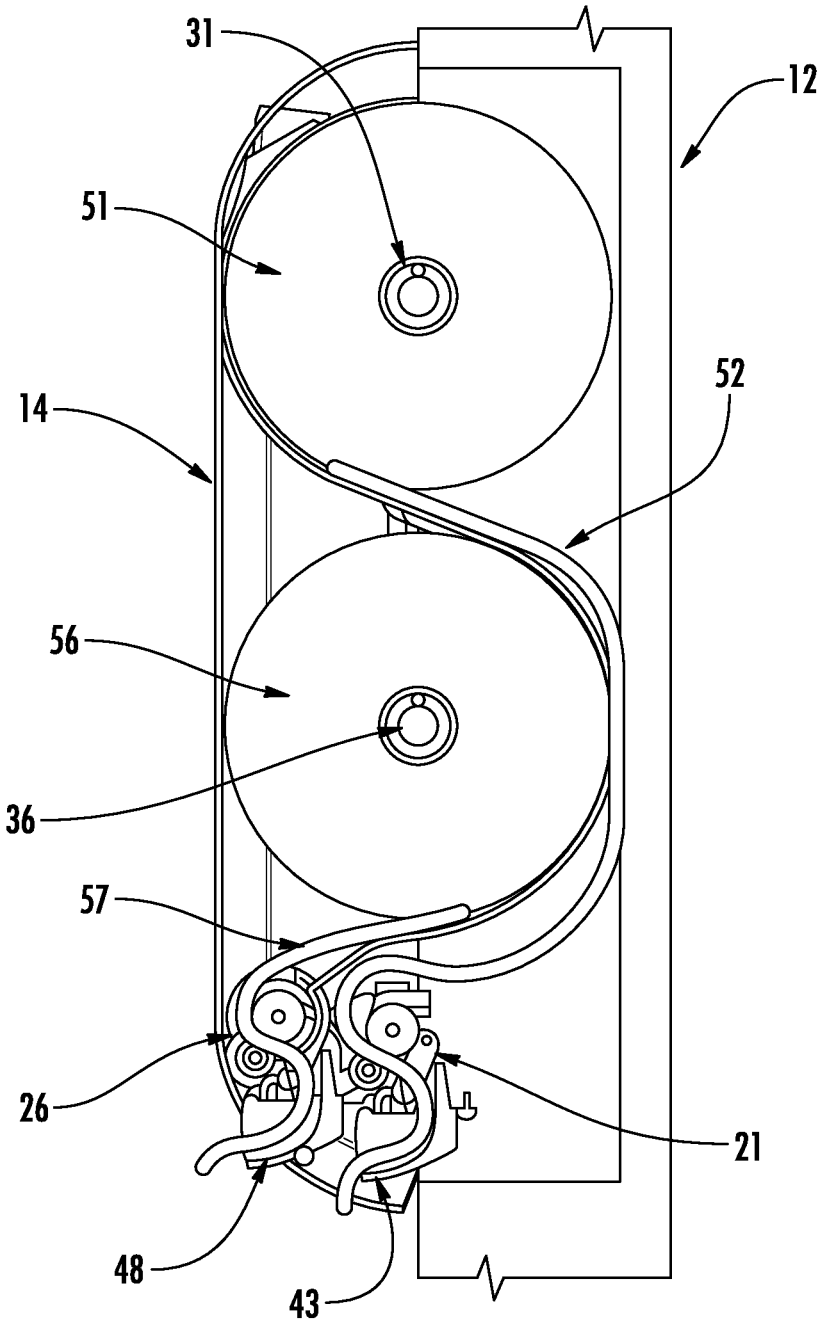
FIG. 3 illustrates a schematic cross-sectional view of components of an example sheet product dispenser, in accordance with some embodiments discussed herein.

In some embodiments, the sheet product dispenser 10 is sized to support two full sheet product (e.g., paper towel) rolls and two separate web paths, each one leading to separate dispensing mechanisms. For example, with reference to FIG. 3, the sheet product dispenser 10 comprises a first set of roll holders 31 to hold a first sheet product roll 51 (e.g., first product roll 151 of FIG. 2) near the top of the dispenser 10. A first web path 52 leads from the first sheet product roll 51 to a first dispensing mechanism 21 (e.g., first dispensing mechanism 121 of FIG. 2). Upon activation and after completing a dispense (using the first dispensing mechanism 21), a portion of the first sheet product roll 51 extends out of a first chute 43 below the first dispensing mechanism 21 and is available for a user. The sheet product dispenser 10 further comprises a second set of roll holders 36 to hold a second sheet product roll 56 (e.g., second product roll 156 of FIG. 2) near the bottom of the dispenser 10. A second web path 57 leads from the second sheet product roll 56 to a second dispensing mechanism 26 (e.g., second dispensing mechanism 126 of FIG. 2). Upon activation and after completing a dispense (using the second dispensing mechanism 26), a portion of the second sheet product roll 56 extends out of a second chute 48 below the second dispensing mechanism 26 and is available for a user.

In some embodiments, the housing and roll holders are designed to enable the product roll to be installed in either a front loading or a back loading orientation, while still operate effectively in either loading orientation. For example, the product roll may be front loaded when the leading edge of the product roll that extends toward the dispensing mechanism comes in front of the product roll. Likewise, the product roll may be back loaded when the leading edge of the product roll that extends toward the dispensing mechanism comes from behind the product roll. Such embodiments offer versatility in loading for the maintainer.

Figure 3A:
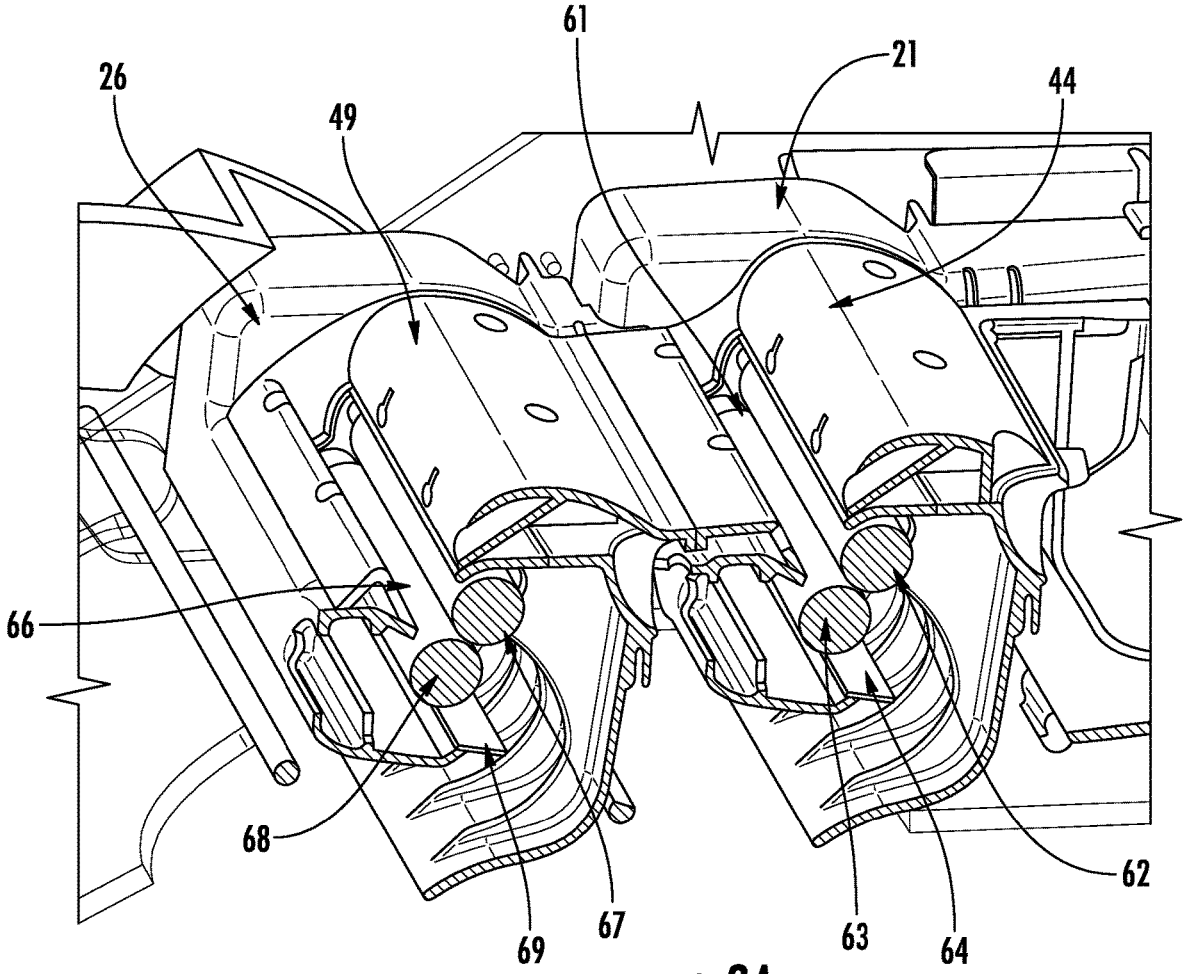
FIG. 3A shows a cross-sectional perspective view of the first and second dispensing mechanisms of an example sheet product dispenser, in accordance with some embodiments discussed herein.

FIG. 3A shows a close up view of the first and second dispensing mechanisms 21, 26. With reference to FIG. 3A, each dispensing mechanism may include components that enable dispensing of the portion of the corresponding sheet product roll. For example, the first dispensing mechanism 21 includes a first nip 61 that is formed between a first pinch roller 63 and first drive roller 62 and covered by a first funnel cover 44. The first drive roller 62 is driven by a motor (e.g., the first motor 122 of FIG. 2). The second dispensing mechanism 26 includes a second nip 66 that is formed between a second pinch roller 68 and second drive roller 67 and covered by a second funnel cover 49. The second drive roller 67 is driven by a motor (e.g., the second motor 127 of FIG. 2). In some embodiments, the dispensing mechanisms may each include more or less components depending on the configuration. Further, in some embodiments, certain components may be shared between two dispensing mechanisms such that each dispensing mechanism has its own set of some components and there is one or more shared additional components. For example, each dispensing mechanism may include a pinch roller, but may share a drive roller. Likewise, depending on the configuration, other components may be shared such as, a pinch roller, a motor, etc. In such embodiments, the shared components (or the components of each dispensing mechanism) may be configured to selectively engage each other depending on which dispensing mechanism is operating.

In some embodiments, such as the depicted embodiment, the sheet product dispenser can include color coded components to aid in easy and intuitive loading. For example, the first funnel cover 44 may be green, which matches the color of corresponding roll holders for the first product roll. Likewise, the second funnel cover 49 may be blue, which matches the color of corresponding roll holders for the second product roll. In this manner, the maintainer can intuitively follow the color coding to ensure that the product rolls are properly loaded into the proper dispensing mechanisms.

In some embodiments, the product dispenser may be designed to hold two different product rolls, each with different properties (one in the first roll holder and the other in the second roll holder). For example, different quality product rolls could be used for expensive and inexpensive situational dispensing. Likewise, a product roll with special absorbency or other attributes could be set in a roll holder and used for special circumstances. In this regard, some embodiments of the present invention utilize web management to maintain separation of the product rolls, which could be useful for such example embodiments that enable two different types of product rolls. Further, in such embodiments with two distinct dispensing mechanisms, the product dispenser may be configured to enable dispensing from either product roll. This may be achieved by providing an input capability for the consumer and/or maintainer to choose which product roll to dispense from.

In some embodiments, the dispenser is an automatic dispenser. In such an embodiment, the dispenser may include an activation sensor (e.g., activation sensor 120 of FIG. 2) that is configured to detect a user command, such as placement of the user's hand in a designated area or pulling on a leading edge of the paper towel roll. Upon sensing the user command, a controller (e.g., controller 110 of FIG. 2) in the dispenser may automatically cause the sheet product dispenser to dispense sheet product from either one of the dispensing mechanisms using one or more motors to operate the corresponding drive roller (and, thus, the corresponding dispensing mechanism). The sensor may be a contact sensor, a non-contact sensor, or other suitable sensor. Alternatively, in some embodiments, the sheet product dispenser may be configured as a non-automated dispenser.

Figure 3B:
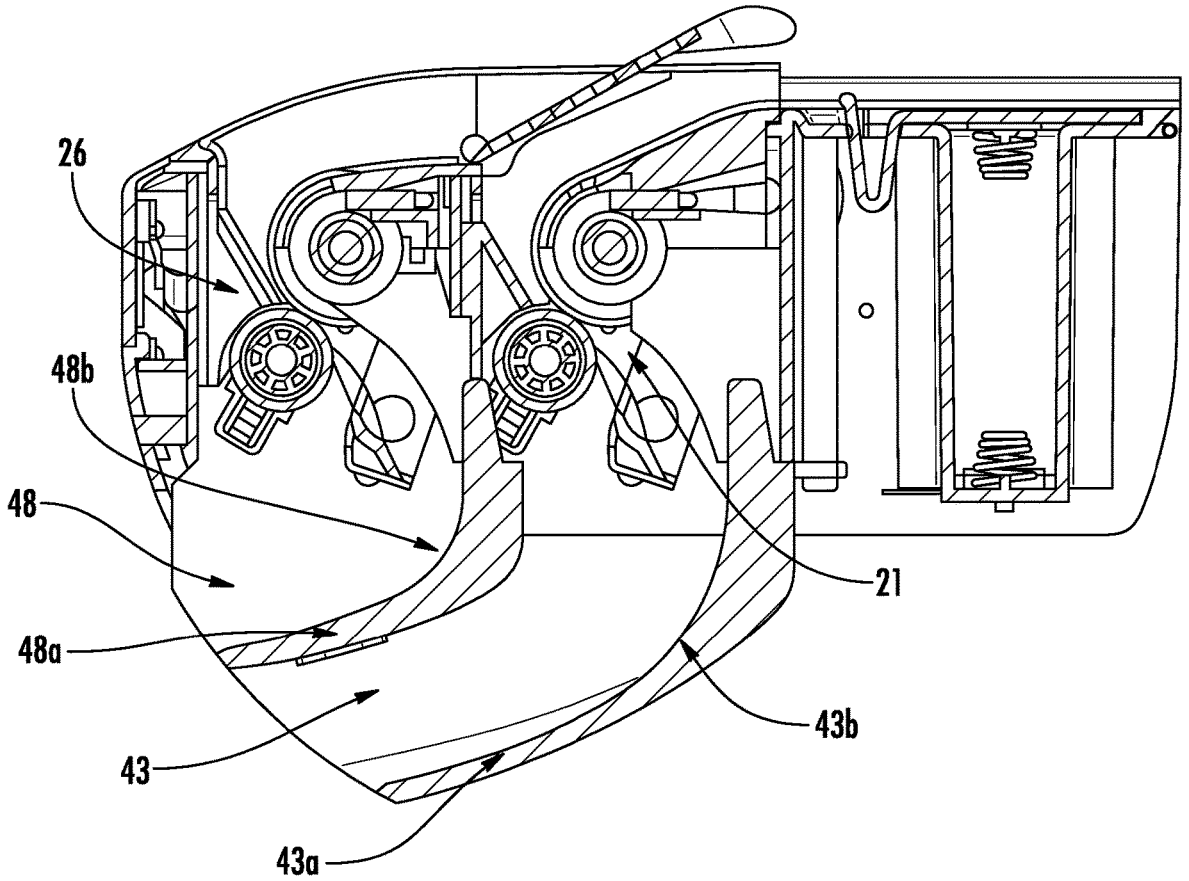
FIG. 3B shows a cross-sectional view of the first and second dispensing mechanisms of an example sheet product dispenser, in accordance with some embodiments discussed herein.

In some embodiments, the dispenser may include one or more chutes for guiding the dispensed portion of the product to user. In some embodiments where there are two dispensing mechanisms, the dispenser housing may define two chutes (one for each dispensing mechanism). For example, with reference to FIG. 3B, the dispenser housing may define a first chute 43 for the first dispensing mechanism 21 and a second chute 48 for the second dispensing mechanism 26. One of the goals of the present invention may be to provide a product dispenser that enables a user to interact with a single activation sensor, but possibly receive dispensed product from either dispensing mechanism without much difference realized by the user. In this regard, it may be desirable to have the dispensed product provided to the user in a common area no matter which dispensing mechanism is used. In order to accomplish this, some embodiments of the present invention provide a front chute (e.g., the second chute 48) and a rear chute (e.g., the first chute 43) that each define a geometry that guides the dispensed product to the common area. Notably, in order to achieve this due to the extra space required for the rear dispensing mechanism 21, the rear chute 43 may define a wall 43*a* that extends at a greater length than the wall 48*a* of the front chute 48. Further, a different angle 43*b* is used to guide the dispensed product through the rear chute 43 than the angle 48*b* used to guide the dispensed product through the front chute 48. In some embodiments, additional static electricity is built-up due to the extended length of the wall 43*a* of the rear chute 43. In some such embodiments, the present invention may employ various static management techniques, such as described in greater detail herein.

In some embodiments, the housing of the sheet product dispenser is designed such that the roll holders may each receive a full-sized (e.g., full-diameter) product roll. In this regard, when the cover is in the closed position, the housing is sized such that both a first roll holder and a second roll holder are configured to each hold a full size sheet product roll in a substantially vertical orientation with respect to each other (including a slightly offset vertical orientation). For example, one product roll may be generally positioned above the other product roll. Additional information and example embodiments of various dispensers configured for use of two full sized paper towel rolls can be found in U.S. application Ser. No. 13/998,753, entitled "System and Method for Reducing Waste Using a Sheet Product Dispenser", filed Dec. 2, 2013, and U.S. Application No. 61/731,812, filed Nov. 30, 2012, both of which are owned by the Assignee of the present application and hereby incorporated by reference in their entireties.

Figure 3C:
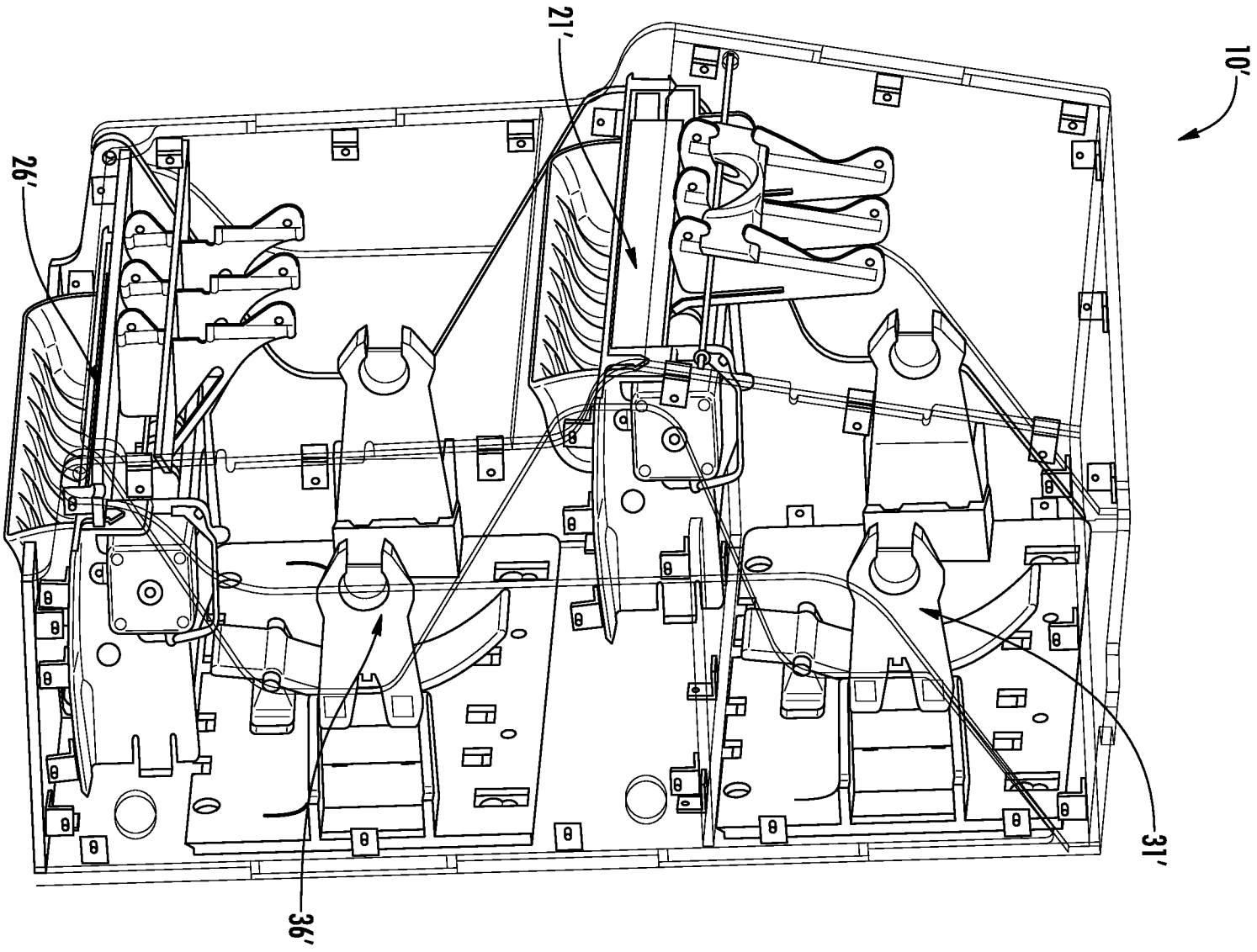
FIGS. 3C-3E illustrate an example sheet product dispenser that holds two rolls and has two dispensing mechanisms, where the dispensing mechanisms are vertically spaced from each other, in accordance with some embodiments discussed herein.
Figure 3D:
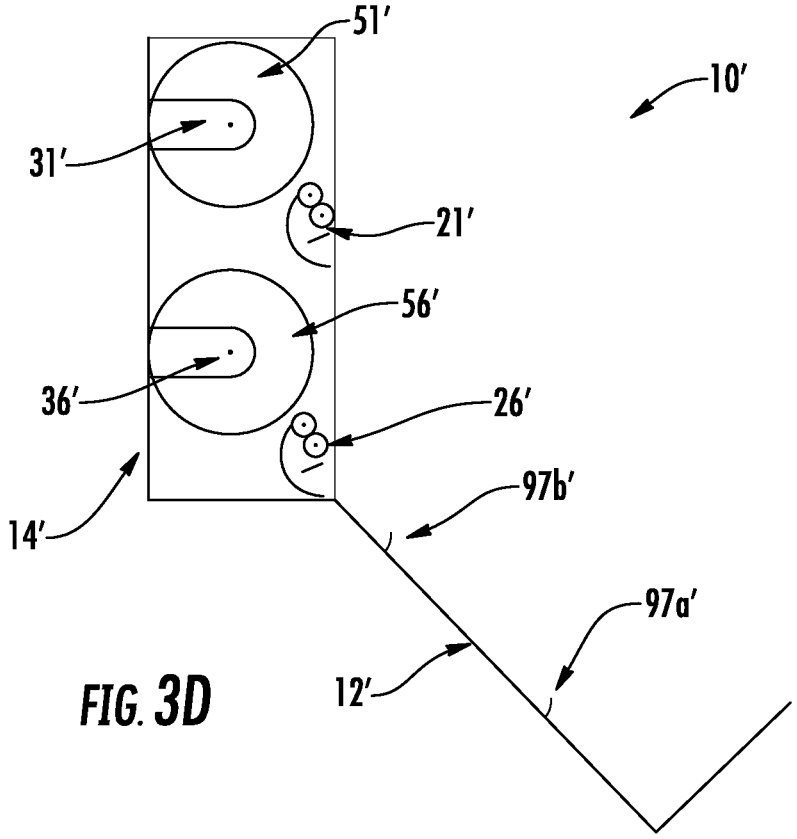
Figure 3E:
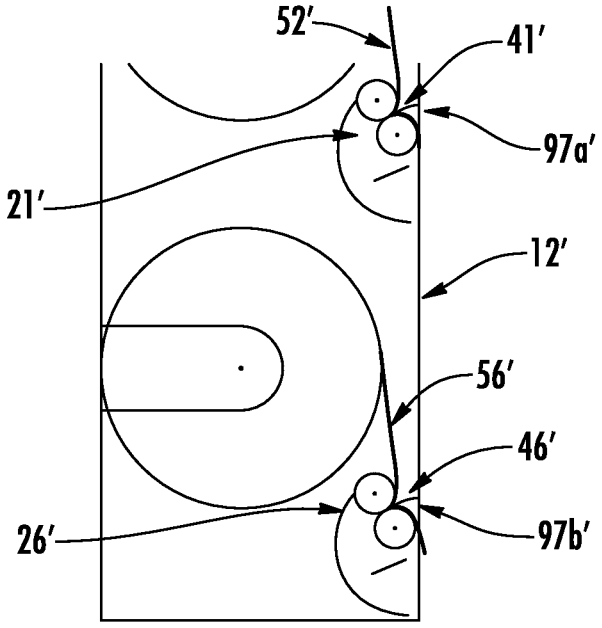

Another example sheet product dispenser 10' that is configured to hold two full size rolls in a vertical relationship with respect to each other is shown in FIGS. 3C-3E. In the depicted embodiment, a first product roll 51' may be received in a first roll holder 31' and a second product roll 56' may be received in a second roll holder 36' (see FIG. 3D). Notably, the first dispensing mechanism 21' is positioned proximate the first roll holder 31' near a top portion of the dispenser 10', while the second dispensing mechanism 26' is positioned proximate the second roll holder 36' near a bottom portion of the dispenser 10'. In such a manner, the product rolls and their corresponding web paths are separated, with the first dispensing mechanism 21' delivering sheet product to a user near the top of the dispenser 10' and the second dispensing mechanism 26' delivering sheet product to a user near the bottom of the dispenser 10'. Further, in some embodiments, one or more tucker fingers 97*a*', 97*b*' may be provided on the cover 12'. In such an example, the tucker fingers 97*a*', 97*b*' may be aligned with the corresponding nips 41', 46' of the first and second dispensing mechanisms 21', 26'. With this configuration, a maintainer may only need to lay the leading edge of the sheet material over the nip 41', 46' and the tucker fingers 97*a*', 97*b*' may automatically push the sheet product 52', 56' into the corresponding nip 41', 46' as the cover 12' closes—thereby loading the dispensing mechanisms. This avoids the need for the maintainer to feed the leading edge of the sheet product into the dispensing nips.

Although the above described multi-roll dispenser includes two roll holders, some embodiments of the present invention are not meant to be limited to two roll holders, as any number of roll holders may be utilized with the present invention. For example, the housing may be sized to include only one full size roll or one full size roll and one partially depleted roll (e.g., stub roll). Along these lines, various embodiments described herein may be utilized with other various configurations including for example one dispensing mechanism (and, in some cases, a transfer mechanism—such as depending on how many rolls are utilized).

Figure 4A:
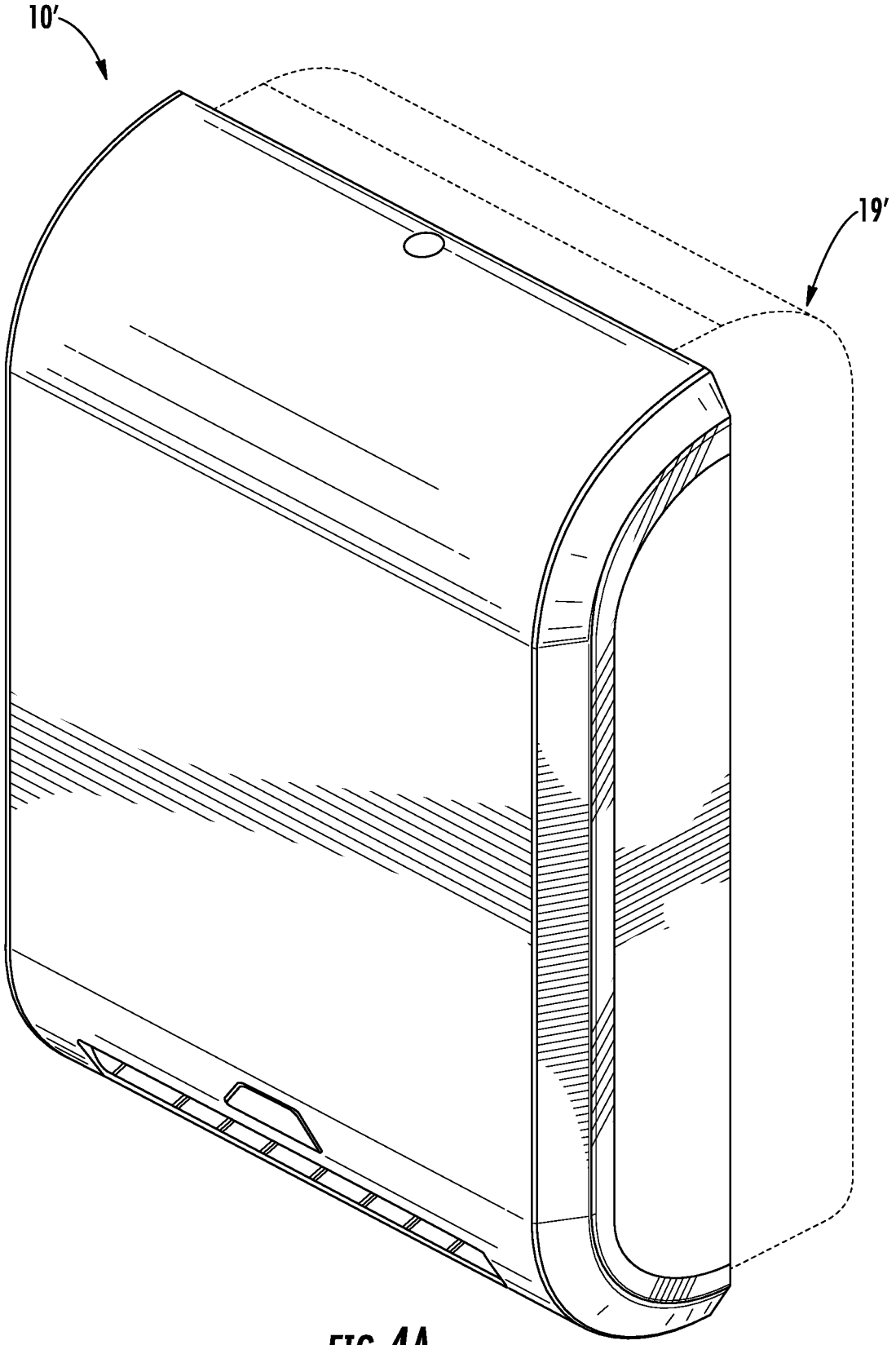
FIGS. 4A-4B show example sheet product dispensers that are configured for recessed wall mounting, in accordance with some embodiments discussed herein.
Figure 4B:
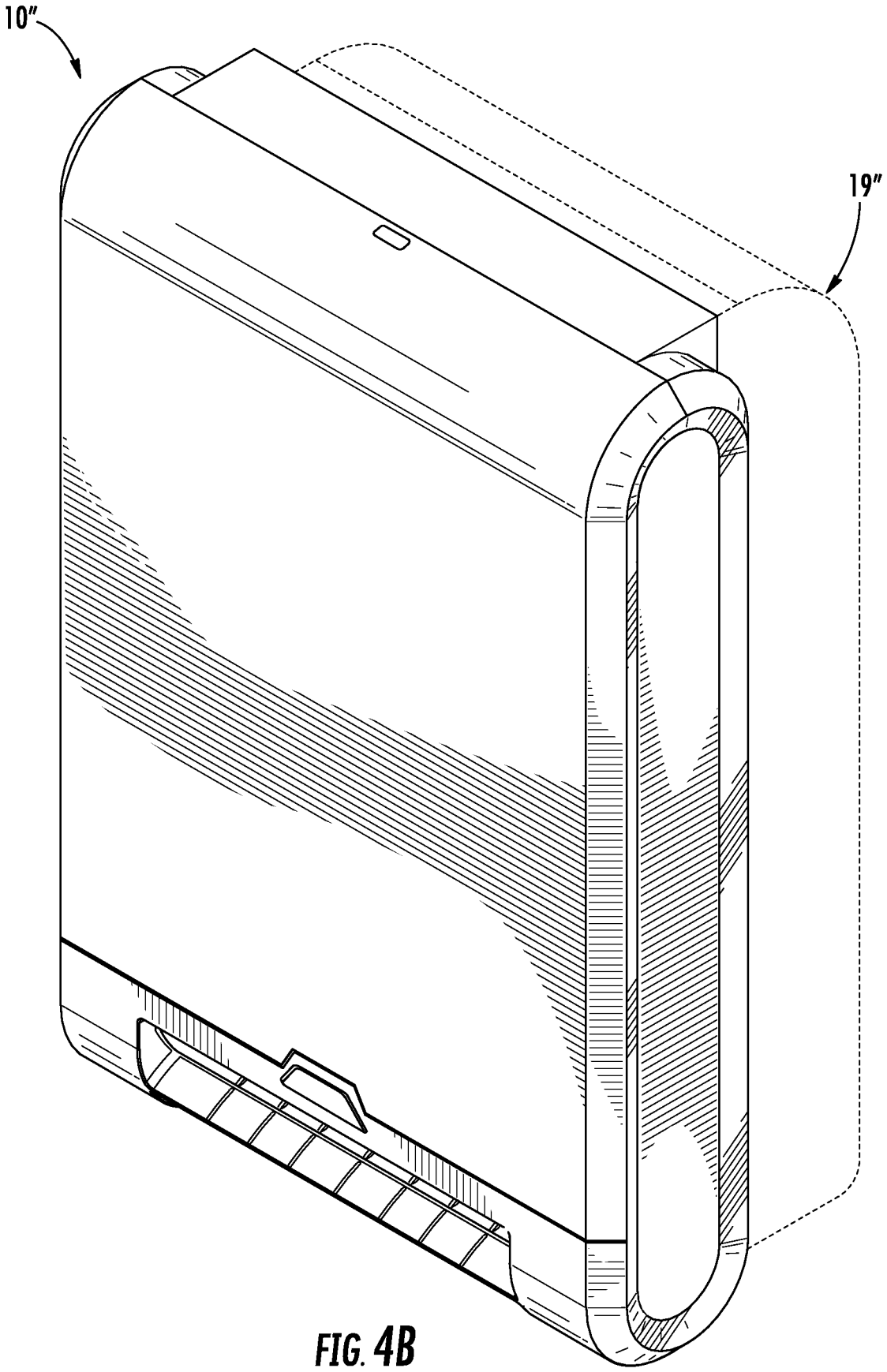

Similarly, housing configurations other than exterior wall mounted may be utilized with various embodiments of the present invention. For example, FIGS. 4A and 4B each show example recessed mounted housings that may be employed with various embodiments of sheet product dispensers described herein. In some such embodiments, a portion 19', 19" of the housing of the sheet product dispenser 10', 10" may be configured to be positioned in a recess or other receptacle of the wall for mounting purposes. Such a recessed design may provide a "sleek" look.

General Refilling and Roll Holder Articulation Example

Figure 5:
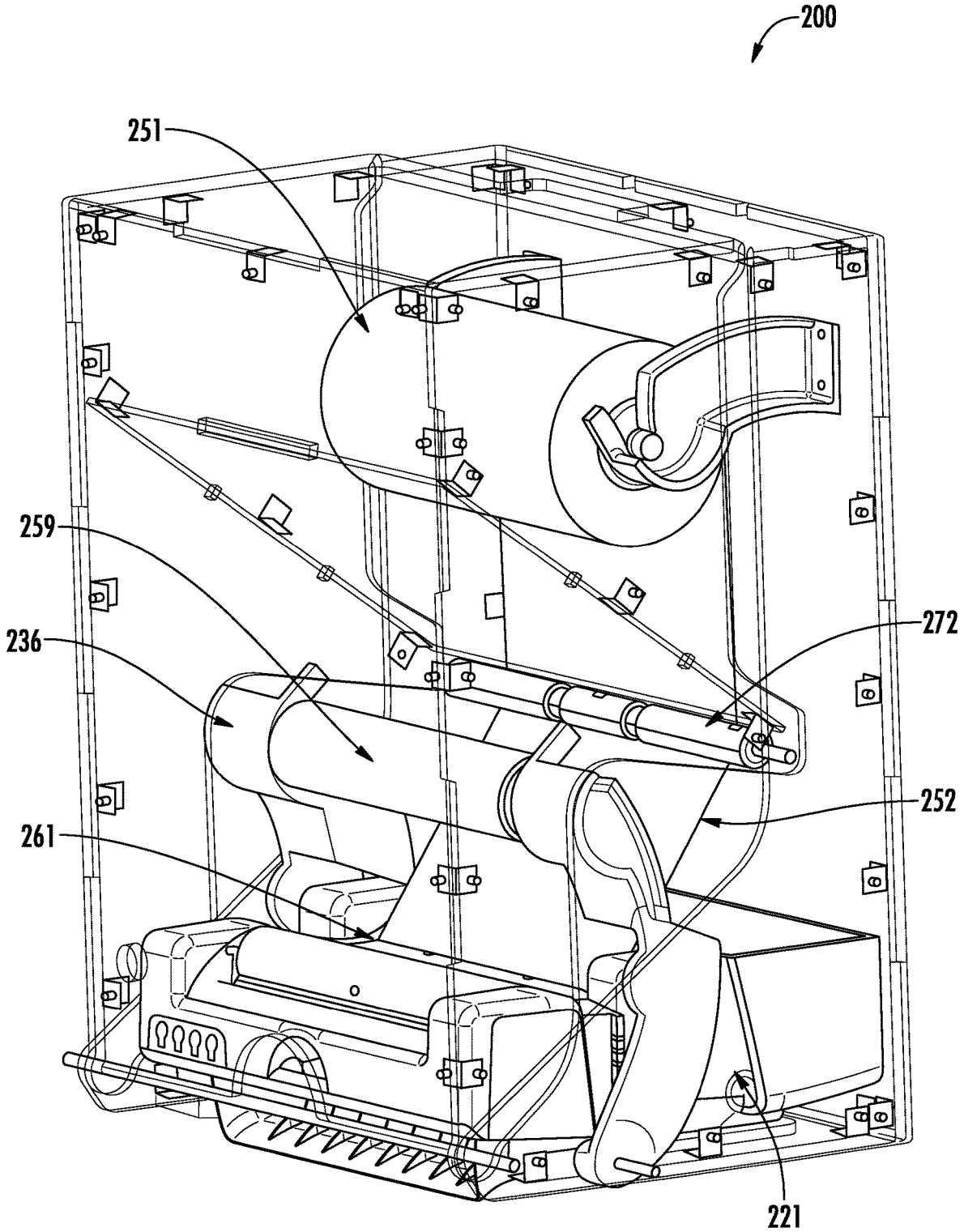
FIGS. 5-13 illustrate various views of example sheet product dispensers that are configured to hold two full size product rolls for dispensing, in accordance with example embodiments described herein.

An example embodiment of the contemplated dispenser operates as described below. FIG. 5 illustrates the example dispenser 200 in a condition that is ready to be serviced when a maintainer (e.g., janitor, maintenance personnel, user, etc.) may approach it. In particular, there is a partially-used first product roll 251 which includes a portion (e.g., leading edge) of the first product roll that extends from the first product roll behind the cover roller 272 and into the first nip funnel 261 of the first dispensing mechanism 221 (thereby defining a first web path 252). At this point, the first drive roller and first pinch roller of the first dispensing mechanism 221 may rotate upon command to dispense a portion of first product roll 251. FIG. 5 also shows a depleted empty product roll 259 in the second roll holder 236 that is ready to be replaced with a new product roll.

Figure 6:
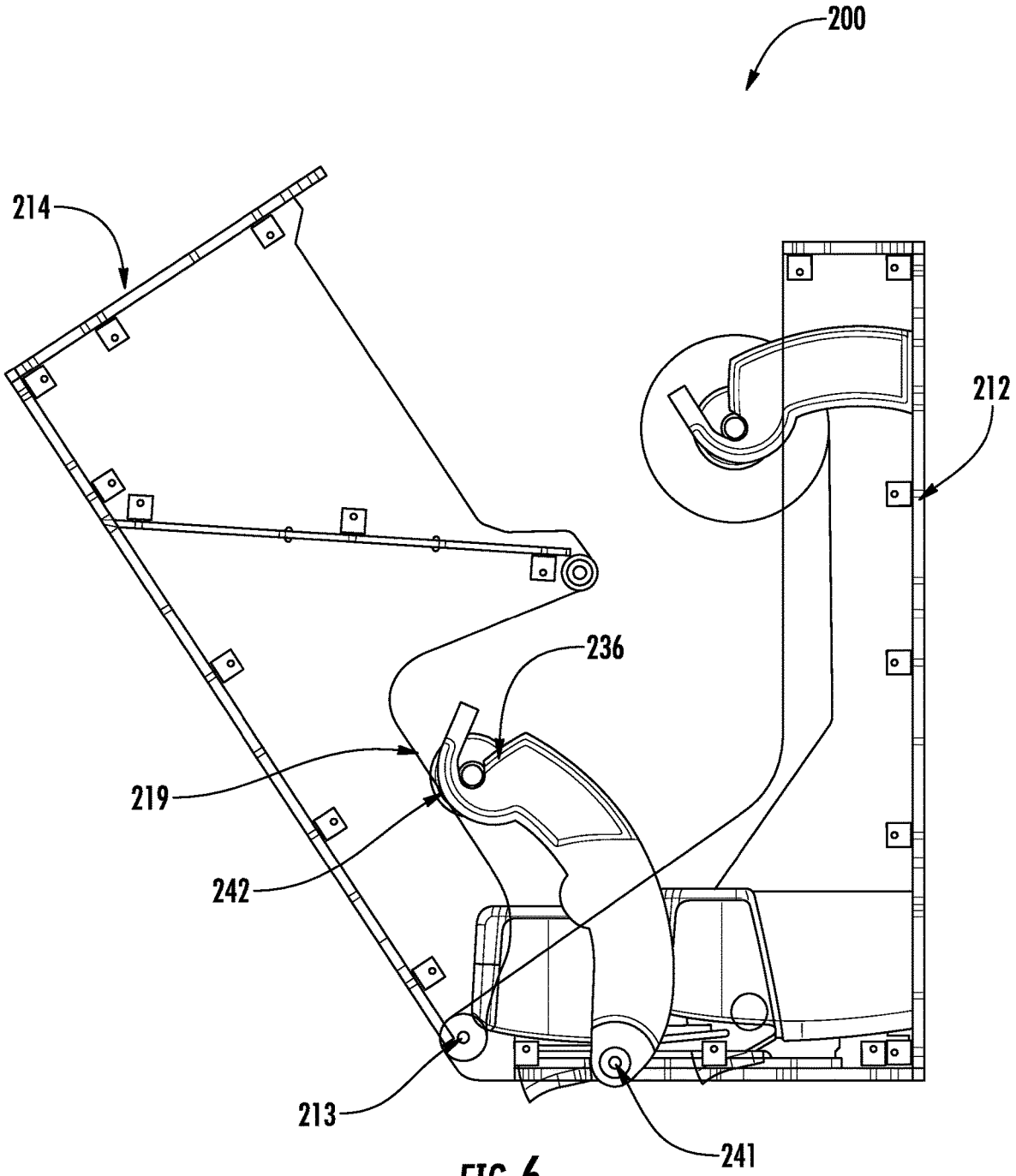

FIG. 6 shows the dispenser 200 when the maintainer is opening the cover 214. As the cover 214 opens, the cover 214 pivots about the cover hinge 213 away from the rear housing 212 and also draws the cover roller 272 away from contact with the portion of the first product roll along the first web path 252. As the cover 214 opens, one or more of gravity, a spring (not shown), intentional contact with the cover 214 (not shown), user interaction, or the like urges the second roll holder 236 (or an intermediate roll partition as described in some embodiments herein) to pivot about a hinge 241. In the illustrated embodiment, the cover 214 includes a cover contact surface 219 that contacts a second roll holder contact surface 242 and limits how far the second roll holder 236 pivots.

Figure 7:
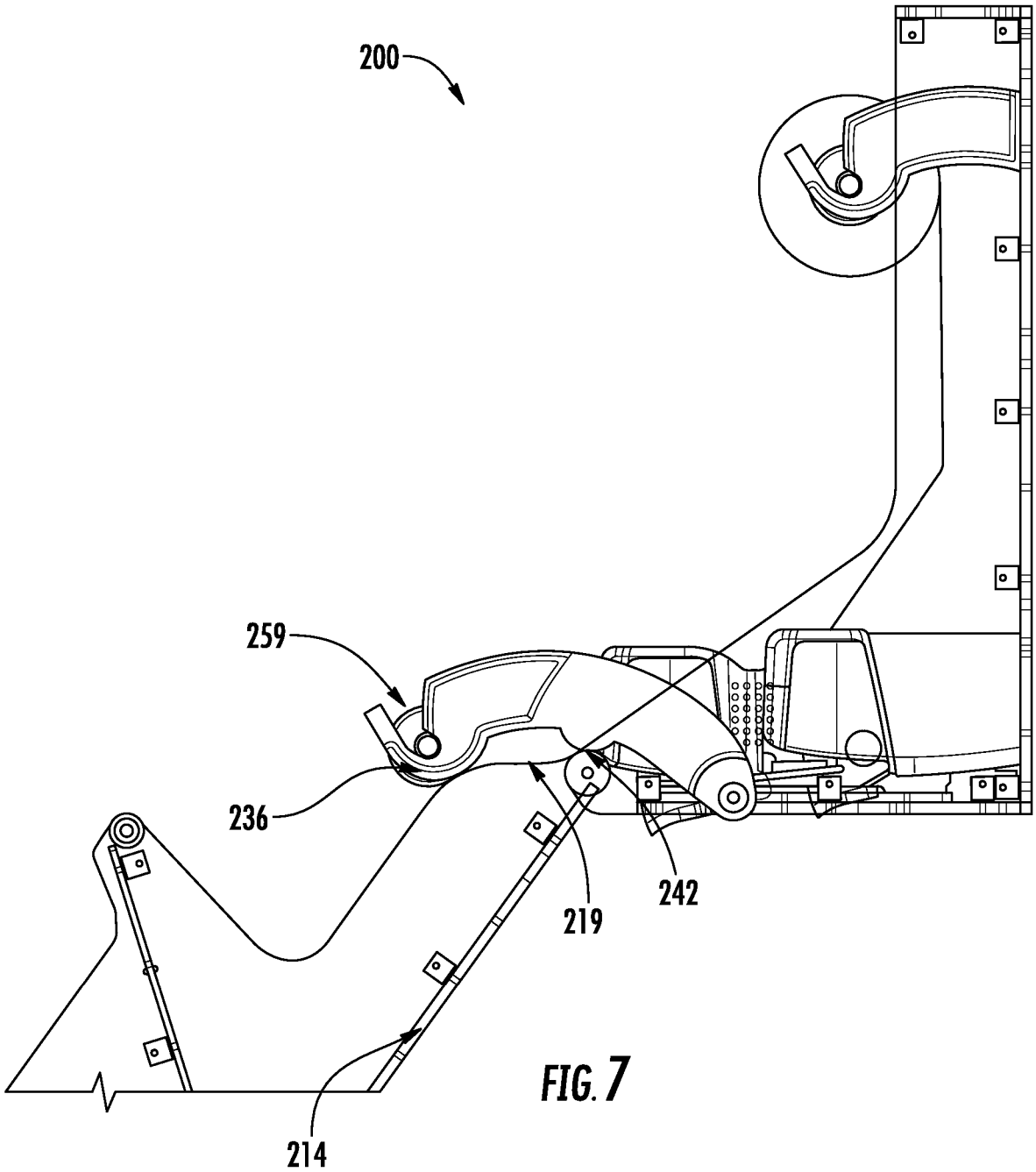
Figure 8:
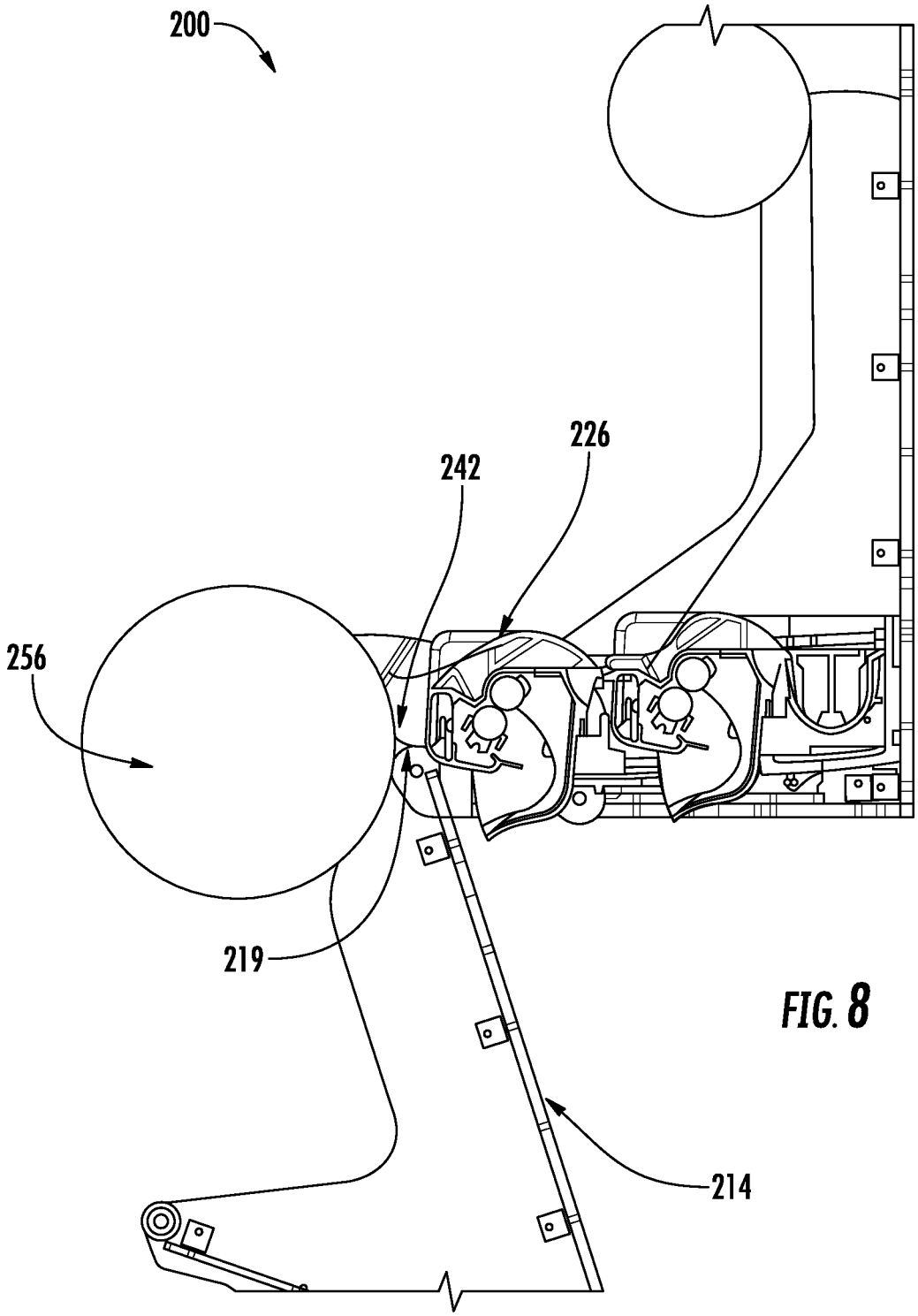

FIG. 7 shows the dispenser 200 once the cover 214 has been opened further to a point that a right portion of the cover contact surface 219 is beginning to contact a right portion of the second roll holder contact surface 242. The cover contact surface 242 is designed such that if the cover is opened further than shown in FIG. 7, the cover contact surface 242 prevents the second roll holders from pivoting further downward, which helps the maintainer avoid bending uncomfortably low to access the second roll holders 236. As shown in FIG. 7, a maintainer has sufficient access to remove the depleted second product roll 259 and replace it with a full second product roll (preferred), or even a second product roll that has already had some paper product removed. If the cover 214 is opened further than shown in FIG. 7 (such as shown in FIG. 8), the left portion of the cover contact surface 219 no longer is in contact with the left portion of the second roll holder contact surface 242. The left and right portions of the cover contact surface 219 and the second roll holder contact surface 242 are used for example description, and either contact surface may be a continuous surface without interruption or separation. Likewise, other means or structures can be used to accomplish the same or similar task of controlling the position of the second roll holders as they articulate out of the dispenser housing when the cover is opened.

FIG. 8 is a section view of the dispenser 200 that shows that the cover 214 has opened further, yet as previously described the cover contact surface 219 and the second roll holder contact surface 242 have maintained a position of the second roll holders 236 that is easy for the maintainer to access. FIG. 8 shows that a maintainer has removed the depleted second product roll, replaced it with a full second product roll 256, and reached over the full second product roll to load the leading edge of the second product roll into the second dispensing mechanism 226. The dispenser 200 is now ready for the maintainer to close the cover 214 as shown in FIG. 8.

Figure 9:
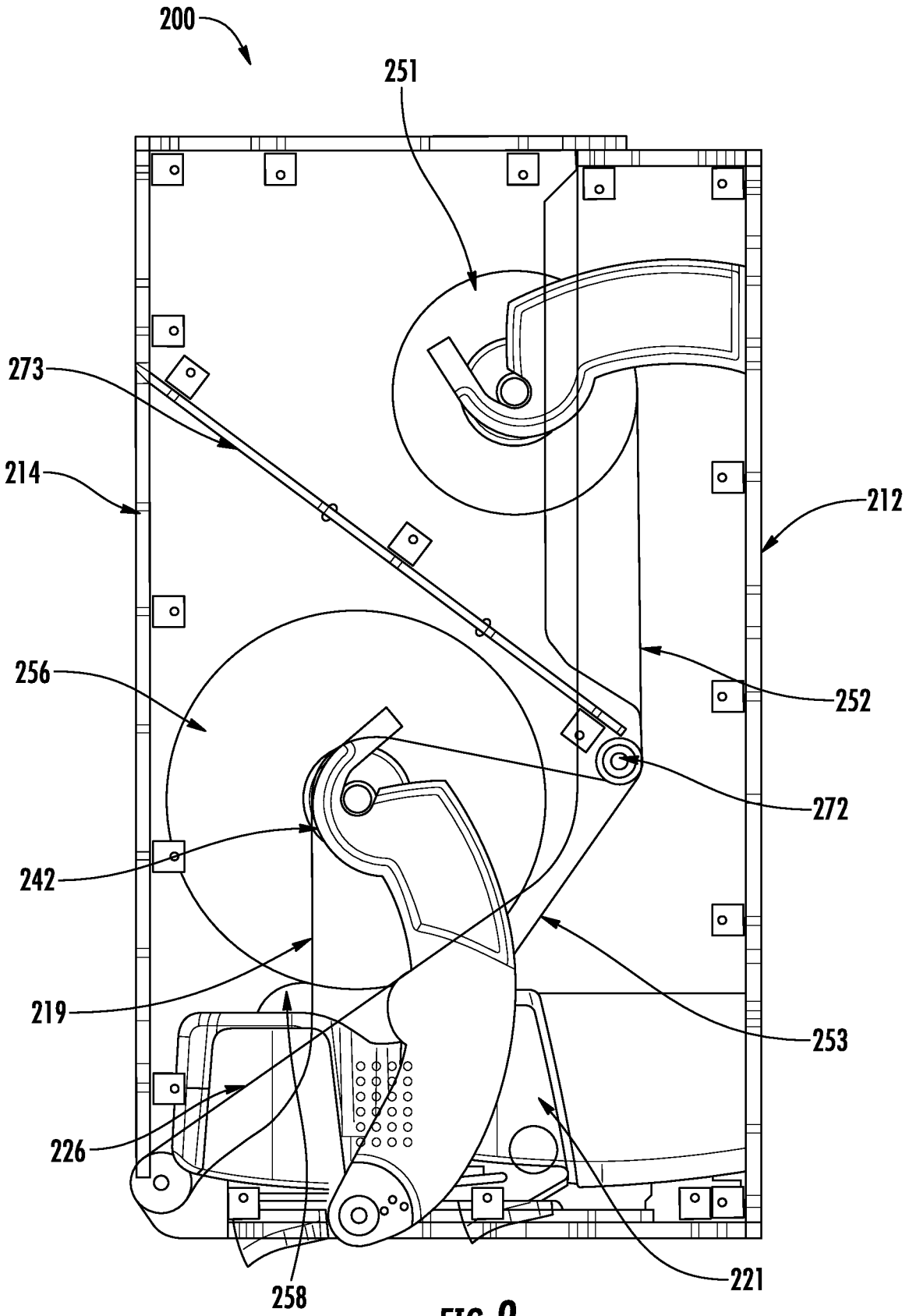

FIG. 9 shows the dispenser 200 replenished with a full second product roll 256 and with the cover 214 closed. In the depicted embodiment, the cover contact surface 219 is contacting, or at least in close proximity with, the second roll holder contact surface 242, which is designed to maintain a clearance between the cover 214 and the second product roll 256 in order to prevent interference as the second product roll 256 rotates during dispensing. In FIG. 9, the leading edge 253 of the first product roll 251 is loaded into the first nip funnel (not shown) of the first dispensing mechanism 221, and the leading edge 258 of the second product roll 256 is loaded into the second nip funnel (not shown) of the second dispensing mechanism 226. Therefore, the dispenser 200 has the option of satisfying a dispense request by dispensing from either the first dispensing mechanism 221 or the second dispensing mechanism 226. As shown in FIG.

9, the first product roll 251 is smaller and contains less product than the second product roll 256, so in an example preferred embodiment the dispenser 200 would dispense from the first product roll 251 until it was depleted. The advantage is that, for any total fixed quantity of total product within the dispenser, dispensing from the smaller product roll first will preserve the larger product roll as a reserve and also create the soonest opportunity for the smaller product roll to deplete so that a maintainer may again replenish the dispenser. Giving the maintainer the soonest opportunity to replenish the dispenser will maximize the amount of product the dispenser contains between maintainer visits, which helps ensure the dispenser is stocked enough to meet user demands and helps reduce the frequency with which a maintainer must visit the dispenser to check product level. As described in greater detail herein, some embodiments of the present invention utilize product level sensors (e.g., fuel gauges, product remaining sensors, low product indicator sensors, etc.) and other sensors to help accomplish such a feature.

FIG. 9 also shows that when the cover 214 is closed, the cover roller 272 moves the webbing 252 leading from the first product roll 251 to the first dispensing mechanism 221 toward the rear housing 212 (e.g., the cover roller 272 acts as a web guide structure that guides the first web path 252). This helps prevent the first product roll web 252 from contacting the second product roll 256 or the second product roll web (e.g., the leading edge 258). It is beneficial to avoid contact, for example, if the first product roll web 252 contacted the second product roll 256, the first product roll web 252 may rotate the second product roll 256 when the first drive roller of the first dispensing mechanism 221 is energized to dispense a portion of product from the first product roll 251. If the second product roll 256 rotates without the second drive roller of the second dispensing mechanism 226 being energized, the second product roll web might accumulate and require increasing space within the dispenser until it encroaches on the first product roll web 252 and is drawn into the first nip of the first dispensing mechanism 221, at which time the second product roll web would be captured by both the first dispensing mechanism 221 and the second dispensing mechanism 226. This condition could prevent either dispensing mechanism from delivering product and may cause a failure (e.g., a jam scenario).

Other web guide structures are also contemplated by some embodiments of the present invention. For example, the illustrated dispenser also includes a cover divider plate 273 that separates the first product roll 251 from the second product roll 256 to further help avoid the product rolls or webs from contacting each other.

Figure 10:
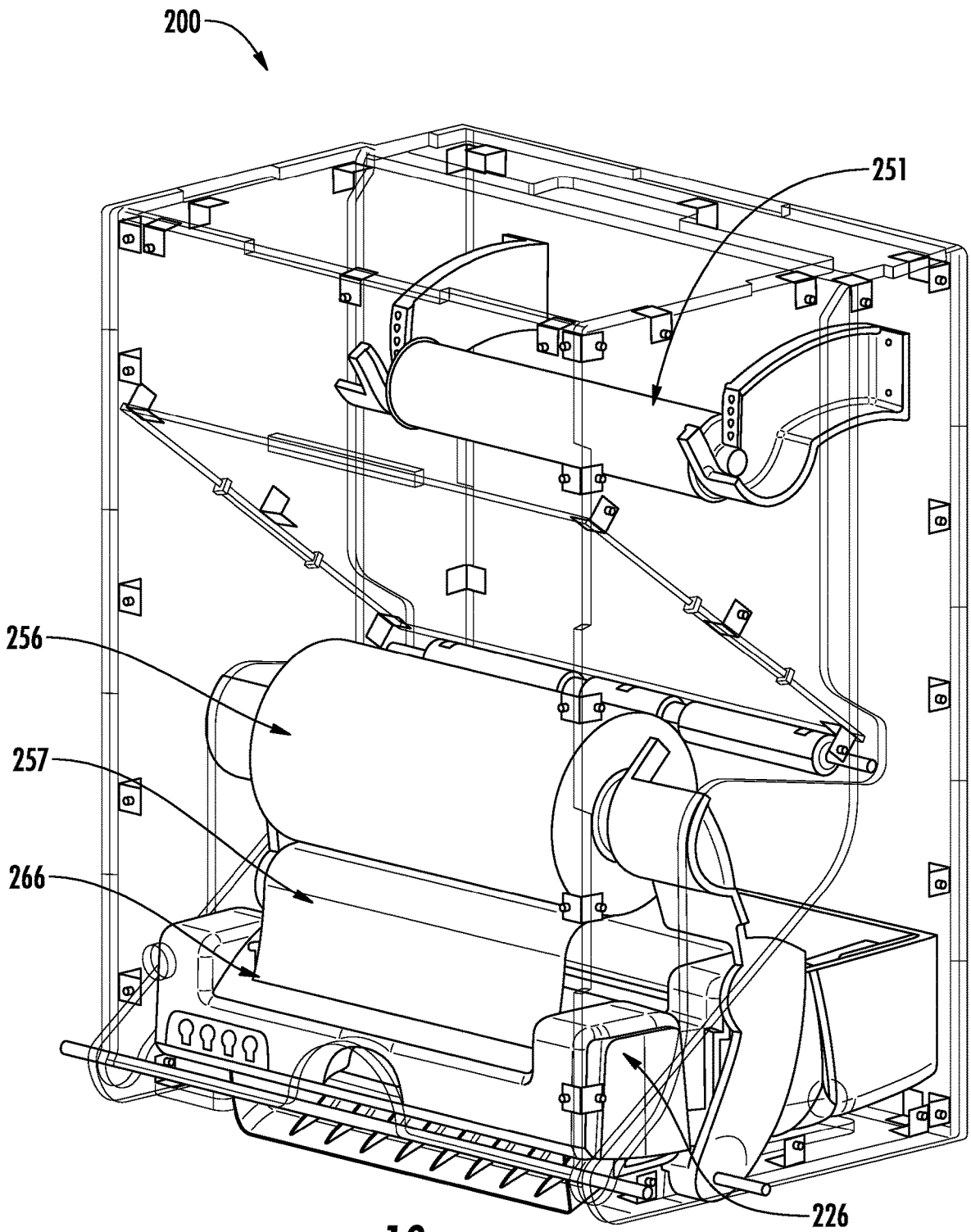

As previously mentioned, in an example embodiment, such as by using product level monitoring, the dispenser controller (e.g., controller 110 of FIG. 2) may cause dispensing to occur firstly from the smaller product roll (e.g., the first product roll 251 in FIG. 9) until the smaller product roll is depleted, at which time the dispenser satisfies user commands for product by dispensing from the reserve product roll (e.g., the second product roll 256 in FIG. 9). This subsequent condition is depicted in FIG. 10. The dispenser 200 shown in FIG. 10 is in a condition in which it is ready to be serviced again, as with FIG. 5. However, unlike FIG. 5, the first product roll 251 is depleted, and the second product roll 256 is a partial product roll with a second product roll web 257 that is fed into the second nip funnel 266 and the second nip of the second dispensing mechanism 226 for dispensing.

Figure 11:
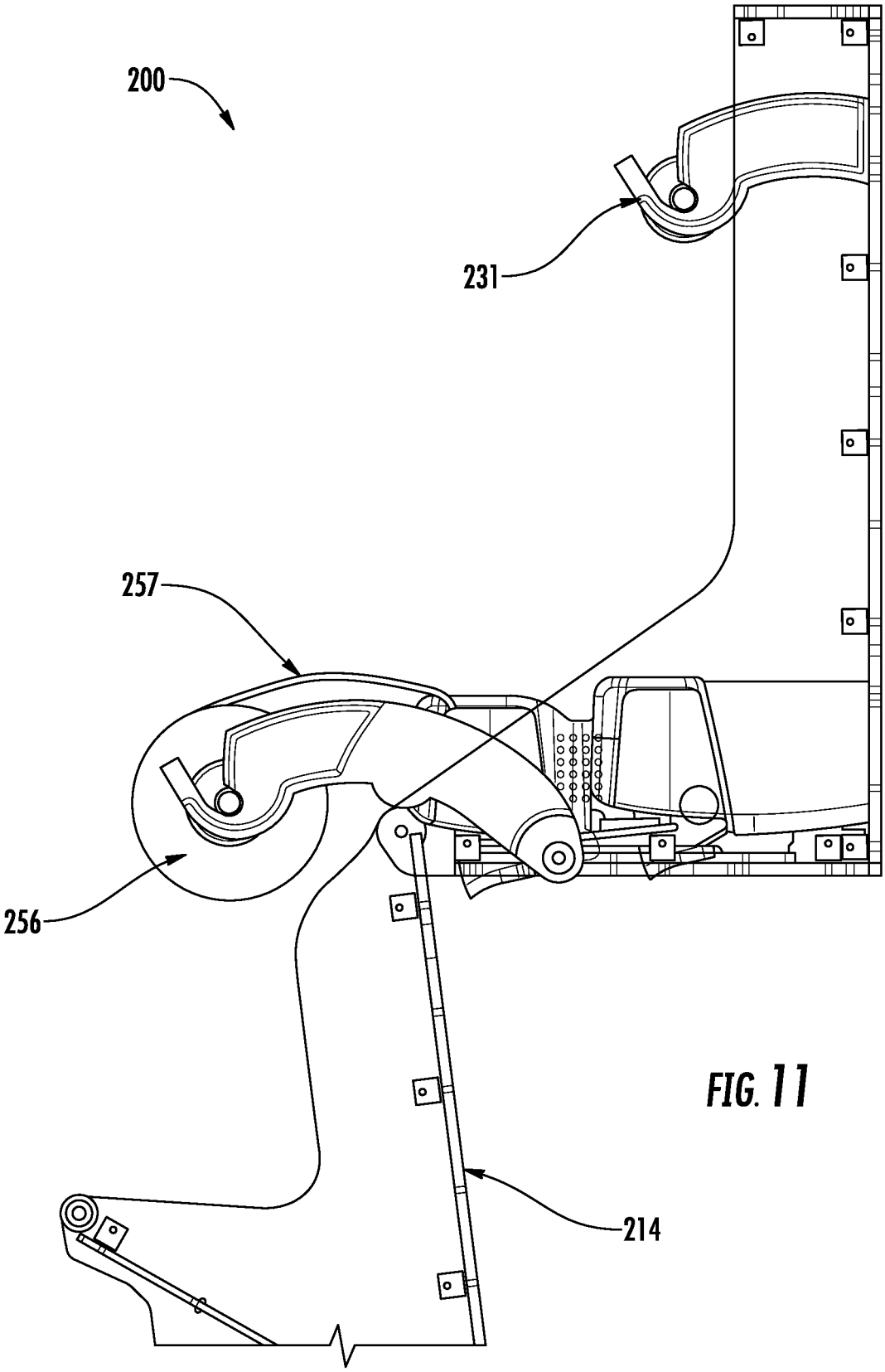

FIG. 11 shows the dispenser after a maintainer has opened the cover 214 to service the dispenser 200. The second product roll 256 and second product roll web 257 have lowered out of the way of the maintainer, so that the maintainer is unobstructed to remove the depleted first product roll from the first roll holder 231.

Figure 12:
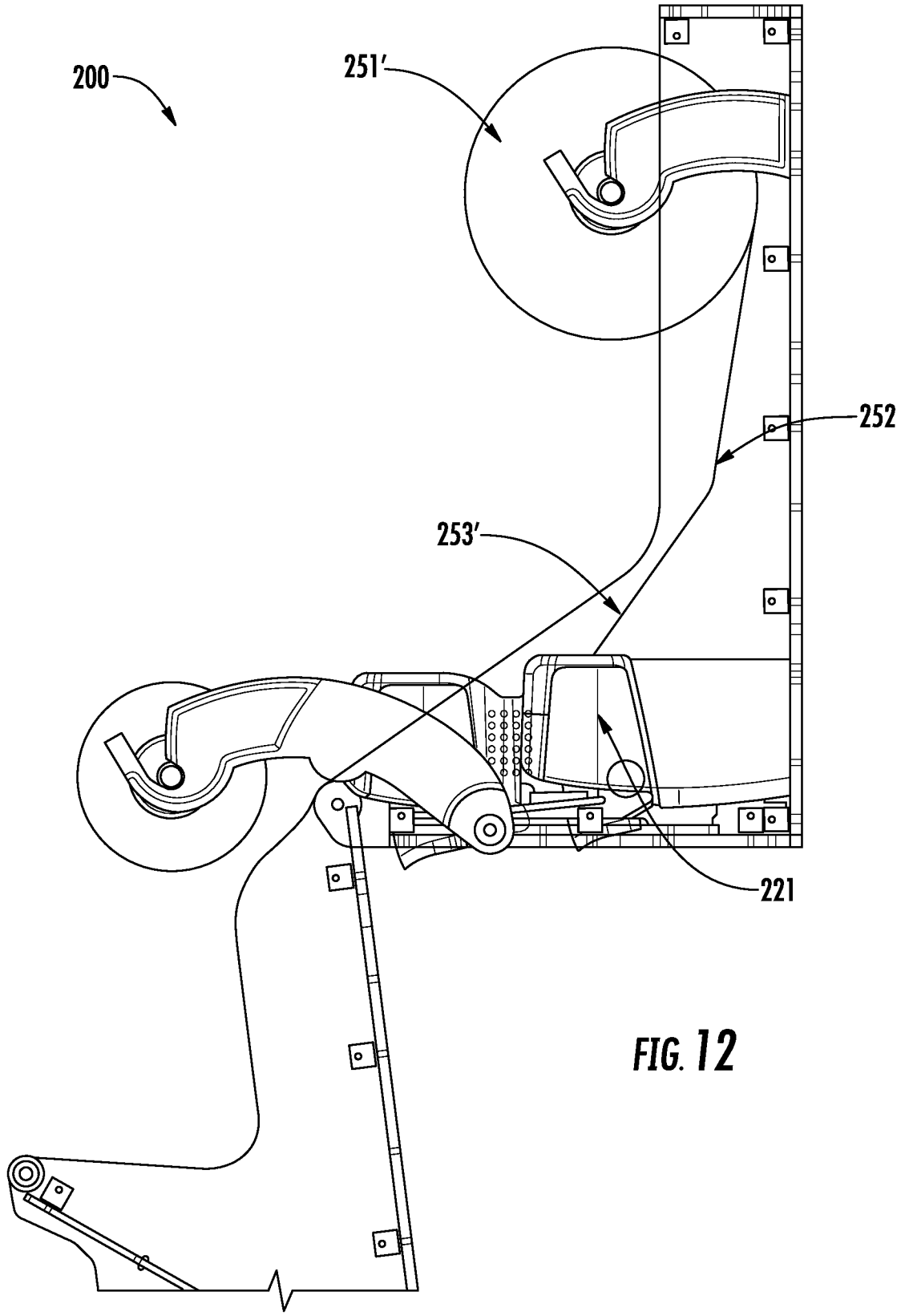

FIG. 12 shows the dispenser 200 after the maintainer has removed the depleted first product roll and replaced it with a full first product roll 251' and loaded the leading edge 253' of the first product roll into the first dispensing mechanism 221. Since the second roll holder 236 moved out from the inner volume of the dispenser 200, the maintainer was able to access the first web path 252 unobstructed by the second web path—thereby enabling loading of the leading edge 253' into the first dispensing mechanism 221.

Figure 13:
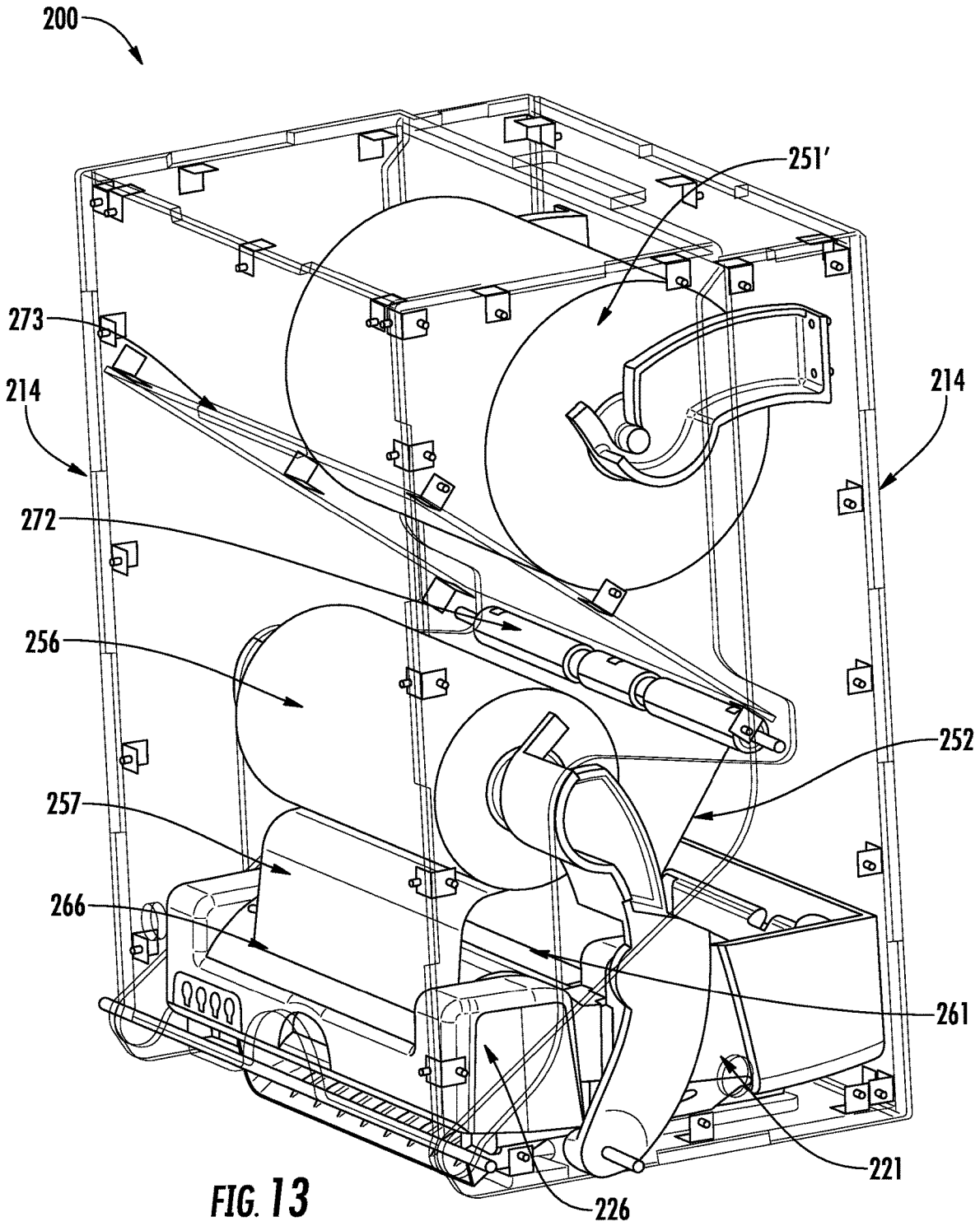

FIG. 13 shows the dispenser 200 replenished with a full first product roll 251' and with the cover 214 closed. The first product roll web 252 is loaded into the first nip funnel 261 of the first dispensing mechanism 221 and the second product roll web 257 is loaded into the second nip funnel 266 of the second dispensing mechanism 226. Since the second product roll 256 is smaller and contains less product than the first product roll 251', for the same principles that were previously described, in a preferred embodiment the dispenser 200 may initially satisfy user commands for product by dispensing from the second product roll 256 until it was depleted. After that, the dispenser may resume satisfying user commands for product by dispensing from the first product roll 251' and the dispenser 200 could be the condition shown in FIG. 5 in which the depleted product roll is available for a maintainer to replace.

FIG. 13 also shows that when the cover 214 is closed, the cover roller 272 moves the first product roll web 252 toward the rear housing 212. FIG. 13 further shows the cover divider plate 273 that separates the first product roll 251' from the second product roll 256. As previously described, both of these features may help prevent the product rolls and roll webs from contacting each other and potentially causing the dispenser to fail.

In some embodiments, a beneficial feature of the dispenser is that the roll holders for one of the product rolls moves out of the dispenser when the cover is open. This allows a user to replace and load either product roll into the dispensing mechanism without disturbing or being obstructed by the other product roll, the other product roll web, or any dispenser components. This also enables a maintainer to service the dispenser without confusion or unnecessary effort. Further, the dispenser may be a compact size while still containing up to two full-sized rolls.

Movable Roll Holders

Some embodiments of the present invention provide movable roll holders to enable the benefits of a compact-sized dispenser that contains up to 2 full-size rolls while still enabling the maintainer to have easy access to replace and load either roll without disturbing or being obstructed by the other product roll, the other product roll web, or dispenser parts. The example dispenser illustrated in FIGS. 5-13 includes a second roll holder that moves by pivoting about a stationary pivot point connected to the rear housing. There are many additional embodiments of movable roll holders that enable convenient access to either roll, some of which are described herein.

Stationary Mounted Movable Roll Holder Via the Cover

Figure 14:
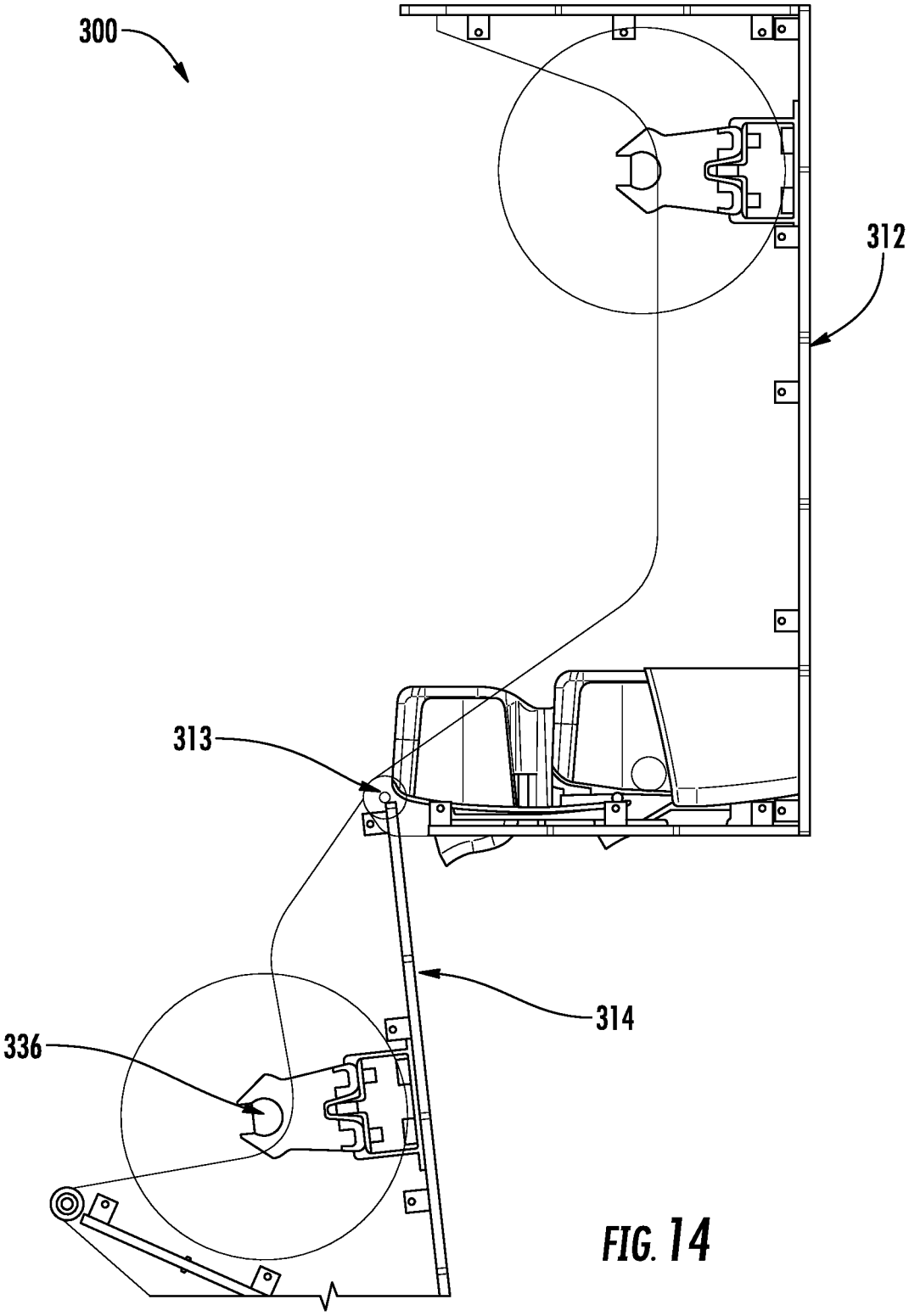
FIGS. 14-15 show an example product dispenser with second (bottom) roll holders attached to the cover, in accordance with example embodiments described herein.

FIG. 14 shows a first example embodiment of "roll-in-lid" dispenser. The illustrated dispenser 300 includes a cover 314 that is pivotally connected to the rear housing 312 with a cover hinge 313. Further, the second roll holder 336 is mounted to the inside of the cover 314 (thus called "roll-in-lid"). The second roll holder 336 is also pivotally connected to the rear housing 312 via the cover hinge 313. FIG. 14 shows that a maintainer may replace and load either product roll and roll web without disturbing the other product roll or roll web.

Figure 15:
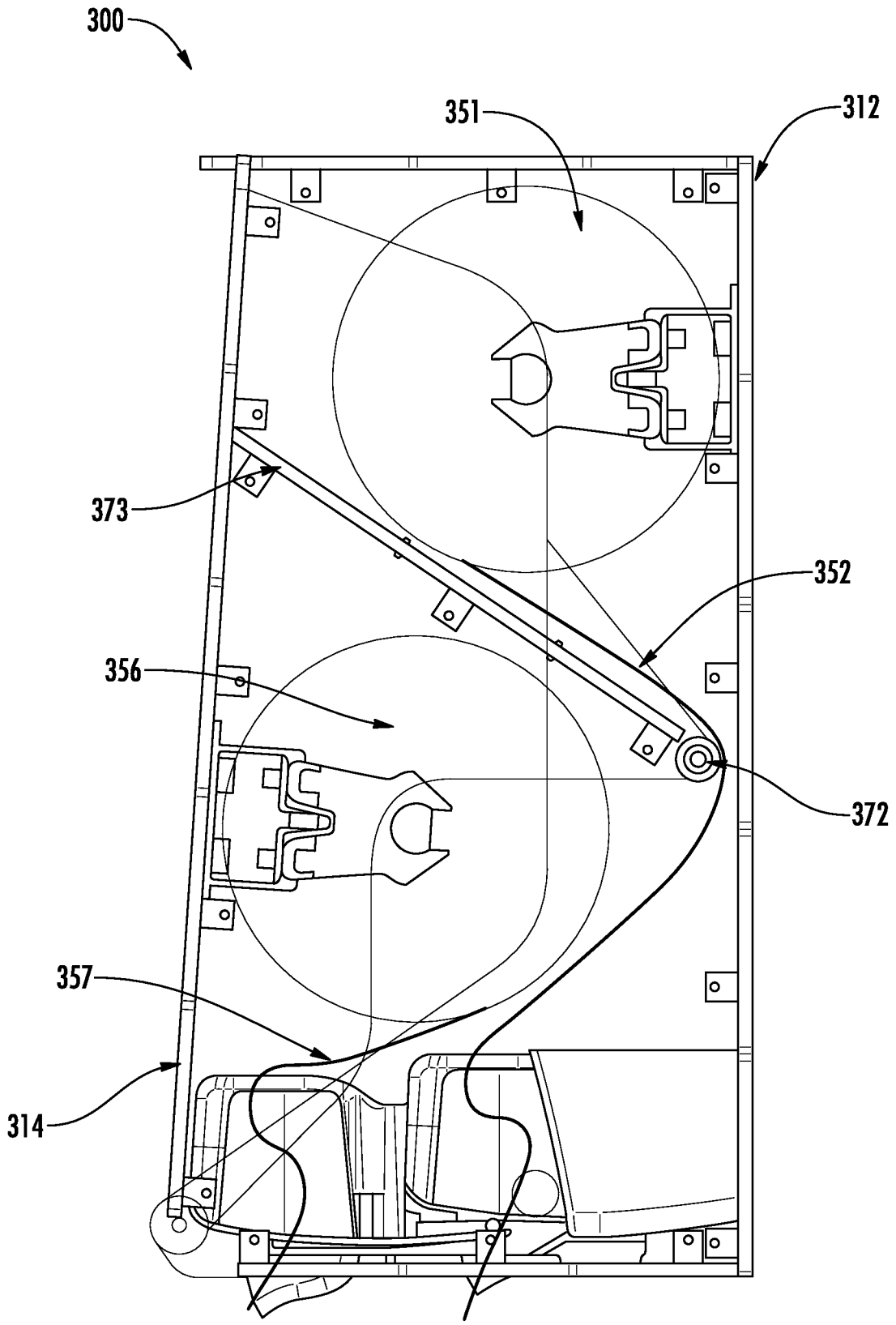

FIG. 15 shows the dispenser 300 with the cover 314 closed. With the cover 314 closed, the cover roller 372 restricts the first roll web 352 toward the rear housing 312, helping separate the first roll web 352 from contacting the second roll 356 or second roll web 357. The cover divider plate 373 further helps separate the first roll web 352 from the second product roll 356 and second roll web 357.

Figure 16:
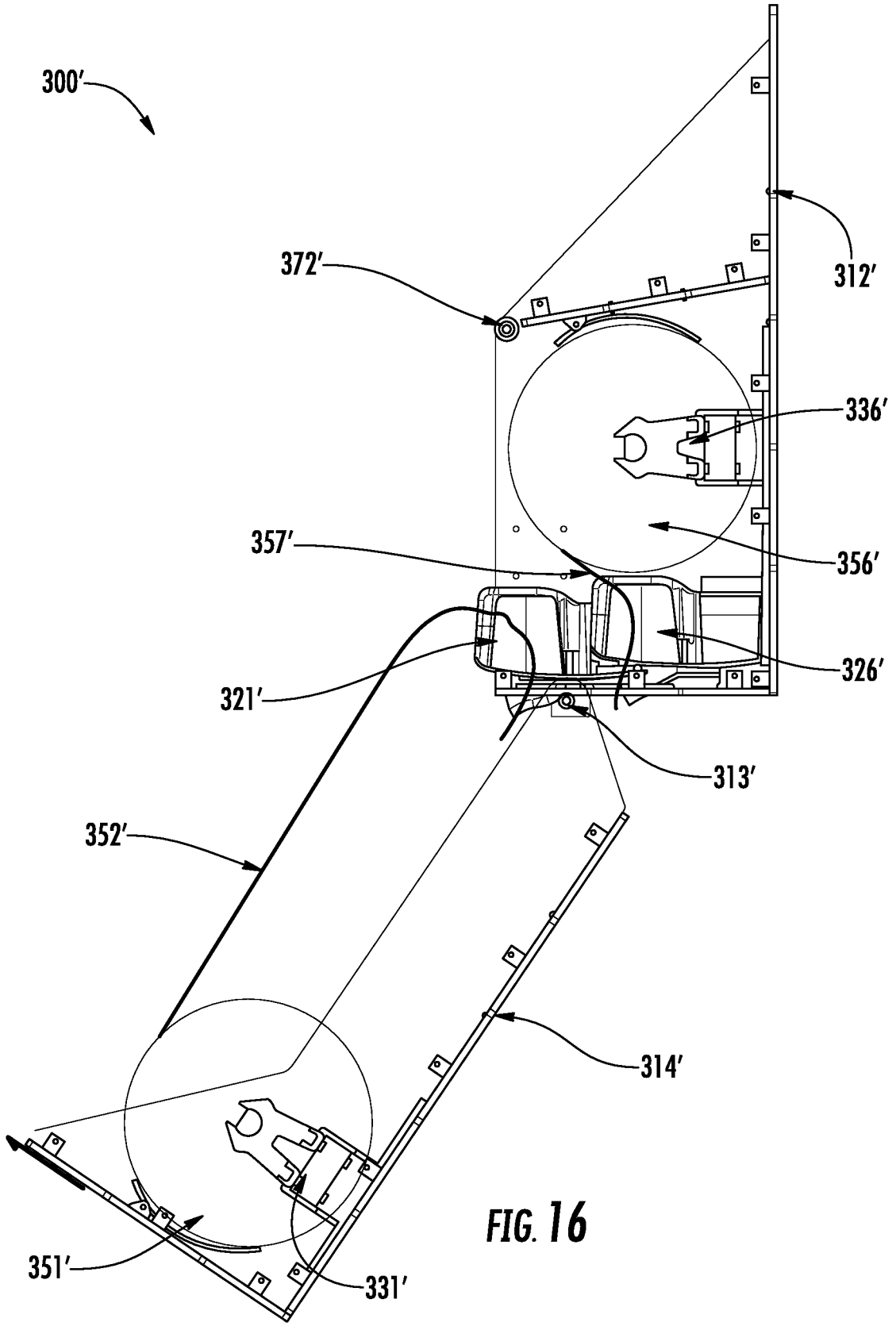
FIGS. 16-17 show another example product dispenser with first (top) roll holders attached to the cover, in accordance with example embodiments described herein.

FIG. 16 shows a second example embodiment of the "roll-in-lid" concept in which the dispenser 300' includes a cover 314' that is pivotally connected to the rear housing 312' with a cover hinge 313'. However, instead of the second roll holder 336' being mounted to the inside of the cover 314', the first roll holder 331' is mounted to the cover. In the depicted embodiment, the position of the cover roller 372' is converted to be attached to and extending from the rear housing (e.g., base portion) 312'. Likewise, the first web path 352' is proximate the front of the dispenser housing and interacts with the first dispensing mechanism 321', which is located near the front of the dispenser 300'. FIG. 16 shows that a maintainer may replace and load either product roll and roll web without disturbing the other roll or roll web when the cover is open. Such an example embodiment may enable low complexity and still allow for easy loading of either product roll by the maintainer.

Figure 17:
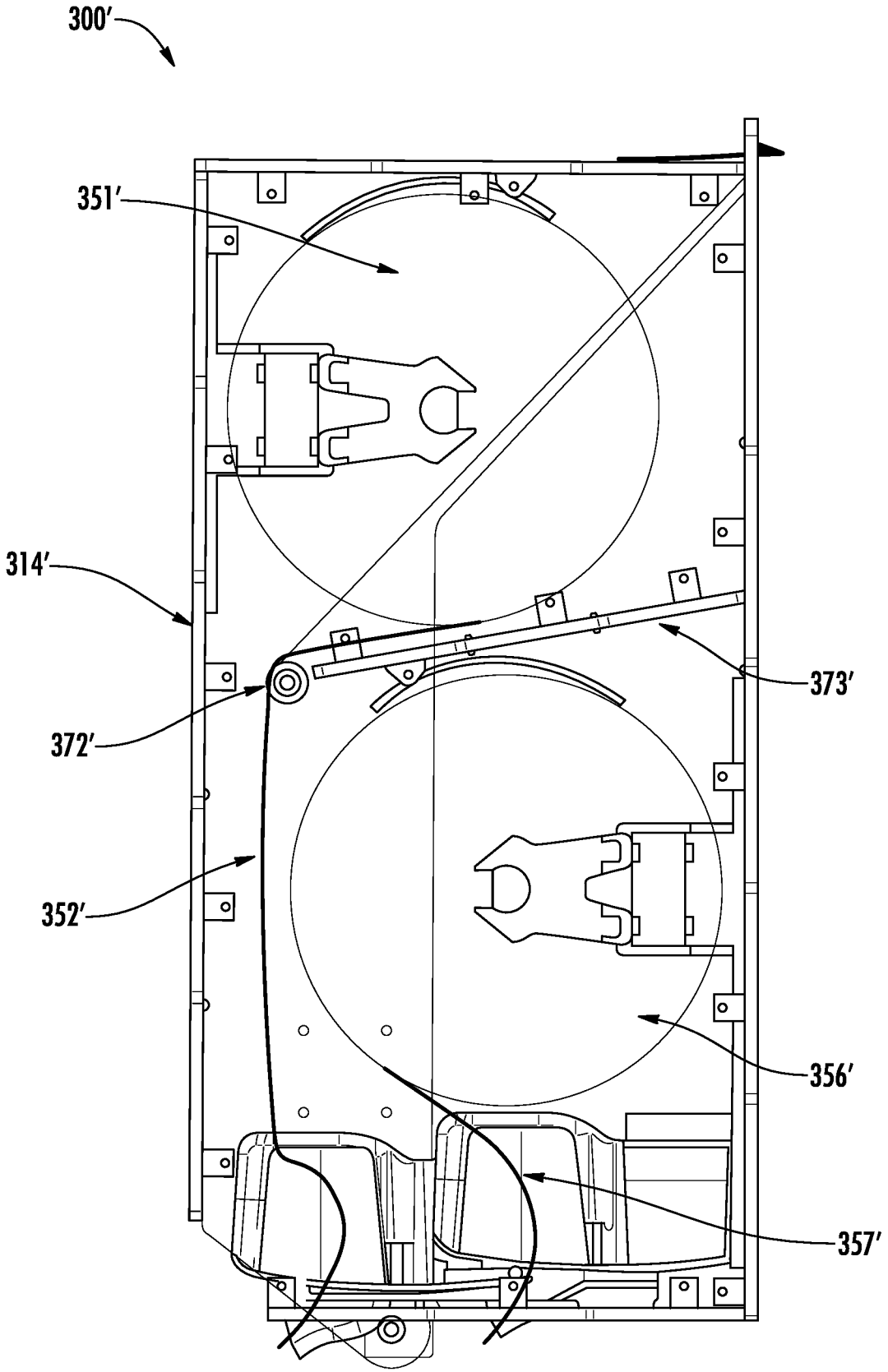

FIG. 17 shows the second embodiment of the "roll-in-lid" concept in which the maintainer has closed the cover 314'. With the cover 314' closed, the cover roller 372' restricts the first product roll web 352' toward the cover 314', helping separate the first product roll web 352' from contacting the second product roll 356' or second product roll web 357'. The housing divider plate 373' further helps separate the first product roll web 352' from the second product roll 356' and second product roll web 357'.

Bottom Roll Holder and Dispensing Mechanism Pivotally Attached

Figure 18:
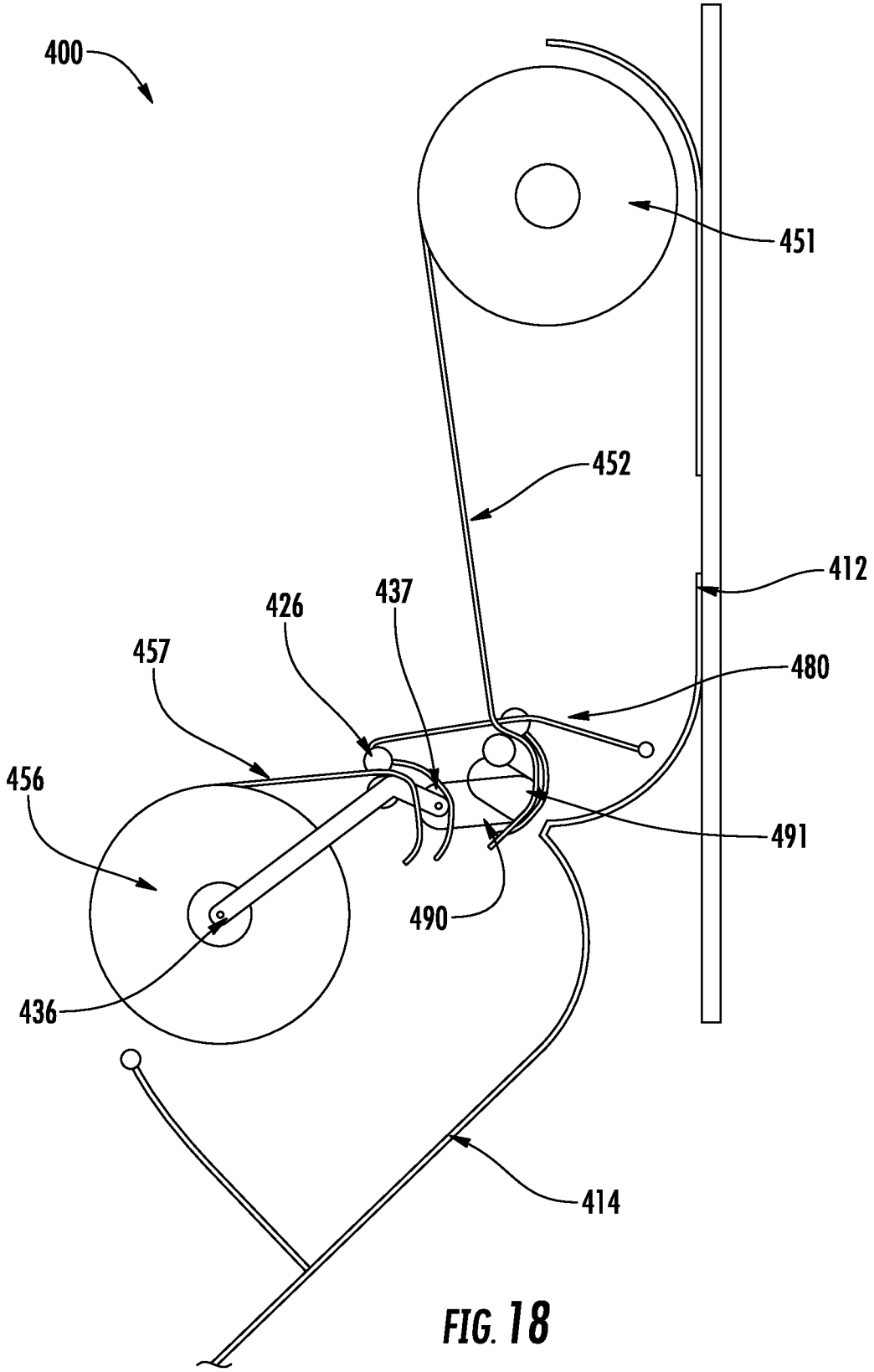
FIGS. 18-19 show another example product dispenser with second (bottom) roll holders and a corresponding chassis that are pivotally attached to a base portion of the product dispenser, in accordance with example embodiments described herein.

FIG. 18 shows another example embodiment of a dispenser 400 that holds a first product roll 451 and a second product roll 456. A first web path 452 leads to a first dispensing mechanism 421 and a second web path 457 leads to a second dispensing mechanism 426. Notably, the second dispensing mechanism 426 (or a portion thereof) is disposed on a chassis 490 that is pivotally coupled to the rear housing 412 with a chassis hinge 491. In the depicted embodiment, and the dispenser 400 further includes second roll holders 436 that are pivotally coupled to the chassis 490 with a second roll holder hinge 437. With reference to FIG. 18, when the cover 414 is opened, the maintainer may pivot the chassis 490 out of the housing, such as around the chassis hinge 491 to provide better access for loading sheet product into the first dispensing mechanism 421. Additionally, when the cover 414 is opened, the chassis 490 may remain inside the housing to enable the maintainer to easily load sheet product into the second dispensing mechanism. In this regard, when the cover 414 is open, a maintainer may decide whether to pivot the chassis out of the housing and, thus, replace and load either product roll and roll web. In some embodiments, the chassis may be configured to automatically pivot out of the housing as the cover is opened. In such an embodiment, the maintainer may replace and load either product roll and roll web without disturbing the other roll or web. In some embodiments, the chassis may be configured to automatically pivot out of the housing as the maintainer pivots the second roll holders 436 out of the rear housing 412 (e.g., the second roll holders 436 and chassis may be connected to pivot together or in response to one or the other being pivoted). In such an embodiment, the maintainer may likewise replace and load either product roll and roll web without disturbing the other roll or web.

Figure 19:
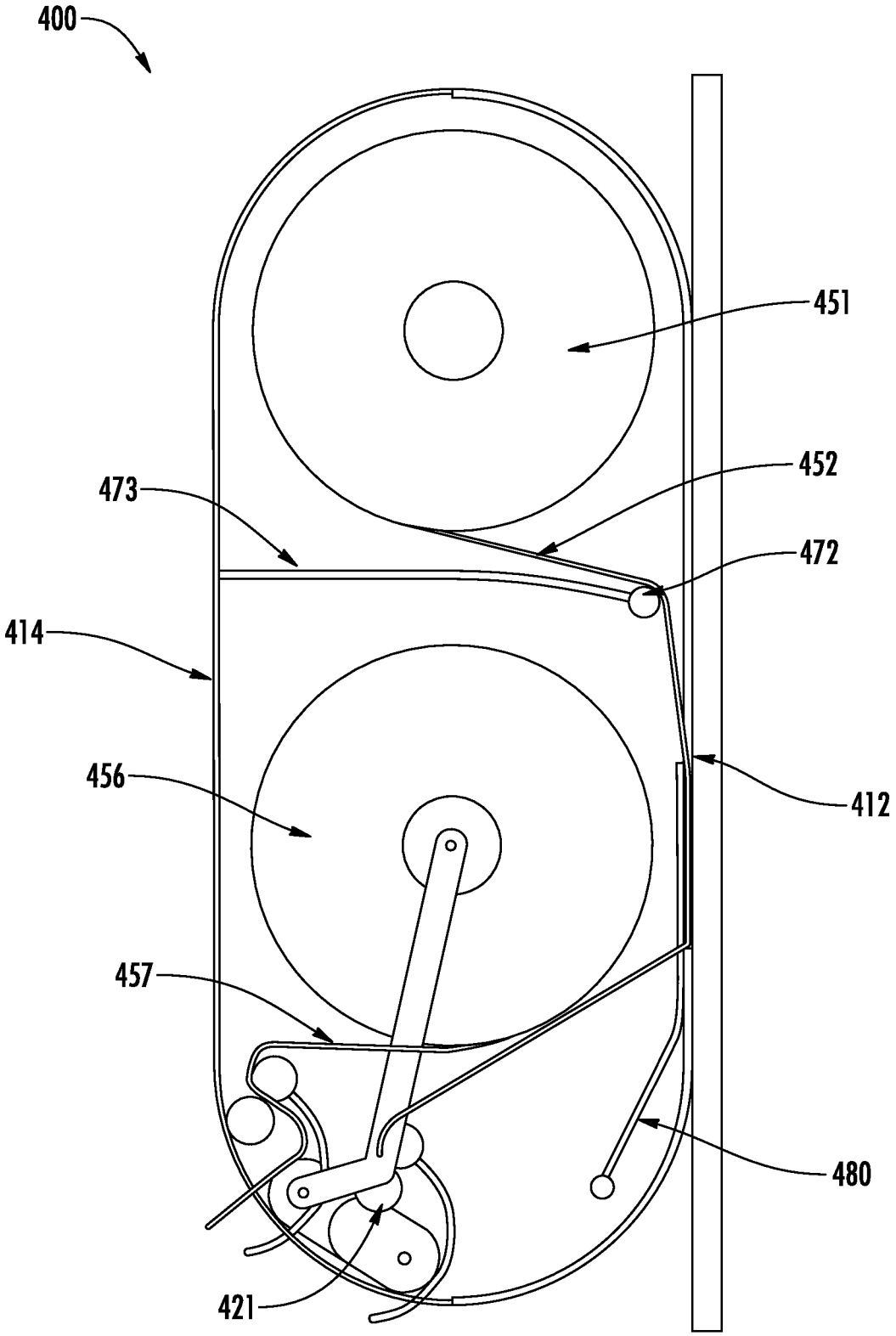

FIG. 19 shows the embodiment of the dispenser 400 shown in FIG. 18 with the cover 414 closed. With the cover 414 closed, the cover roller 472 restricts the first roll web 452 toward the housing 412, helping separate the first roll web 452 from contacting the second product roll 456 or second roll web 457. The cover divider plate 473 further helps separate the first roll web 452 from the second product roll 456 and second roll web 457. The depicted embodiment also includes a nesting arm 480 that further helps separate the first roll web 452 from the second roll web 457. Indeed, with reference to FIG. 19, the nesting arm 480 has a length that causes it to, when positioned vertically in the dispenser housing, extend upwardly such that a web path is created that leads the first roll web 452 around a cover roller 472 and on the side of the nesting arm 480 opposite the second product roll 456. A hole within the nesting arm 480 enables the first roll web 452 to then be directed around the second product roll 456 and into the first dispensing nip 421. By enabling the chassis 490 to pivot out of the housing, the nesting arm 480 may have sufficient length to separate the two roll webs, as the nesting arm 480 is also enabled to pivot, at least, partially out of the footprint of the housing. To explain, with reference to FIG. 18, the nesting arm 480 extends at a length that would cover the nip of the second dispensing mechanism 426 if the chassis 490 did not otherwise pivot forward out of the dispenser housing. However, by pivoting the chassis 490 forward, the maintainer still has access to load the sheet product from the second product roll 456 into the second dispensing mechanism 426. In some example embodiments, a cover contact surface, a second roll holder contact surface, or other suitable means (not shown) may be provided to urge the second roll holder and the chassis to pivot toward the rear housing when the cover is closed.

Bottom Roll Holder Pivotally Attached to Base Portion and Separate from Cover

As noted herein, some embodiments of the present invention contemplate different ways to manage two separate web paths and still enable a maintainer (or other user) to easily load either product roll and load the corresponding leading edge into the proper dispensing mechanism. In this regard, some embodiments utilize a configuration where the second (e.g., bottom) roll holder is pivotally attached to the base portion (e.g., rear housing) and separate from the cover. In this regard, the movement of the second roll holder can be distinct from the cover even if not (in some cases) independent from movement of the cover. The following description details a number of different embodiments that utilize such a configuration.

Figure 20A:
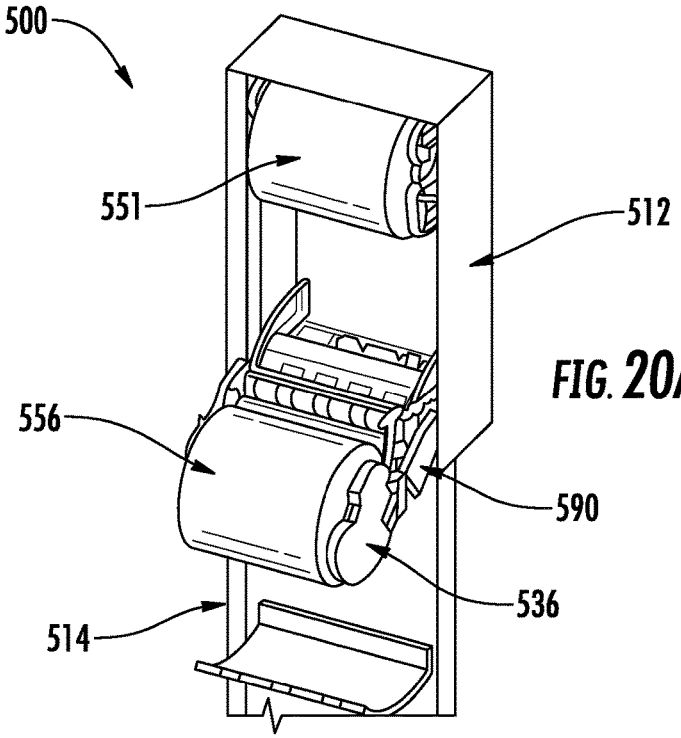
FIGS. 20A-20D show another example product dispenser that is configured to include a movable roll holder, in accordance with example embodiments described herein.
Figure 20B:
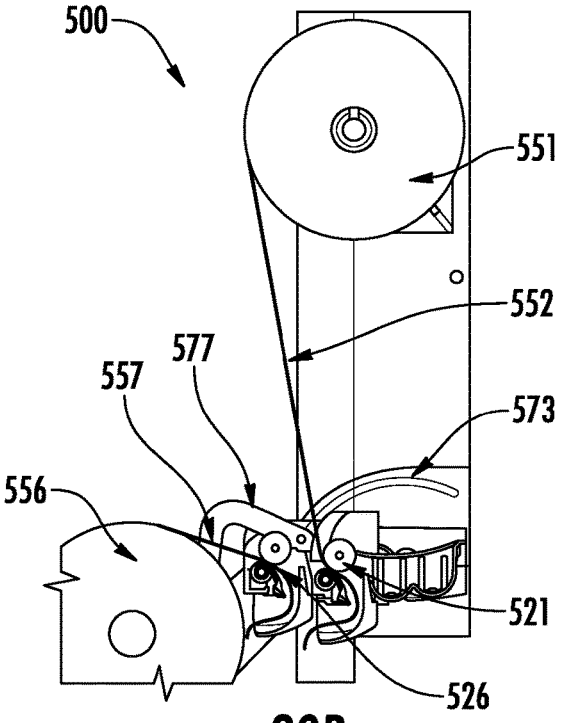
Figure 20C:
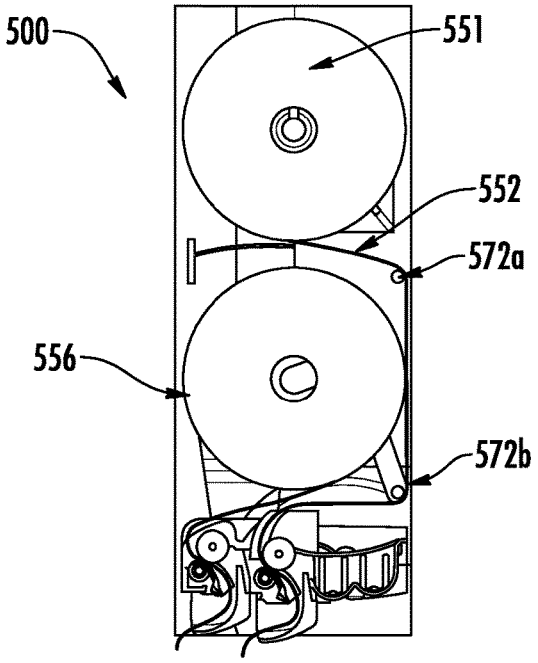

FIGS. 20A-20D illustrate an example embodiment of a dispenser with a movable roll holder. In particular, the dispenser includes a pivoting second (bottom) roll holder that "flips" out when the cover is opened. The dispenser 500 shown in FIG. 20A holds a first product roll 551 and a second product roll 556. Further, the dispenser 500 includes a second roll holder 536 that is attached to the base portion 512 with a pivot arm 590 and configured to move between a first position (shown in FIG. 20C) and a second position (shown in FIG. 20B). Notably, the second roll holder 536 is separate from the cover 514, but still moves out of the way when the cover 514 is in the open position such that the maintainer can load either the top or bottom product roll and can easily load the leading edge of either the first (top) product roll 551 (e.g., web path 552) into the first dispensing mechanism 521 or second (bottom) product roll 556 (e.g., web path 557) into the second dispensing mechanism 526. With reference to FIG. 20C, two rollers 572*a*, 572*b* near the rear housing 512 (one in the middle and one near the bottom) are used to guide the first web path 552 around the second (bottom) roll 556. Such rollers (e.g., web guide structures) can be either attached to the cover or pivotally attached to the second roll holder 536 such that they move out of the way when the cover 514 is open, but back into position to separate the web paths when the cover 514 is closed. For example, the second roller 572*b* may be attached to a link arm 577 that is connected with the second roll holder 536 and configured to move as prescribed by a slot 573 and along with rotation of the second roll holder 536. The link arm 577 may be configured to rotate out of the way of a nip 561 for the first dispensing mechanism 521 when the second roll holders 536 are rotated out of the dispenser housing. In this regard, a maintainer may have access to load the leading edge of the first product roll 551 into the first dispensing mechanism 521.

Figure 20D:
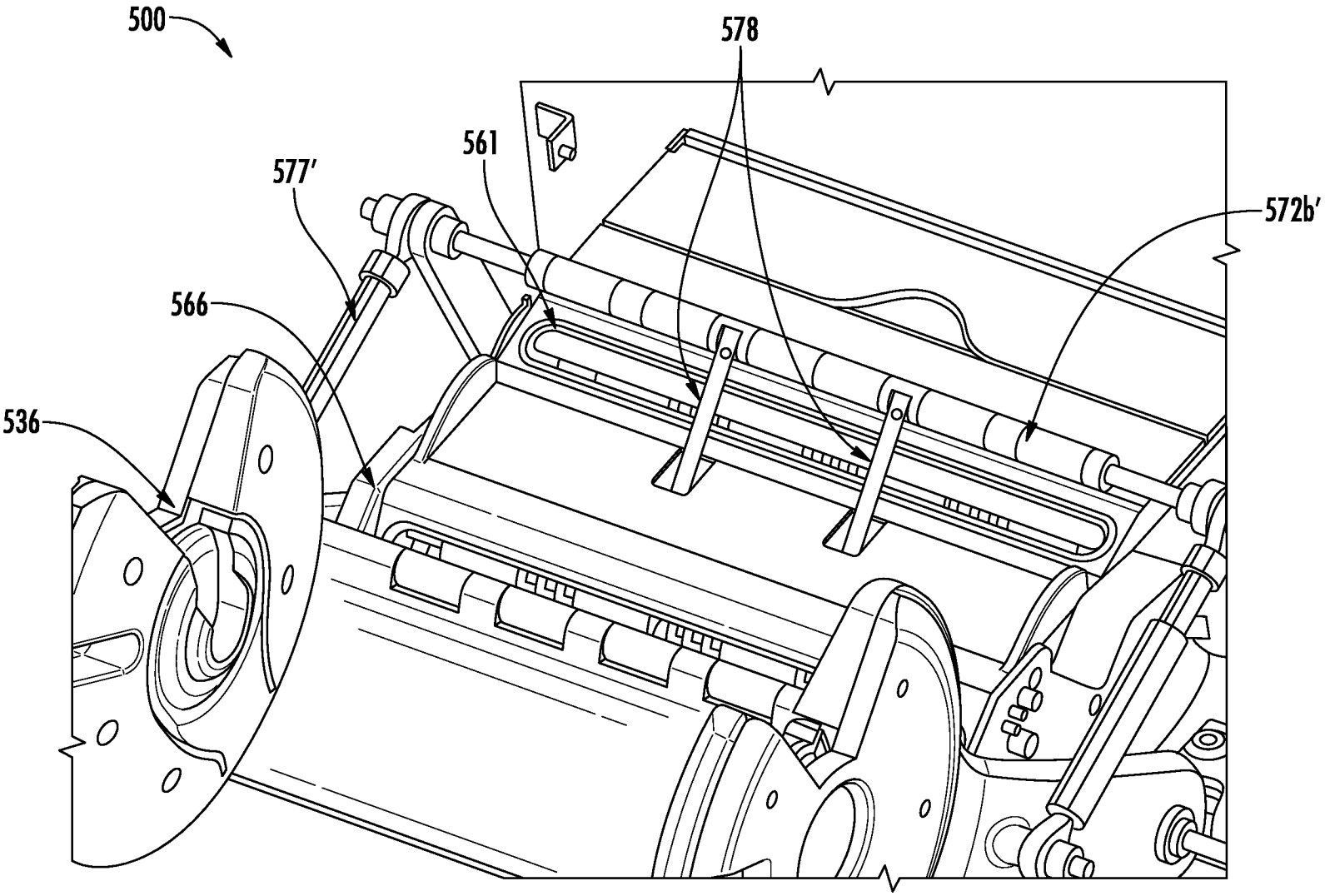

FIG. 20D illustrates another example embodiment that is similar to the embodiment shown and described with respect to FIGS. 20A-20C, however, the link arm 577' is attached to a web guide roller 572*b*' that is attached to two web dividers 578 that are fixed to the dispenser chassis and configured to extend and retract with movement of the link arm 577'. In some embodiments, the web dividers 578 are designed to separate the web paths for the first product roll 551 and the second product roll 556. For example, though not shown in FIG. 20D, the web dividers 578 may be positioned in between sheet product from the first product roll 551 extending from the roll into the nip 561 of the first dispensing mechanism 521 and sheet product from the second product roll 556 extending from the roll into the nip 566 of the second dispensing mechanism 526. Additionally, in some embodiments, the web dividers 578 may be force springs that are biased to pull the web guide roller 572*b* forward. Additionally or alternatively, the web dividers 578 may be formed of electrically conductive material and may provide a path to ground for static buildup that occurs as the paper towel contacts the web dividers 578.

Additionally, in the depicted embodiment, the link arm 577' comprises a piston that is configured to extend the range of travel of roll holders 536' while still enabling retraction within the dispenser housing when the cover is closed. In this regard, the designed motion of the link arm 577' and web guide roller 572*b*' can be maintained while still enabling the roll holders 536' to extend and retract as needed.

Figure 21:
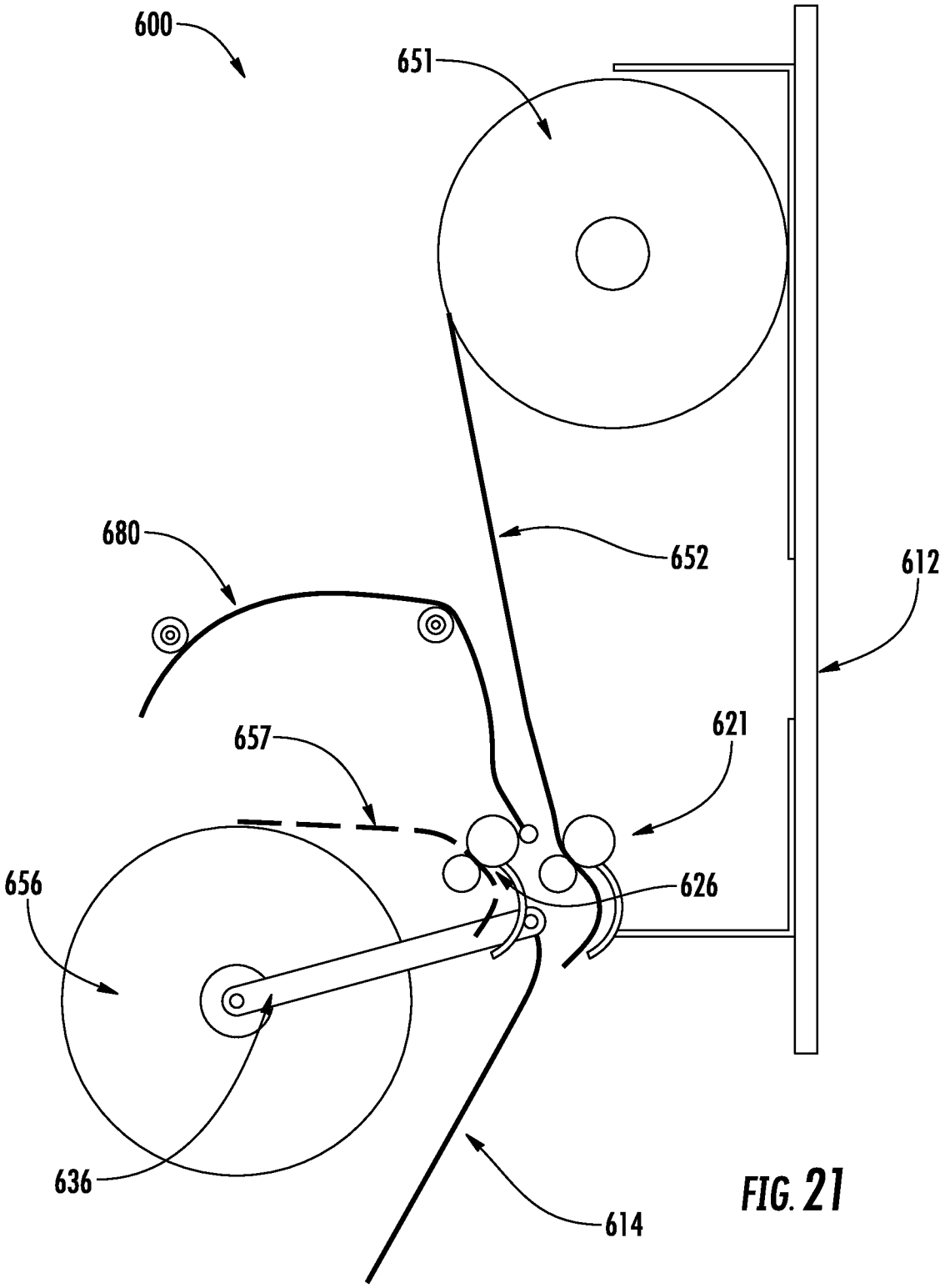
FIGS. 21-23 show another example product dispenser that is configured to include a movable roll holder and a movable web guide feature, in accordance with example embodiments described herein.

FIGS. 21-24B illustrates an example embodiment with dispenser that includes a movable roll holder and movable web management structure. The dispenser 600 shown in FIG. 21 holds a first product roll 651 and a second product roll 656 and includes a second roll holder 636. The second roll holder 636, like the embodiment described with respect to FIGS. 20A-D, is pivotally mounted to the base portion 612 such that it can pivot out of the housing in a suitable manner when the cover 614 is opened. The embodiment in FIG. 21, however, further includes a pivoting arm 680 that is pivotally coupled to the base portion 612 at a location between the first dispensing mechanism 621 and the second dispensing mechanism 626. When the cover 614 is opened, the pivoting arm 680 pivots away from the base portion (rear housing) 612 to a position such as shown in FIG. 21, at which point a maintainer may load a first roll web 652 from a first product roll 651 into a first dispensing mechanism 621 and/or may load a second roll web 657 from a second product roll 656 into a second dispensing mechanism 626. Since the pivoting arm 680 is pivotally coupled to the housing at a point between the first dispensing mechanism 621 and the second dispensing mechanism 626, it is not practical for the maintainer to erroneously load a roll web into the wrong dispensing mechanism (e.g., the maintainer must load the appropriate leading edge of the product roll into the appropriate dispensing mechanism on either side of the pivoting arm).

Figure 22:
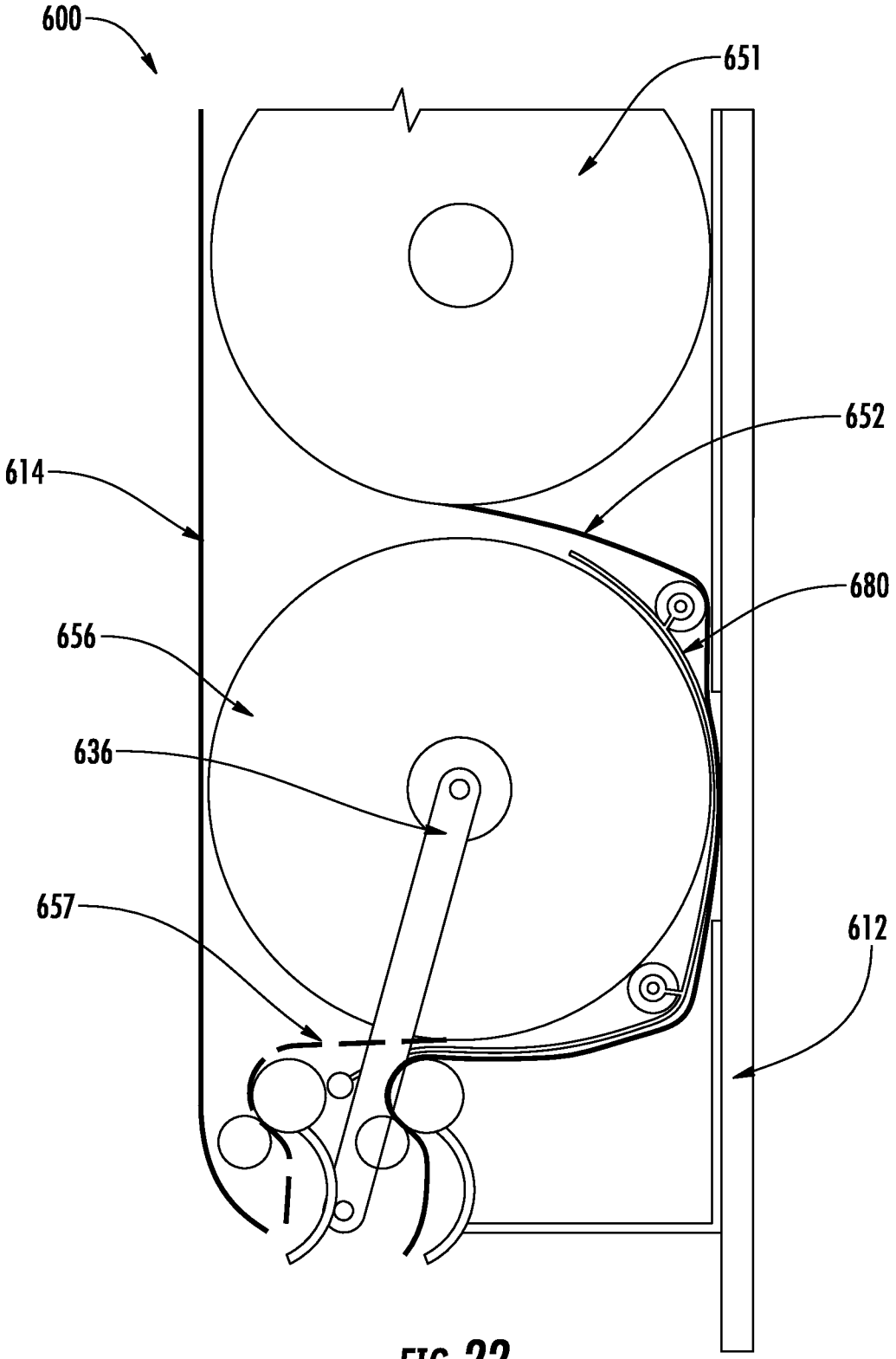

Once the dispenser is loaded, the maintainer may subsequently close the cover 614 which thereby moves the second roll holder 636 toward the rear housing 612. Furthermore, closing the cover 614 causes the pivoting arm 680 to be urged toward the rear housing 612, as shown in FIG. 22. The pivoting arm 680 may be urged toward the rear housing 612 by one or more means such as contact between the second roll 656 and the pivoting arm 680; contact between the second roll holders 636 and the pivoting arm 680; contact between the cover 614 and the pivoting arm 680; or other suitable coupling. FIG. 22 illustrates that once the cover 614 is closed, the pivoting arm 680 separates the first roll web 652 from the second product roll 656 and second roll web 657, thereby mitigating the risk of dispenser failure due to such contact.

Figure 23:
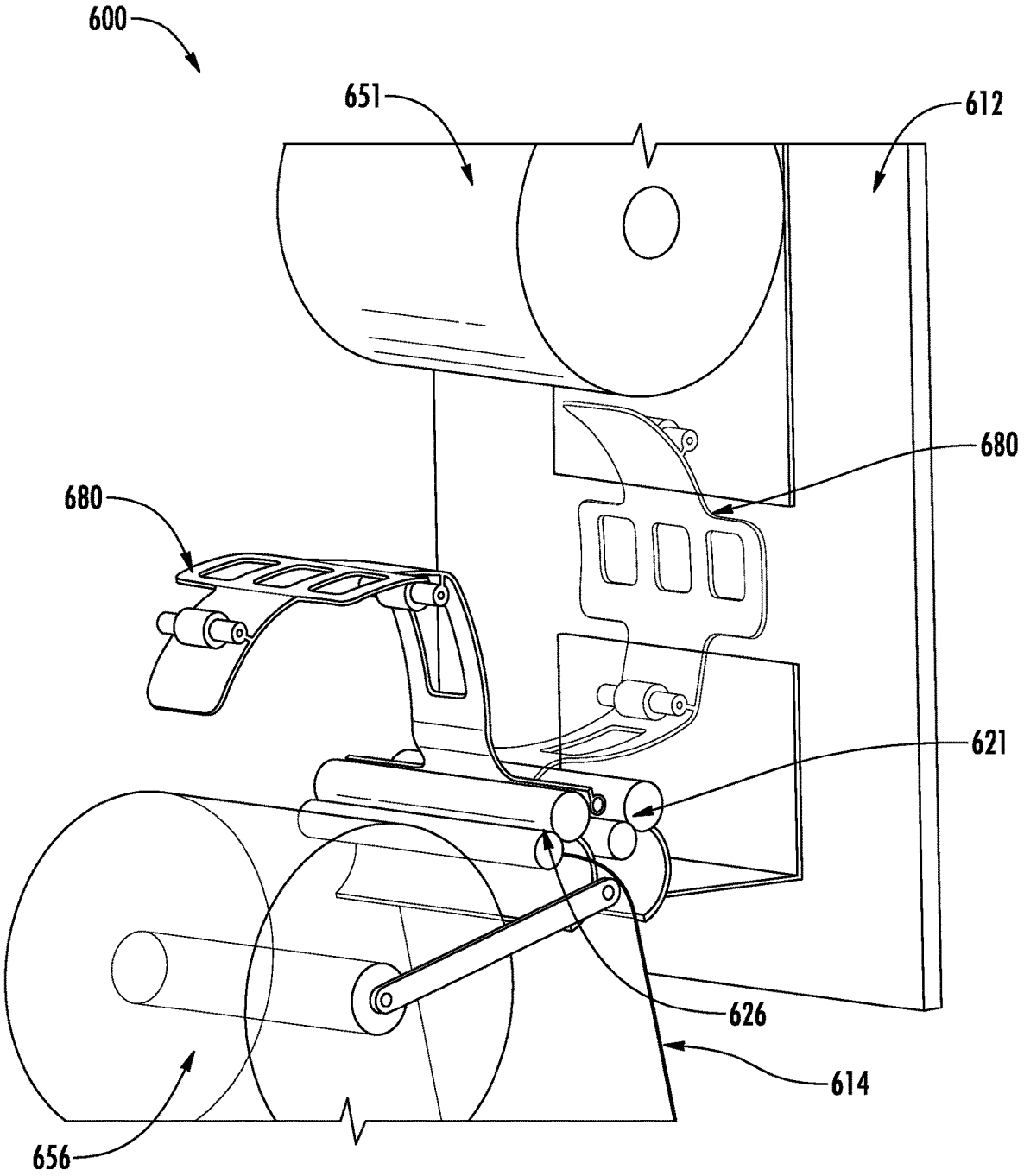

As shown in FIG. 23, the pivoting arm 680 allows the maintainer access to reach around either side of the pivoting arm 680 to load the first roll web 652 into the first dispensing mechanism 621 or to load the second roll web 657 into the second dispensing mechanism 626. FIG. 23 shows the pivoting arm 680 both in the extended position during loading, as well as in outline form while in the retracted position when the cover 614 is closed.

Figure 24A:
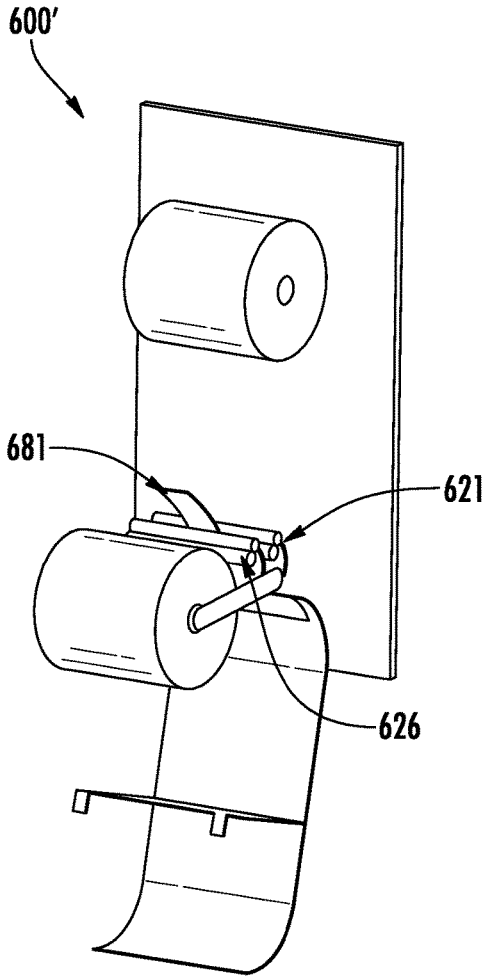
FIGS. 24A-24B show another example product dispenser that is configured to include a movable roll holder and a movable web guide feature, in accordance with example embodiments described herein.
Figure 24B:
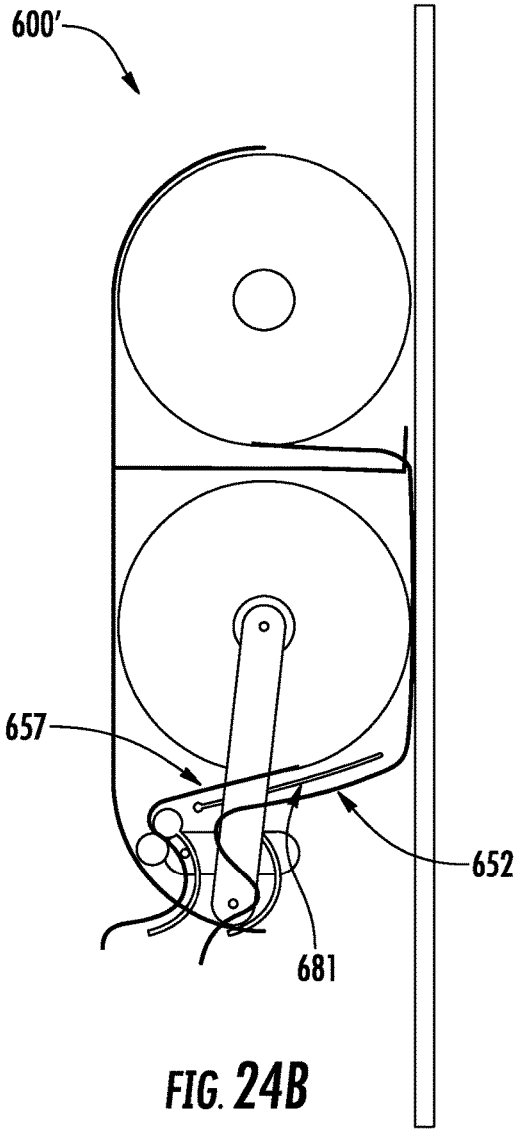

A similar example embodiment is illustrated with the dispenser 600' shown in FIGS. 24A and 24B. The depicted embodiment is similar to the embodiment shown and described with respect to FIGS. 21-23, but uses a simple structure in the form of a tongue 681 instead of the pivoting arm 680 shown in FIGS. 21-23. Like the pivoting arm 680, the tongue 681 is positioned between the two dispensing mechanisms. With reference to FIG. 24B, the tongue separates the two web paths (652 and 657) leading into the dispensing mechanisms (621 and 626). When the cover 614 opens, the tongue flips out (such as due to a bias, pulling, or pushing force), which forces the maintainer to properly distinguish the two web paths for installing the leading edges of the rolls in the proper dispensing mechanisms (such as on either side of the tongue).

Figure 25:
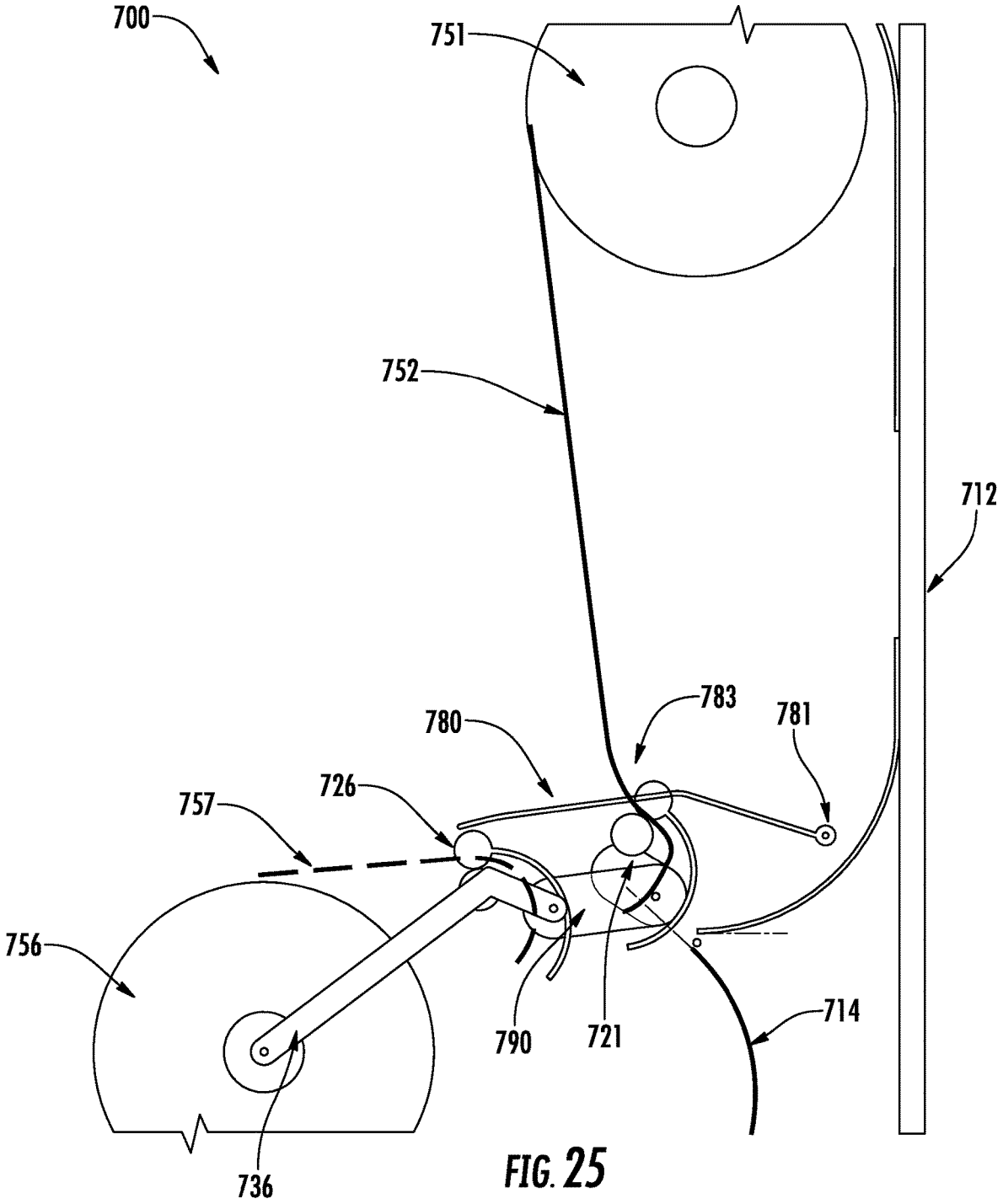
FIGS. 25-28 show another example product dispenser that is configured to include a movable roll holder, a rotating chassis, and a moveable web guide structure, in accordance with example embodiments described herein.

FIGS. 25-28 illustrate another example embodiment where the dispenser includes a movable roll holder, a movable chassis, and a movable web management structure. A similar example embodiment was shown and described with respect to FIGS. 18-19. The dispenser 700 shown in FIG. 25 holds a first product roll 751 and a second product roll 756 and includes a second roll holder 736. FIG. 25 shows that the dispenser utilizes a second product roll 756 that is mounted upon second roll holders 736 that pivot about a second roll chassis 790. The second roll chassis 790 is pivotally coupled to the rear housing 712. As such, the second roll holders 736 pivot and move away from the rear housing 712 as the cover 714 is opened in a suitable manner. The embodiment shown in FIG. 25 includes a nesting arm 780 that is pivotally coupled (e.g., at 781) to the rear housing 712 at a location between the rear housing and the first dispensing mechanism 721. When the cover 714 is opened, the nesting arm 780 pivots away from the rear housing 712 to a position such as shown in FIG. 25, in which the nesting arm 780 is positioned above the first dispensing mechanism 721 and the second dispensing mechanism 726 such that a maintainer may load a leading edge of the second product roll 756 into the second dispensing mechanism 726. Furthermore, the nesting arm 780 includes a nesting arm opening 783 (more clearly shown in FIGS. 27 and 28) through which the maintainer may load a leading edge of the first product roll 751 into the first dispensing mechanism 721.

Figure 26:
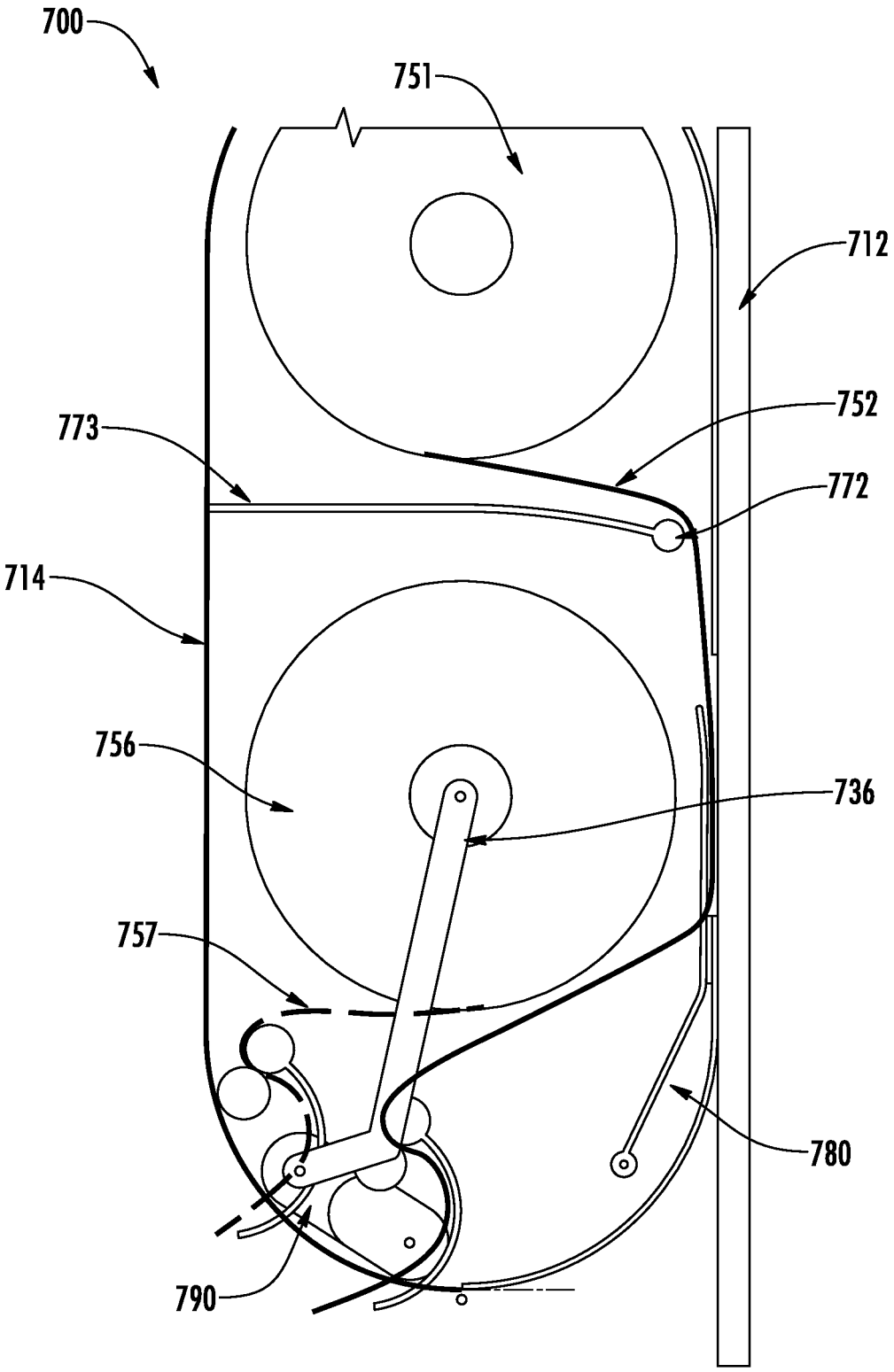

Once the dispenser is loaded, the maintainer may subsequently close the cover 714 which thereby moves the second roll holders 736 towards the rear housing 712. Closing the cover 714 also urges and pivots the second roll chassis 790 towards the rear housing 712, as shown in FIG. 26. The nesting arm 780 and the second roll chassis 790 may be urged toward the rear housing 712 by one or more means such as contact between the second roll holders 736 and the nesting arm 780; contact between the second roll holders 736 and the second roll chassis 790; contact between the cover 714 and the nesting arm 780; contact between the cover 714 and the second roll chassis 790; or other suitable coupling. FIG. 26 illustrates that once the cover 714 is closed, the nesting arm 780 separates the first roll web 752 from the second product roll 756 and second roll web 757, thereby mitigating the risk of dispenser failure due to such contact. In the depicted embodiment, the dispenser 700 uses a cover roller 772 and a cover divider plate 773 to further separate the first roll web 752 from the second roll 756 and second roll web 757 as has been previously described.

Figure 27:
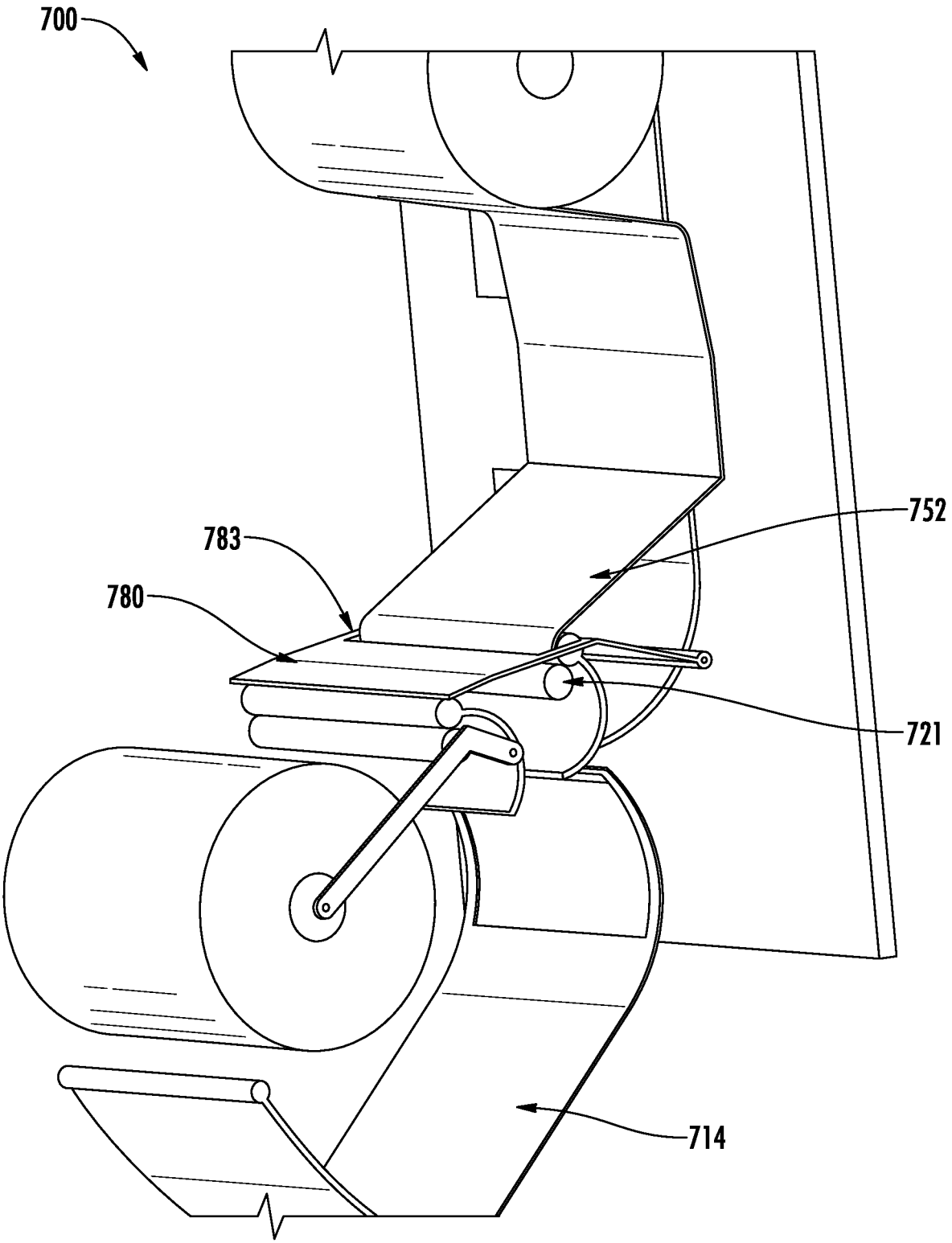
Figure 28:
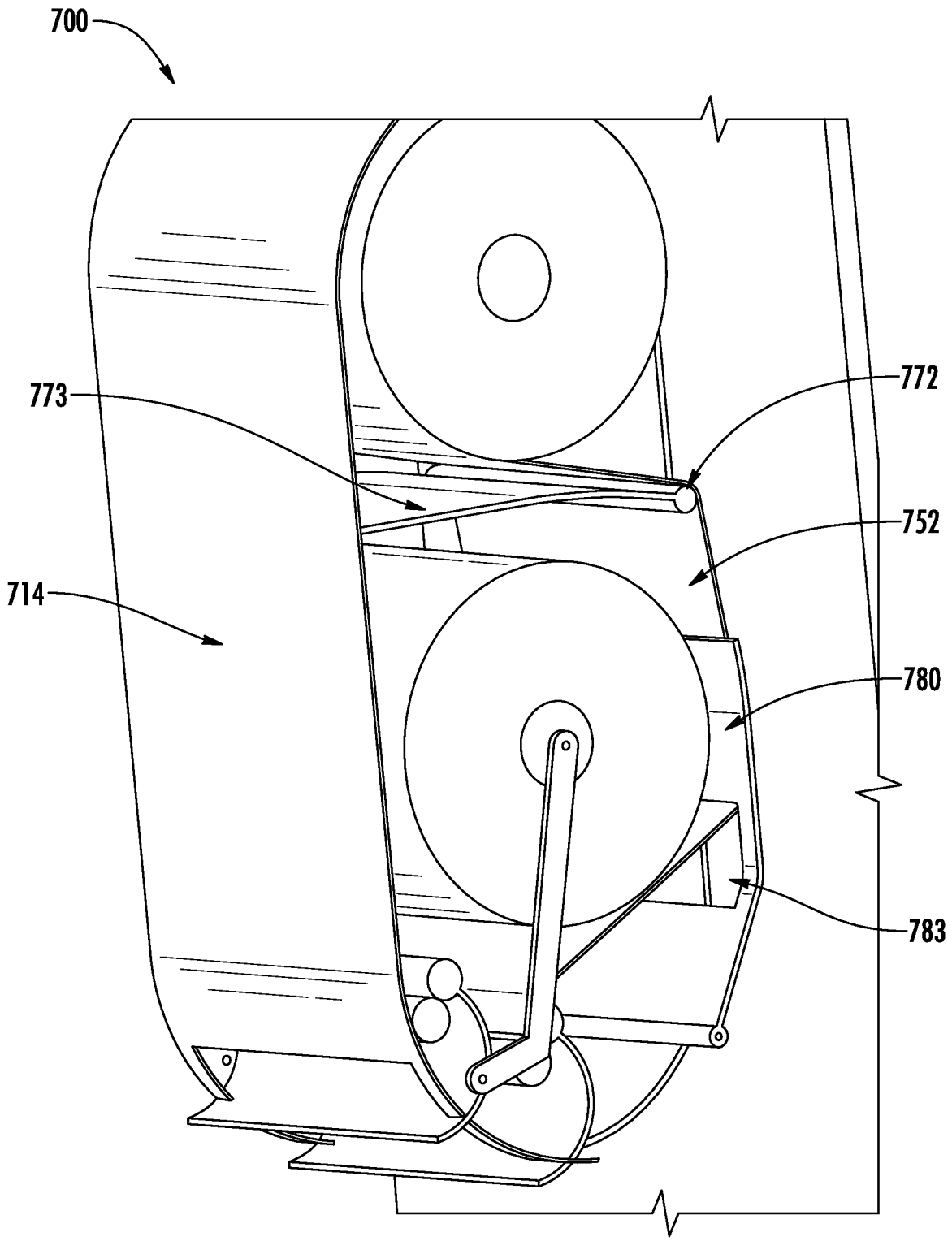

FIG. 27 shows the dispenser embodiment with the cover 714 open and a maintainer loading the first roll web 752 through the nesting arm opening 783 into the first dispensing mechanism 721. FIG. 28 shows the dispenser 700 with the cover 714 closed and the nesting arm 780, cover divider plate 773, and cover roller 772 helping prevent the first roll web 752 from contacting the second roll 756.

Figure 29A:
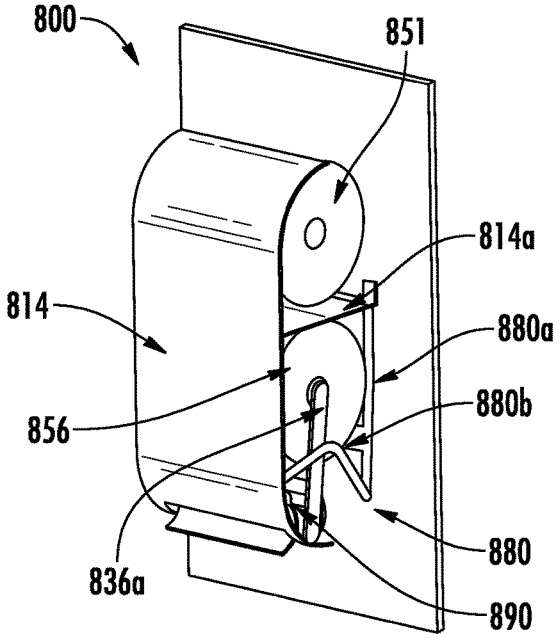
FIGS. 29A-29C show another example product dispenser that is configured to include a movable roll holder and a movable linkage system for web management, in accordance with example embodiments described herein.
Figure 29B:
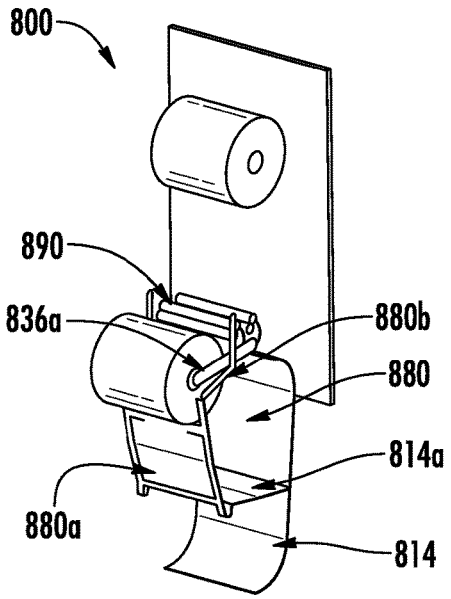
Figure 29C:
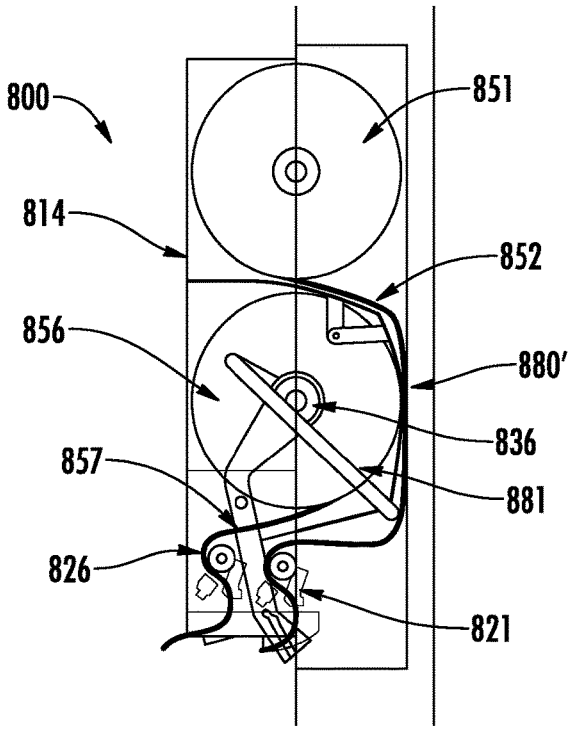

FIGS. 29A-29C illustrates example embodiments of a dispenser that includes a movable roll holder and a linkage structure that aids in web management. The dispenser 800 shown in FIG. 29A holds a first product roll 851 and a second product roll 856 and includes a second roll holder 836. Similar to the embodiment described with respect to FIGS. 20A-D, the dispenser includes a second roll holder 836 that pivots out of the dispenser 800 to enable easy loading (see FIG. 29B). Additionally, however, the depicted embodiment of FIGS. 29A-C includes a web guide structure 880 that also pivots out of the dispenser 800 with the second roll holder 836. With reference to FIG. 29B, the web guide structure 880 includes linkages 880*a*, 880*b* that are designed to move as the cover 814 is opened to enable a maintainer easy access to load either product roll and either leading edge of a loaded product roll into the appropriate dispensing mechanism 821, 826 (shown in FIG. 29C). To explain, the cover 814 includes a divider plate 814*a* that acts as a web management feature (such as described herein). A first linkage 880*a* is rotatably connected to the divider plate 814*a* at a first end. A second linkage 880*b* is rotatably connected at a first end to the second end of the first linkage 880*a*. The second end of the second linkage 880*b* is fixedly attached to the chassis 890. Due to the various sizes and rotatable connections, as the cover 814 is opened the linkages 880*a*, 880*b* move relative to each other and generally cause the first linkage 880*a* to rotate around the second product roll 856 to the position shown in FIG. 29B. In this position, the nips of the dispensing mechanisms of the chassis 890 are exposed and available for loading of sheet product from either or both of the first or second product roll respectively.

FIG. 29C illustrates another example embodiment of a sheet product dispenser that includes a web guide structure 880' that is similar to the web guide structure 880 shown and described with respect to FIGS. 29A-B. FIG. 29C illustrates that the web guide structure 880' is designed to form a web guide structure that separates the first web path 852 from either the second product roll 856 or the second web path 857 to prevent jamming or other complications. Notably, the web guide structure 880' includes a second linkage 881 that is connected to the second roll holder 836 (e.g., instead of being connected to the chassis as shown in FIG. 29A-B), and the second roll holder 836 is coupled to the cover 814. Depending on the configuration, such embodiments may provide an advantageous motion path that enables the web guide structure 880' to somersault high enough to vault over the second roll 856 as the cover 814 opens. In this regard, the depicted embodiment of FIG. 29C provides for an advantageous motion path because the second roll holder 836 is simultaneously moving the second roll 856 (along with the web guide structure 880') out of the dispenser housing as the cover 814 opens.

Figure 30A:
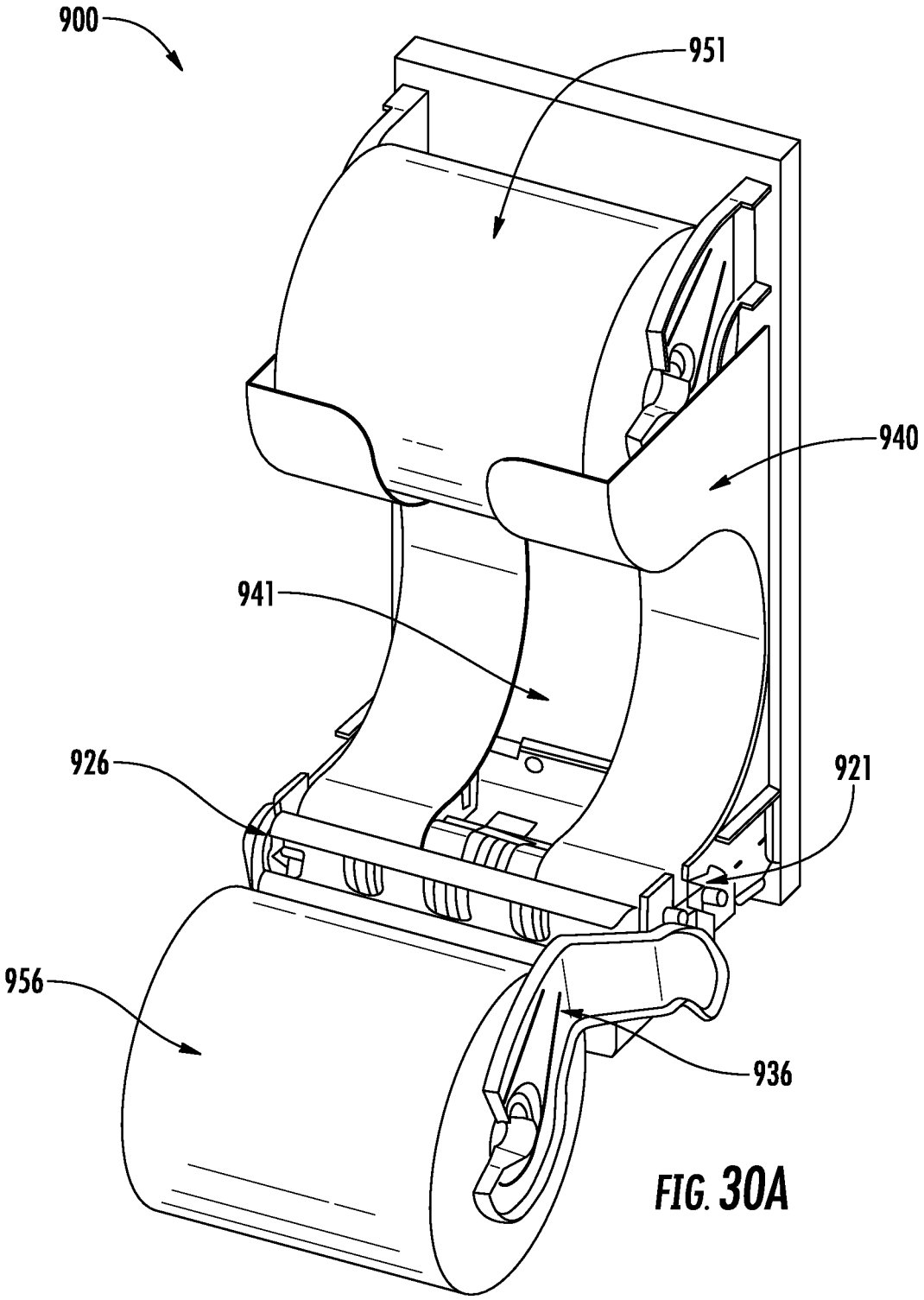
FIGS. 30A-30C show another example product dispenser that is configured to include a movable roll holder and a web management structure, in accordance with example embodiments described herein.
Figure 30B:
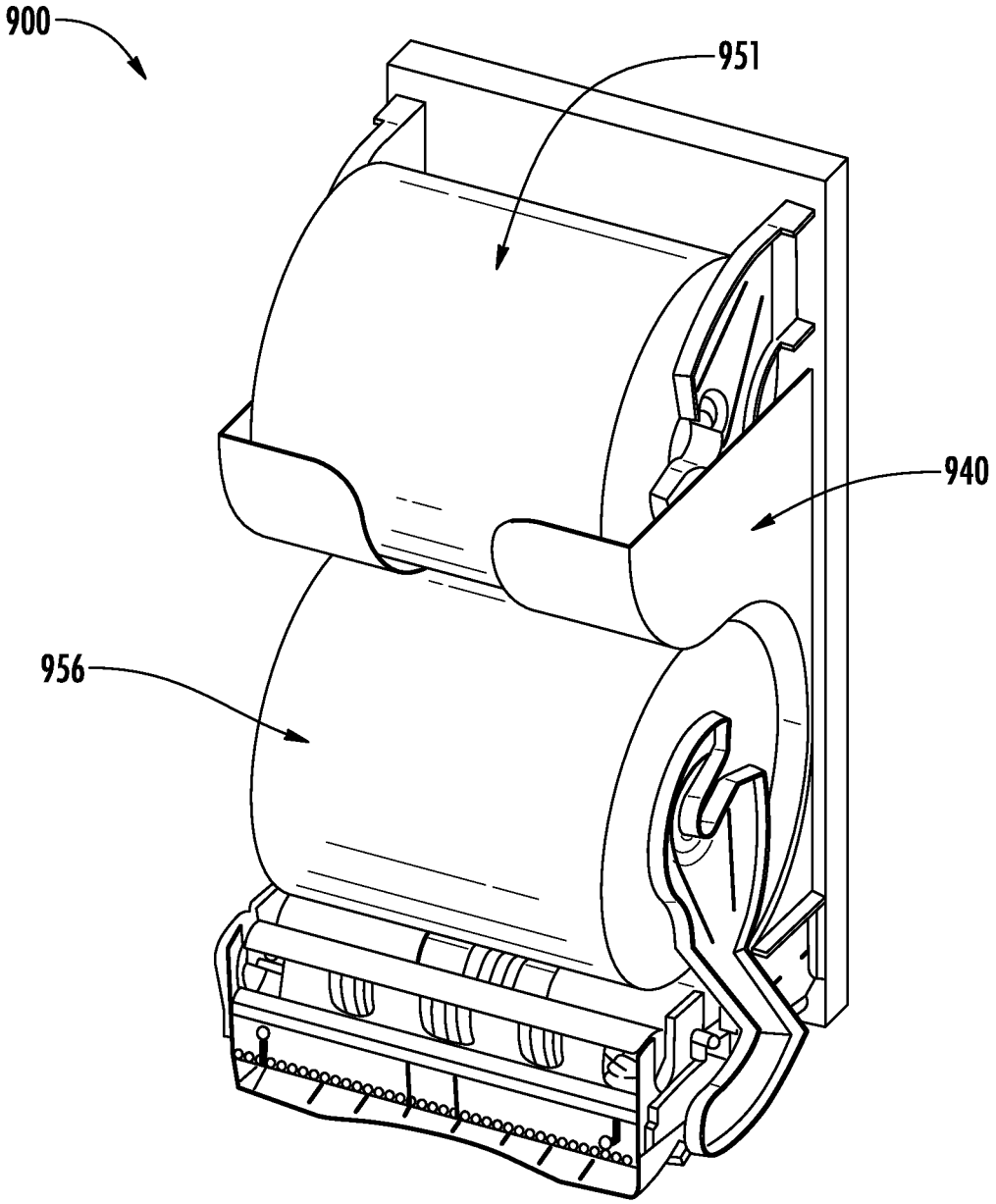
Figure 30C:
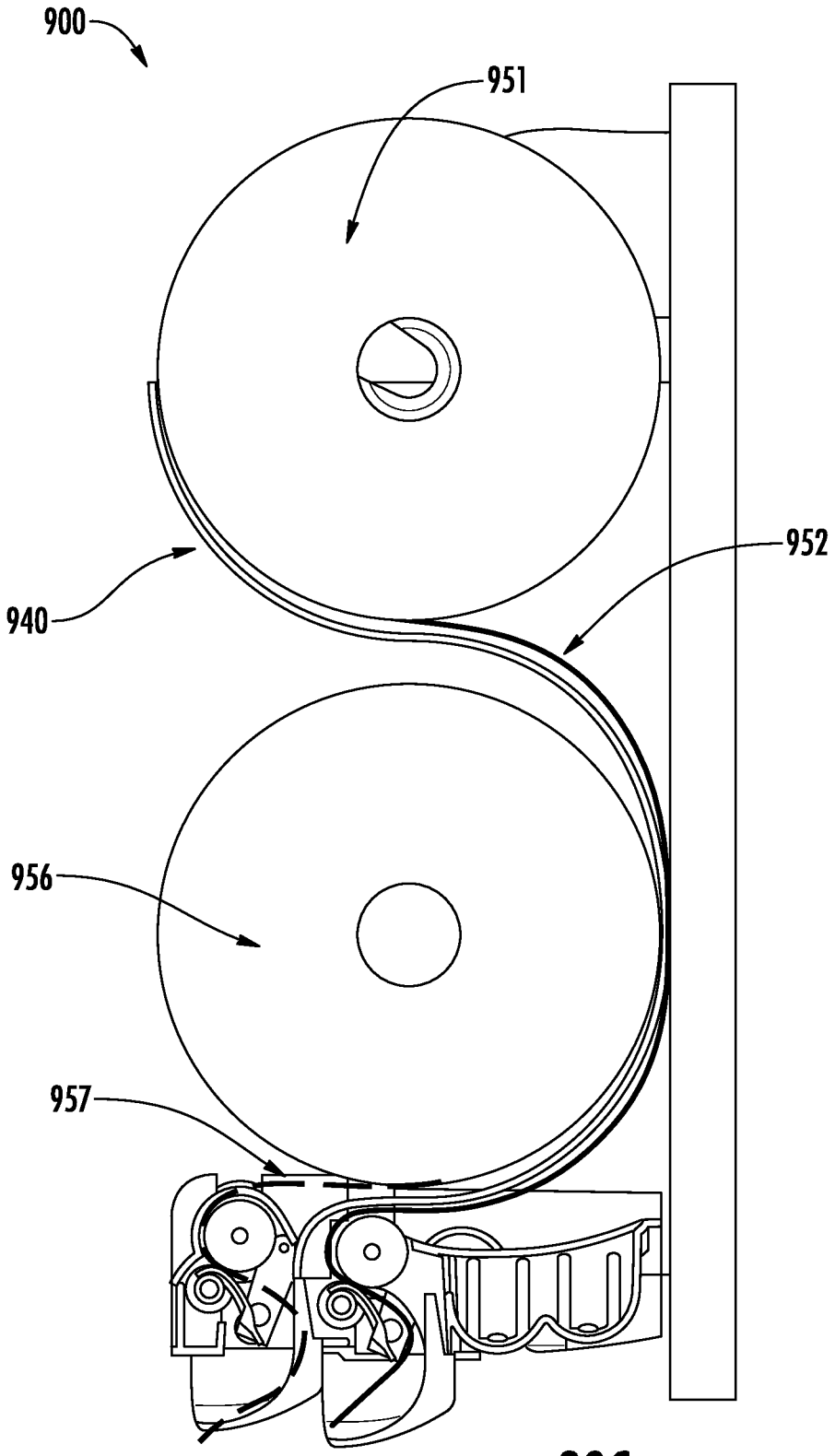

FIGS. 30A-30C illustrate an example embodiment of a dispenser that includes a movable roll holder and a web management structure. The dispenser 900 shown in FIG. 30A holds a first product roll 951 and a second product roll 956 and includes a second roll holder 936. Like the example embodiment described with respect to FIGS. 20A-D, the dispenser includes a second roll holder 936 that pivots out of the dispenser to enable easy loading (see FIG. 30A). In this position, the maintainer is free to replace a depleted second product roll with a new second product roll and feed the leading edge of the second roll 956 into the second dispensing mechanism 926 (e.g., through the second nip). Additionally, however, the dispenser 900 includes an intermediate shell 940 (e.g., a roll partition and/or web management structure) that includes a gap 941. If a maintainer chooses to replace a depleted first product roll with a new first product roll, the maintainer may reach through the gap 941 to pull the leading edge of the first product roll 951 along the rear-facing surfaces of the intermediate shell 940 until the leading edge enters the first nip of the first dispensing mechanism 921. The intermediate shell 940 separates the first roll web 952 from the second product roll 956 and second roll web 957. The maintainer may then close the cover 914, after which the dispenser 900 may resume dispensing product to users from the smaller roll.

FIG. 30B shows the dispenser 900 as configured once the cover 914 is closed. FIG. 30C shows the dispenser 900 with the cover 914 in the closed position and illustrates that the intermediate shell 940 helps separate the first roll web 952 from the second roll 956 and second roll web 957 so that the webs do not interact and cause the dispenser to jam.

Figure 31A:
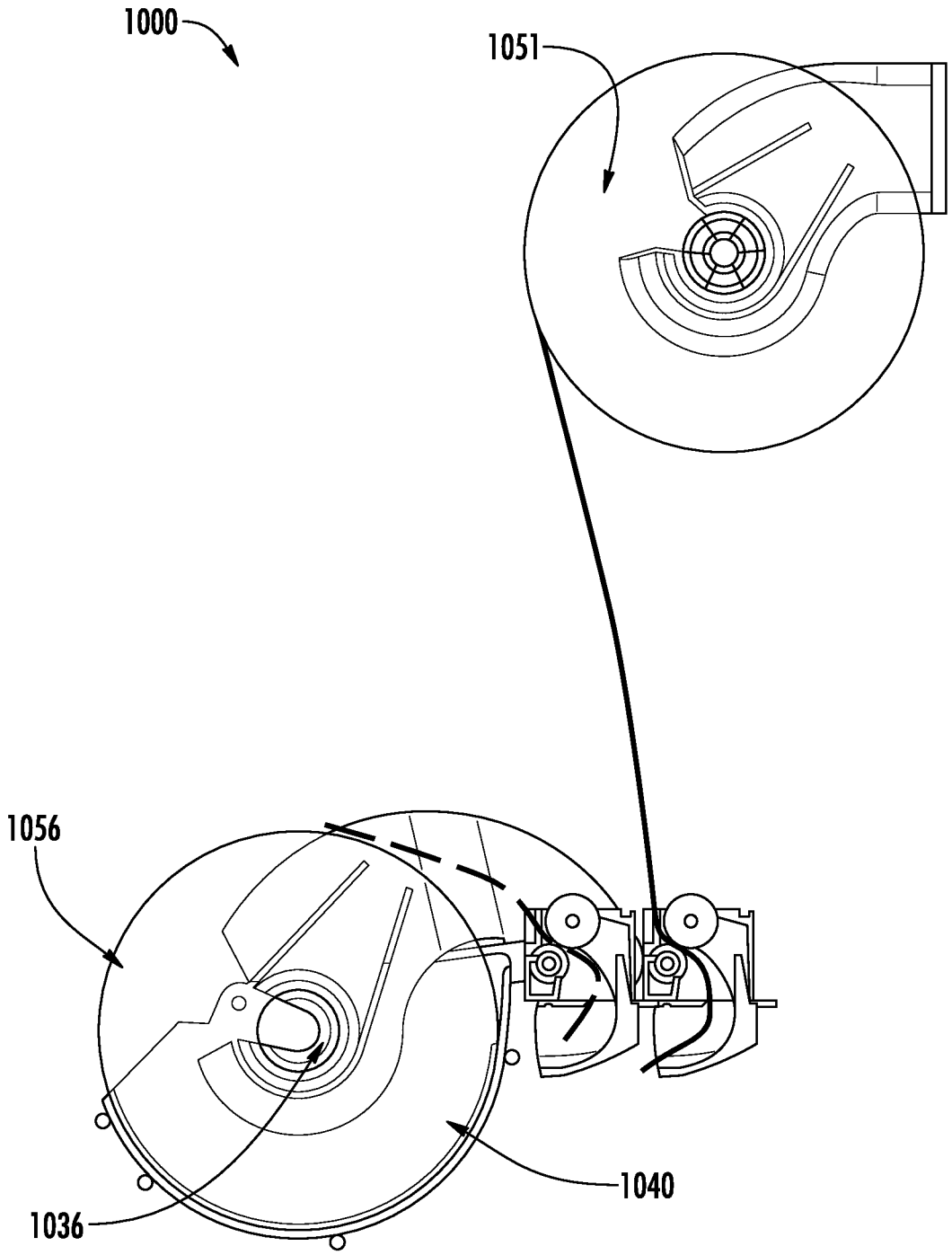
FIGS. 31A-31D show another example product dispenser that is configured to include a movable roll holder and a movable web management structure, in accordance with example embodiments described herein.
Figure 31B:
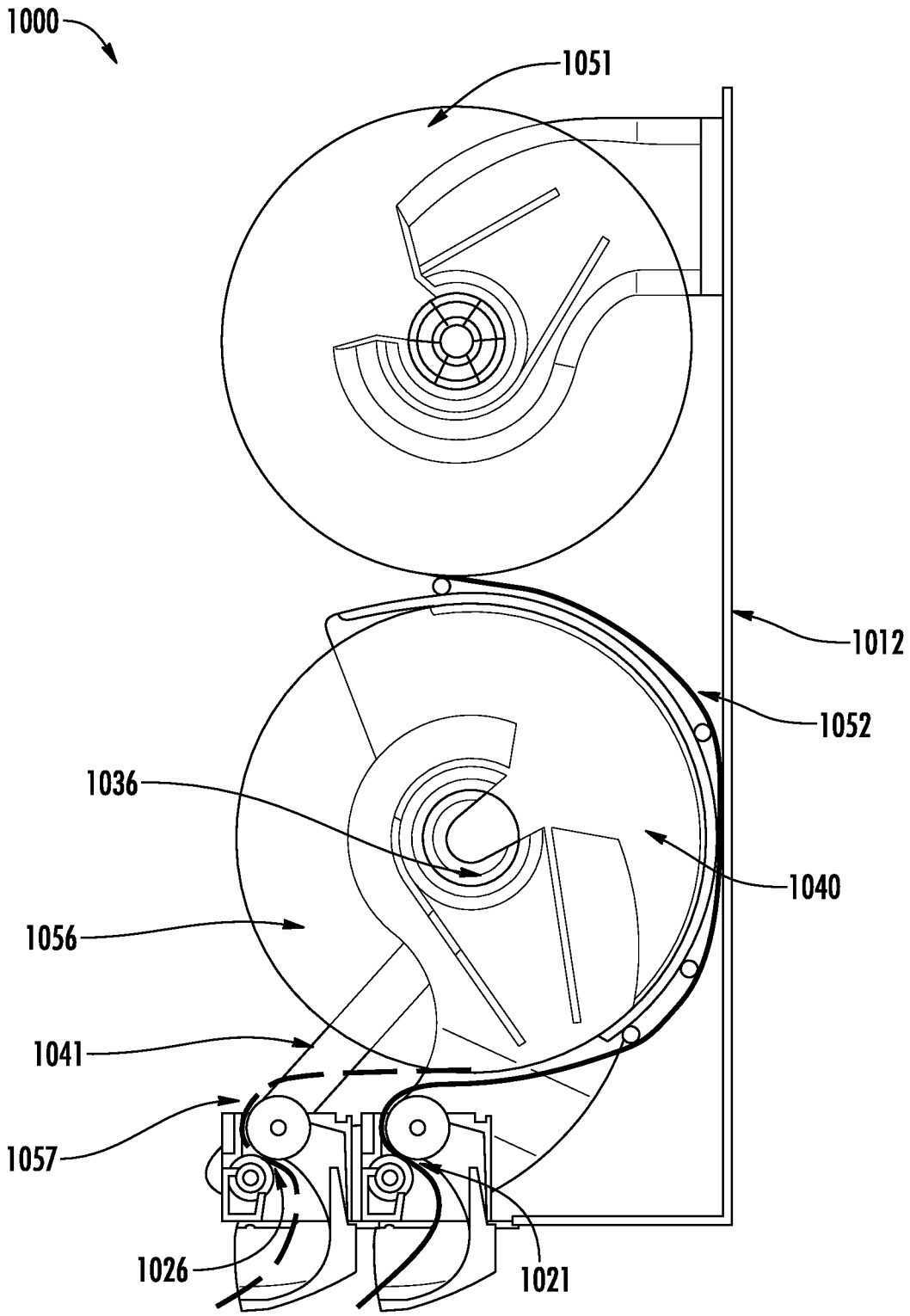

FIGS. 31A-31D illustrate another example embodiment of a dispenser that includes a movable roll holder and a movable web management structure. The dispenser 1000 shown in FIG. 31A holds a first product roll 1051 and a second product roll 1056 and includes a second roll holder 1036. With reference to FIG. 31A, the second roll 1056 is mounted upon second roll holders 1036 that are pivotally coupled to the rear housing 1012. The second roll holders 1036 rotatably support a roll shroud 1040. The roll shroud 1040 is coupled with a roll shroud linkage 1041 (shown in FIG. 31B) to the second roll holders 1036 and to the rear housing 1012 such that when the cover (not shown) opens, the second roll holders 1036 pivot to the loading position and the roll shroud 1040 rotates counter-clockwise (as viewed from the perspective of FIG. 31B) about the second roll holders 1036 to provide access for a maintainer to load the second product roll into the second roll holders 1036 and further to load the leading edge 1057 of the second product roll 1056 into the second dispensing mechanism 1026. Once the dispenser 1000 is loaded, the maintainer may subsequently close the cover which thereby pivots the second roll holders 1036 towards the rear housing 1012. As the second roll holders 1036 pivot towards the rear housing 1012, the roll shroud linkage 1041 urges the roll shroud 1040 to rotate clockwise (as viewed from the perspective of FIG. 31B) about the second roll holders 1036 into the position shown in FIG. 31B, in which orientation the roll shroud 1040 separates the first roll web 1052 from the second product roll 1056 and second roll web 1057, thereby mitigating the risk of dispenser failure due to such contact.

Figure 31C:
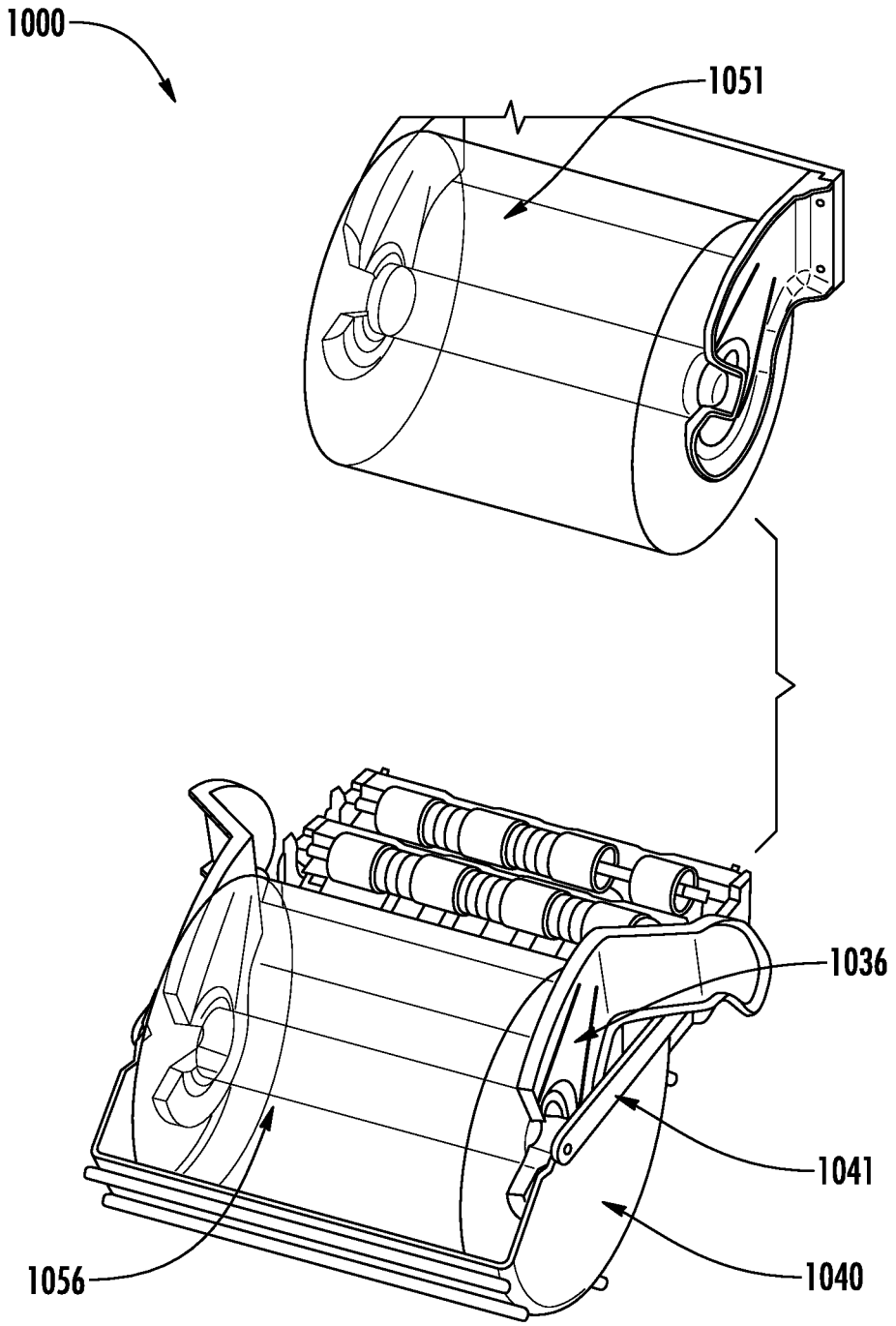
Figure 31D:
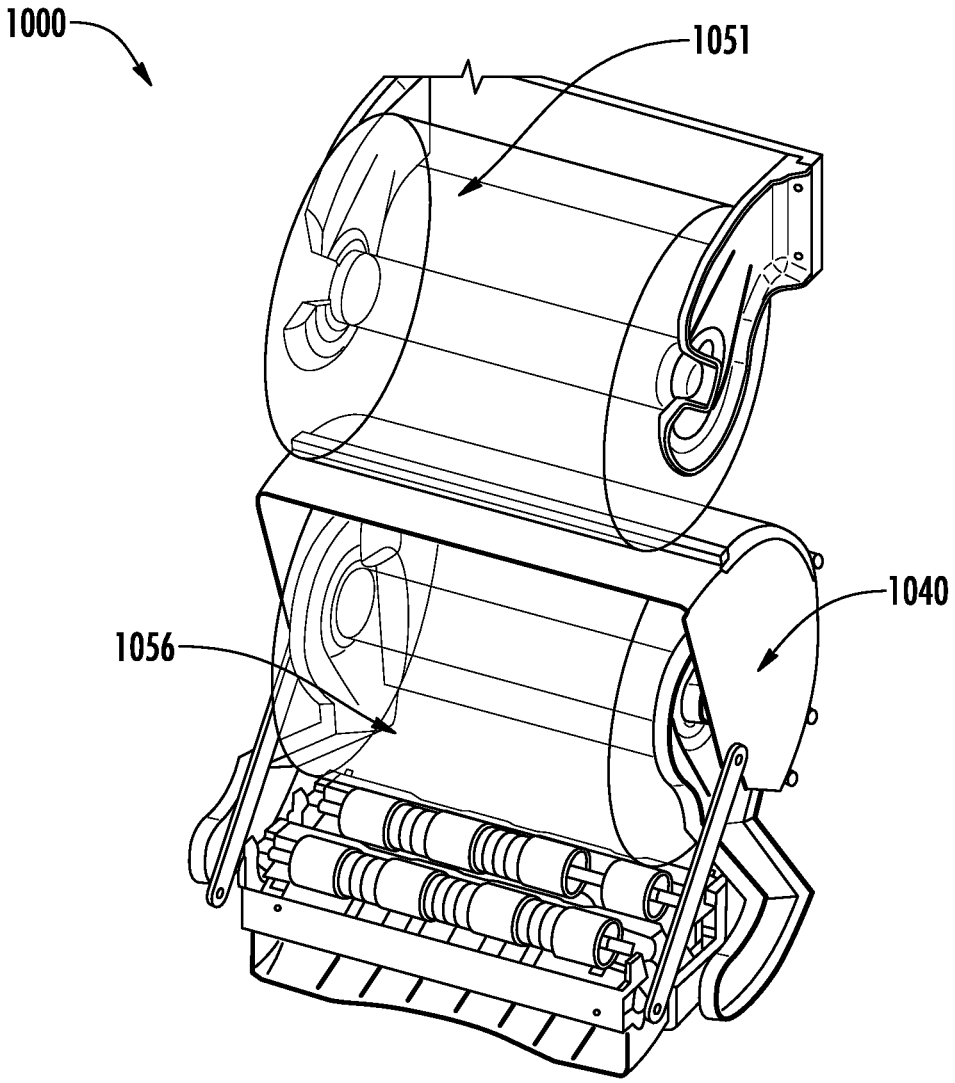

FIG. 31C shows a perspective view of an instance in which the second roll holders 1036 are in the loading position and the roll shroud linkage 1041 prescribes the roll shroud 1040 to be in the open-access loading position. FIG. 31D shows a perspective view of an instance in which the second roll holders 1036 are in the dispensing position and the roll shroud linkage 1041 prescribes the roll shroud 1040 to be in the dispensing position that separates the first roll web 1052 from the second product roll 1056 and second roll web 1057.

Figure 32A:
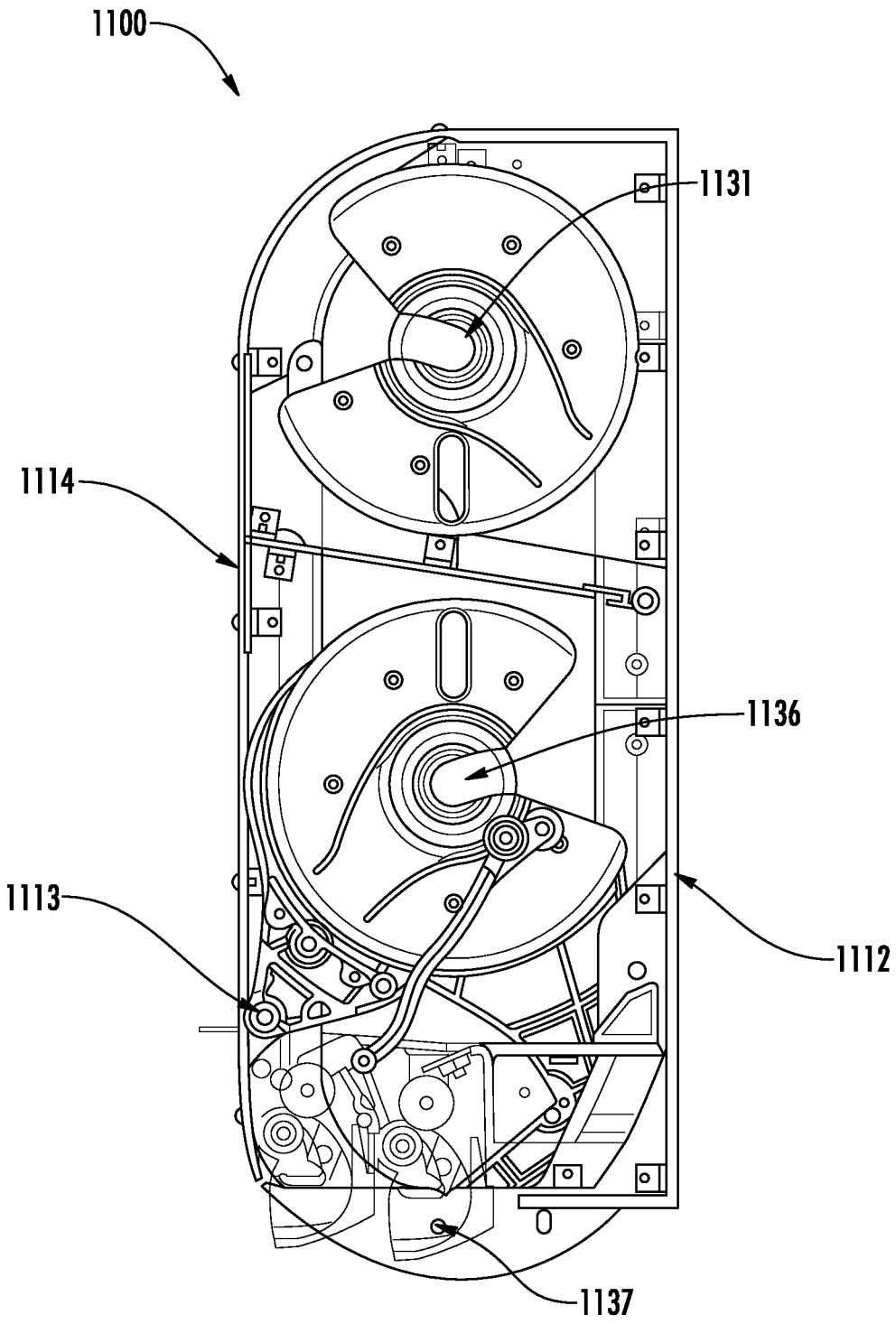
FIGS. 32A-32E show another example product dispenser that is configured to include a movable roll holder and a floating cover, in accordance with example embodiments described herein.

FIGS. 32A-E illustrate another example embodiment of a dispenser that includes a floating cover. The dispenser 1100 shown in FIG. 32A is configured to hold a first product roll (not shown) within a first roll holder 1131 and a second product roll (not shown) and includes a second roll holder 1136. In this illustrated embodiment, the second roll holders 1136 are pivotally coupled to the rear housing 1112 with a second roll holder hinge 1137 and the cover 1114 is coupled to the second roll holders 1136 with a cover hinge 1113. This cover hinge 1113 is in place of a typical cover hinge that attaches to the rear housing. In this regard, when the cover 1114 opens, it give the appearance of "floating." See FIG. 32C.

With reference to FIG. 32A, the cover 1114 closes flush against the rear housing 1112 without revealing any unsightly hinge. When a user pulls open the cover 1114 from the position shown in FIG. 32A, the cover 1114 and the second roll holders 1136 remain in the same position relative to each other due to suitable urging such as gravity urging the second roll holders 1136 toward the cover 1114, a spring force urging the second roll holders 1136 towards the cover 1114, or any other suitable means. As such, when a user pulls the cover 1114 open, the cover 1114 does not pivot about the cover hinge 1113, although both the cover 1114 and the second roll holders 1136 pivot together about the second roll holder hinge 1137. For example, the cover 1114 and second roll holder 1136 pivot to the position shown in FIG. 32B.

Figure 32B:
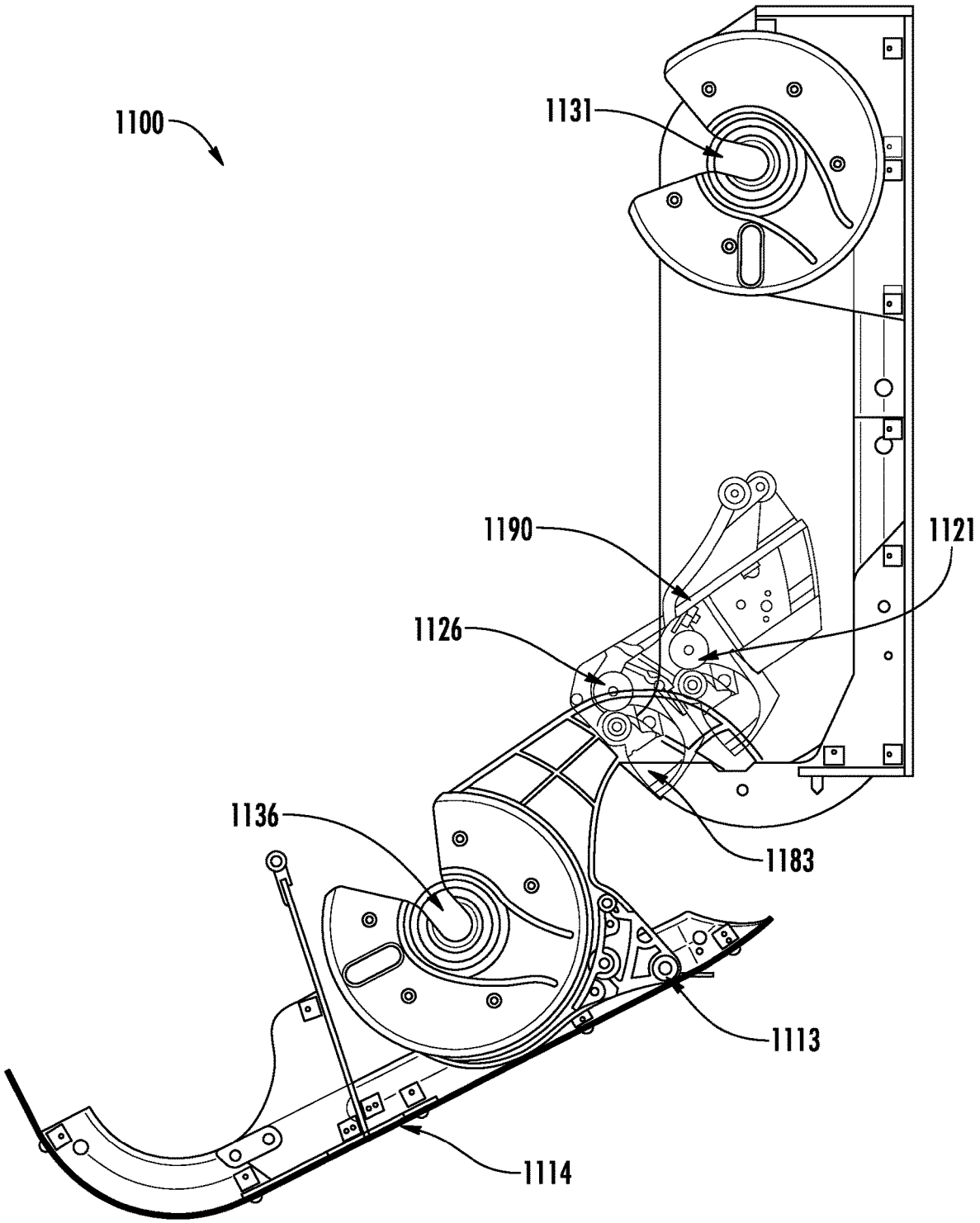
Figure 32C:
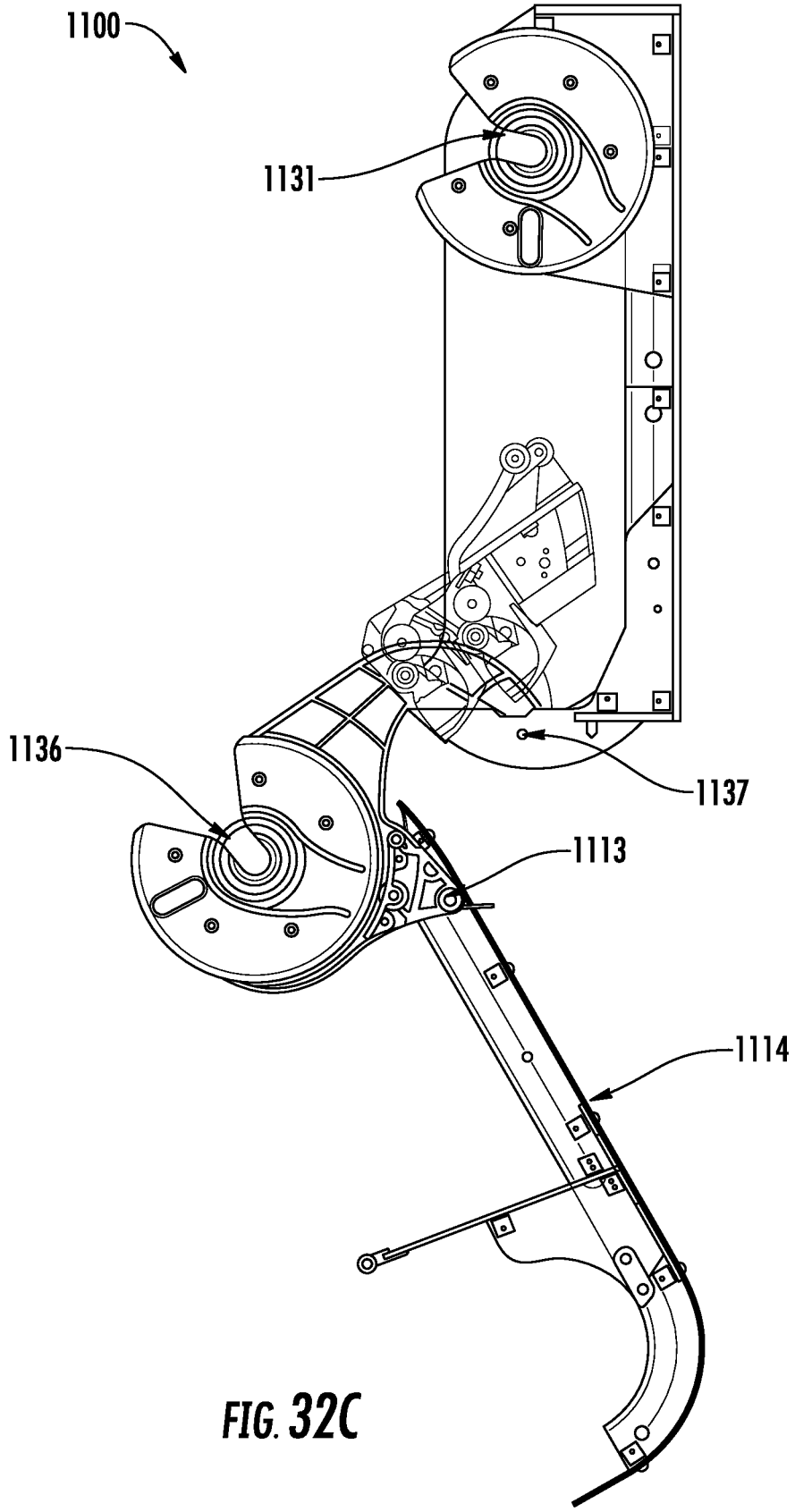
Figure 32D:
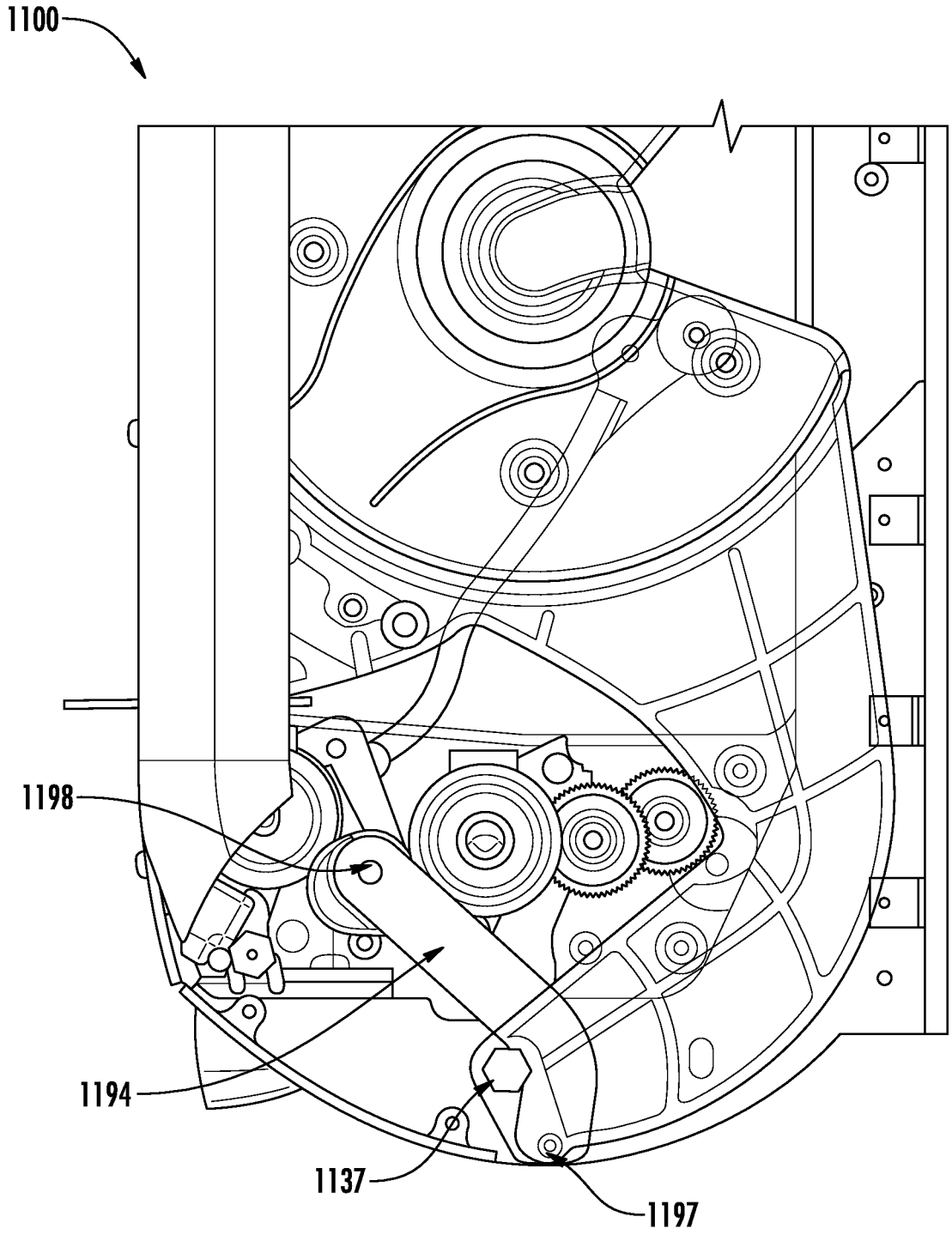
Figure 32E:
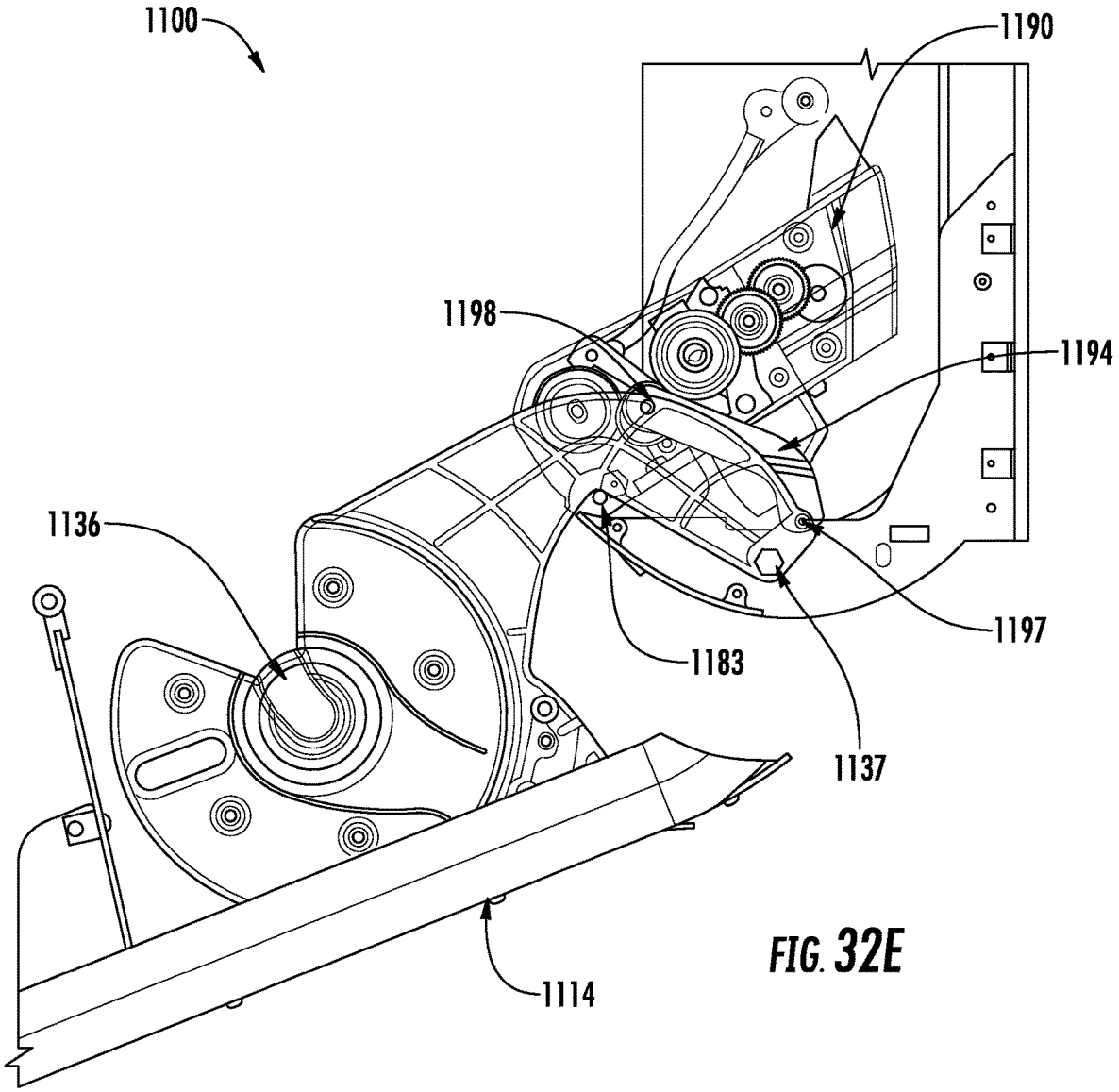

As shown in FIG. 32B, the second roll holders 1136 have descended until they rest upon a chassis hinge 1183 and can descend no further (see FIG. 32E for a more detailed illustration). In FIG. 32B, the second roll holders 1136 are in a position to allow a maintainer to change product rolls. The cover 1114 has maintained its position relative to the second roll holders 1136. However, the cover 1114 may descend further if it overcomes the means that urges the cover 1114 to maintain position with the cover 1114. For example, the weight of the cover 1114 might overcome a spring force urging the cover 1114 towards the second roll holders 1136, in which case the cover 1114 may pivot about the cover hinge 1113 to a lower position depicted in FIG. 32C. The position shown in FIG. 32C may offer advantages such as increased access to change a product roll. Further, the pivoting cover in FIG. 32C helps to reduce shock, stress, and potential for resulting damage upon the dispenser 1100 that may occur if a maintainer were to allow the cover and lower roll holders to freely fall to the position shown in FIG. 32B.

In some embodiments, the chassis 1190 may be configured to pivot upwardly for easier access. For example, as the cover 1114 and second roll holders 1136 pivot out of the dispenser between FIGS. 32A and 32B, a suitable mechanism pivots the chassis 1190 upwards about a chassis hinge 1183. This mechanism is further shown in FIGS. 32D and 32E. In this embodiment, a chassis link 1194 connects the second roll holders 1136 to the pivoting chassis 1190 via a second link hinge 1197 and a first link hinge 1198, respectively. When the second roll holders 1136 pivot to allow a product roll to be serviced, the second roll holders 1136 move the chassis link 1194, which further urges the chassis 1190 to pivot upwards to a raised position in FIG. 32E. Both the first nip of the first dispensing mechanism 1121 and the second nip of the second dispensing mechanism 1126 are affixed to the chassis and likewise both pivot with the chassis 1190. As such, the chassis 1190 is in a "home" position during dispensing, and in a "raised" position during maintenance. The "home" position is advantaged for dispensing because product dispenses from the first nip in a location that is lower than, and not obstructed by, the chute from the second nip. The "raised" position is advantaged for maintenance because it provides better access for a maintainer to reach the first nip to load product. Such advantages may be realized by such example embodiments described herein that enable pivoting or movement of the chassis to a raised position (e.g., the embodiments shown in and described with respect to FIGS. 18, 19, and 25-28).

Roll Partition

Another example embodiment of the present invention that provides, for example, a movable roll holder that is separately movable from the cover also includes a roll partition. FIGS. 33A-37B illustrate various example embodiments related to providing a movable (e.g., rotatable, pivotable, displaceable, slidable, etc.) roll partition for example dispensers.

Figure 33A:
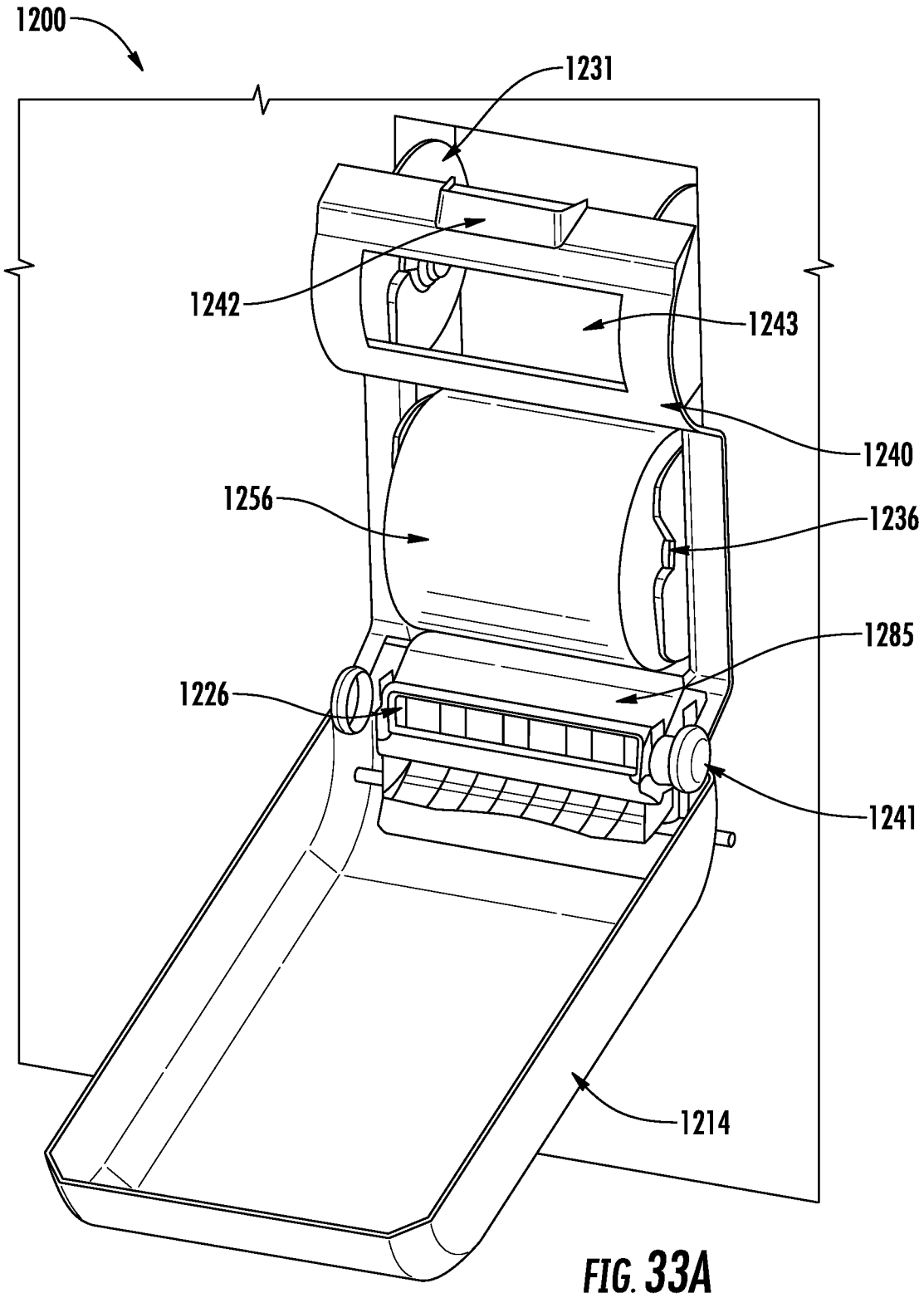
FIGS. 33A-33B illustrate example product dispensers configured to include a roll partition, wherein the cover is opened or removed, in accordance with example embodiments described herein.
Figure 33B:
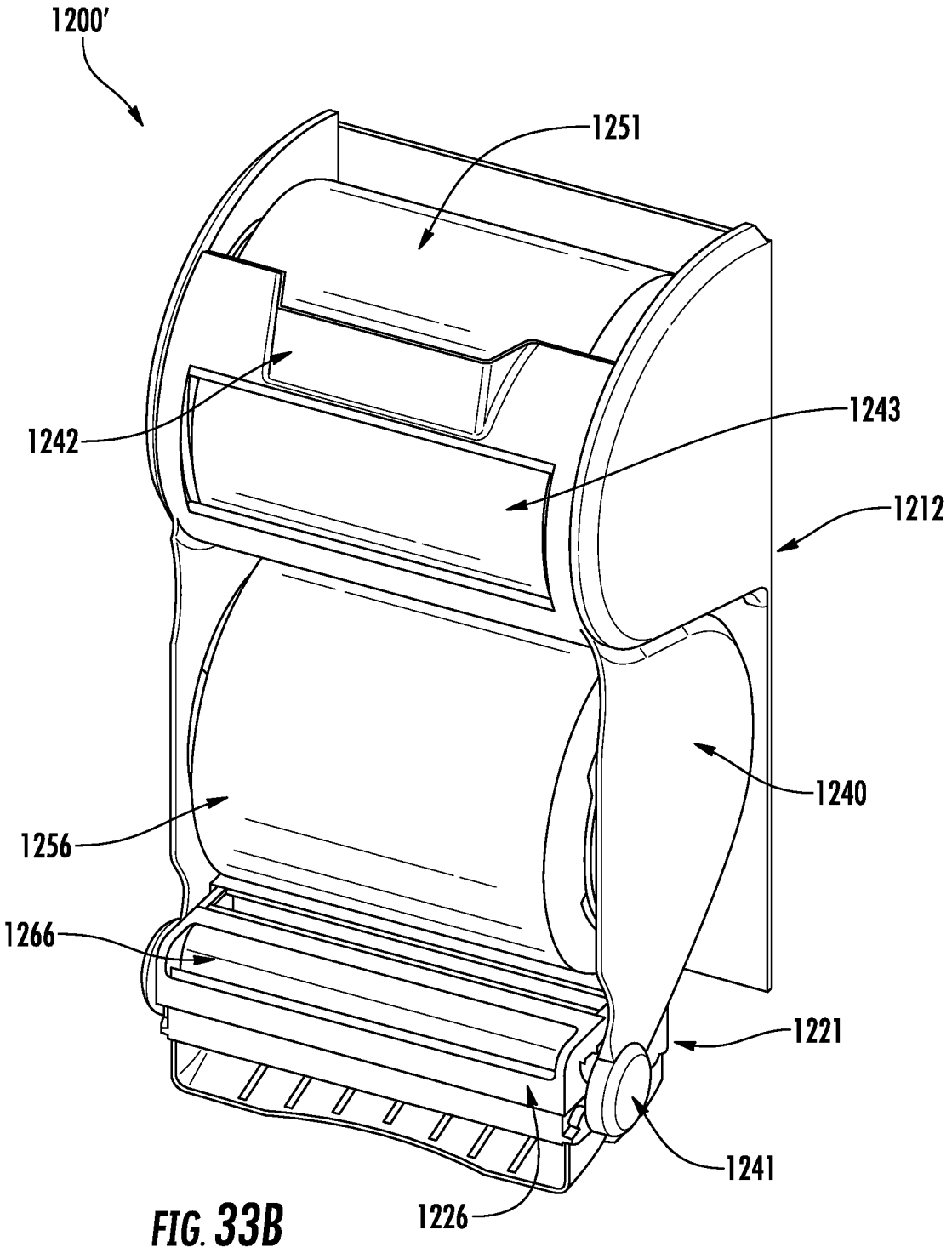

With reference to FIGS. 33A and 33B, the example dispensers 1200, 1200' are configured to hold a first product roll 1251 and a second product roll 1256. In order to separate the web paths and provide for easy loading, among others things, the dispensers 1200, 1200' each include a roll partition 1240 (e.g., an intermediate shell). In the depicted embodiment, the roll partition 1240 is configured to hold the second product roll 1256, such as through the second roll holders 1236 which are attached to the roll partition 1240. In some embodiments, the roll partition 1240 may define a first portion 1247 that is shaped (e.g., rounded) to cover at least a back portion of the second product roll 1256 (see FIGS. 34B and 34C) to separate the first web path 1252 of the first product roll 1251 and the second product roll 1256 and second web path 1257 when the roll partition is in the closed position (shown in FIGS. 37A and 37B). Additionally or alternatively, in some embodiments, the roll partition 1240 may define a second portion 1248 that is shaped and configured to at least partially cover the first product roll 1251. The second portion 1248 may be designed to cover the first product roll 1251, but may also include one or more features (e.g., window 1243) to aid in viewing the first product roll 1251 such as for visual confirmation of the amount of product remaining on the first product roll 1251.

Further, the roll partition 1240 may comprise a handle 1242 that can be utilized to cause rotation of the roll partition 1240 (e.g., to or from the closed position shown in FIGS. 33A and 33B).

Figure 33C:
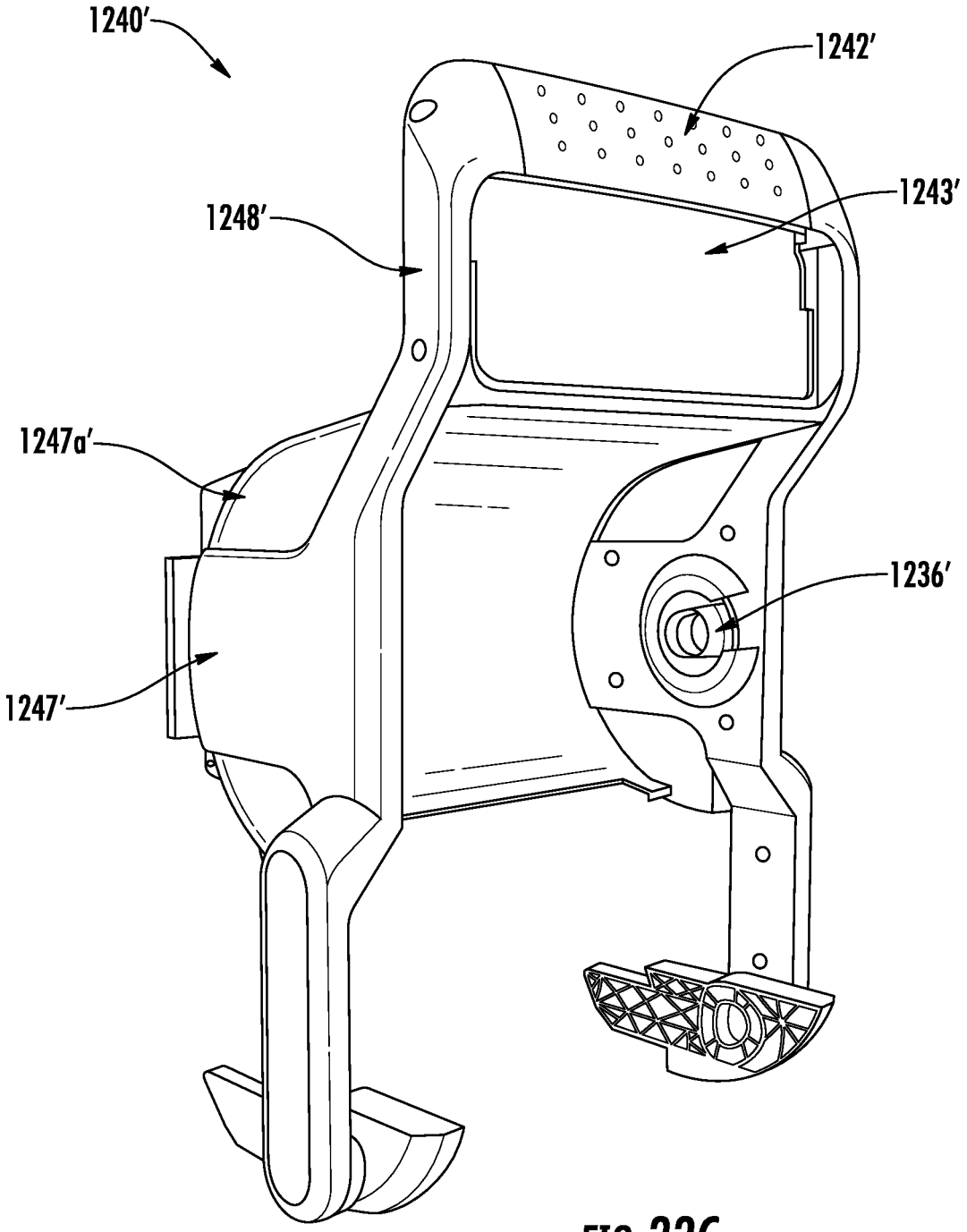
FIG. 33C shows an example roll partition, in accordance with example embodiments described herein.

FIG. 33C shows another example roll partition 1240' that can be utilized with various embodiments of the present invention. The roll partition 1240' defines a first portion 1247' that is shaped to cover at least a back portion of the second product roll (see FIGS. 34B and 34C). In the depicted embodiment, the first portion 1247' includes a transparent (or semi-transparent) section 1247*a*' that enables a maintainer to visually discern the amount of remaining sheet product on an installed second product roll (not shown)—such as through a side window (not shown) of the dispenser housing. Additionally, the roll partition 1240' defines a second portion 1248' that is shaped and configured to at least partially cover the first product roll (not shown). The second portion 1248' also includes an opening 1243' to aid in viewing the first product roll (not shown) such as for visual confirmation of the amount of product remaining on the first product roll. Further, the roll partition 1240' includes a handle 1242' that can be utilized to cause rotation of the roll partition 1240'.

Figure 39:
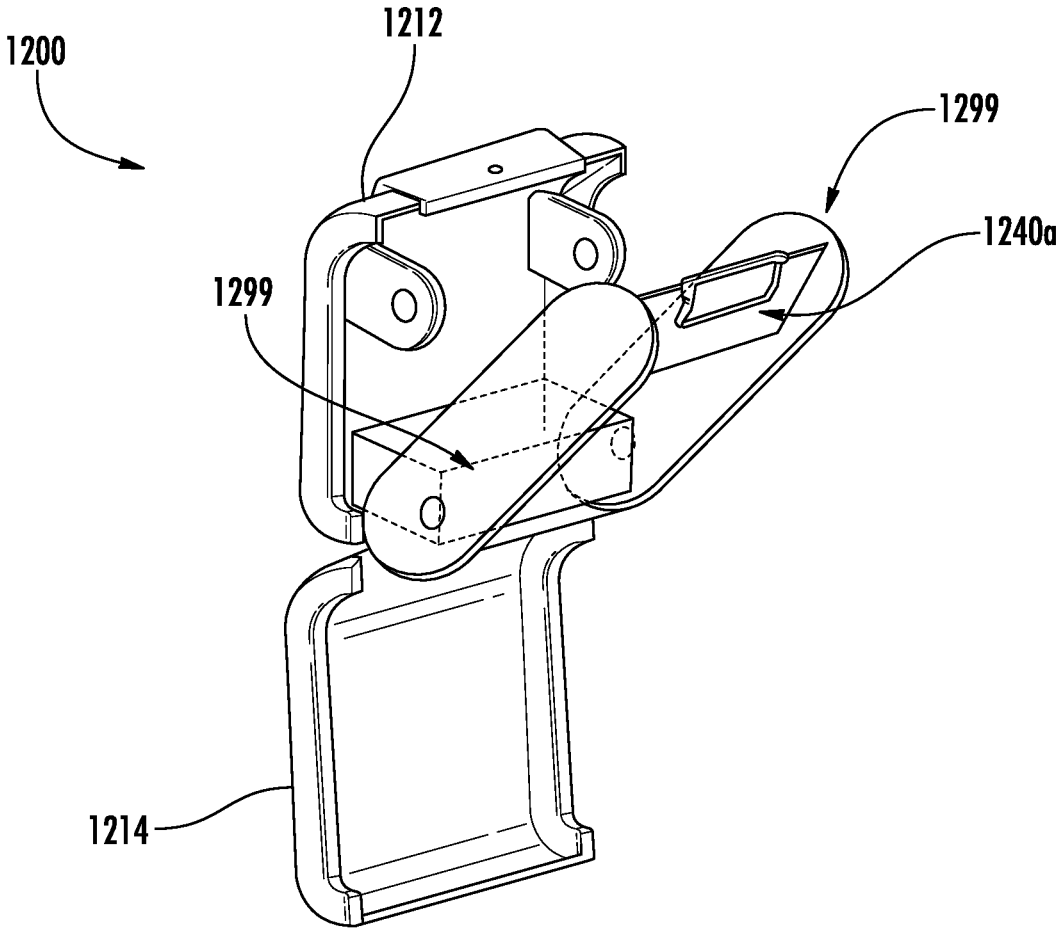
FIG. 39 illustrates an example product dispenser where the roll partition is attached to side windows that form an outside portion of the housing, in accordance with some example embodiments described herein.

In some embodiments, with reference to FIG. 39, the roll partition 1240*a* may include one or more side wall portions 1299 that is designed to fit between the rear housing 1212 and the cover 1214 when the cover 1214 is closed, such that the side wall portion of the roll partition 1240*a* forms a part of the exterior of the dispenser 1200. In some embodiments, the side wall portions 1299 may be formed of transparent or partially transparent material for aesthetics and/or to provide the maintainer or user the ability to visually assess the product level of the first or second product rolls.

FIGS. 33A and 33B each illustrate the roll partition 1240 in the closed position. In the closed position, the maintainer is free to replace a depleted second (bottom) roll 1256 with a new second product roll and load the leading edge of the second (bottom) roll into the second dispensing mechanism 1226, which has an exposed and accessible second nip 1266. Notably, however, in some embodiments, when in the closed position, as will be described in greater detail herein, a nip cover 1285 may prevent access to the first dispensing mechanism 1221. This forces the maintainer to properly install and load the leading edge of the second product roll 1256 into the second dispensing mechanism 1226 (as it is the only dispensing mechanism that is available for loading). The maintainer may then close the cover 1214 of the dispenser 1200, after which the dispenser will resume dispensing product to users.

Figure 34A:
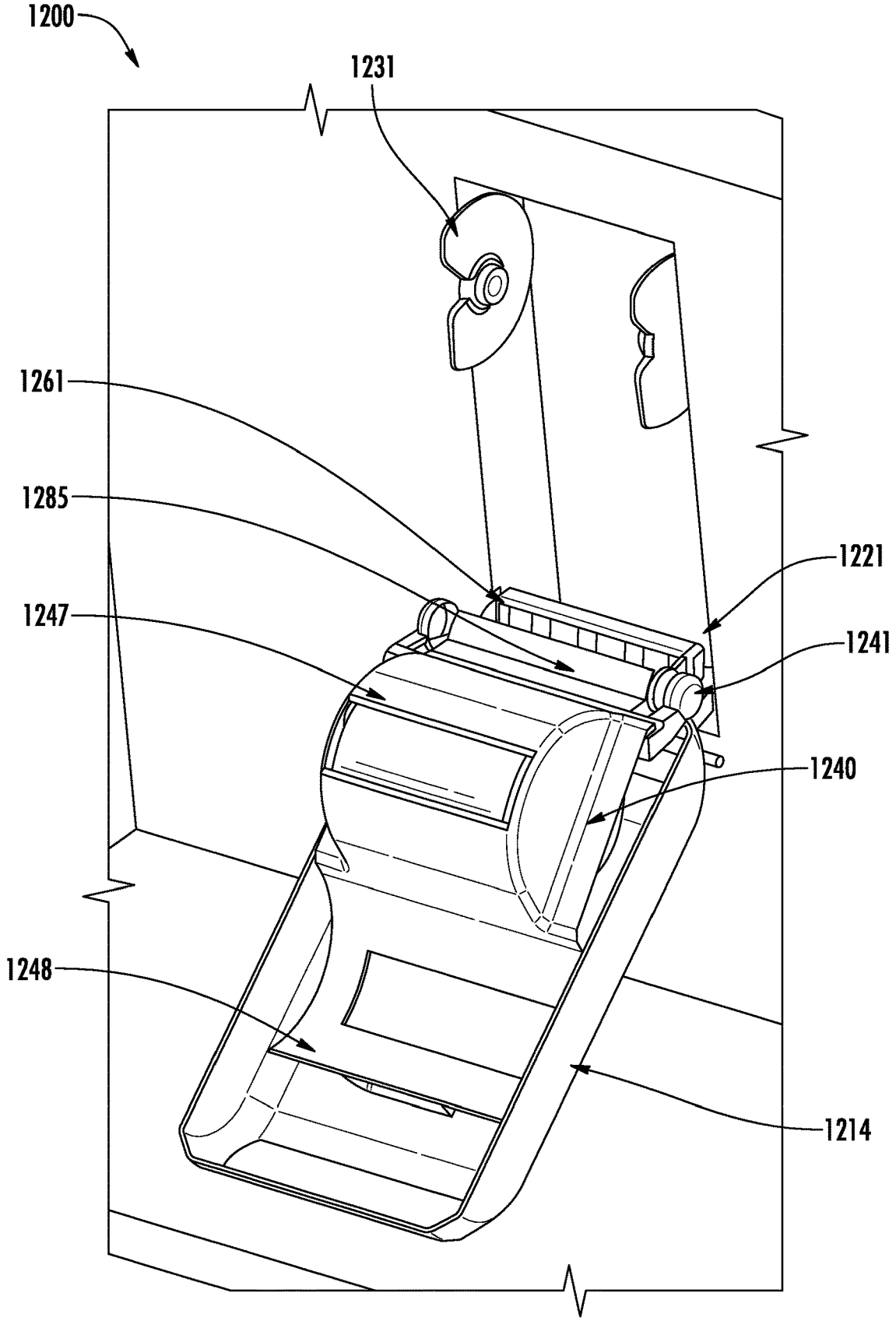
FIG. 34A shows the example product dispenser of FIG. 33A with the roll partition rotated forward into the cover and without a top product roll loaded, in accordance with example embodiments described herein.
Figure 34B:
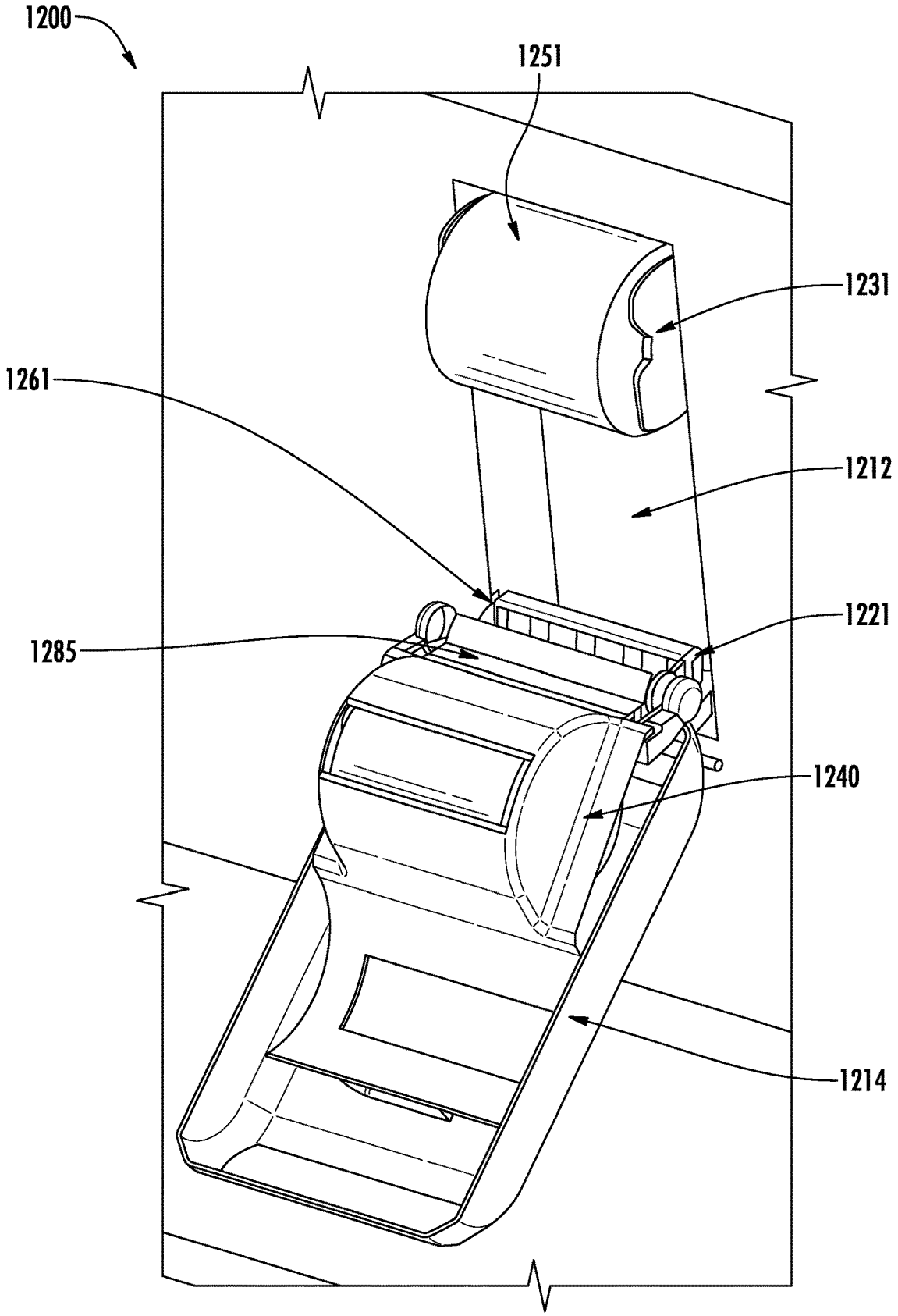
FIGS. 34B-34C illustrate example product dispensers configured to include a roll partition, wherein the roll partition is rotated forward into the cover and a top product roll is loaded, in accordance with example embodiments described herein.
Figure 34C:
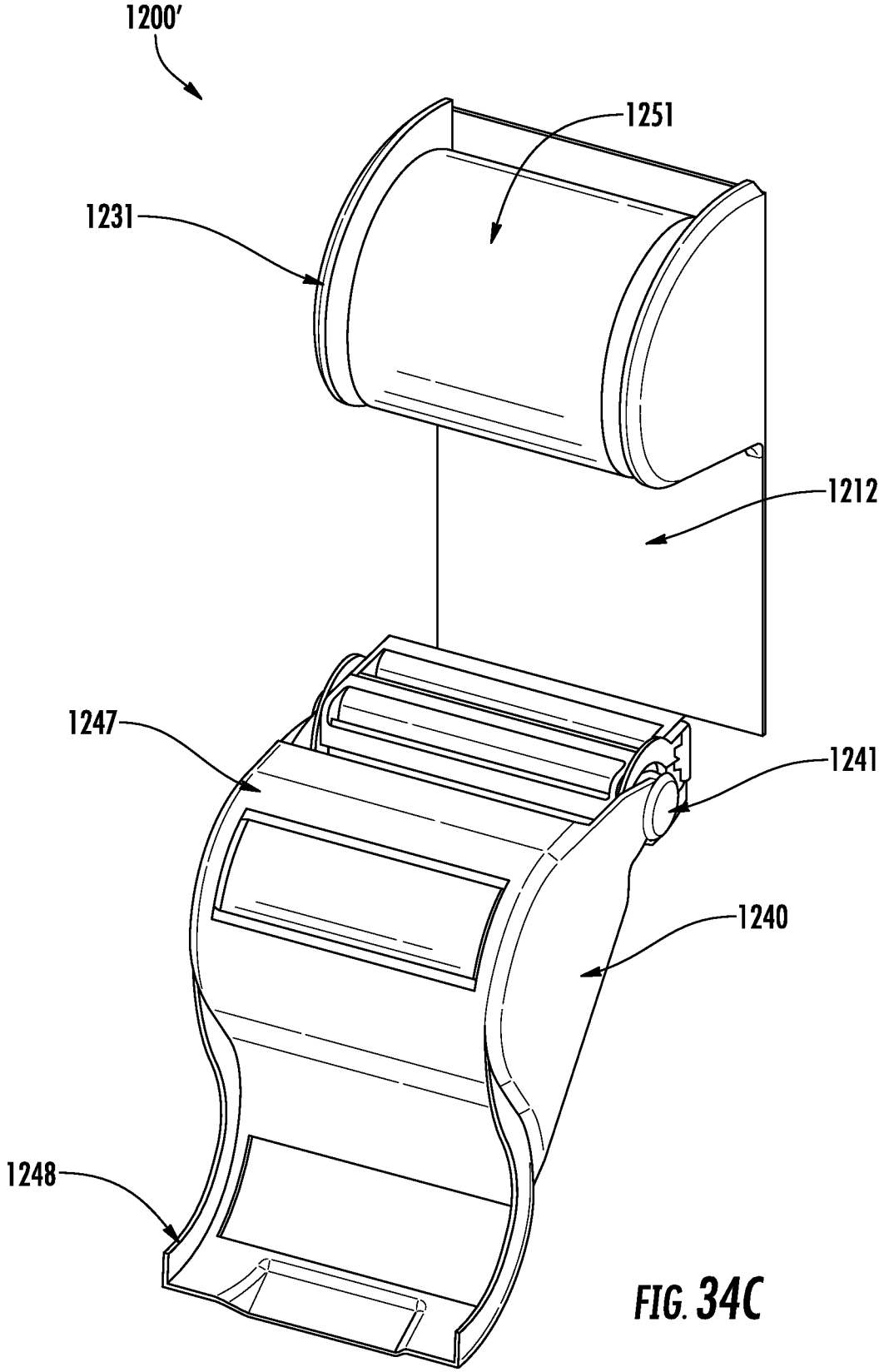

In some embodiments, the roll partition 1240 may be configured to rotate around the roll partition hinge 1241, such as from a closed position (FIGS. 33A and 33B) to an open position (FIGS. 34A-34C). Notably, the cover 1214 may, in some embodiments, be configured to rotate separately from the roll partition 1240. In this regard, the cover 1214 may have a separate hinge and/or may rotate around a separate axis than the roll partition 1240. Alternatively, in some embodiments, the cover and roll partition may be configured to rotate around the same axis. Further, in some embodiments, the cover and roll partition may be configured to rotate around the same axis, but also may be configured to be able to rotate separately.

Figure 36A:
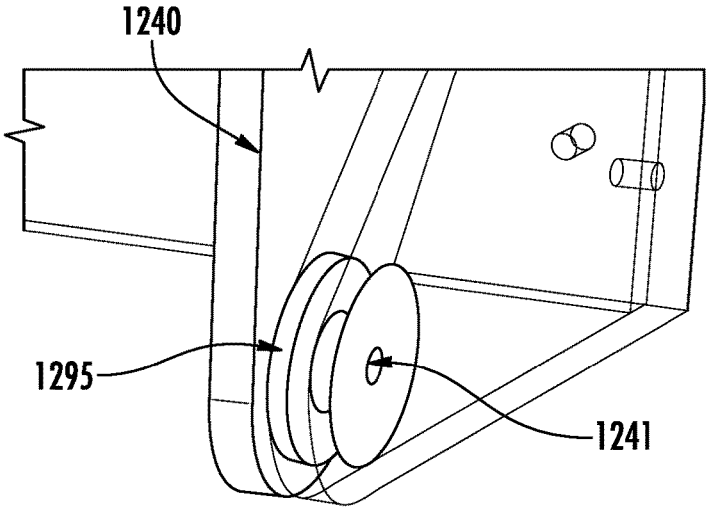
FIGS. 36A-36C illustrate example dampener systems for example product dispensers, in accordance with example embodiments described herein.
Figure 36B:
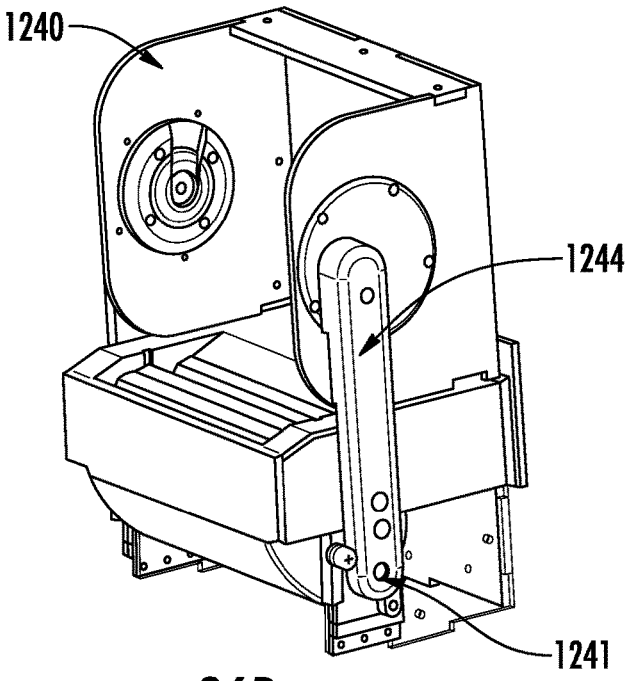
Figure 36C:
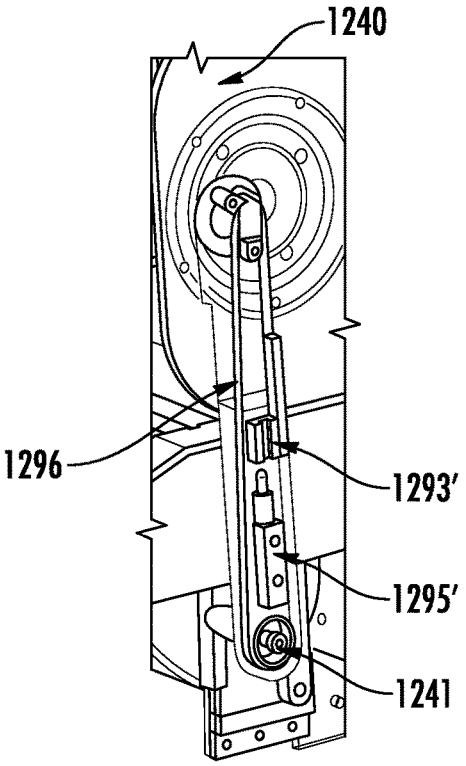
Figure 37B:
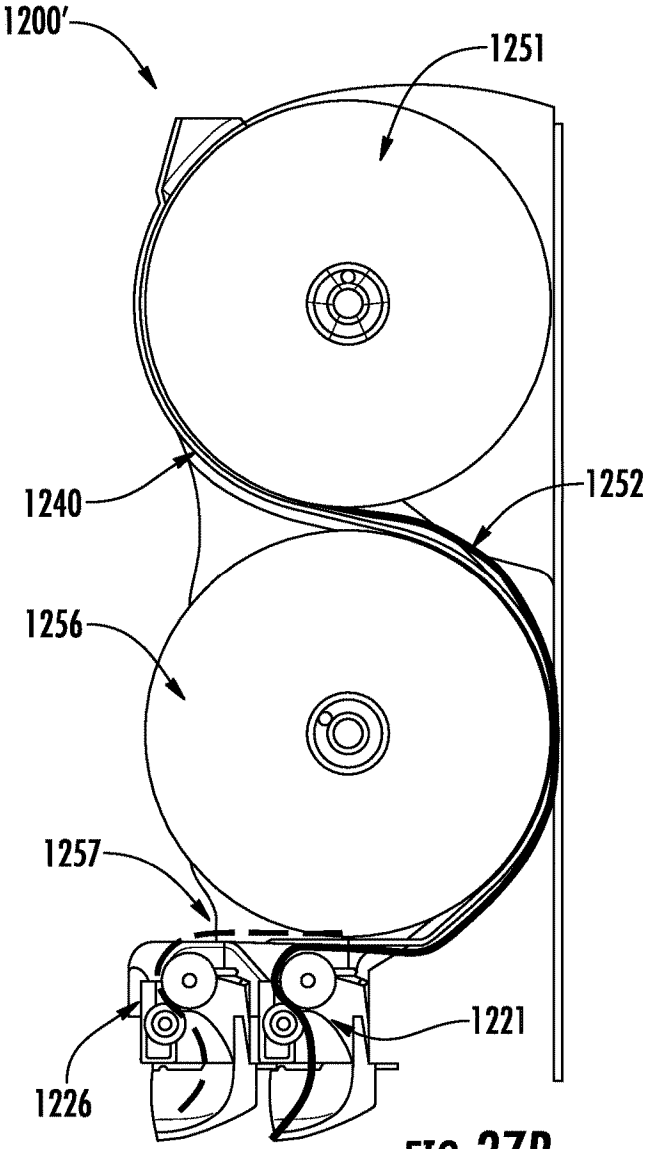
FIGS. 37A-37B illustrate cross-sectional views of the example product dispensers of FIGS. 33A and 33B, in accordance with example embodiments described herein.
Figure 37A:
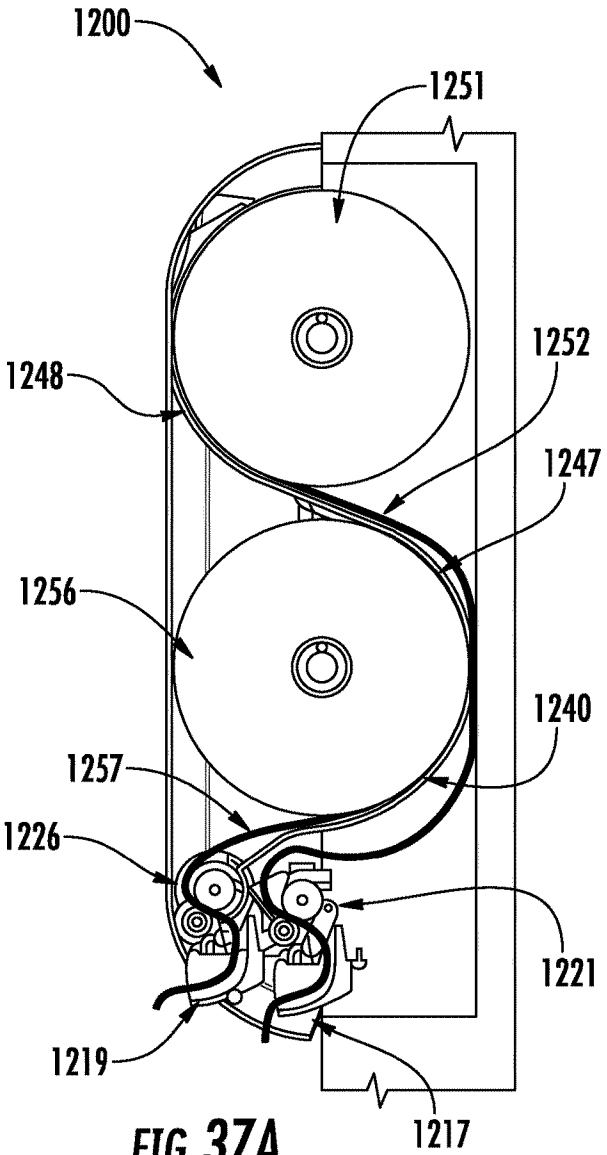

With reference to FIGS. 34A-34C, the roll partition 1240 has been rotated to the open position. In such an embodiment, the roll partition 1240 can fit within the cover 1214 (which is also in the open position). In this regard, the maintainer may have engaged the roll partition handle 1242 (shown in FIGS. 33A and 33B) and lowered the roll partition 1240 to the opened position. In some cases, such as shown in FIGS. 34A-34C, a second product roll 1256 may be already installed in the second roll holders 1236 of the roll partition 1240. This may add significant weight to the roll partition 1240. To aid in rotation of the roll partition 1240 and prevent damage (such as from the roll partition 1240 dropping under the influence of gravity into the opened cover 1214), some embodiments of the present invention provide a dampening system for dampening the rotation of the roll partition 1240. For example, a rotation dampener (e.g., a rotary vane dampener) may be positioned at the roll partition hinge 1241 to provide dampening during rotation. Additionally or alternatively, other dampening systems may be used, such as a frictional dampener located about the axis of rotation. For example, FIG. 36A illustrates a frictional dampener 1295 located about the roll partition hinge 1241. FIGS. 36B and 36C illustrate another possible dampener. With reference to FIG. 36B, in some embodiments, the roll partition 1240 may comprise a linkage arm 1244 that, in some cases, may aid and/or control rotation of the roll partition 1240 around the roll partition hinge 1241. For example, with reference to FIG. 36C, the linkage arm 1244 may house or cover a belt drive 1296 that moves along with rotation of the roll partition 1240 around the roll partition hinge 1241. In some such embodiments, a linear dampener 1295' can be used in conjunction with the belt drive 1296 to provide dampening and/or control rotation of the roll partition 1240. For example, the linear dampener 1295' may provide a resistance force to rotation of the belt drive 1296, such as through interaction with one or more structures associated with the belt drive, such as structure 1293'. Such a resistance force may be designed to provide for a slowed or controlled rotation of the belt drive 1296. Further information regarding the belt drive may be found in the description corresponding to the embodiments shown and described with respect to FIG. 61.

With the roll partition 1240 in the opened position, the maintainer is free to replace a depleted first (top) product roll with a new first product roll and feed the leading edge of the first product roll into the first dispensing mechanism 1221. In this regard, with reference to FIG. 34B, rotation of the roll partition 1240 (and, in some cases the nip cover 1285) to the open position has revealed access to the rear housing 1212 and the first nip 1261 of the first dispensing mechanism 1221. In particular, the maintainer may pull the leading edge of the first product roll 1251 along the rear housing 1212 and into the first nip 1261.

Figure 35A:
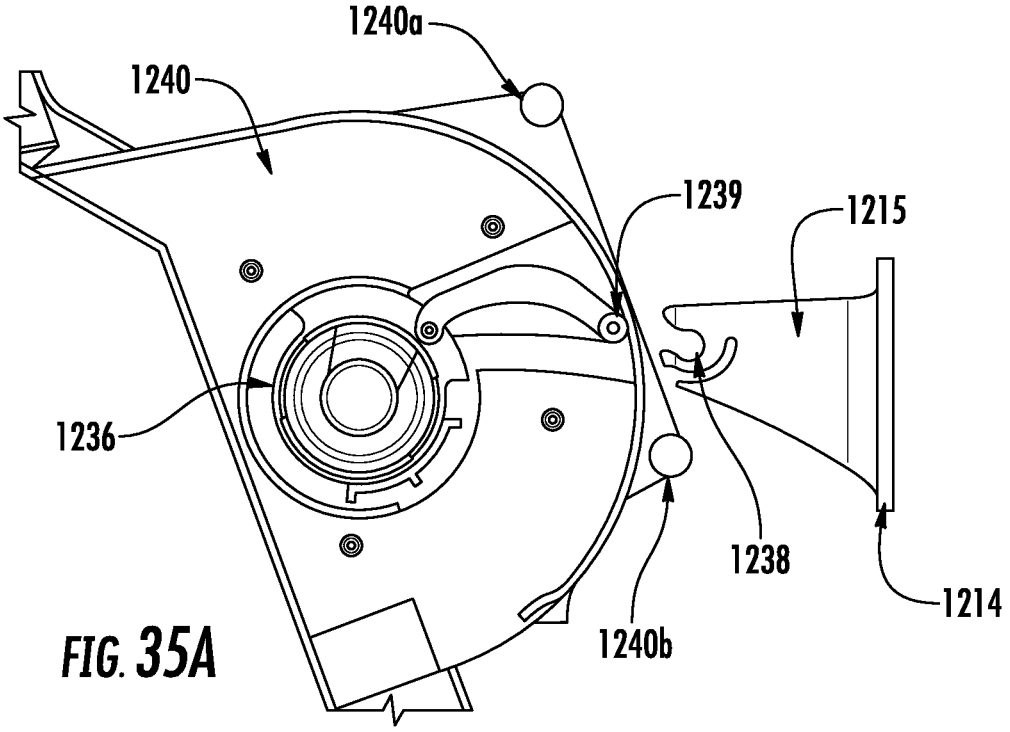
FIGS. 35A-35B illustrate an example roll partition that snaps into engagement with the dispenser housing, in accordance with example embodiments described herein.
Figure 35B:
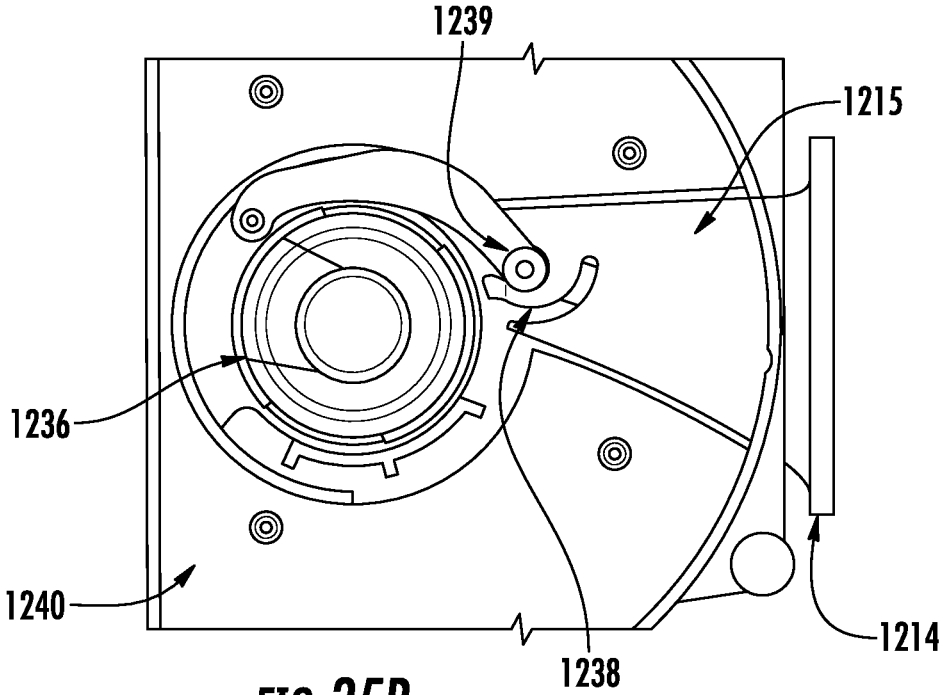

The maintainer may then close the roll partition 1240 and close the cover 1214, after which the dispenser 1200 will resume dispensing product to users. In some embodiments, the maintainer only needs to close the cover 1214 because the cover 1214 captures and in turn rotates the roll partition 1240 to a closed position. In some embodiments, the roll partition 1240 may be designed to attach to (e.g., snap into engagement with) the rear housing of the dispenser. In such embodiments, an audible snap may occur to provide confirmation to the maintainer that the roll partition 1240 has been properly re-installed inside the dispenser housing (into the closed position) for continued dispensing. FIGS. 35A-35B illustrate an example embodiment with a roll partition that includes a snap engagement with the dispenser housing. As shown in FIG. 35A, the roll partition 1240 includes a second roll holder 1236 that includes a pin 1239. As the roll partition 1240 moves from the open position (as shown in FIG. 35A) to the closed position (shown in FIG. 35B), the pin 1239 snaps into a receiving portion 1238 of a protrusion 1215 that extends from the rear housing 1214. Further information regarding how an example embodiment that utilizes the snap engagement works can be found herein, such as the example embodiments described and shown with respect to FIGS. 59A-I.

As detailed above, a benefit of using a roll partition is to provide separate web paths that limit contact between the product rolls and web paths. In this regard, with reference to FIGS. 37A and 37B, using a roll partition 1240 for example dispensers 1200, 1200' enables separation of the first product roll 1251 and first web path 1252 from the second product roll 1256 and second web path 1257. Indeed, in some embodiments, the shape of the first portion 1247 of the roll partition 1240 may cause it to act as a separator for web management purposes thereby creating a pathway for the web path 1252 leading to the first dispensing mechanism 1221 around the first portion 1247. In some embodiments, rollers (e.g., rollers 1240*a*, 1240*b* shown in FIG. 35A) or other web management features can be added to the dispenser 1200, 1200'. For example, one or more rollers may be positioned on the first portion 1247 of the roll partition 1240 to help guide the web path 1252. In some embodiments, the rollers or other web management features may reduce friction or static build-up due that would otherwise occur due to contact between the roll partition and the sheet product. Ultimately, the first product roll 1251 may be dispensed from a first chute 1217 and the second product roll 1256 may be dispensed from a second chute 1219—maintaining separation between the product rolls during the entire dispensing process.

In the illustrated embodiments of FIGS. 33A-37B, the second roll holders 1236 are fixed to the roll partition 1240. Other embodiments of the present invention, however, contemplate providing other configurations, such as providing that the second roll holders 1236 are movable relative to and separately from the roll partition 1240. For example, the second roll holders may separately pivot out of the roll partition or dispenser housing in a suitable manner as has been previously described in other concepts (such as in the example embodiment described above with respect to FIGS. 20A-D).

Figure 38A:
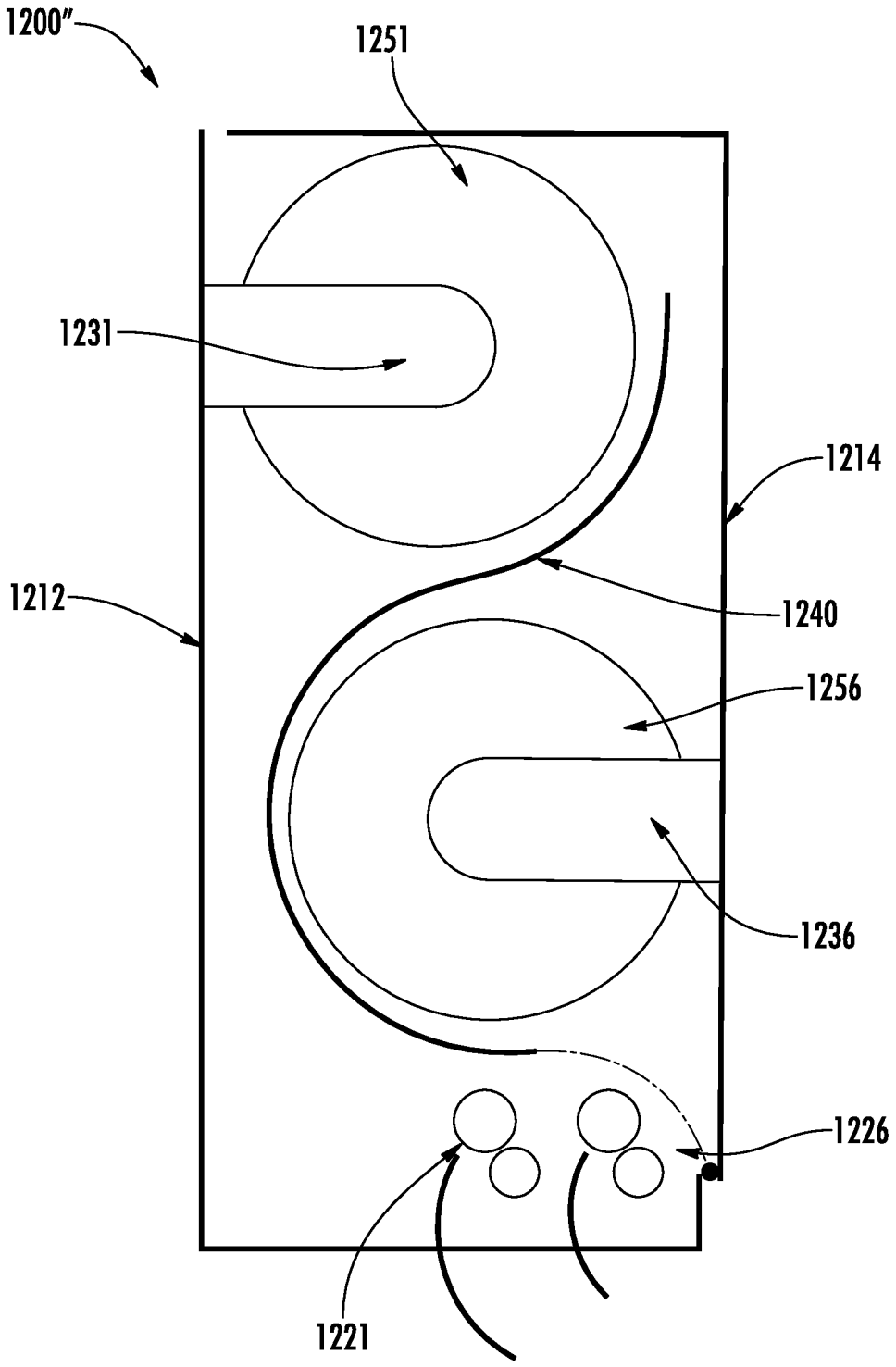
FIGS. 38A-38C illustrate an example product dispenser configured according to the Roll Partition concept, wherein the bottom roll holders are attached to the cover, in accordance with example embodiments described herein.
Figure 38B:
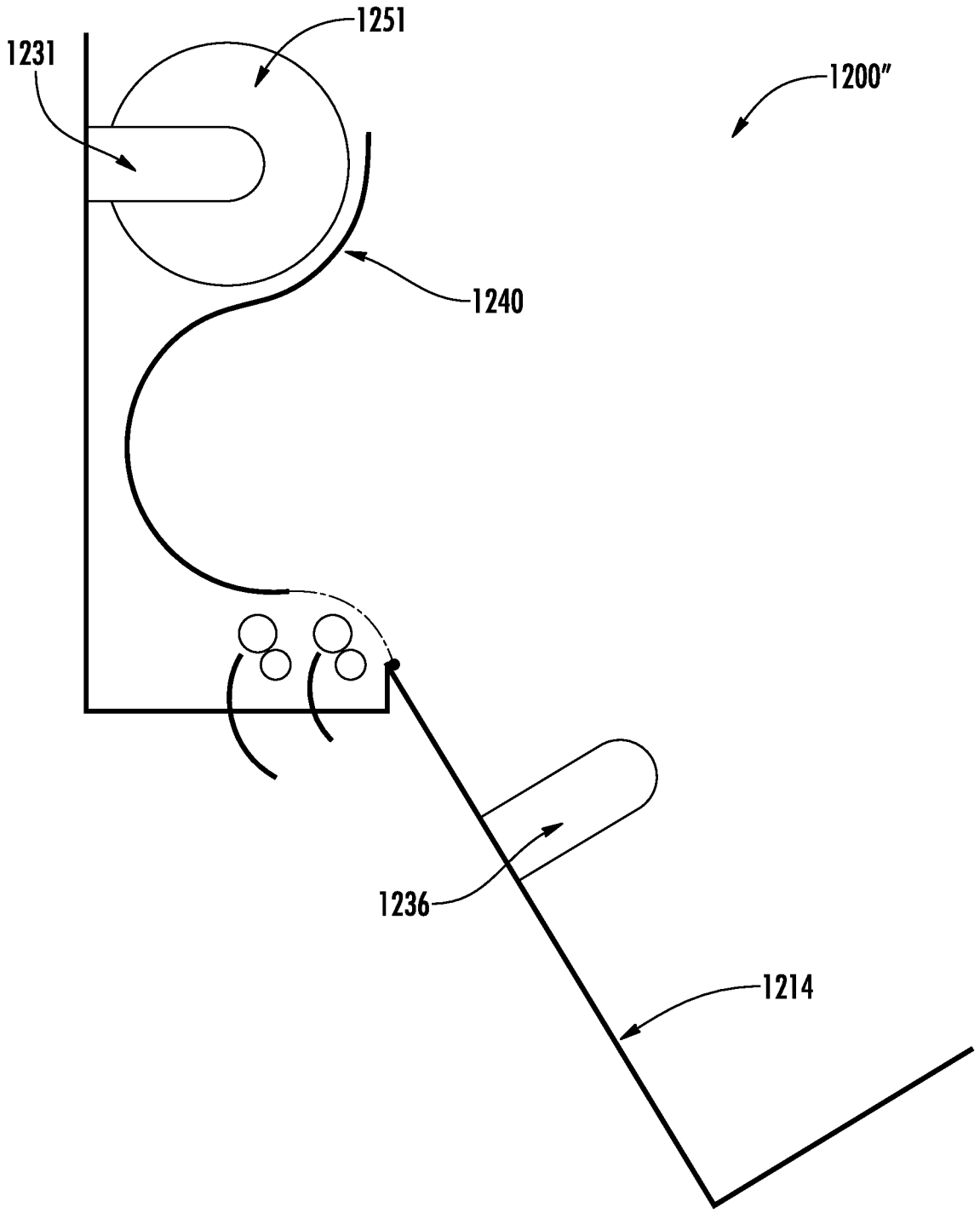
Figure 38C:
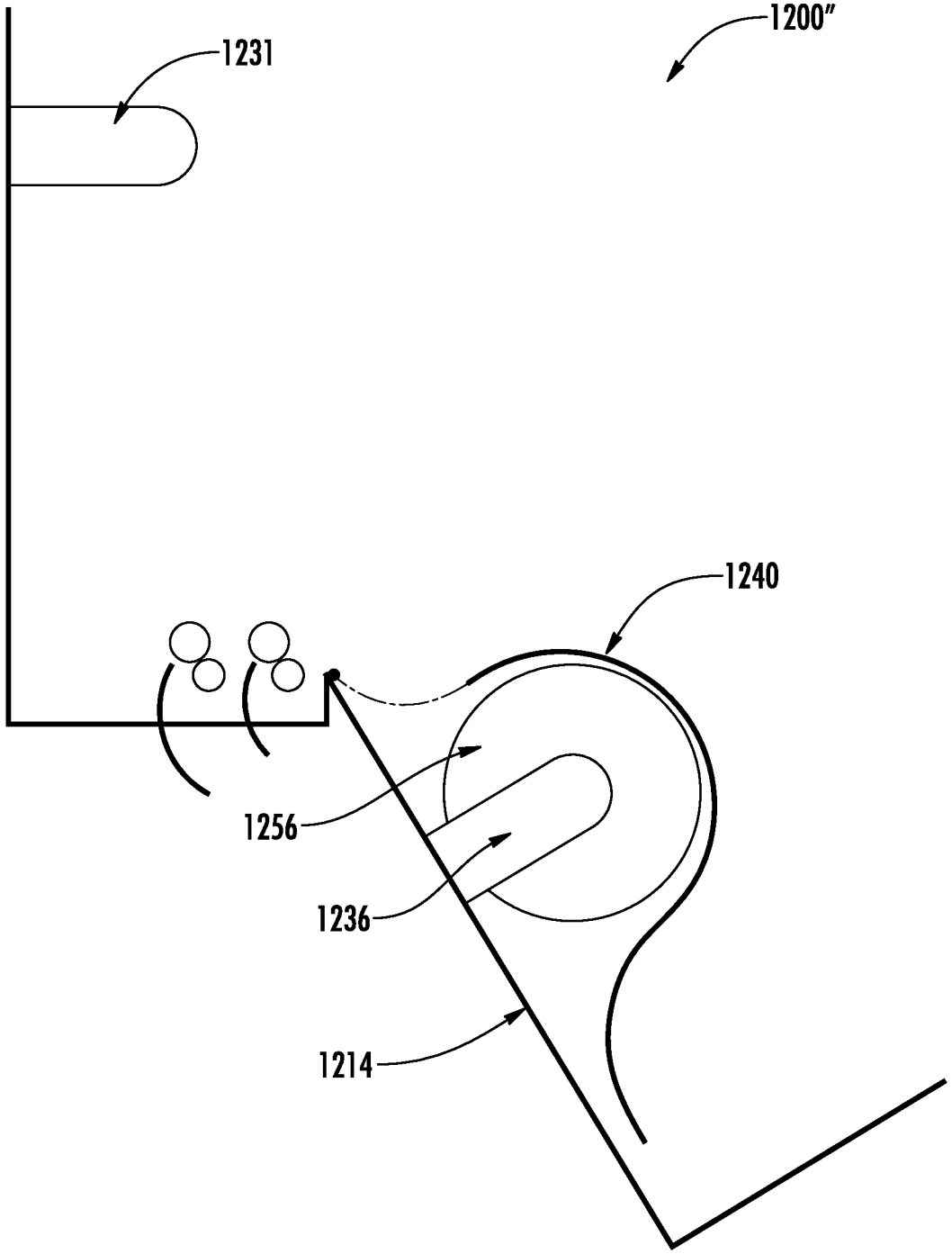

Another example configuration is shown in FIGS. 38A-38C. In the depicted embodiment, the dispenser 1200" includes a roll partition 1240 like prior described embodiments, however, the second roll holders 1236 in the depicted embodiment are attached directly to the cover 1214 (as opposed to the roll partition 1240). As shown in FIG. 38B, the second roll holders 1236 will rotate with the cover 1214 to the open position even while the roll partition 1240 stays in the closed position. The maintainer can then load the new second product roll. Additionally, the maintainer has the option to rotate the roll partition 1240 to the open position (shown in FIG. 38C). Notably, with the second product roll 1256 attached to the cover 1214, the weight of the roll partition 1240 is reduced, enabling easier rotation. In some embodiments, the cover 1214 may employ a dampening system, such as described above with respect to the roll partition.

Web Management

As has been described herein, the dispenser of various embodiments of the present invention might jam if the first drive roller draws the second roll web into the first nip, and the dispenser might likewise jam if the second drive roller draws the first roll web into the second nip. This tendency is described in further detail below with reference to FIGS. 40A-46. Further, the following description provides detail regarding possible web management features that can be used to avoid such issues. Though the following description focuses on web management features, various embodiments of the present invention described herein, including some embodiments previously described, employ some such web management features.

Figure 40A:
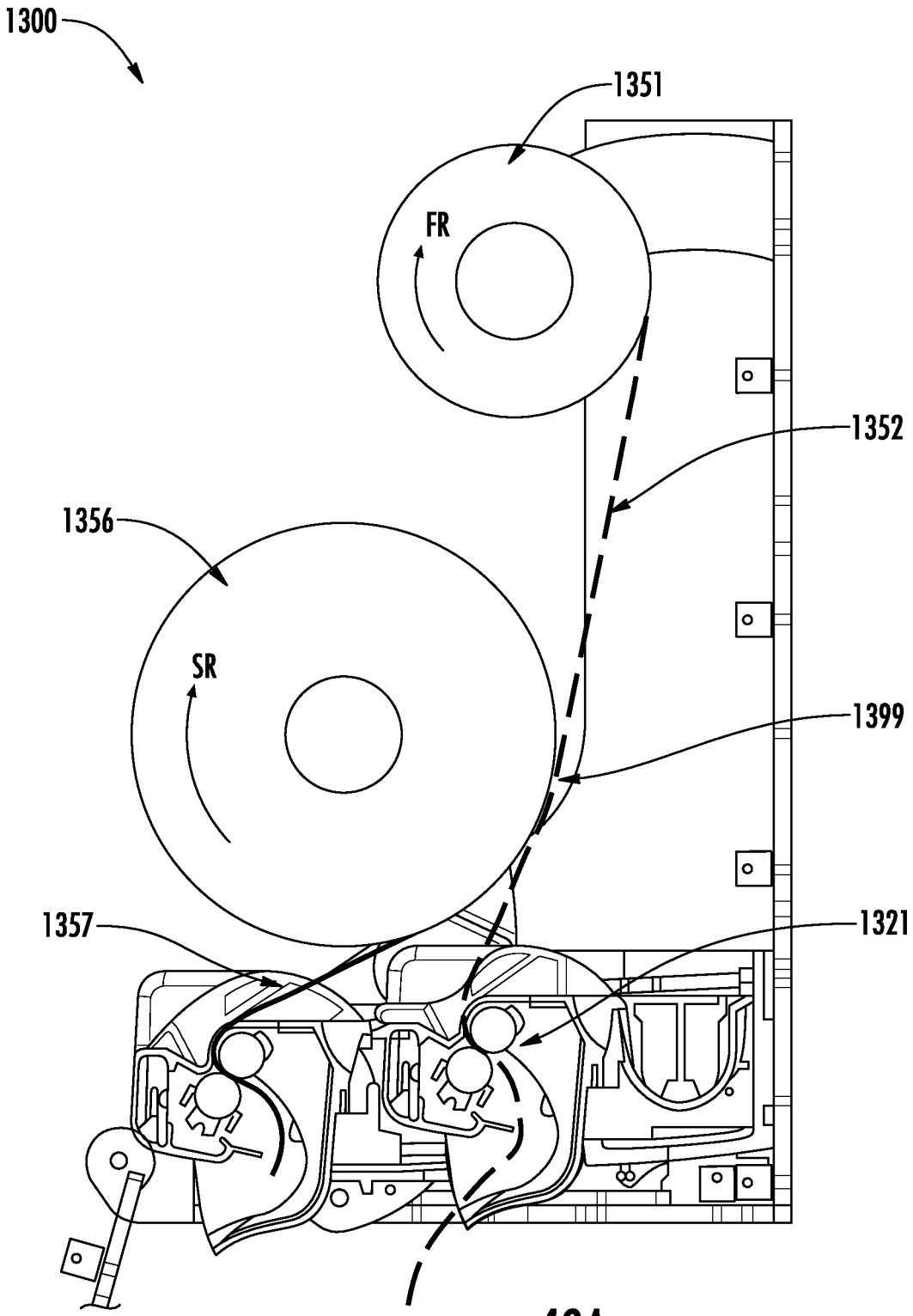
Figure 40B:
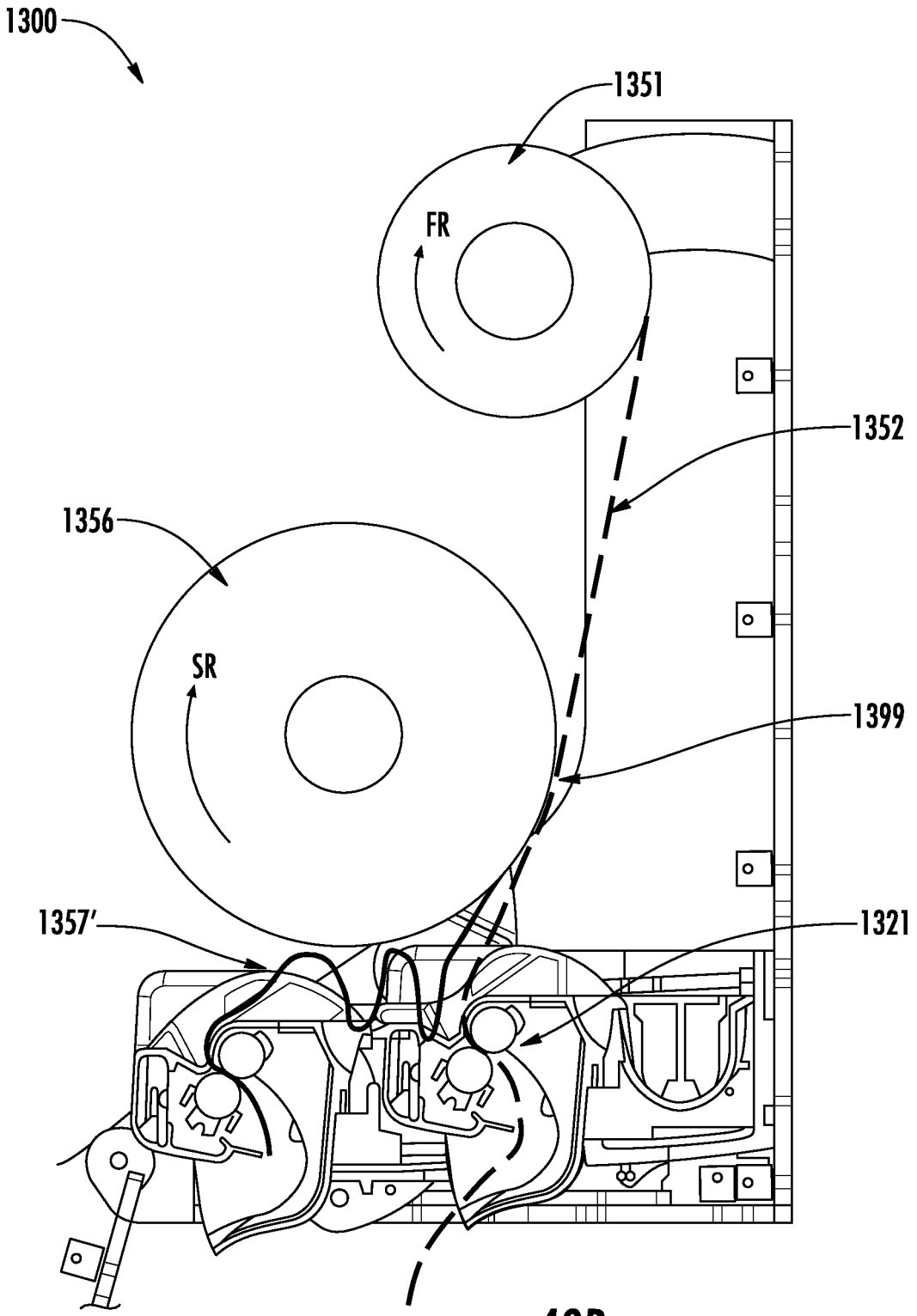
Figure 41:
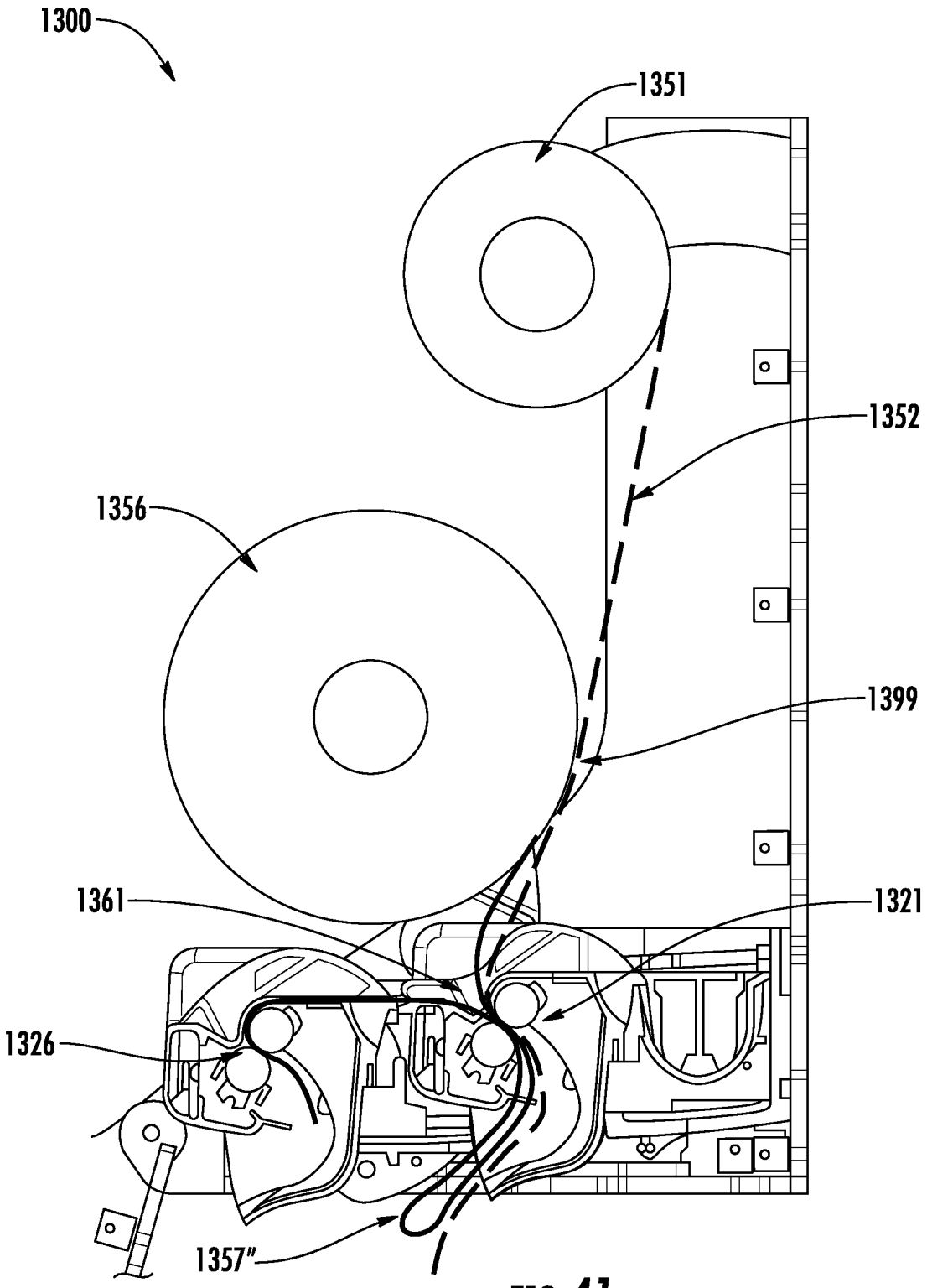

FIG. 40A shows an embodiment of a dispenser 1300 that does not include any web management features. In the depicted embodiment, the dispenser 1300 is dispensing from a condition in which the first product roll 1351 is smaller than the second product roll 1356, therefore the dispenser satisfies user commands for product by initially dispensing from the first product roll, which rotates the first product roll 1251 in a clockwise direction (FR). FIG. 40A also shows that the first roll web 1352 (dashed black line) contacts (at 1399) the second product roll 1356 due to the geometry of the dispenser 1300. Due to this contact, the first roll web 1352 may potentially cause the second product roll 1356 to rotate in a clockwise direction (SR) while the first dispensing mechanism 1321 dispenses the first roll web. Notably, FIG. 40A shows that the second roll web 1357 (solid red line) is in a taught condition. However, FIG. 40B shows the second roll web 1357' after the first roll web 1352 has rotated the second product roll 1356 and caused the second roll web 1357' to unwind and accumulate. FIG. 41 shows that the accumulating second roll web is prone to accumulating near the first nip funnel 1361, until the first dispensing mechanism 1321 catches the second roll web 1357" and pulls the second roll web 1357" into the first nip funnel 1361 and first dispensing mechanism 1321 as shown in FIG. 41. When this happens, the first dispensing mechanism 1321 draws the second roll web 1357 taught between the first dispensing mechanism 1321 and the second dispensing mechanism 1326, which may render the dispenser 1300 unable to deliver product to a user from either roll, and may require a maintainer to service the dispenser (e.g., create a jam scenario).

One way to lessen the above noted problem is shown in an example embodiment in FIG. 42, in which the cover 1314 includes a cover roller 1372 configured such that as the user closes the cover 1314, the cover roller 1372 displaces the first roll web 1352 towards the rear housing 1312 and away from contact with the second product roll 1356 or second roll web 1357. Further, the cover 1314 includes a cover divider 1373 that further aids in separating the first product roll 1351 and the second product roll 1351. Such web management features help avoid the likelihood of the second product roll 1356 rotating or accumulating the second roll web 1357, thereby helping avoid the risk of the second roll web 1357 feeding into both dispensing mechanisms and causing the dispenser to fail.

Figure 43:
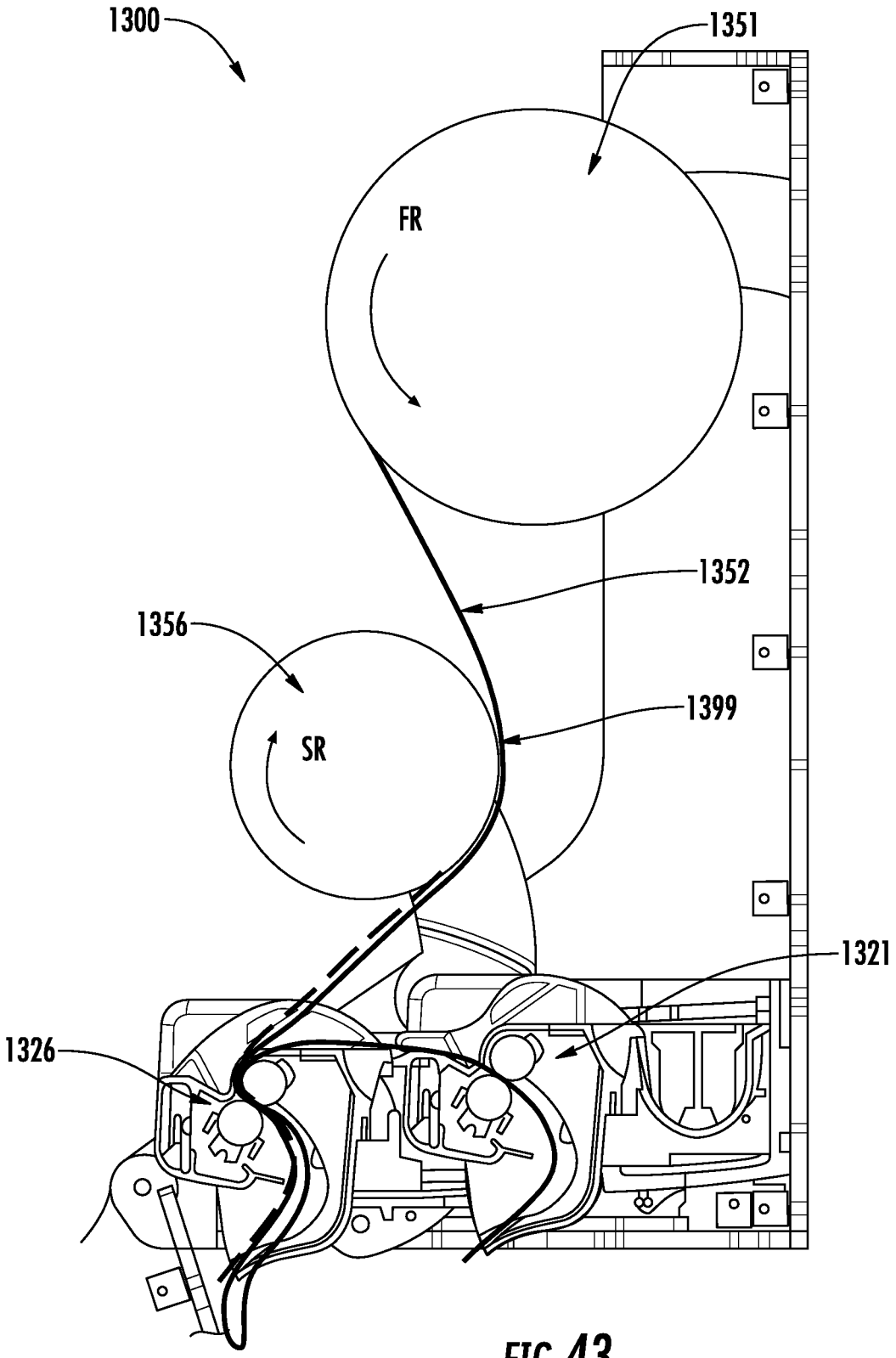

Likewise, a form of web management, such as the web management features described above, may be useful to help prevent the second product roll 1356 from contacting the first roll web 1352 and unwinding the first product roll 1351 enough that the second dispensing mechanism 1326 might draw in the first roll web 1352 and cause the dispenser 1300 to fail. FIG. 43 shows this type of failure with the first roll web 1352 (solid red line) captured by both the first dispensing mechanism 1321 and the second dispensing mechanism 1326 due to contact (at 1399) between the second product roll 1356 and the first roll web 1352. FIG. 44 shows that a cover roller 1372 helps prevent such contact and avoid the dispenser failure. FIG. 44 further shows that the cover 1314 may include a cover divider 1373 that prevents the first roll web 1352 from sagging below the cover roller 1372 and positively separates the first roll web 1352 from the second product roll 1356, thereby further preventing the first roll web 1352 and second product roll 1356 from contacting each other and potentially causing related dispensing failures. In some embodiments, the cover roller and cover divider may be referred to as web guide structures or web management features.

FIG. 45 shows yet another embodiment of web management in which the cover 1314 and second roll holders 1336 are coupled to a pivoting roller 1380 in a manner that nests the pivoting roller 1380 between the first nip funnel (not shown) of the first dispensing mechanism 1321 and the second nip funnel (not shown) of the second dispensing mechanism 1326 when the cover 1314 is open. This allows a maintainer to load either the first roll web 1352 (solid red line) into the first nip funnel and/or load the second roll web 1356 (dashed black line) into the second nip funnel without interference. Then the maintainer may close the cover as shown in FIG. 46 which causes the pivoting roller 1380 to move (e.g., through a linkage or other means) to a position near the rear housing 1312. For example, the cover 1314 may be pivotably connected to a first linkage 1382*a*, such that the first linkage 1382*a* rotates as the cover 1314 closes. Additionally, the first linkage 1382*a* may be connected to the second roll holders 1336 (or an associated arm thereof), such that the second roll holders 1336 rotate into the housing as the first linkage 1382*a* rotates. Further, the second roll holders 1336 may be connected to a second linkage 1382*b*, such that the second linkage 1382*b* rotates into the housing as the second roll holders 1336 rotate. Finally, the second linkage 1382*b* may be connected to a third linkage 1382*c* connected to the pivoting roller 1380, such that the third linkage 1382*c* and the pivoting roller 1380 rotate into the housing as the second linkage 1382*b* rotates. As the pivoting roller 1380 moves towards the rear housing 1312, it engages the first roll web 1352 and draws the first roll web 1352 towards the rear housing 1312 and away from contact with the second product roll 1356 that could potentially causing a dispensing failure.

As described above, some example embodiments of the present invention provide a dispenser that dispenses from the smaller product roll until it is depleted, after which time the dispenser dispenses from the remaining product roll. This preserves the larger product roll as a reserve to sustain the longest time between refills and also to create the soonest opportunity for the smaller product roll to deplete so that a maintainer may again replenish the dispenser. Although this principle is generally true, some embodiments of the dispenser may dispense several feet off the second product roll if the second product roll is full-size, even if the first product roll is the smaller roll. The purpose of firstly dispensing off of a full-size second product roll is to help prevent the risk of a pivoting arm or a nesting arm (such as in certain embodiments) from pressing the first roll web against the rear housing and thereby causing an obstruction to dispensing. By firstly dispensing several feet off of a full-size second product roll, the second product roll decreases in diameter enough for the pivoting arm or nesting arm to pivot away from the rear housing enough to avoid obstructing the first roll web when the first drive roller rotates to dispense product.

Color Coding

In some cases, it is possible for a maintainer to erroneously load the leading edge of the first product roll into the second dispensing mechanism, or alternatively to load the leading edge of the second product roll into the first dispensing mechanism. To help minimize the likelihood of this error, with reference to FIG. 47, some embodiments of the present invention provide a dispenser 1400 that uses color-coding to help the maintainer associate each roll holder with the proper nip funnel (of the proper dispensing mechanism). FIG. 47 illustrates that the first roll holders 1431 and first nip funnel 1461 are green, while the second roll holders 1436 and second nip funnel 1466 are blue. In various other embodiments, other colors may be used to associate each roll holder with the proper nip funnel. In some embodiments, different textures, visual patterns, or other cues may be used to associate each roll holder with the proper nip funnel.

Roll Holders

Some embodiments of the present invention seek to provide a dispenser with one or more sets of roll holders that are configured to enable easy loading of new sheet product rolls. As used herein "a roll holder" may refer to a set of roll holders that are used to support a single product roll (e.g., "a roll holder for supporting a product roll" and "a set of roll holders for supporting a product roll" may be used interchangeably). In particular, some of the example roll holders are designed to provide a snap-in feature that emits a "click" to give the maintainer confidence that the product roll was loaded properly. Additionally, some example roll holders are designed to provide a drag force on the product roll to aid in preventing overspin of the product roll during dispensing. An additional benefit may include providing a resistance force or feature that prevents the product roll from unintentionally falling out of engagement with the roll holder. Further, some of the example roll holders may be designed to enable a maintainer to simply "drop" the product roll into the roll holder for proper loading. With reference to, for example, FIGS. 33A, 34A, and 34B, an example dispenser 1200 may include a first set of roll holders 1231 for receiving and holding a first product roll 1251 and a second set of roll holders 1236 for receiving and holding a second product roll 1256. Notably, however, some embodiments of the present invention may have only one set of roll holders, such as for a dispenser that holds a single product roll for dispensing (whether full or partially depleted).

Some embodiments of the present invention contemplate a number of different configurations for roll holders that provide for easy and intuitive loading. For example, FIGS. 48-54C illustrate example roll holders.

FIGS. 48-51B illustrate example roll holders that operate using a cantilever arm for enabling the product roll to be received and secured by the roll holder. For example, with reference to FIG. 48, the roll holder 1531 includes a stationary body portion 1502 and a cantilevered portion 1505 that are connected to the dispenser housing, such as the rear portion 1512 of the dispenser (although the roll holder could be connected to another portion of the dispenser, such as a movable roll partition). Notably, the cantilevered portion 1505 is designed to be flexible to deflect outwardly from the product roll (such as in a direction DRH that is opposite the direction facing the opposed roll holder (not shown)). In this regard, the cantilevered portion 1505 of the roll holder 1531 may deflect along arrow DRH to enable a plug or core of the product roll (not shown) to be positioned within the center engagement portion 1510 of the roll holder 1531. This deflection may occur automatically as the maintainer pushes the product roll through a receiving slot 1503 of the roll holder 1531 and over a tab 1515. The depicted roll holder 1531 also includes guide tabs 1517 that help guide the plug or core of the product roll along a track toward the engagement feature 1510. Due to the rigidity of the cantilevered portion 1505, the cantilevered portion 1505 may be biased to return to its original position and securely engage the plug or core of the product roll with the engagement feature 1510.

Notably, the tab 1515 of the depicted roll holder 1531 may be designed to snap back into contact with the product roll (or a portion thereof) to create an audible noise—thereby providing an indication to the user that the product roll is properly loaded.

A slight variation of the depicted roll holder shown in FIG. 48 is illustrated in FIG. 49. In particular, a larger portion of the roll holder 1531' defines the cantilevered portion 1505', as the stationary body portion 1502' is smaller and only extends part of the way down the length of the roll holder 1531'.

Another similar embodiment of a roll holder can be seen in FIGS. 50A-50B. In the depicted embodiment, the roll holder 1531" includes a cantilevered portion 1505" with an engagement feature 1510" with a deep hole defined by a tab 1515". This deep hole provides a retention mechanism that makes it even more difficult to remove the product roll once it is loaded. Such a feature may be useful for roll holders that may be rotated into and out of the dispenser—as the retention mechanism may prevent the loaded product roll from unintentionally falling out of the roll holders during such rotation when the tab may align downward and retention is necessary to prevent gravity from causing the roll to drop out of the roll holder engagement feature 1510".

In some embodiments, the roll holder may include a drag feature that may provide a friction force against the product roll that helps to prevent overspin of the product roll after the motor ceases during dispensing. In this regard, once the motor stops pulling the product from the product roll there may be momentum that would cause the product roll to continue to spin. The friction force provided by the drag feature 1507" is designed to counteract that momentum and prevent or limit overspin. For example, the roll holder 1531 depicted in FIG. 48 includes a drag feature 1507 that presses up against the side of the product roll or a feature of the product roll (e.g., a plug or the core of the product roll). Likewise, the roll holder 1531" includes a similar drag feature 1507" that presses up against the side of the product roll or a feature of the product roll (e.g., a plug or the core of the product roll).

Yet another example embodiment of a roll holder that utilizes a cantilever portion is shown in FIGS. 51A-51B. In the depicted embodiment, the roll holder 1631 includes a stationary body portion 1602 and a cantilevered portion 1605 that are connected, such as via a rear stationary portion 1603, to the dispenser housing or a feature of the dispenser (such as a roll partition). The cantilevered portion 1605 includes an engagement feature 1610 that protrudes from the cantilevered portion 1605 toward the product roll (not shown). The engagement feature 1610 defines a tapered front edge 1626 that causes the cantilevered portion 1605 and the engagement feature 1610 to deflect in a direction opposite the product roll when the product roll is fed into the roll holder 1631. This deflection is illustrated in FIG. 51B with the cantilevered portion deflecting from left to right as shown along arrow $RH_{1631}$ at different times 1605, 1605', and 1605". Due to the rigidity of the cantilevered portion 1605, the cantilevered portion 1605 may be biased to return to its original position and securely engage the plug or core of the product roll with the engagement feature 1610. Notably, the engagement feature 1610 may also be designed with a back edge 1627 that is configured to abut against an internal circumferential surface of the product roll or a portion thereof (e.g., the plug or the core). The designed shape of the engagement feature 1610 may help maintain the product roll in engagement with the roll holder and prevent unintentional removal or release of the product roll.

FIGS. 52A-53B illustrate example roll holders that operate using a biased (e.g., spring-loaded) feature for enabling the product roll to be received and secured by the roll holder. For example, with reference to FIG. 52A, the roll holder 1731 includes a main body portion 1702 and an engagement portion 1704 that are connected to the dispenser housing or a feature of the dispenser (such as a roll partition). Notably, the engagement portion 1704 includes an engagement feature 1710 (e.g., a "button" or "latch") that is configured to bias (e.g., through a spring 1711 shown in FIG. 52B) to protrude outwardly of the engagement portion 1704. Similar to the engagement feature 1610 of FIGS. 51A-51B, the engagement feature 1710 defines a tapered front edge 1726 and an opposing back edge 1727. As the product roll is fed into the guide slot 1703 of the engagement portion 1704, the product roll will interact with the tapered front edge 1726 of the engagement feature 1710 thereby forcing the engagement feature 1710 against the bias of the spring 1711 and into the roll holder 1731 (such as shown in FIG. 52B which is a cross-sectional view taken along line 52B in FIG. 52A, but with the engagement feature 1710 in a withdrawn position inside the roll holder). With the engagement feature 1710 inside the roll holder, the plug or core of the product roll may pass into the center of the engagement portion 1704. Due to the bias, the engagement feature 1710 will return to its original position (shown in FIG. 52A) and securely engage the plug or core of the product roll with the engagement feature 1710. The back edge 1727 of the engagement feature 1710 may be configured to abut against an internal circumferential surface of the product roll or a portion thereof (e.g., the plug or the core) to maintain the product roll in engagement with the roll holder and prevent unintentional removal or release of the product roll. Additionally, the raised portion 1707 of the engagement portion 1704 may provide additional support for maintaining the product roll within the roll holder. Likewise, as similar to described above, in some embodiments, the raised portion 1707 may act as a drag feature to help prevent overspin of the product roll.

Yet another example embodiment of a roll holder that utilizes a biased feature is shown in FIGS. 53A-53B. In the depicted embodiment, the roll holder 1831 includes an engagement portion 1804 and is connected to a feature of the dispenser (such as a roll partition), although the roll holder 1831 could, in some embodiments, be connected to the dispenser housing, such as the rear portion (e.g., via a stationary body portion). The engagement portion 1804 includes an engagement feature 1810 (e.g., a "center piece") that is configured to bias (e.g., through a spring 1811 shown in FIG. 53B) to protrude outwardly of the engagement portion 1804. As the product roll (or the plug 1859 thereof, such as shown in FIG. 53B) is fed into the guide slot 1803 of the engagement portion 1804, the product roll will interact with a tapered front edge 1826 of the engagement feature 1810 thereby forcing the engagement feature 1810 against the bias of the spring 1811 and into the roll holder 1831. With the engagement feature 1810 inside the roll holder, the plug (e.g., plug 1859) or core of the product roll may pass into the center 1819 of the engagement feature 1810. Due to the bias, the engagement feature 1810 will return to its original position (shown in FIGS. 53A and 53B) and securely engage the plug or core of the product roll with the engagement feature 1810. The raised portion 1807 of the engagement feature 1810 may provide additional support for maintaining the product roll within the roll holder. Likewise, as similar to described above, in some embodiments, the raised portion 1807 may act as a drag feature to help prevent overspin of the product roll. Notably, a difference between the roll holder 1831 shown in FIGS. 53A-53B and the roll holder 1731 shown in FIGS. 52A-52B is that that engagement feature 1810 (which is the biased portion) includes the raised portion 1807 such that it completely surrounds the plug or core of the product roll. This provides additional surface area that flexes with insertion of the product roll (e.g., the engagement feature 1810 (which deflects) is larger than the engagement feature 1710 (which also deflects)), providing an easier loading experience for the maintainer.

FIGS. 54A-54C illustrate another example roll holder that operates using a linkage feature for enabling the product roll to be received and secured by the roll holder. For example, with reference to FIG. 54A, the roll holder 1931 includes a main body portion 1902, an engagement portion 1904, and a linkage 1984. The roll holder 1931 may be connected to the dispenser housing or a feature of the dispenser (such as a roll partition). The engagement portion 1904 includes a guide slot 1903 defined to receive the product roll (e.g., a plug 1959 of the product roll). As will be described in greater detail herein with respect to various example retention mechanisms, the linkage 1984 may be configured to cause a tab 1985 to either protrude into the engagement portion 1904 to engage a wall 1958 of the plug 1959 (shown in FIGS. 54B and 54C) or retract from the engagement portion 1904 to enable easy insertion and removal of the plug 1959 (shown in FIG. 54A). In some embodiments, the tab 1985 may still protrude slightly into the engagement portion 1904 even when "retracted" so that it can create an audible "snap" noise when the plug 1959 passes over the tab 1985 during loading (e.g., insertion of the plug 1959 into the engagement portion 1904). Such a "snap" noise gives an indication to the maintainer that the product roll was properly loaded.

As noted above, some embodiments of the present invention may provide a retention mechanism for one or more sets of roll holders for the dispenser. In this regard, as detailed herein, some embodiments of the present invention provide a dispenser that includes one or more sets of movable roll holders. For example, FIGS. 6-38C provide a number of various examples of dispensers that include movable roll holders. As a particular example, FIGS. 33A-38C illustrate various configurations of dispensers that include a roll partition. In such example embodiments, with reference to FIG. 33A, a second set of roll holders 1236 for receiving and holding a second product roll 1256 are positioned on the roll partition 1240 and are movable by virtue of movement of the roll partition 1240. Notably, as the roll holder (and, in some embodiments, the roll partition) moves, such as from a vertical orientation (shown in FIG. 33A) to a generally horizontal orientation (shown in FIG. 34), the installed product roll may fall out due to gravity and orientation of the guide slot of the roll holder. For example, with reference to FIG. 48, the guide slot 1503 may generally face upwardly and outwardly when the roll holder 1531 is in the first or vertical orientation (e.g., the roll holder is within the dispenser housing in the position to receive the replacement product roll). However, upon rotation of, for example, the roll partition and roll holders to the second or generally horizontal orientation (e.g., shown in FIG. 34) the guide slot 1503 may generally face downwardly. Thus, the force of gravity on the product roll along with the alignment of the guide slot 1503 to the downward direction may cause the product roll to fall out of the roll holders.

Some embodiments of the present invention seek to provide a retention mechanism for the roll holders that keep the product roll installed even during and after movement of the roll holders. In some embodiments, the retention mechanism is configured to retract or be removed from secure engagement with the product roll when the roll holder is in the stowed position or generally vertical orientation so as to enable easy removal and loading. Some embodiments of the present invention contemplate a number of different configurations for retention mechanisms for roll holders.

FIGS. 54A-56B illustrate some example embodiments of roll holders that use a trigger that forces a tab or similar feature into and out of engagement to secure the product roll in the roll holder. For example, FIGS. 54A-54C illustrate an example roll holder 1931 with a retention mechanism in the form of a linkage. As noted above, with reference to FIG. 54A, the roll holder 1931 includes a main body portion 1902, an engagement portion 1904, and a linkage 1984. Notably, the depicted embodiment is designed to be movable so as to move into and out of the dispenser housing. In this regard, the retention mechanism is designed to use the dispenser housing (not shown) to activate the retention mechanism for securing the product roll from removal. To explain, the main body portion 1902 defines a back edge 1901 that is configured to abut the dispenser housing (or a related portion thereof). Further, the roll holder 1931 includes a trigger 1987 that is biased to protrude outwardly from the back edge 1901 of the roll holder 1931 (shown in FIG. 54B).

With reference to FIG. 54A, when the roll holder 1931 is disposed inside the dispenser in the stowed position, the trigger 1987 is forced inside the main body portion 1902 by the force of the dispenser housing on the back edge 1901 of the roll holder 1931. In this position, a tail 1981 of the linkage 1984 is disposed inside a hole 1988 of the trigger 1987 (this is due to a bias 1983 forcing the tail 1981 of the linkage 1984 generally toward the hole 1988). With the tail 1981 inside the hole 1988, a tab 1985 at the other end of the linkage 1984 is retracted from substantially blocking the wall 1958 of the product roll plug 1959 from removal—thereby enabling easier removal or loading (e.g., while the roll holder 1931 is in the stowed position in the dispenser—see e.g., the position of the roll holder 1236 shown in FIG. 33A).

With reference to FIG. 54B, when the roll holder 1931 is moved to an unstowed position (e.g., the roll partition 1240 containing the roll holder 1236 is rotated downwardly, such as shown in FIG. 34), the trigger 1987 is biased (e.g., through a spring 1989*a*) and now free to extend outwardly from the back edge 1901. However, as the trigger 1987 moves, a raised portion 1989 of the trigger 1987 forces the tail 1981 of the linkage 1984 to retract out of the hole 1988 against its bias. In response, the tab 1985 of the linkage 1984 protrudes into the engagement portion 1904 to engage the wall 1958 of the plug 1959 (shown in FIGS. 54B and 54C). This interaction between the tab 1985 and the product roll causes the product roll to be securely engaged within the roll holder 1931 including, for example, in an instance in which the roll holders 1931 have rotated to face generally downwardly such that gravity and the alignment of the guide slot 1903 may otherwise cause the product roll to fall out of engagement with the roll holder.

FIGS. 55A-55C illustrate another example embodiment of roll holders that use a trigger that forces a tab or similar feature into and out of engagement to secure the product roll in the roll holder. For example, with reference to FIG. 55A, the depicted embodiment of the roll holder 2031 is designed to be movable so as to move into and out of the dispenser housing. In this regard, the retention mechanism is designed to use the dispenser housing (not shown) to activate the retention mechanism for securing the product roll from removal. To explain, the main body portion 2002 defines a back edge 2001 that is configured to abut the dispenser housing (or a related portion thereof). Further, the roll holder 2031 includes a trigger 2087 that is biased to protrude outwardly from the back edge 2001 of the roll holder 2031 (shown in FIG. 55A).

With reference to FIG. 55B, when the roll holder 2031 is disposed inside the dispenser in the stowed position, the trigger 2087 is forced inside the main body portion 2002 by the force of the dispenser housing pressing against the trigger 2087. In this position, a blocking element 2081 of the trigger 2087 is positioned to hold a retention pin 2085 inside the main body 2002 of the roll holder 2031 in a retracted position (this is due to a bias forcing the retention pin 2085 generally toward the product roll). In the retracted position, the retention pin 2085 is retracted from substantially blocking the wall of the product roll plug 2059 from removal—thereby enabling easier removal or loading (e.g., while the roll holder 2031 is in the stowed position in the dispenser—see e.g., the position of the roll holder 1236 shown in FIG. 33A).

With reference to FIG. 55C, when the roll holder 2031 is moved to an unstowed position (e.g., the roll partition 1240 containing the roll holder 1236 is rotated downwardly, such as shown in FIG. 34), the trigger 2087 moves out of engagement with a portion of the dispenser housing. In this regard, the force being applied by the dispenser housing against the trigger 2087 is removed and a bias being applied to the trigger 2087, such as a spring (not shown) inside the main body 2002 of roll holder 2031, causes the trigger 2087 to extend outwardly from the back edge 2001. As the trigger 2087 moves, the blocking element 2081 of the trigger 2087 moves out of engagement with a portion of the retention pin 2085 (which is otherwise retained within the main body 2002 by the blocking element 2081). With the blocking element 2081 out of engagement with the retention pin 2085, the bias of the retention pin 2085 (e.g., a spring attached to the retention pin 2085) causes the retention pin 2085 to extend out of the main body 2002 and toward the product roll to engage with the product roll plug 2059 (e.g., the retention pin 2085 is shown retracted within the main body 2002 in FIG. 55B and extended in contact with the product roll plug 2059 in FIG. 55C). The interaction between the retention pin 2085 and the product roll causes the product roll to be securely engaged within the roll holder 2031 including, for example, in an instance in which the roll holders 2031 have rotated to face generally downwardly such that gravity and the alignment of the guide slot may otherwise cause the product roll to fall out of engagement with the roll holder. Upon return of the roll holder 2031 to engage with the dispenser (e.g., when the roll holder 2031 returns to the vertical position), the dispenser housing engages with and forces the trigger 2087 back into the main body 2002. Further, however, the trigger 2087 and/or retention pin 2085 may include a ramp or other feature that causes the trigger 2087 to force the retention pin 2085 to retract back into the main body 2002 as the trigger 2087 itself is pushed back into the main body 2002. In this manner, the retention pin 2085 releases from engagement with the product roll (such as to enable removal by a maintainer).

FIGS. 56A-56B illustrate another example embodiment of roll holders that use a trigger that forces a tab or similar feature into and out of engagement with the product roll to secure it within the roll holder. For example, with reference to FIG. 56A, the depicted embodiment of the roll holder 2131 is designed to be movable so as to move into and out of the dispenser housing. In this regard, the retention mechanism is designed to use the dispenser housing (not shown) to activate and/or deactivate the retention mechanism for securing the product roll from removal and/or freeing the product roll for removal. To explain, a main body portion 2102 of the roll holder 2131 defines a back edge 2101 that is configured to abut the dispenser housing (or a related portion thereof). Additionally, the roll holder 2131 includes a cantilevered portion 2104 that is configured to flex in a direction opposite to the product roll to enable loading of the product roll. Further, the roll holder 2131 includes a trigger 2187 that is biased to protrude outwardly from the back edge 2101 of the roll holder 2131 (shown in FIG. 56A).

With reference to FIG. 56B, when the roll holder 2131 is disposed inside the dispenser in the stowed position, the trigger 2187 is forced inside the main body portion 2102 by the force of the dispenser housing on the back edge 2101 of the roll holder 2131. In this position, a blocking element 2181 (e.g., a wedge) of the trigger 2187 is positioned past an edge portion 2105 of the cantilevered portion 2014 such that the cantilevered portion 2104 is free to flex in the direction opposite the product roll (e.g., the cantilevered portion 2014' has deflected past the blocking element 2181). This may be caused, for example, during insertion of a plug 2159 of the product roll over a tapered front edge 2126 of the engagement feature 2185 for holding the product roll. When the blocking element 2181 is positioned past the edge 2105 of the cantilevered portion 2104, the product roll is more easily removed or replaced. This may occur, for example, while the roll holder 2131 is in the stowed position in the dispenser (see e.g., the position of the roll holder 1236 shown in FIG. 33A).

With reference to FIGS. 56A-56C, when the roll holder 2131 is moved to an unstowed position (e.g., the roll partition 1240 containing the roll holder 1236 is rotated downwardly, such as shown in FIG. 34), the trigger 2187 is free to extend outwardly from the back edge 2101 (such as due to a bias on the trigger 2187). However, with reference to FIG. 56C, as the trigger 2187 moves, the blocking element 2181 moves to abut (e.g., underneath) the edge 2105 of the cantilevered portion 2104. In this regard, the cantilevered portion 2104 is not free to deflect and, thus, the product roll is not freely removable, as the engagement feature 2185 is secure within the plug 2159 of the product roll. This interaction between the engagement feature 2185 and the product roll causes the product roll to be securely engaged within the roll holder 2131 including, for example, in an instance in which the roll holders 2131 have rotated to face generally downwardly such that gravity and the alignment of the guide slot may otherwise cause the product roll to fall out of engagement with the roll holder.

FIGS. 57A-59G and 61 illustrate some example embodiments of roll holders that operate to change the orientation of the engagement feature of the roll holder to always remain generally upward (even when the roll holder is otherwise in a generally horizontal orientation, such as the roll holder 1236 in FIG. 34) in order to prevent the product roll from unintentionally falling out of the roll holder. For example, FIGS. 57A-57B illustrates an example dispenser 2200 with a set of roll holders 2236 that are attached to a roll partition 2240. As detailed herein, the roll partition 2240 is configured to be rotated (such as around axis 2241) between a stowed position within the dispenser housing (shown in FIG. 57A) to an unstowed position out of the dispenser housing (shown in FIG. 57B). In the depicted embodiment, the roll holder 2236 is attached to a linkage 2295 at connection point 2292. The linkage 2295 is rotatably attached to the dispenser housing about axis 2293. The connection point 2292 between the linkage 2295 and the roll holder 2236 is configured to ride within a track 2297 within the roll partition 2240 as the roll partition 2240 rotates. In this regard, as the roll partition 2240 rotates, the orientation of the roll holder 2236 stays substantially (or generally) constant (as the connection to the linkage 2295 causes the roll holder 2236 to rotate to maintain a generally upward and outward orientation of the guide slot 2203). For example, the orientation of the guide slot 2203 of the roll holder 2236 is the same between FIGS. 57A and 57B despite the fact that the roll partition 2240 has rotated from a vertical orientation (FIG. 57A) to a horizontal orientation (FIG. 57B). Although the above example describes that the orientation of the guide slot is the same, in some embodiments, the orientation of the guide slot may not stay the same and may just maintain a generally upward and/or outward orientation as the roll holders rotate.

FIGS. 58A-58D illustrate another example embodiment of roll holders that operate to change the orientation of the engagement portion to maintain the product roll within the roll holder. For example, with reference to FIG. 58A, the depicted embodiment of the roll holder 2331 is designed to be movable so as to move into and out of the dispenser housing. In this regard, the retention mechanism is designed to use the dispenser housing (not shown) to control orientation of the engagement portion 2380 for securing the product roll from unintentional removal as the roll holders 2331 rotate. To explain, the main body portion 2302 defines a back edge 2301 that is configured to abut the dispenser housing (or a related portion thereof). Further, the roll holder 2331 includes a trigger 2387 that is biased to protrude outwardly from the back edge 2301 of the roll holder 2331 (shown in FIG. 58C), such as due to a spring (not shown) that is positioned within the main body 2302 of the roll holder 2331 and configured to act on the trigger 2387.

Figure 58A:
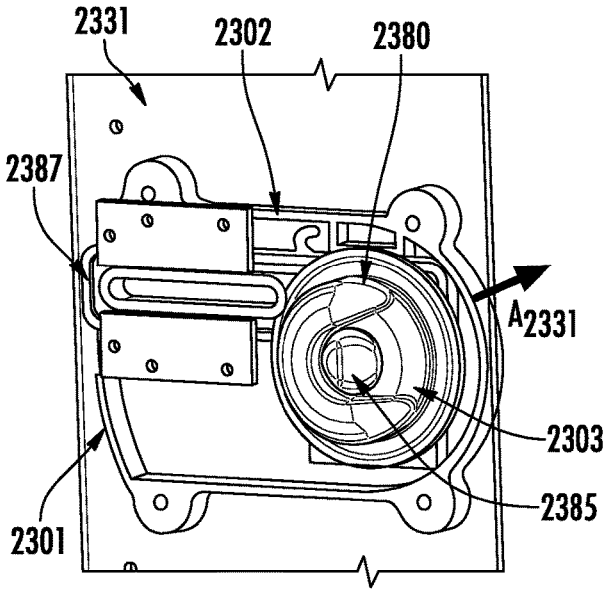
Figure 58B:
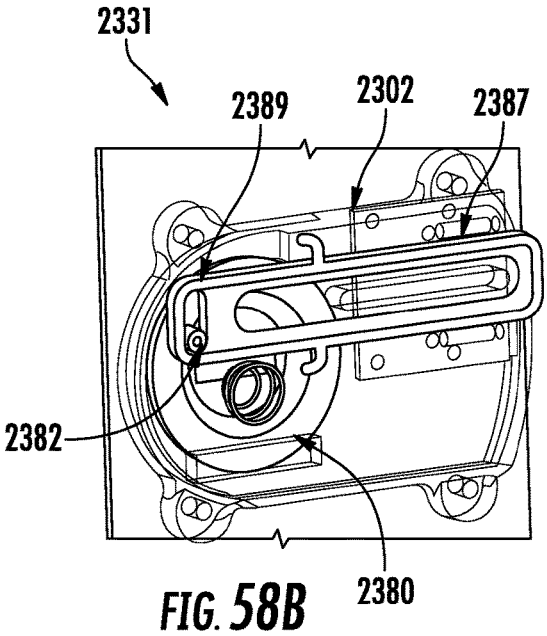

With reference to FIGS. 58A and 58B, when the roll holder 2331 is disposed inside the dispenser in the stowed position, the trigger 2387 is forced inside the main body portion 2302 by the force of the dispenser housing on the trigger 2387. In this position, a track 2389 of the trigger 2387 engages with and forces a pin 2382 of the engagement portion 2380 to a stowed position (shown in FIG. 58B). In this position, the guide slot 2303 of the engagement portion 2380 faces generally outwardly and upwardly (e.g., see arrow $A_{2331}$) enabling easy access for the maintainer for loading and unloading the product roll with respect to the engagement feature 2385.

Figure 58C:
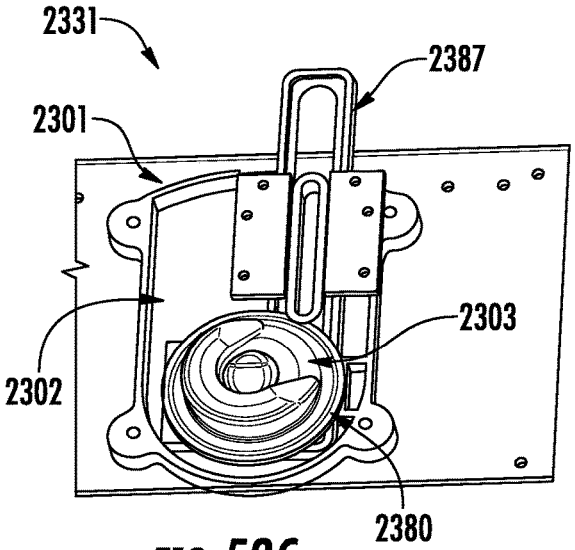
Figure 58D:
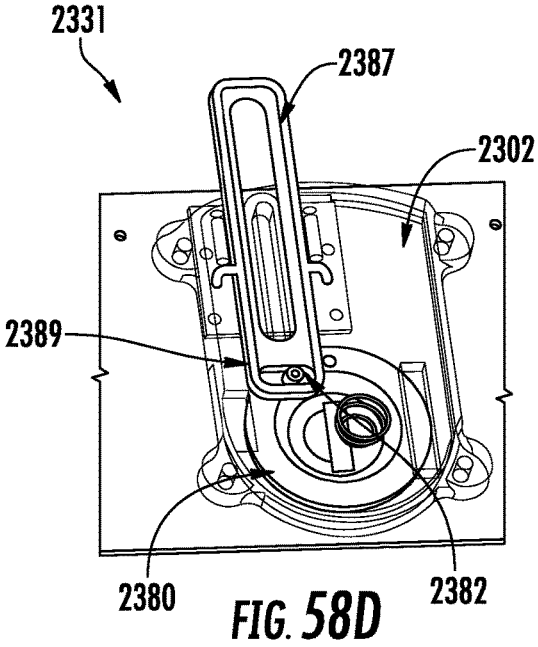

With reference to FIGS. 58C-58D, when the roll holder 2331 has rotated to an unstowed position (e.g., the roll partition 1240 containing the roll holder 1236 is rotated downwardly, such as shown in FIG. 34), the trigger 2387 is free to extend outwardly from the back edge 2301 (such as due to a bias on the trigger 2387). However, as the trigger 2387 moves, the track 2389 forces the pin 2382 of the engagement portion 2380 to rotate about the roll holder 2331 such that the orientation of the engagement portion 2380 stays at least generally upward. For example, with the trigger 2387 in the fully extended position (such as may occur when the roll holder 2331 has rotated to the unstowed position), the engagement portion 2380 may be rotated such that it maintains a generally outward and upward orientation (e.g., see arrow $A_{2331}$ in FIG. 58C). In this manner, with the guide slot 2303 maintaining a generally upward orientation, the product roll may be prevented from falling out unintentionally during rotation of the roll holders (e.g., as the raised portion of the engagement portion 2380 may prevent the product roll from falling out of engagement).

FIGS. 59A-59D illustrate another example embodiment of roll holders that operate to change the orientation of the engagement portion to maintain the product roll within the roll holder. For example, with reference to FIGS. 59A-B, the depicted embodiment of the roll holder 5031 is designed to be movable so as to move into and out of the dispenser housing. In this regard, the retention mechanism is designed to use the dispenser housing 5014 to control orientation of the engagement portion 5080 for securing the product roll from unintentional removal as the roll holder 5031 rotates. To explain, the main body portion 5002 defines a back edge 5001 that is configured to interact with the dispenser housing (or a related portion thereof). In the depicted embodiment, the dispensing housing 5014 defines a protrusion 5015 that fits within the main body portion 5002 of the roll holder 5031 through the back edge 5001. When the roll holder 5031 is generally within the dispenser housing, the protrusion 5015 fits within the main body 5002 and contacts a linkage 5087 that is biased (such as due to spring 5090) to protrude toward the back edge 5001 of the roll holder 5031 (shown in FIG. 59D).

The linkage 5087 defines a first pin 5088 that is connected to the engagement portion 5080 and travels within a first slot 5038 of the roll holder 5031 to define an orientation of the engagement portion 5080 with respect to the roll holder 5031 (e.g., an open position shown in FIG. 59A and a retained position shown in FIG. 59C). The linkage 5087 also defines a second pin 5089 that travels within a second slot 5039 of the roll holder 5031 to guide movement of the linkage 5087.

With reference to FIGS. 59A and 59B, when the roll holder 5031 is disposed inside the dispenser in the stowed position, the linkage 5087 is forced inside the main body portion 5002 by the force of the protrusion 5015 on the linkage 5087. In this position, the second pin 5089 of the linkage 5087 is forced to the distal end of the second slot 5039 and the first pin 5088 is forced to the distal end of the first slot 5038, thereby forcing a guide slot 5003 of the engagement portion 5080 to face generally outwardly and upwardly to enable easy access for the maintainer for loading and unloading the product roll. In the depicted embodiment, the guide slot 5003 aligns with a corresponding guide slot 5006 of the main body portion 5002 of the roll holder 5031.

With reference to FIGS. 59C-59D, when the roll holder 5031 has rotated to an unstowed position (e.g., the roll partition 1240 containing the roll holder 1236 is rotated downwardly, such as shown in FIG. 34), the linkage 5087 is free to extend toward the back edge 5001 (such as due to a bias of the spring 5090). However, as the linkage 5087 moves, the second pin 5089 of the linkage 5087 moves to the proximal end of the second slot 5039 and the first pin 5088 moves to the proximal end of the first slot 5038 such that the orientation of the engagement portion 5080 (and the guide slot 5003) changes to block removal or release of the loaded product roll. In the depicted embodiment, the guide slot 5003 moves out of alignment with a corresponding guide slot 5006 of the main body portion 5002 of the roll holder 5031 and, instead, aligns with a wall portion 5007 to prevent removal of the installed product roll. In this manner, with the guide slot 5003 maintaining an orientation towards the wall portion 5007, the product roll may be prevented from falling out unintentionally during rotation of the roll holders. In some embodiments, the engagement portion 5080 and guide slot 5003 maintain a generally upward orientation to further help prevent the product roll from falling out.

FIGS. 59E-59I illustrate another example embodiment of roll holders that operate to change the orientation of the engagement portion to maintain the product roll within the roll holder. The depicted embodiment of the roll holder 5031' operates in the same manner as the roll holder 5031 shown in FIGS. 59A-D, except that the roll holder 5031' does not have a spring or other biasing element and the second pin 5089' of the linkage 5087' interacts with (e.g., snaps into and out of) a receptacle of the protrusion 5015' of the dispenser housing 5014' (example receptacles 5016', 5016" are shown in FIGS. 59G and 59H).

With reference to FIG. 59E, when the roll holder 5031' is disposed inside the dispenser in the stowed position, the linkage 5087' is held inside the main body portion 5002' by the connection of the second pin 5089' and the receptacle 5016' of the protrusion 5015'. In this position, the second pin 5089' of the linkage 5087' is forced to the distal end of the second slot 5039' and the first pin 5088' is forced to the distal end of the first slot 5038', thereby forcing a guide slot of the engagement portion to face generally outwardly and upwardly to enable easy access for the maintainer for loading and unloading the product roll, such as shown in FIG. 59A.

With reference to FIGS. 59F and 59I, as the roll holder 5031' rotates to an unstowed position (e.g., the roll partition 1240 containing the roll holder 1236 is rotated downwardly, such as shown in FIG. 34), the receptacle 5016' retains the second pin 5089' (shown in FIG. 59I). Therefore, rotation of the roll holder 5031' causes the proximal end of the second slot 5039' to move toward the second pin 5089' that is retained in the receptacle 5016', which also causes the proximal end of the first slot 5038' to move closer to the first pin 5088', which causes the orientation of the engagement portion and the guide slot to change so that the guide slot aligns with a wall portion to prevent removal or release of the installed product (e.g., similar to the embodiment shown in FIG. 59C). In the specific embodiment shown, the orientation of the engagement portion and the guide slot stays at least generally upward, such as shown in FIG. 59C, to further help prevent the product from falling out of the engagement portion.

In some embodiments, at some point during the rotation of the roll holder 5031' toward the unstowed position, the second pin 5089' may disengage from the receptacle 5016' to enable full rotation of the roll holder 5031' to the unstowed position. In this regard, the receptacle 5016' may be shaped with a snap-fit (e.g., interference fit) design to hold engagement with the second pin 5089' until enough force is provided to overcome the snap-fit.

In some embodiments, at some point during rotation of the roll holder 5031' toward the stowed position (from the unstowed position), the second pin 5089' may contact the receptacle 5016', but not have enough force to overcome the snap-fit (e.g., to re-engage the second pin 5089' with the receptacle 5016'). However, that contact may be enough force to cause the second pin 5089' of the linkage 5087' to move to the distal end of the second slot 5039' and the first pin 5088' to move to the distal end of the first slot 5038', thereby forcing a guide slot of the engagement portion to face generally outwardly and upwardly (e.g., as shown in FIG. 59A). Thereafter, to complete rotation of the roll holder 5031' within the dispenser housing 5014', a force sufficient enough to overcome the snap-fit may be applied to cause re-engagement of the second pin 5089' and the receptacle 5016'. Such an action may cause an audible "snap" that may indicate proper re-engagement.

FIG. 59H shows another embodiment of a protrusion 5015" that includes a differently shaped receptacle 5016". Notably, the depicted receptacle 5016" defines a pronounced snap-fit receptacle that requires additional force to disengage and/or engage the second pin 5089' with the receptacle 5016". The depicted protrusion 5015" also includes a cut-out portion 5017" that enables deflection of the receptacle 5016". Such an example embodiment may provide increased flexibility and a more audible "snap" to help a maintainer feel confident with proper positioning of the roll holder.

In some embodiments, the roll holder 5031' may be installed on a roll partition and may, in some cases, provide for an audible "snap" as the roll holder and roll partition are moved to their stowed position. For example, FIGS. 59J-590 illustrate an example interaction between a roll partition 5040'/roll holder 5031' and the rear dispenser housing 5014' as the roll partition 5040' (and the roll holder 5031') rotates from a stowed position to an unstowed position and back again.

FIG. 59J shows the roll partition 5040' and roll holder 5031' in the stowed position, being held in engagement with the rear housing 5014' of the dispenser. In the depicted embodiment, the roll holder 5031' includes a linkage 5087' with a first pin 5088' and a second pin 5089'. In the stowed position, the second pin 5089' is engaged with a receptacle 5016' of a protrusion 5015' that extends from the rear housing 5014' and the first pin 5088' is positioned at a distal end of a first slot 5038' (shown in FIG. 59F) such that the guide slot 5003' of the roll holder 5031' faces generally outwardly and upwardly.

FIG. 59K shows the roll partition 5040' beginning to rotate toward the unstowed position. As shown, a proximal end of the first slot 5038' (shown in FIG. 59F) has moved to the first pin 5088' and a proximal end of the second slot 5039' (shown in FIG. 59F) has also moved to the second pin 5089'. Notably, however, the second pin 5089' has not yet become disengaged from the receptacle 5016' due to the interference fit engagement. Further, due to movement of the roll holder 5031' away from the first pin 5088' within the first slot 5038', the guide slot 5003' of the roll holder 5031' has rotated to now be oriented generally upwardly (which helps with retaining an installed product roll as described herein).

Figure 59M:
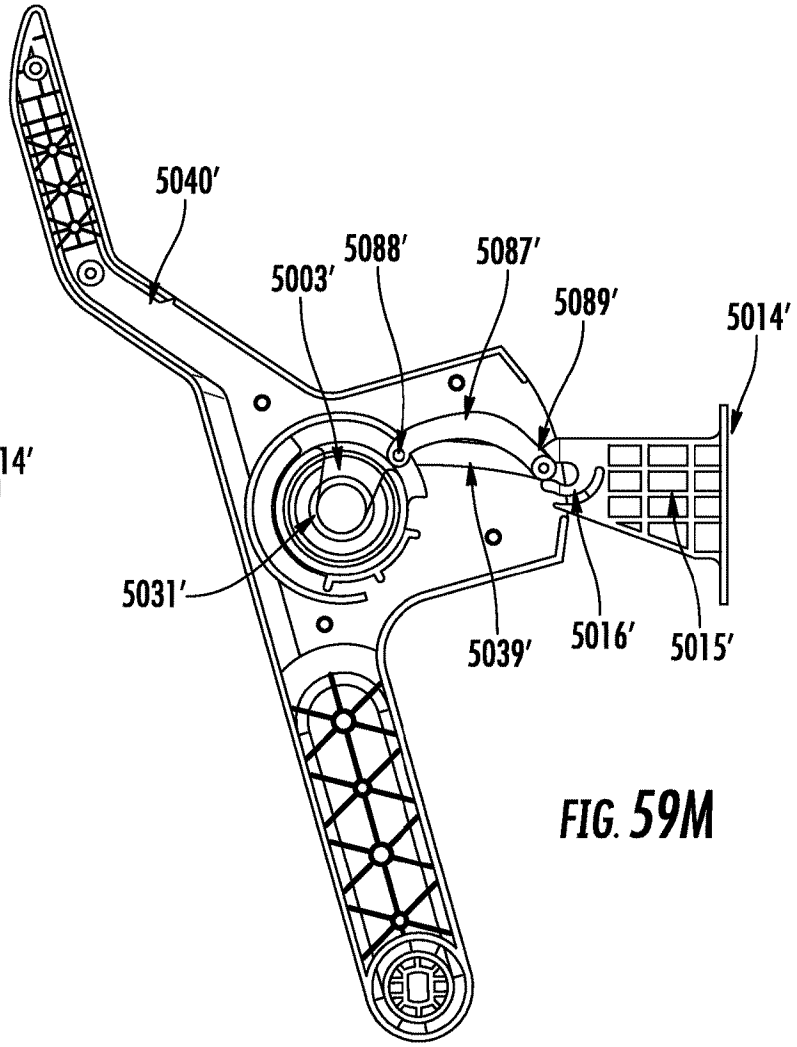
Figure 59L:
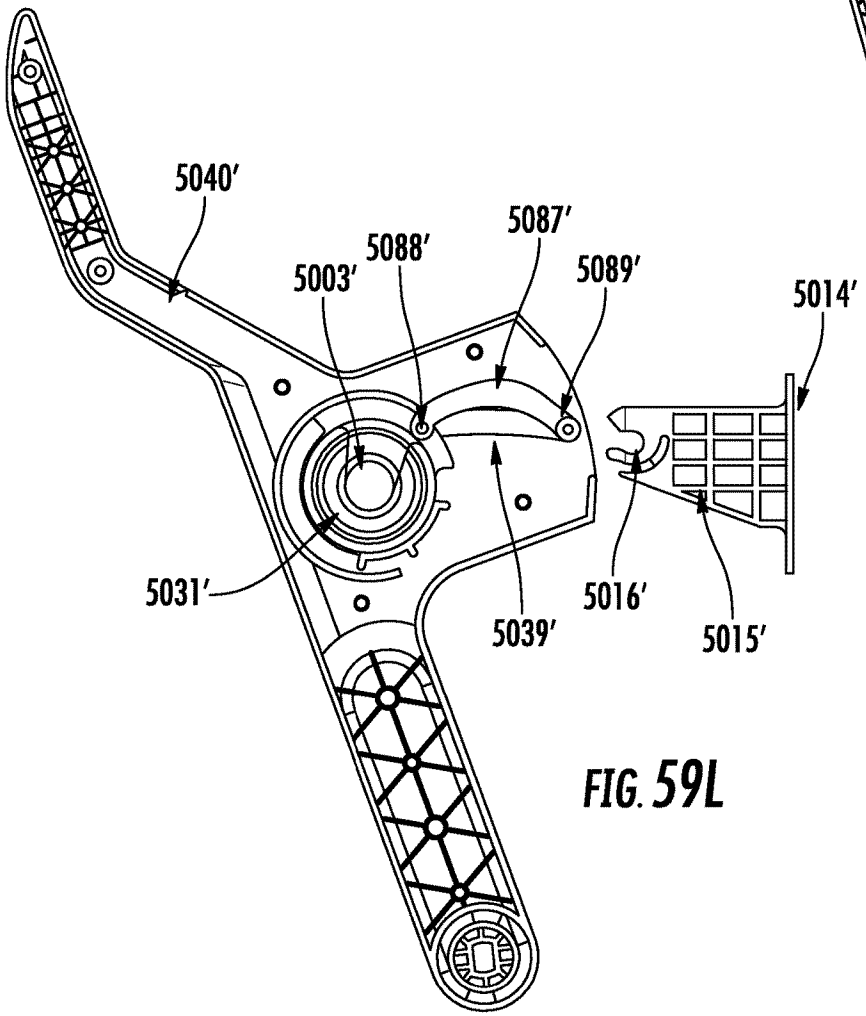

FIG. 59L shows that the roll partition 5040' has further rotated toward the unstowed position such that the second pin 5089' has disengaged from the receptacle 5016'. In some cases, an audible "snap" may have occurred upon disengagement—thereby confirming detachment to the maintainer. Additionally or alternatively, a physical snap release may be felt by the maintainer to confirm detachment.

FIG. 59M shows the roll partition 5040' beginning to rotate back toward the stowed position. As shown, the first pin 5088' is still at the proximal end of the first slot 5038' (shown in FIG. 59F) and the second pin 5089' is still at the proximal end of the second slot 5039' (shown in FIG. 59F). Notably, however, the second pin 5089' has not yet re-engaged with the receptacle 5016' since some amount of force is required to create the interference fit engagement.

Figure 59O:
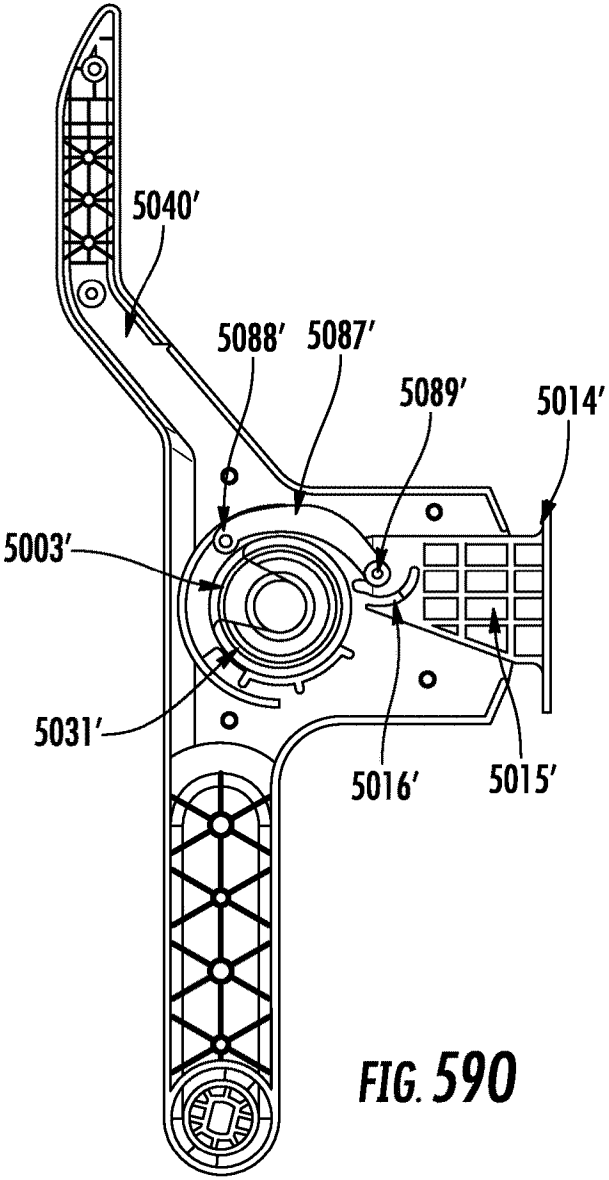
Figure 59N:
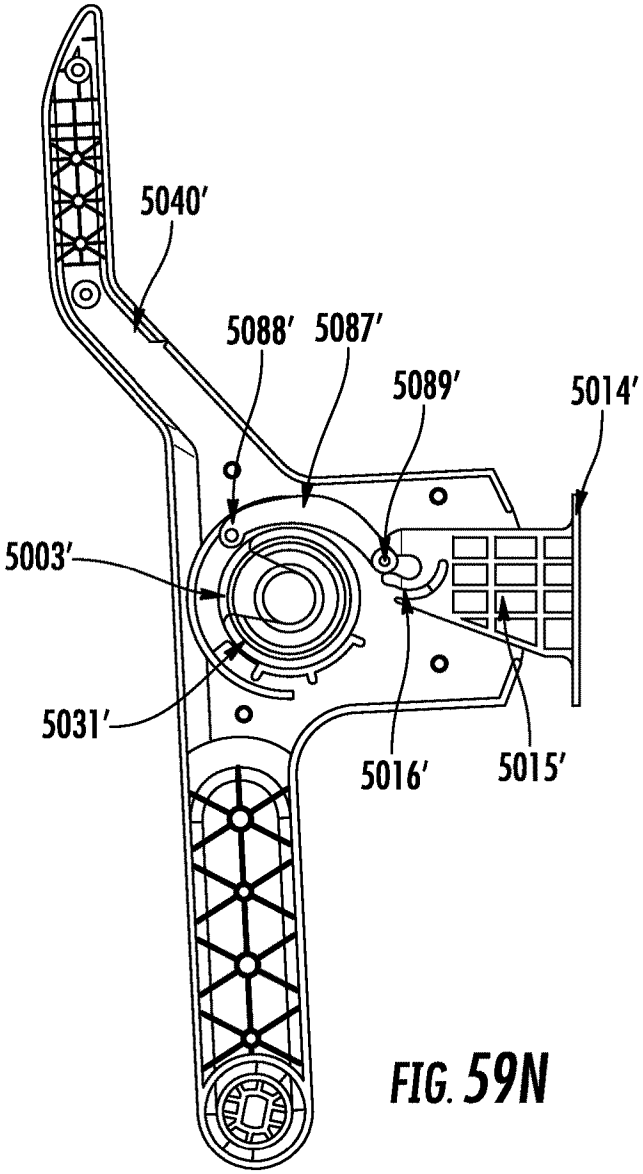

FIG. 59N shows the roll partition 5040' further rotated toward the stowed position. As shown, a distal end of the first slot 5038' (shown in FIG. 59F) has moved to the first pin 5088' and a distal end of the second slot 5039' (shown in FIG. 59F) has also moved to the second pin 5089', the first pin 5088' and second pin 5089' being restrained from movement by the contact between the second pin 5089' and receptacle 5016'. Notably, however, the second pin 5089' still has not yet re-engaged with the receptacle 5016'. Further, due to movement of the roll holder 5013' toward the first pin 5088' within the first slot 5038', the guide slot 5003' of the roll holder 5031' has rotated to now be oriented generally outwardly and upwardly (returning generally to its original orientation shown in FIG. 59J).

FIG. 59O shows that the roll partition 5040' has further rotated into the stowed position such that the distal end of the first slot 5038' (shown in FIG. 59F) urged the first pin 5088', and thereby the second pin 5089', to move toward the rear housing 5014' until the second pin 5089' has re-engaged with the receptacle 5016'. In some cases, an audible "snap" may have occurred upon re-engagement—thereby confirming proper engagement between the roll partition and dispenser housing to the maintainer. Additionally or alternatively, a physical snap force may be felt by the maintainer to confirm re-attachment.

FIGS. 60A-60E illustrate another example embodiment of a roll holder that operates to retain the product roll within the roll holder as the roll holder rotates. However, the depicted roll holder 6031 is designed to prevent the engagement portion 6080 from retracting out of engagement with a plug 6059 of the product roll 6051 when the roll holder 6031 is rotated downwardly by using gravity and a blocking element (e.g., a steel ball 6090).

Figure 60A:
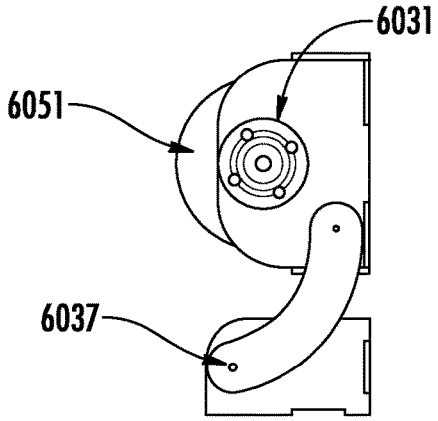
Figure 60B:
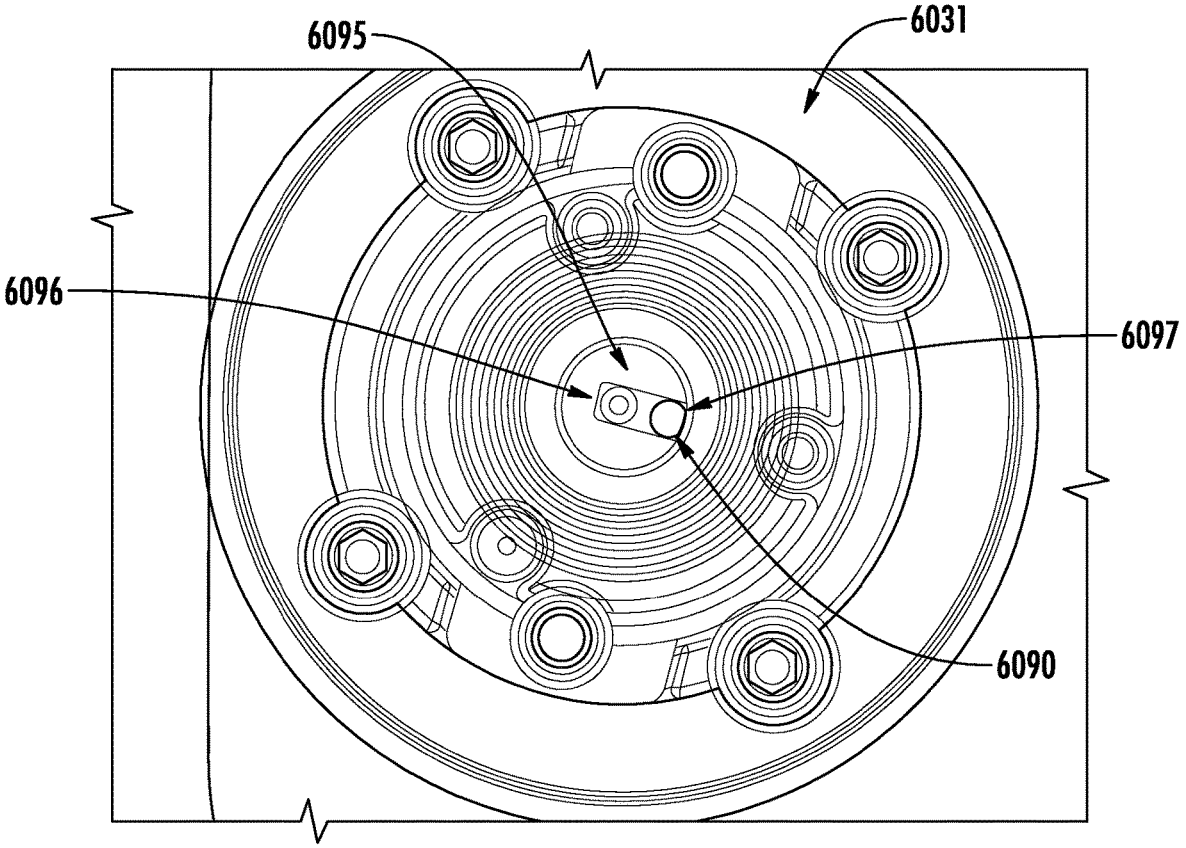

FIG. 60A illustrates the roll holder 6031 with a product roll 6051 installed. Further, the roll holder 6031 and the product roll 6051 are in the vertical, stowed position within the dispenser housing. In the stowed position, with reference to FIG. 60B, a blocking element (e.g., a steel ball 6090) of the roll holder 6031 is positioned at a first end 6097 of a blocking element guide slot 6095. In some embodiments, the blocking element guide slot 6095 may be designed such that it slopes at least partially downwardly toward the first end 6097 when the roll holder 6031 is in the stowed position. As such, the blocking element 6090 may be biased due to gravity to travel (e.g., roll) toward the first end 6097 as the roll holder 6031 rotates toward the stowed position.

Figure 60C:
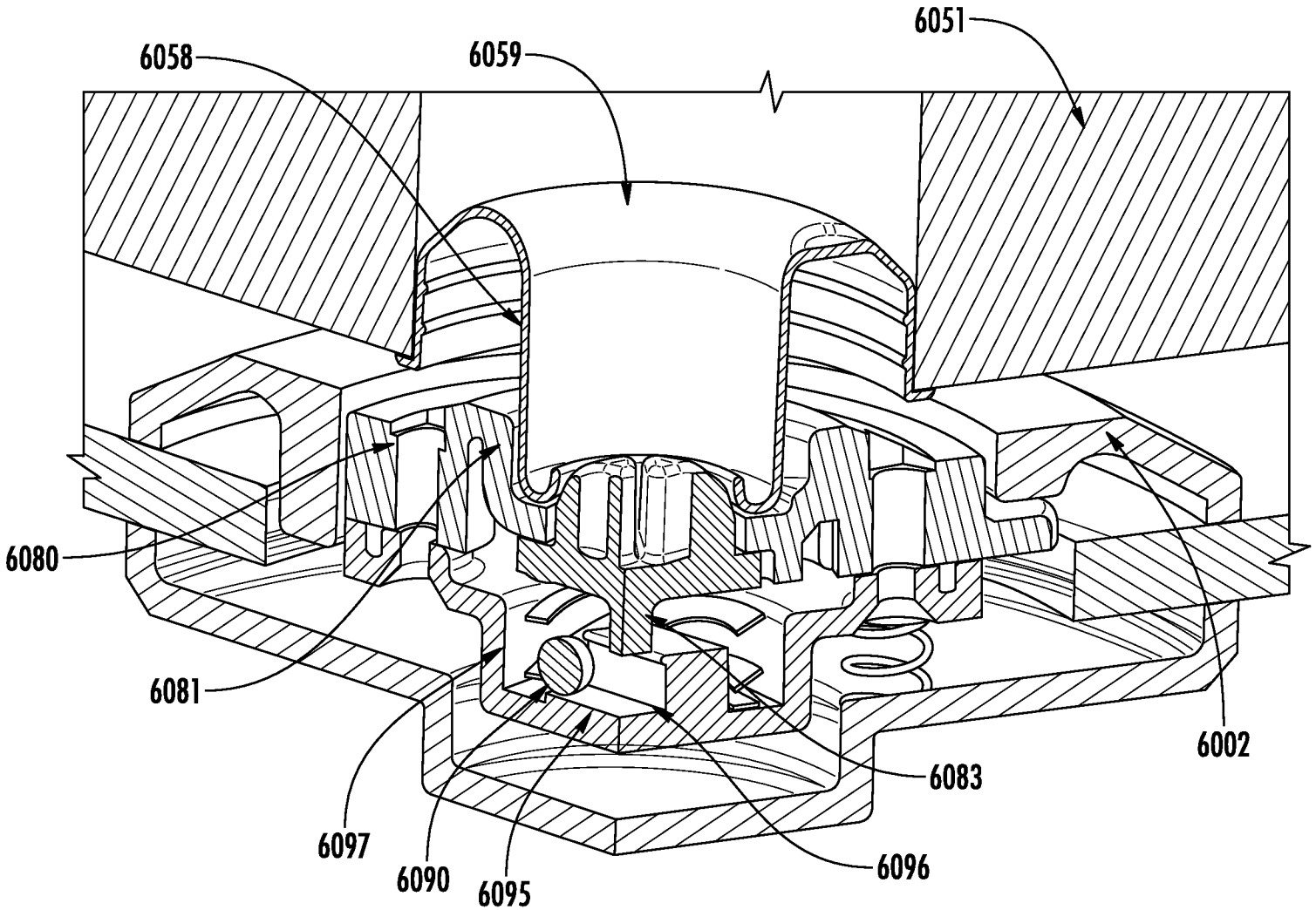

With reference to FIG. 60C (which shows a dual cross sectional view of the roll holder and product roll engagement when in the stowed position), the blocking element 6090 is in a position near the first end 6097 and out of alignment with a stop element 6083 of the engagement portion 6080. As such, the engagement portion 6080 is free to retract within the main body portion 6002 of the roll holder 6031. This free movement enables loading and unloading of the product roll 6051 into and out of engagement with the engagement portion 6080. The depicted example illustration of FIG. 60C shows a view orientation that shows the product roll directly above the roll holder. In this regard, the view orientation of FIG. 60C is shown for ease of explanation and is not meant to provide a limiting example of an orientation of the example roll holder embodiment.

Figure 60D:
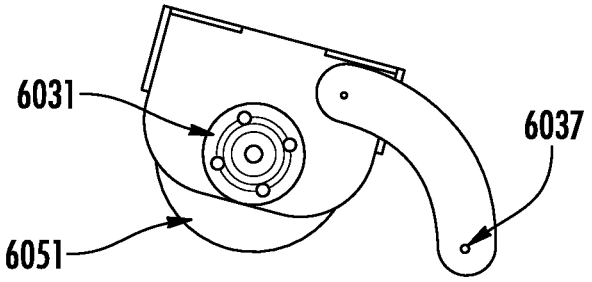
Figure 60E:
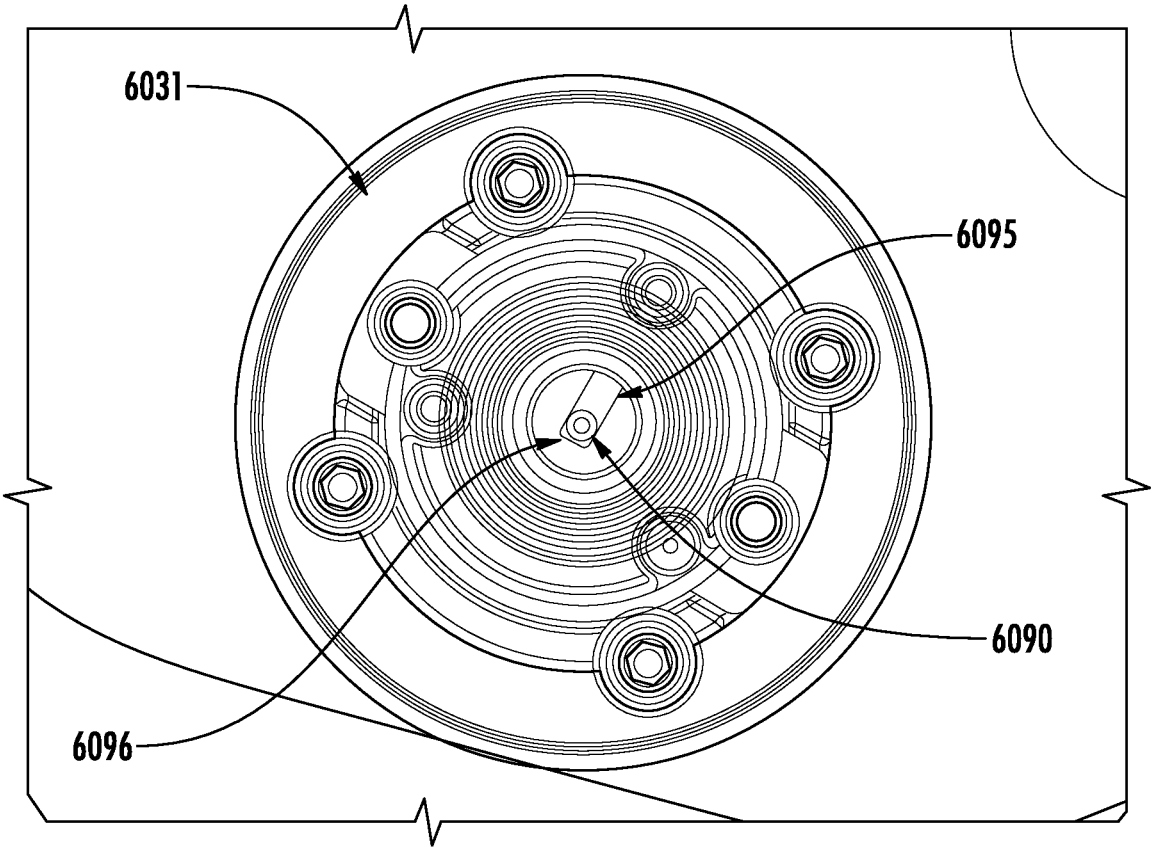

FIG. 60D illustrates the roll holder 6031 and the product roll 6051 in the horizontal, unstowed position within the dispenser housing (e.g., the roll holder 6031 and product roll 6051 have rotated downwardly around the axis 6037). In the unstowed position, with reference to FIG. 60E, a blocking element (e.g., a steel ball 6090) of the roll holder 6031 is positioned at a second end 6096 of a blocking element guide slot 6095. In some embodiments, the blocking element guide slot 6095 may be designed such that it slopes at least partially downwardly toward the second end 6096 when the roll holder 6031 is in the unstowed position. As such, the blocking element 6090 may be biased due to gravity to travel (e.g., roll) toward the second end 6096 as the roll holder 6031 rotates toward the unstowed position.

With reference to FIG. 60C (which shows the roll holder 6031 in the stowed position), when the roll holder 6031 rotates toward the unstowed position, the blocking element 6090 moves (e.g., rolls) to the second end 6096 underneath the stop element 6083 of the engagement portion 6080. As such, the engagement portion 6080 is prevented from retracting within the main body portion 6002 of the roll holder 6031. This maintains engagement of the engagement portion 6080 with the product roll 6051, such as through engagement of a wall 6081 of the engagement portion 6080 with a wall portion 6058 of the plug 6059 of the product roll 6051. Since retraction of the engagement portion 6080 is prevented, the engagement with the product roll 6051 will be maintained even as the roll holder 6031 rotates to the unstowed position—thereby preventing the product roll from falling out of installed engagement.

FIG. 61 illustrates another example embodiment of roll holders that operate to change the orientation of the engagement feature of the roll holder to always remain generally upward (even when the roll holder is otherwise in a generally horizontal orientation, such as the roll holder 1236 in FIG. 34) in order to prevent the product roll from unintentionally falling out of the roll holder. For example, FIG. 61 illustrates an example dispenser 2400 with a set of roll holders 2436 that are attached to a roll partition 2440. As detailed herein, the roll partition 2440 is configured to be rotated (such as around axis 2441) between a stowed position within the dispenser housing (shown in FIG. 61) to an unstowed position out of the dispenser housing (not shown). In the depicted embodiment, the engagement portion 2480 of the roll holder 2436 is connected to one or more gears (as described herein) that are rotatably attached to a rotatably cogged pulley 2444 (e.g., upper pulley) that is attached to a belt 2485 at connection point 2482. A stationary cogged pulley 2443 (e.g., lower pulley) is positioned at the axis 2441 of rotation. The belt 2485 wraps around and couples the stationary cogged pulley 2443 and rotatable cogged pulley 2444. The rotatable cogged pulley 2444 is coupled to one or more gears 2446 that are affixed to the roll holder 2436. As the roll partition 2440 rotates around its axis 2441, the belt 2485 rotates to cause the orientation of the roll holder 2436 to stay constant (e.g., the rotation of the belt 2485 and the connection between the rotatable cogged pulley 2444 and the gear 2446 of the engagement portion 2480 causes the engagement portion 2480 of the roll holder 2436 to rotate to maintain a generally upward and outward orientation of the guide slot 2403).

Figure 62A:
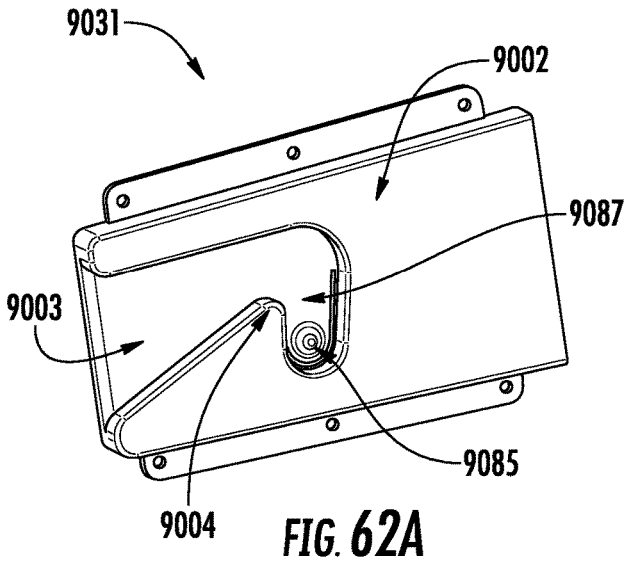
Figure 62B:
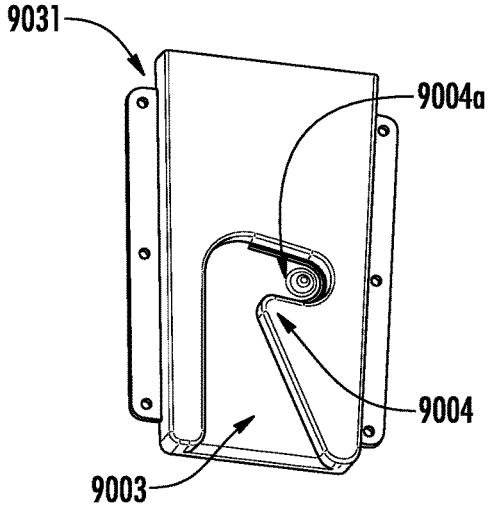
Figure 62C:
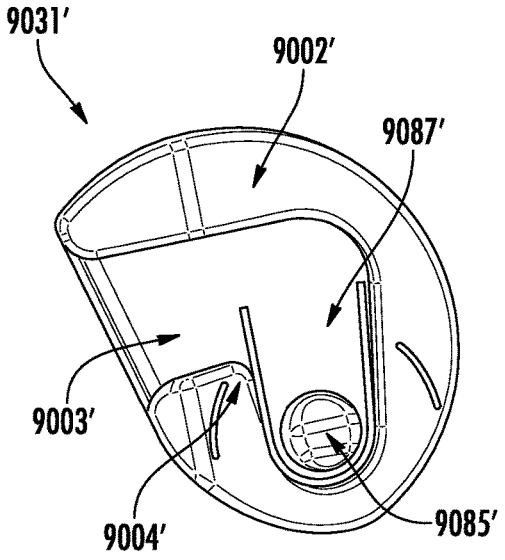
Figure 62D:
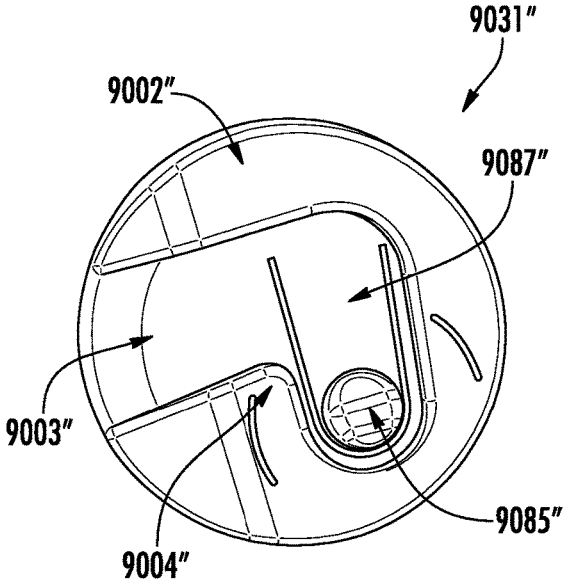

In some embodiments, one or more roll holders may be designed with one or more slopes, angles, or other wall shapes that are configured to help prevent an installed product roll from being removed or releasing unintentionally (e.g., during rotation of the roll holder). For example, with reference to FIG. 62A, an example roll holder 9031 includes a body portion 9002 with a slot 9003 that is configured to receive a core of the product roll (not shown). Notably, the slot 9003 includes a bend 9004 that changes the angle (e.g., 110 degrees) of the slot 9003. A maintainer can insert the core of the product roll into the slot 9003 and "drop" it over the bend 9004. An engagement feature 9085 can engage the core of the product roll to cause the product roll to be installed. In the depicted embodiment, the engagement feature 9085 is positioned on a cantilevered portion 9087 of the roll holder 9031 to enable deflection of the engagement feature 9085 for easier installation and/or formation of an audible "snap" confirmation during installation. With the bend 9004 and angle change, the slot 9003 includes walls that help retain the installation of the product roll even in the instance where the orientation of the roll holder 9031 changes, such as due to rotation of the roll holder 9031 (e.g., if the roll holder is attached to a roll partition or otherwise rotatable). In this regard, the angle change is sufficient enough to keep the angle of the wall with respect to the new orientation at a slope that prevents disengagement of the core of the product roll from the engagement feature 9085 (such as due to gravity keeping the core of the product roll within the angled portion of the slot 9003). For example, FIG. 62B illustrates that the slope 9004*a* of the slot 9003 before the bend 9004 prevents the product roll from falling out of the slot 9003 even when the roll holder 9031 is oriented downwardly as shown. FIGS. 62C and 62D show additional example roll holders 9031' and 9031" that have similar features to the roll holder 9031 shown in and described with respect to FIG. 62A.

Nip Cover

As detailed herein, some embodiments of the present invention provide a dispenser that is configured to hold two product rolls and provide corresponding dispensing mechanisms for each product roll. Notably, however, when such a dispenser is completely empty and the maintainer is loading a product roll a further goal may be to ensure that the product roll being installed is loaded into the proper dispensing mechanism. For example, with reference to FIG. 3, the dispenser 10 includes a first dispensing mechanism 21 and a second dispensing mechanism 26. As noted herein, in order to avoid possible jam scenarios, web management is used to separate the web paths for each product roll. Thus, it is desirable for a first product roll 51 to be loaded into the first dispensing mechanism 21 and a second product roll 56 to be loaded into the second dispensing mechanism 26. While color coding may be employed in some embodiments (see e.g., FIG. 47 and the corresponding description above), it may be desirable to force the maintainer to load the product roll into the proper dispensing mechanism.

As such, some embodiments of the present invention provide a nip cover that moves with the movable roll holder (e.g., a roll partition with a roll holder) to reveal the proper dispensing mechanism for loading the current product roll and, at the same time, block the improper dispensing mechanism to ensure that improper loading does not occur. For example, with reference to FIGS. 63A-63B, some embodiments of the present invention contemplate using a nip cover with movable roll holders, such as the roll partition 1240 shown in FIGS. 33A and 34. In the depicted embodiment, the example dispenser 2500 includes a roll partition 2540.

When the roll partition 2540 is in the stowed position (vertical orientation), as shown in FIG. 63A, the maintainer may install the second product roll (not shown). The dispenser 2500 may include a nip cover 2565 that covers the nip (not shown) to the first dispensing mechanism 2521 when the roll partition 2540 is in the stowed position, as the second product roll should not be loaded into the first dispensing mechanism 2521. However, the nip 2566 of the second dispensing mechanism 2526 is revealed and, thus, the maintainer may load the leading edge from the second product roll into the second nip 2566, thereby causing the second product roll to be loaded into the proper second dispensing mechanism 2526.

When the roll partition 2540 is in the unstowed position (e.g., horizontal orientation), as shown in FIG. 63B, the maintainer may install the first product roll (not shown). In this unstowed position, the nip cover 2565 moved (such as with the roll partition 2540) so that it covers the nip (not shown) to the second dispensing mechanism 2526, as the first product roll should not be loaded into the second dispensing mechanism 2526. However, the nip 2561 of the first dispensing mechanism 2521 is revealed and, thus, the maintainer may load the leading edge from the first product roll into the first nip 2561 thereby causing the first product roll to be loaded into the proper first dispensing mechanism 2521.

Some embodiments of the present invention contemplate various configurations for how the nip cover moves. For example, FIGS. 63C and 63D illustrate an example nip cover that rotates with the roll partition to move between revealing the appropriate nip for loading purposes. For example, the dispenser 2600 may include a nip cover 2665 that is pivotally attached at a point between the first nip 2661 of the first dispensing mechanism 2621 and the second nip 2666 of the second dispensing mechanism 2626 (see e.g., FIGS. 63A and 63B).

In some embodiments, the nip cover 2665 may be biased (e.g., spring biased) away from the rear housing 2614 of the dispenser 2600. When the roll partition 2640 is being rotated towards the stowed position (shown in FIG. 63C), the roll partition 2640 may force the nip cover 2665 against the bias to cover the first nip 2661 and reveal the second nip 2666. When the roll partition 2640 rotates to the unstowed position (shown in FIG. 63D), the nip cover 2665 may rotate forward (such as due to the bias) to cover the second nip 2666 and reveal the first nip 2661. When the roll partition 2640 rotates back to the stowed position, the roll partition 2640 may interact with the nip cover 2665 to force it back toward the rear housing 2614.

Additionally or alternatively, the nip cover 2665 may have one or more pins 2669 that are configured to be received within tracks that are formed into the roll partition 2640. The tracks may be designed to "grab" the pins 2669 and pull the nip cover 2665 forward when the roll partition 2640 rotates forward such that the nip cover 2665 rotates forward to cover the second nip 2666 and reveal the first nip 2661. Similarly, the tracks may be designed to "push" the pins 2669 and the nip cover 2665 backward when the roll partition 2640 rotates backward such that the nip cover 2665 rotates backward to cover the first nip 2661 and reveal the second nip 2666. Along these same lines, other configurations may be contemplated for rotating the nip cover. For example, the nip cover may be pivotally attached to the roll partition (instead of the dispenser/dispensing mechanisms).

FIGS. 64A and 64B illustrate another example nip cover that slides within a track to move with the roll partition between revealing the appropriate nip for loading purposes. For example, the dispenser 2700 may include a nip cover 2765 that is slidably attached to selectively travel along a track 2768 defined in the dispenser housing over the first nip 2761 of the first dispensing mechanism 2721 (see FIG. 64A) or over the second nip 2766 of the second dispensing mechanism 2726 (see FIG. 64B) depending on the position of the roll partition 2740.

In some embodiments, the nip cover 2765 may have one or more pins 2769 that are configured to be received within corresponding pin guide tracks that are formed into the roll partition 2740. The pin guide tracks may be designed to "grab" the pins 2769 and pull the nip cover 2765 forward when the roll partition 2740 rotates forward such that the nip cover 2765 slides forward to cover the second nip 2766 and reveal the first nip 2761. Similarly, the pin guide tracks may be designed to "push" the pins 2769 and the nip cover 2765 backward when the roll partition 2740 rotates backward such that the nip cover 2765 slides backward to cover the first nip 2761 and reveal the second nip 2766.

In some embodiments, the nip cover 2765 may be biased (e.g., spring biased) away from the rear housing 2714 of the dispenser 2700. When the roll partition 2740 is in the stowed position (shown in FIG. 64A), the roll partition 2740 may force the nip cover 2765 against the bias to cover the first nip 2761 and reveal the second nip 2766. When the roll partition 2740 rotates toward the unstowed position (shown in FIG. 64B), the nip cover 2765 may slide forward (such as due to the bias) to cover the second nip 2766 and reveal the first nip 2761. When the roll partition 2740 rotates back to the stowed position, the roll partition 2740 may interact with the nip cover 2765 to force it to slide backward toward the rear housing 2714.

Some embodiments of the present invention contemplate other types of nip covers for selectively covering or revealing nips of dispensing mechanisms based on the position of the roll holder. For example, in some embodiments, the nip cover may be made of elastic material. The nip cover may be attached at one end between the first dispensing mechanism and the second dispensing mechanism and to the roll holder (or corresponding structure with the roll holder) at the other end. In this regard, the elastic nip cover may cover up the first nip when the roll holder is in the stowed position. However, as the roll holder rotates toward the unstowed position, the elastic nip cover may stretch and move generally forward to cover the second nip while revealing the first nip.

Although the above example embodiments illustrate and describe use of a nip cover with a roll partition, some embodiments of the present invention contemplate use of a nip cover with other configurations where the roll holders move (e.g., any of the embodiments described herein and shown in the various figures, such as FIGS. 14-32E).

Funnel Cover

Some embodiments of the present invention provide a funnel cover for a nip of the dispensing mechanism. The funnel cover may be designed to improve loading of the leading edge of product into the nip of the dispensing mechanism. In this regard, the funnel cover may provide a surface that physically and/or visually leads the maintainer to where to position the leading edge of the product roll for proper loading.

FIGS. 65A-65B illustrate an example funnel cover 2875 for a nip 2861 for a dispensing mechanism 2821 of a dispenser 2800. The funnel cover 2875 is visually appealing to the maintainer and provides a visual attractant and structure that covers up much of the structure of the nip 2861 (e.g., the drive and nip rollers). Additionally, with reference to FIG. 65A, in the depicted embodiment, the funnel cover 2875 includes portions that define a color (e.g., light green) that can be used to help differentiate the corresponding nip 2861 and associate the nip 2861 with the proper roll holder for the proper product roll to be loaded into the nip 2861. For example, the funnel cover 2875 can be utilized for color coding, such as described herein with respect to FIG. 47.

With reference to FIG. 65B, the funnel cover 2875 may define a front surface 2879 and a back surface 2877 that are angled so as to be parallel to the intended web paths (2852, 2852') from the installed full product roll 2851 to the nip 2861 such that the product web does not "touch" the funnel cover 2875 during dispensing. This is important to avoid static build-up and prevent unintended jamming. Moreover, the funnel cover 2875 may be designed to maintain the parallel nature of the surfaces 2877, 2879 despite what orientation the product roll is loaded into the dispenser. For example, the web path 2852 from a front loaded product roll (e.g., the leading edge comes from the front of the product roll) leads into the nip 2861 without touching the front surface 2879 of the funnel cover 2875. Further, the web path 2852' from a backward loaded product roll (e.g., the leading edge comes from the back of the product roll) leads into the nip 2875 without touching the back surface 2877 of the funnel cover 2875.

Various Sensors, Product Roll and Dispensing Management

Some example embodiments of the present invention contemplate use of various sensors in the product dispenser. For example, as described herein, some embodiments contemplate a product dispenser with one or more funnel sensors, one or more chute sensors, one or more product level (e.g., fuel) gauges, one or more motor operation sensing systems, one or more tear bar detection mechanisms, an activation sensor, among other sensors. By utilizing the gathered information, example product dispensers (such as through the controller) may be configured to perform various functions (e.g., switch dispensing between product rolls, display information to the user/maintainer, automatic or assisted feed, etc.) and determine various scenarios (e.g., a jam scenario, out of paper scenario, etc.). The following describes various example sensors and functions or scenarios that can be performed or determined using the gathered information from the sensors.

Activation Sensor(s)

Some embodiments of the present invention provide an activation sensor (e.g., activation sensor 120 of FIG. 2) for the product dispenser, where the activation sensor is configured to sense a user's desire for the product dispenser to dispense a portion of the product. Depending on the configuration, the activation sensor may be configured in various forms. For example, in some embodiments, the activation sensor may be a capacitive sensor that is configured to sense the presence of a user (e.g., a user's hand). In other embodiments, the activation sensor may be an infrared sensor that is configured to sense the presence of a user (e.g., a user's hand). In response to sensing the presence of the user, the controller may be configured to cause the product dispenser to dispense a portion of the product, such as described herein.

In some embodiments, an IR activation sensor may be formed of a transmitter and a receiver. The transmitter may be configured to transmit one or more pulses of infrared light in a direction (e.g., an activation sensor space). In some embodiments, one or more light pipes may be used to direct light traveling from an LED on a printed circuit board toward a desired space. The receiver may be configured to sense a reflection of the transmitted infrared light, such as when it reflects off the hand of a user. Depending on the configuration, in some embodiments, the transmitter and receiver may be controlled separately such that they can be operated independently of each other. For example, the transmitter can be turned on and off (e.g., pulsed) and the receiver can be separately turned on and off. By operating the transmitter and receiver separately, overall power consumption can be reduced.

Depending on the location of the sheet product dispenser and general preferences of the maintenance personnel, having an adjustable sensing range can be desirable. For example, the range can be set to high, medium, or low (or other variations), and generally correlates to a distance away that a user's hand may be sensed. By using a lower setting, the IR activation sensor may be configured to avoid detecting passing objects (such as users) at distances further away than the desired distance from the IR activation sensor that are indicative of a user intentionally trying to activate the dispenser. In some embodiments, the IR activation sensor may be enabled with an adjustable sensing range. For example, with reference to FIG. 65C, some embodiments may utilize a circuit 2890 that includes an inductor 2893. Such an inductor 2893 may be in series with a limiting resistor 2894 for the lighting emitting diode (LED) 2895 for the IR transmitter. In such example embodiments, the inductor 2893 may provide (such as through software implementation) for a controlled ramp up of power delivered to the IR LED transmitter (e.g., increasing current from 0%). By adjusting the "on" time of the IR LED transmitter, the controlled ramp can be de-energized once the IR activation sensor has had an opportunity to detect objects within the desired activation range, but before the IR activation sensor would be intense enough to detect objects at distances further away than the desired activation range. To explain further, with no inductor present, the IR LED transmitter would switch on to 100% immediately, and might detect objects at distances further away than desired. For example, prior circuits may have used several resistors and switches to allow the dispenser, user, and/or maintainer to optionally select configurations that would reduce the current through the LED to cause the IR activation sensor to only detect objects within shorter distances from the sensor. However, the additional resistors and switches can increase costs that may be avoided by utilizing an inductor. Further, such prior circuits are not adjustable with simple software changes, and in some embodiments require a more complex printed circuit board and more expensive microcontroller with more pins to control the resistors and switches. Therefore, the inductor embodiment in FIG. 65C is simpler, lower-cost, and provides a more adjustable configuration to provide adjustment of the IR activation sensor range. For background, additional information regarding adjustability of IR LED activation sensors can be found in U.S. Pat. No. 7,793,882, entitled "Electronic Dispenser for Dispensing Sheet Products", which is assigned to the owner of the current application, and which is incorporated by reference herein in its entirety.

Automatic/Assisted Feed, Funnel and Chute Sensors

Some example embodiments of the present invention contemplate a product dispenser that is configured to enable automatic or assisted loading of a leading edge of a product roll. For example, in some embodiments, the product dispenser may be configured to automatically energize a drive roller of the dispensing mechanism during loading of the leading edge of the product roll to make it easier for a maintainer to load the dispenser with the product roll. Such automatic energizing of the drive roller may occur in response to sensing the leading edge of the product roll. Further, some embodiments may sense that the product roll has successfully been loaded and, in response, may de-energize or stop rotation of the drive roller.

FIG. 66A shows an example product dispenser 2900 that is configured to enable automatic or assisted feed (e.g., auto-loading or assisted loading) for loading the leading edge of a new product roll into the dispensing mechanism (although the product rolls are already loaded successfully in FIG. 66A). A first product roll 2951 is installed and includes a web path 2952 that passes through the first dispensing mechanism 2921. The product dispenser 2900 includes a first funnel sensor 2941 proximate the nip 2961 of the first dispensing mechanism 2921 and a first chute sensor 2942 positioned within the first chute 2943 (see e.g., FIG. 66B). A second product roll 2956 is installed and includes a web path 2957 that passes through the second dispensing mechanism 2926. The product dispenser 2900 also includes a second funnel sensor 2946 proximate the nip 2966 of the second dispensing mechanism 2926 and a second chute sensor 2947 positioned within the second chute 2948 (see e.g., FIG. 66B).

The funnel and chute sensors are each configured to detect whether or not product is present in the corresponding area. In the depicted embodiments of FIGS. 66A and 66B, the funnel sensors and chute sensors are each infrared sensors that use a light beam directed down the width of the corresponding funnel or chute. Such a sensor is designed to be transmissive such that any break in the light triggers an indication that product is present. However, as provided in greater detail herein, some example embodiments contemplate other configurations for the funnel and/or chute sensors, such as the sensor directing light in a different direction or pattern and/or using a reflective sensor configuration.

In some embodiments other directions or configurations for the funnel and/or chute sensors can be used. For example, FIGS. 67A-68B illustrate an example embodiment that utilizes an IR sensor that emits light "across" the width of the funnel (e.g., nips 3061, 3066), although the same or similar design may be applied to the first and second chutes. Further, as will be described in greater detail herein, the illustrated embodiment employs a light pipe that enables a single IR transmitter to emit light that has three paths across each nip 3061, 3066. A break in any of the three paths indicates a detection of the product. Since the three paths are spread along the entire width of the nip 3061, 3066, more area is covered and, thus, there is a low likelihood that product may pass through the nip 3061, 3066 without being detected. Additional example sensors include a single IR light emitted across the nip or chute in which a break in the light beam indicates the presence of product (see, for example, the funnel sensor 3091 of FIG. 70A), a reflective IR sensor designed to reflect off the product and be detected by a receiver (see, for example, the funnel sensor 3092 of FIG. 70B), and an IR sensor that emits light at a slight angle "down" (e.g., diagonally down) the width of the nip or chute (see, for example, the funnel sensor 3093 of FIG. 70C). Along similar lines, non-IR sensors can be utilized, including, for example, a capacitive sensor 3094 that is attached to the dispenser near the nip 3061 and designed to sense the product when it is proximate the nip 3061 (see, for example, FIG. 70D) or a mechanical switch sensor 3095 that is designed to detect the presence of the product proximate the nip 3061 (see, for example, FIG. 70E).

FIG. 66C shows that after loading a first roll 2951 into the first roll holders 2931, the maintainer has pulled the leading edge 2953 from the product roll 2951 and begun to move the leading edge 2953, or first roll tail, of the first product roll 2951 towards the first nip 2961 of the first dispensing mechanism 2921. In some embodiments, loading guides 2901, such as loading instructions in the form of arrows, text, or other indications suitable for helping a maintainer load the leading edge 2953 into the first nip 2961 may be utilized for additional guidance.

When the maintainer has pulled the leading edge 2953 of the first product roll 2951 to a position that is within a threshold distance of the nip 2961 of the first dispensing mechanism 2921 the first funnel sensor 2941 will detect the leading edge 2953 (e.g., the leading edge 2953 will cross and break the IR light 2941*a* emitted down the width of the first nip 2961). Though the first funnel sensor 2941 is shown as emitting an IR light 2941*a* down the width of the nip 2961, other IR sensors are contemplated (such as those described herein).

When the first funnel sensor 2941 detects the presence of the leading edge 2953 of the product roll, the controller may be configured to activate the first dispensing mechanism 2921, such as by causing rotation of the drive roller of the first dispensing mechanism 2921. As the drive roller and pinch roller of the first dispensing mechanism 2921 rotate, the maintainer may further lower the leading edge 2953 of the first product roll 2951 into contact with the drive roller and pinch roller such that the drive roller and pinch roller pull the leading edge 2953 of the first product roll 2951 and automatically feed the leading edge 2953 into the first dispensing mechanism 2921 to subsequently meet user commands for product.

In some embodiments, the controller may continue to operate the motor of the first dispensing mechanism 2921 for a pre-determined amount of time (e.g., 0.3 seconds, 2 seconds, etc.). Additionally or alternatively, in some embodiments, the controller may be configured to operate the motor of the first dispensing mechanism 2921 until the first chute sensor 2942 detects the presence of the leading edge 2953 signifying that the leading edge 2953 has successfully passed through the dispensing mechanism 2921 and into the first chute 2943. Thereafter, the controller may deactivate the motor of the first dispensing mechanism 2921 and the product roll may be successfully loaded. The ability to automatically feed product into the dispensing mechanism is useful to the maintainer because it replaces the step in which the maintainer may need to press a button or otherwise manually activate the dispensing mechanism to feed the leading edge of the product roll into the appropriate dispensing mechanism.

Though the above description focuses on automatically loading a leading edge of a first product roll into a first dispensing mechanism, some embodiments of the present invention may also utilize similar features to enable automatic or assisted loading of a leading edge of a second product roll into a second dispensing mechanism. For example, FIG. 66C shows an example second funnel sensor 2946 with emitted light 2946*a* that can be used for automatic or assisted loading of the second dispensing mechanism 2926. In some embodiments, one or more manual feed buttons (e.g., such as described with respect to FIG. 82) may be pressed to cause the corresponding dispensing mechanism to operate to feed the product through the dispensing mechanism—such as may be useful for loading the product, which may occur independently or in conjunction with various automatic/assisted loading example embodiments.

In some embodiments, the controller may be configured to cause the automatic or assisted feed operation to initiate slowly to make the experience more pleasant for the maintainer. To explain, the controller may operate the motor of the dispensing mechanism slowly at first and slowly ramp up speed. In this regard, the maintainer might not get scared or intimidated by the burst of motor operation (as their hand is nearby). Further, in some embodiments, the slow acceleration of the motor invites the maintainer to maneuver the leading edge of the product roll near the nip for loading.

In some embodiments, the controller may be configured to enable re-installation of the leading edge. For example, a maintainer may feel that the leading edge was awkwardly loaded. In this case, after the motor stops running (e.g., the controller sensed the leading edge in the chute), the maintainer may pull out the leading edge from above the dispensing mechanism (e.g., upward from within the dispensing mechanism). Instead of fighting, the motor may be configured to cooperate and enable the maintainer to remove the installed leading edge of product roll. Then, in some embodiments, the funnel sensor may detect the lack of presence of the leading edge (as it was pulled out) and the controller may reset the automatic or assisted feed operation and be ready to begin automatic or assisted feeding again.

In some embodiments, the product dispenser may include one or more light pipes to facilitate operation of one or more of the funnel sensor and/or chute sensor. In this regard, in some embodiments, a light pipe system may be configured to reduce parts and maximize the ability to accurately detect the presence or absence of the product roll in the corresponding funnel or chute. FIGS. 67A and 67C illustrate two example light pipe systems that provide such advantages for both of two funnel sensors (e.g., when the product dispenser has two dispensing mechanisms and two corresponding funnel sensors).

FIG. 67A illustrates a top view of an example light pipe system 3000 for an example product dispenser with two nips 3061, 3066 (e.g., the product dispenser 2900). The light pipe system 3000 includes a first printed circuit board (PCB) 3011, a second printed circuit board (PCB) 3016, a first light pipe 3080*a*, and a second light pipe 3080*b*. The first PCB 3011 and the second PCB 3016 are positioned on opposite sides of both nips 3061, 3066 (e.g., on either side of the dispensing mechanisms). The first PCB 3011 includes a single transmitter 3012 and two receivers 3013*a*, 3013*b*. Likewise, the second PCB 3016 includes a single transmitter 3017 and two receivers 3018*a*, 3018*b*. Two light pipes 3080*a*, 3080*b* are positioned in between the two nips 3061, 3066, with the first light pipe 3080*a* facing the first PCB 3011 and the second light pipe 3080*b* facing the second PCB 3016.

The shape of the illustrated light pipes 3080*a*, 3080*b* enable a single transmitter 3012, 3017 to emit light for the IR sensor such that the IR sensor effectively covers the entire nip 3061, 3066 to efficiently and effectively detect the presence or absence of the product in the nip 3061, 3066. To explain, with reference to FIG. 67A, the first light pipe 3080*a* includes an inlet 3081 that is positioned across the nip 3061 from the single transmitter 3012 (positioned on the first PCB 3011). Light is emitted from the single transmitter 3012 across the nip 3061 into the inlet 3081 across Path $P_T$. The light pipe 3080*a* includes a first splitting surface 3082 and a second splitting surface 3087 that are designed to split the received light, with a first portion of the light travelling toward a first deflecting surface 3083 and the second portion of the light travelling toward a second deflecting surface 3088. The first portion of the light is deflected off the first deflecting surface 3083 out of the first outlet 3084 across the nip 3061 and toward the first receiver 3013*a* across $P_{R1}$. The second portion of the light is deflected off the second deflecting surface 3088 out of the second outlet 3089 across the nip 3061 and toward the second receiver 3013*b* across $P_{R2}$. In this manner, a single transmitter 3012 is capable of creating three distinct paths ($P_T$, $P_{R1}$, and $P_{R2}$) across the nip 3061, where breaking any one of the paths indicates the presence of product in the nip 3061. Further, the light pipe 3080*a* can be designed such that the paths can extend across the nip at various desirable points (such as proximate the ends of the nip) to maximize the potential to sense the presence of the product in the nip. In this regard, a compact system that minimizes parts is created that enables both funnel sensors. FIG. 67B illustrates a side view of the light pipe system 3000 in use with both nips 3061, 3066 of a product dispenser.

FIG. 67C illustrates another example light pipe system 3100. Notably, the light pipe system 3100 is similar to light pipe system 3000 (shown in FIG. 67A), but the position of the second light pipe 3180*b* and the second PCB 3116 are switched.

FIGS. 68A-B show example light pipes that are usable for example embodiments, such as the examples described above with respect to FIGS. 67A-67C.

Although the above example light pipes are described for funnel sensors, some embodiments of the present invention contemplate use for one or more chute sensors. Along these same lines, some embodiments of the present invention contemplate other light pipe systems for the one or more chute sensors.

FIGS. 69A-69C show an example light pipe system for both chute sensors for an example product dispenser. With reference to FIG. 69A, the product dispenser 3001 may have a first chute 3048 and a second chute 3049, each of which may be designed to direct dispensed product to a user, such as from a corresponding first and second dispensing mechanism. FIG. 69A shows a second light pipe 3046 for the second chute 3049. The second light pipe 3046 extends from a second printed circuit board 3047 (e.g., PCB 3111 in FIG. 67C). The second light pipe 3046 may include an emitter light pipe arm 3047*a* that is configured to direct light into the second chute 3049. The second light pipe 3046 may also include a receiver light pipe arm 3047*b* that is configured to receive reflected light and direct it back to a receiver positioned on the PCB 3047. In this regard, with reference to FIGS. 69A and 69B, product that passes through the second chute 3049 may cause light emitted from the emitter light pipe arm 3047*a* to reflect back into the receiver light pipe arm 3047*b* to indicate the presence of the product in the second chute 3049. Thus, the chute sensor may form a reflective IR sensor. As shown in FIG. 69B, the second light pipe 3046 may be configured to direct light into the second chute 3049 at a position downstream of a second tear bar mechanism 3003. In such embodiments, the chute sensor may be configured to only indicate when product is in the chute and not yet retrieved by a user (e.g., torn off using the tear bar mechanism). This positioning is important because there may be product that remains upstream of the tear bar mechanism even after a successful dispense and tearing occurs. FIG. 69C shows that a first light pipe 3041 may be positioned to sense product in the first chute 3048 downstream of the first tear bar mechanism 3004 in a similar manner to the second light pipe 3046. In some embodiments, the first light pipe 3041 may extend from a first PCB (e.g., PCB 3116 in FIG. 67C) and be configured in a similar manner to the second light pipe 3046.

Though the above described examples employ light pipes, some example embodiments may employ other structures to reflect and/or direct light, such as mirrors. For example, one or more mirrors could be positioned at various points within the dispenser to redirect light in a desired direction or according to a desired pattern.

Though some example described embodiments contemplate sensing product, the funnel sensors and/or chute sensors may be used to sense other objects, such as a user's hand. In this regard, in some embodiments, if a funnel sensor senses a user's hand, the controller may be configured to initiate automatic or assisted loading operations (such as described herein). In such a situation, a user may be bringing their hand close to the funnel to begin loading or installing the product roll therein. In some embodiments, if a chute sensor senses a user's hand, the controller may be configured to cause operation of the corresponding dispensing mechanism so as to attempt to provide product to the user. In such a situation, the user may be attempting to reach up the chute to grab a small remaining portion of the product, thereby indicating a desire for dispensed product.

Tear Bar Detection Mechanism

Some embodiments of the present invention may include one or more tear bar detection mechanisms (e.g., tear bar detection mechanisms 124, 129 of FIG. 2) that are each configured to detect when a sheet of the product roll has been torn using the tear bar. For example, each chute may include a tear bar detection mechanism. By utilizing a tear bar detection mechanism, the controller may determine when a sheet has been dispensed and removed. Such information may be useful for various features contemplated by some embodiments of the present invention, including for example determining whether or not the product dispenser or dispensing mechanism is operating properly (e.g., if the dispensing mechanism is jammed), performing hang mode operation of the dispenser (e.g., the dispensing mechanism may operate after a user removes a sheet to cause the next portion of the product roll to "hang" out of the dispenser for subsequent tearing by the next individual), determining the amount of the product roll that has been dispensed (e.g., by counting how many sheets have been dispensed and knowing the programmed length of each dispensed sheet), among other things.

FIGS. 71A-71F illustrate example tear bar detection mechanisms that can be used by various embodiments of the present invention.

Figure 71A:
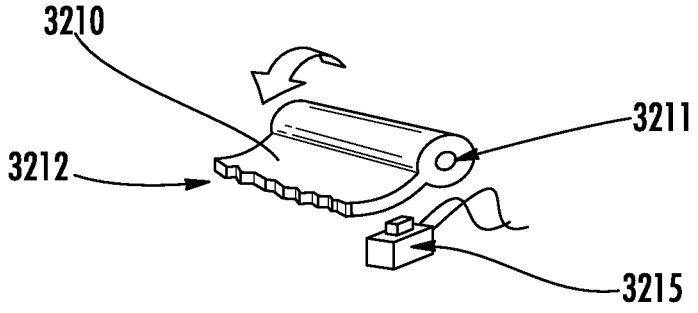

FIG. 71A illustrates a tear bar 3210 that pivots about an axis 3211. The tear bar 3210 includes serrated edges 3212 that are configured to, when a user pulls on a portion of the paper towel hanging from the dispenser, contact and cut the paper towel. As the paper towel is pulled downwardly, the tear bar 3210 rotates about the axis 3211 and contacts a micro switch 3215 which sends a signal to the controller indicating that the sheet has been dispensed.

Figure 71B:
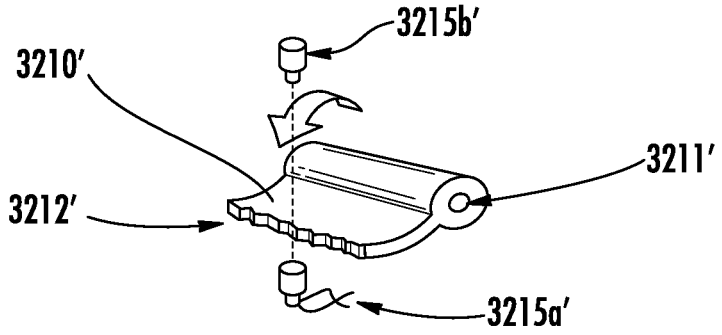

FIG. 71B illustrates a tear bar 3210' that pivots about an axis 3211'. The tear bar 3210' includes serrated edges 3212' that are configured to, when a user pulls on a portion of the paper towel hanging from the dispenser, contact and cut the paper towel. As the paper towel is pulled downwardly, the tear bar 3210' rotates about the axis 3211' to trigger a sensor (e.g., an IR sensor) that emits a light beam between a transmitter 3215*a*' and a receiver 3215*b*'. In response, a signal is sent to the controller indicating that the sheet has been dispensed.

Figure 71C:
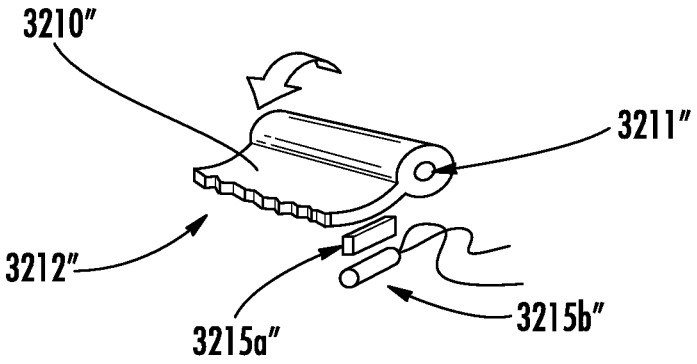

FIG. 71C illustrates a tear bar 3210" that pivots about an axis 3211". The tear bar 3210" includes serrated edges 3212" that are configured to, when a user pulls on a portion of the paper towel hanging from the dispenser, contact and cut the paper towel. A magnet 3215*a*" is affixed or coupled to the tear bar 3210". As the paper towel is pulled downwardly, the tear bar 3210" rotates about the axis 3211" and the magnet 3215*a*" moves toward a magnet sensor 3215*b*" (e.g., a Hall Effect sensor). In response to sensing the magnet 3215*a*", a signal is sent to the controller indicating that the sheet has been dispensed.

Figure 71D:
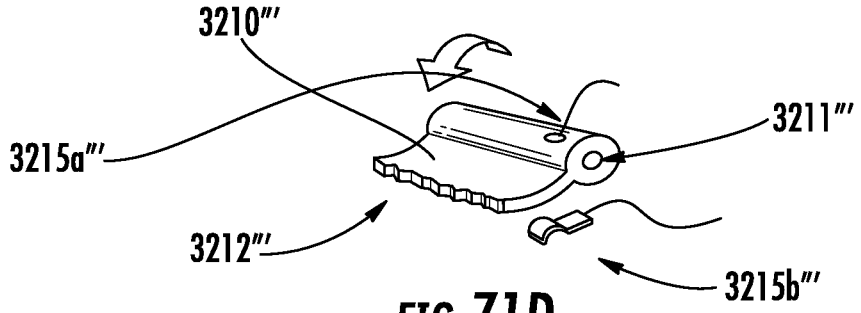

FIG. 71D illustrates a tear bar 3210' that pivots about an axis 3211'". The tear bar 3210'" includes serrated edges 3212'" that are configured to, when a user pulls on a portion of the paper towel hanging from the dispenser, contact and cut the paper towel. As the paper towel is pulled downwardly, the tear bar 3210'" rotates about the axis 3211'" and establishes electrical conductivity with an electrical contact 3215*b*'" (e.g., electricity is passed to the electrical contact 3215*b*" through the tear bar 3210'" by a wire connection 3215*a*'". In response, a signal is sent from the electrical contact 3215*b*" to the controller indicating that the sheet has been dispensed.

Figure 71E:
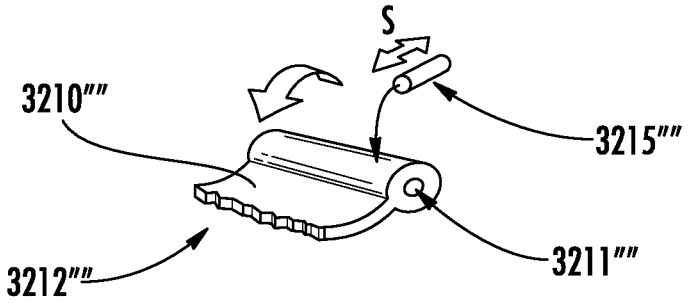

FIG. 71E illustrates a tear bar 3210"" that pivots about an axis 3211"". The tear bar 3210"" includes serrated edges 3212"" that are configured to, when a user pulls on a portion of the paper towel hanging from the dispenser, contact and cut the paper towel. A strain gauge sensor 3215"" is affixed or coupled to the tear bar 3210"". As the paper towel is pulled downwardly, the tear bar 3210"" rotates about the axis 3211"" and the strain gauge sensor 3215"" is pulled (e.g., along arrow S). In response, the strain gauge sends a signal to the controller indicating that the sheet has been dispensed.

Figure 71F:
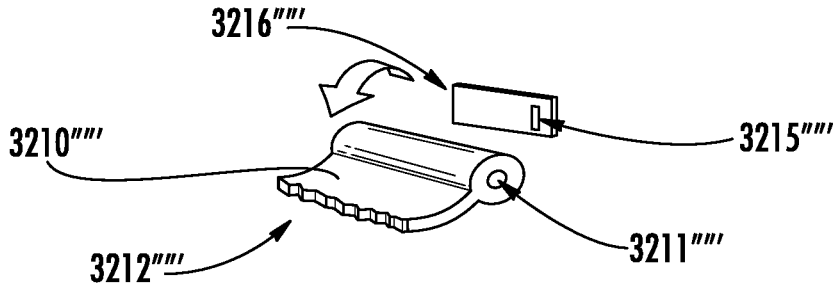

FIG. 71F illustrates a tear bar 3210"""" that pivots about an axis 3211"""". The tear bar 3210"""" includes serrated edges 3212"""" that are configured to, when a user pulls on a portion of the paper towel hanging from the dispenser, contact and cut the paper towel. As the paper towel is pulled downwardly, the tear bar 3210"""" rotates about the axis 3211"""" and emits one or more vibrations or vibration pattern(s). An accelerometer 3215' is positioned in a suitable location to sense vibrations, for example the accelerometer 3215"""" is positioned on a nearby printed circuit board 3216"""". In particular, actuation of the tear bar 3210"""" may emit a recognizable and specific vibration pattern that can be recognized by the accelerometer 3215"""" as dispensing of a sheet of the paper towel. In response, a signal is sent to the controller indicating that the sheet has been dispensed.

Additional example tear bar mechanisms and the various features that can be used due to information gathered by the tear bar mechanism can be found in U.S. application Ser. No. 12/437,921, entitled "Sheet Product Dispenser With Sensor For Sheet Separation", which is assigned to the assignee of the present application and incorporated by reference herein in its entirety.

While some of the above described example embodiments utilize a movable tear bar to determine a tear event, some embodiments of the present invention may utilize other sensors, such as one or more chute sensors (e.g., the chute sensor examples described herein) to detect tearing and/or removal of a dispensed sheet. In such example embodiments, the tear bar may be stationary and/or the paper may be pre-perforated. In a further example, another type of sensor, such as an accelerometer, may be used to sense the occurrence of a tear event. For example, a stationary tear bar may vibrate upon removal of the paper towel. In such an embodiment, the accelerometer may sense the vibration and determine the occurrence of the tear event.

Motor Operation Sensing, Assigning Sheet Length

Some embodiments of the present invention provide product dispensers that may be configured to sense when a motor for a dispensing mechanism operates. Such information can be used by the controller of the product dispenser for a number of different operations including, for example, ensuring dispensing of a desired sheet length, detecting a jamming scenario, detecting an out of paper or near out of paper scenario, among many others.

In some embodiments, the motor operation sensing information may be utilized by the controller for detecting various scenarios related to the product roll and/or dispensing mechanism, such as some examples described herein. Additionally or alternatively, in some embodiments, knowledge of how many times the motor operates may be utilized with a known time period and/or other information, such as information gathered from other sensors (e.g., a funnel sensor, a chute sensor, a tear bar detection mechanism, a product level sensors, etc.), to determine various scenarios regarding the product roll and/or dispensing mechanism.

In some embodiments, knowing when the motor operates, such as one full rotation of the motor, or alternatively, fractions of a full rotation, may allow the controller to cause the desired sheet length of a dispensed portion of paper towel to be achieved for the dispense. To explain, the number of times a motor rotates is correlated to the number of rotations of the drive roller for the dispensing mechanism, for example by a known gear ratio. The number of rotations of the drive roller is directly correlated to the length of dispensed paper towel, since the size of the drive roller is known. Thus, the controller may be configured to cause the motor to operate and count the number of rotations of the motor. When a certain number of rotations is achieved, then the controller may cease operation of the motor. In this regard, a desired sheet length can be achieved by stopping the motor when the desired sheet length is reached. In some embodiments, the controller may be configured to cause one of at least three different sheet lengths to be dispensed. As described herein in greater detail, the maintainer may set a desired sheet length for dispensing, such as through interaction with a user interface.

Embodiments of the present invention contemplate a number of different ways to sense operation of the motor for the dispensing mechanism. The following describes some example ways in which the product dispenser may be configured to sense operation of the motor of the dispensing mechanism (e.g., each dispensing mechanism).

In some embodiments, with reference to FIGS. 72-75B, the product dispenser (such as through the controller) may be configured to monitor and filter a voltage signal from the motor to detect operation of the motor. For example, FIG. 72 shows a graph 3300 illustrating an example voltage signal return of a motor taken over time. During operation of the motor, shown as a time period 3305, the voltage signal can be filtered to enable sensing of commutation spikes/noise as the motor switches poles during operation. Each spike may indicate a full or fractional rotation of the motor, which may correspond to a rotation of the drive roller. In some embodiments, the voltage signal shown in FIG. 72 may be weak and difficult to monitor. As such, in some embodiments, the voltage signal may be amplified, such as using the circuit 3310 shown in FIG. 73, which includes one or more bandpass filters/amplifiers 3312. Using the bandpass filters/amplifiers, unwanted low and high frequency noise in the voltage signal can be filtered out, leaving an easily recognizable signal that is amplified. An example of the desired frequency response is shown as 3325 in the graph 3320 in FIG. 74.

In some embodiments, the filtered and amplified signal is sent to a comparator, which compares the motor signal to a set reference voltage and outputs a high logic signal when the motor signal is greater than the set reference voltage. This results in a pulse being sent to the controller every time the motor commutates (e.g., switches poles during operation). FIG. 75A shows a simulation 3330 of the voltage signal chain in an example embodiment during operation of the motor, where the time period 3338 shows the effect of commutation ripple on the signal (e.g., see the ripples in the signal), and operation before and after time period 3338 ignores the effect of commutation ripple (e.g., no ripples in the signal). Notably, the time period shown before and after the time period 3338 is not representative of signal response and was added to aid in reference of different signals/information that would otherwise be hard to discern within time period 3338. The first, top voltage signal 3337, which is shown in green, is the motor voltage and is exaggerated to illustrate fluctuations in the voltage. The second signal 3332, which is blue, is the signal after the first filter/amplify stage. The third signal 3331, which is red, is the signal after the second filter/amplify stage. The fourth, steady signal 3334, which is cyan, is the comparator reference voltage. The fifth signal 3335, which is purple, is the comparator output which outputs a low (e.g., 0V) signal each time the third signal is less than the comparator, and outputs a high (e.g., 3.3V) signal each time the third signal is greater than the comparator. An example desired signal is the 360 Hz sine wave shown during operation of the motor signal (e.g., during time period 3338). In this example, the controller will receive an indication of motor operation (e.g., a count) whenever the signal is greater than the comparator reference voltage. In this regard, the controller may receive a pulse every time the motor switches poles.

FIG. 75B illustrates an example circuit diagram 3310' for an example implementation of the motor operation sensing. In the depicted embodiment, the commutation voltage ripple is picked up directly from the positive lead of the motor, which is connected to positive battery voltage. In the depicted embodiment, the motor may rotate at a maximum of 3500 rpm, which correlates to a commutation frequency of 350 Hz. If the paper bunches or if the batteries deplete, it may slow the motor down. Thus, the filter is built to pick up and amplify the commutation signal throughout the motor's operational range. The signal is amplified and filtered by the operational amplifiers U6A and U6B. Each filter stage is a second order multiple feedback topology, with a Chebyshev response. The first stage is centered at 114 Hz, and the second stage is centered at 352 Hz (seen as the first and second "bumps" in curve 3325 shown in FIG. 74). Together, these filters center at 200 Hz and amplify the signal with a gain of 10. The −3 dB points are at 40 Hz and 1000 Hz. The final stage of the sensing circuit is a comparator that compares the amplified motor signal to a set reference voltage. When the motor signal is greater than the reference, the comparator sends a logic high to the controller. Thus, a digital pulse train is sent to the controller to make the counting easy to implement.

In some embodiments, other methods for sensing operation of the motor may be utilized. For example, the controller may monitor the battery voltage to sense operation of the motor. Additional information regarding example embodiments that utilize battery voltage to sense motor operation can be found in U.S. application Ser. No. 14/750,333, entitled "Methods, Systems, and Apparatus for Monitoring a Dispensing State of a Dispensing System", which is assigned to the assignee of the present application and incorporated by reference herein in its entirety.

Some embodiments of the present invention contemplate other types of sensors for sensing motor operation. FIGS. 76A-76C illustrate example motor operation sensing systems that can be used by various embodiments of the present invention.

FIG. 76A illustrates an example motor operation sensing system that includes a drive roller 3350 connected to a cam plate 3355. The depicted embodiment includes a cam plate 3355 with a perimeter profile that includes an engagement surface such that as the drive roller 3350 rotates (e.g., around arrow $M_D$), the cam plate 3355 rotates and interacts with a micro-switch 3360 at its pole to indicate a rotation of the drive roller. In response, the micro-switch 3360 sends a signal to the controller indicating that the motor has commutated and/or the drive roller has rotated.

FIG. 76B illustrates another example motor operation sensing system that includes a drive roller 3350' connected to a perforated plate 3355'. As the drive roller 3350' rotates, the perforated plate 3355' also rotates. An optical sensor 3360' is positioned to pass light from one end of the optical sensor 3360' to the other end of the optical sensor 3360' and through the perforated plate 3355'. In particular, the light is emitted toward one or more holes in the perforated plate 3355'. As the perforated plate 3355' rotates, the light will be interrupted at one or more points during the rotation cycle. In such a manner, the rotations of the perforated plate 3355' and drive roller 3350' can be counted. In response, corresponding signals are sent to the controller indicating that the motor has commutated and/or the drive roller has rotated.

FIG. 76C illustrates another example motor operation sensing system that includes a drive roller 3350" connected to a magnet 3355". As the drive roller 3350" rotates, the magnet 3355" also rotates. A Hall Effect sensor 3360" is positioned proximate the magnet 3355" and configured to sense when the magnet 3355" completes a rotation cycle. In response, a signal is sent to the controller indicating that the motor has commutated and/or the drive roller has rotated.

Product Level Gauges, Dispense from Smaller Product Roll

As noted herein, some embodiments of the present invention provide a product dispenser that is configured to dispense from one of two product rolls. In particular, in some embodiments, with two separate dispensing mechanisms, either dispensing mechanism can be used to dispense from either product roll. A goal of some embodiments of the present invention is to provide the best opportunity to avoid a completely empty scenario (e.g., where both product rolls are empty and the dispenser cannot meet user demand). In order to attempt to avoid such a scenario, some embodiments of the present invention seek to always dispense product from the smaller of the two installed product rolls. In such a situation, the smaller (first) product roll will be depleted first, leaving the larger (second) product roll as a back up to dispense while the originally smaller (first) product roll is depleted. Further, since the now depleted (first) product roll can be replaced without the need to replace the currently dispensing other (second) product roll, there is the largest time opportunity for the maintainer to replace the now depleted (first) product roll and avoid a completely empty scenario. Further, such a configuration may help ensure that all of the paper within the dispenser is used up in a timely manner. For example, such a configuration may avoid a single roll sitting in the dispenser as a "permanent" back up roll, with the maintainer always (or often) replacing and dispensing from the other roll.

Along these lines, in some embodiments, the product dispenser (such as through the controller) may be configured to identify which of the first product roll and the second product roll is the smaller roll (i.e., more product has been used from the roll), and then cause dispensing to occur from the smaller roll until it is depleted. After that, the product dispenser may be further configured to dispense from the remaining roll (which was the larger roll).

In some embodiments, the dispenser may use a product level (e.g., fuel) gauge for aiding in identification of the smaller product roll. The following examples provide various product level sensors that may be utilized to aid in identification of the size of the product roll, such as how much product is remaining on the product roll.

In some embodiments, the product dispenser may include one or more pivoting product level arms for each product roll. The pivoting product level arm may be rotatably connected to the dispenser housing at one end. At the other end, the product level may contact the outer circumference of the product roll. As the product roll size decreases (as product is dispensed), the product level arm will rotate toward the center of the product roll. This angular change can be sensed and used (e.g., by the controller) to determine the remaining amount of product on the product roll. FIGS. 77 and 78 each illustrate example product level arms 3405, 3415 that abut the outer circumference of the product roll 3407, 3417 at one end and pivot about point 3406, 3416 on the dispenser 3400, 3410 at the other end. Each figure shows three different positions of the product level arm 3405, 3415 as the product roll is depleted. In FIG. 77, the product level arm 3405 abuts the product roll 3407 using a roller 3402. In FIG. 78, the product level arm 3415 directly contacts the product roll 3417 using surface 3414. Notably, the product level arms 3405, 3415 of FIGS. 77 and 78 are also used for web management such as described herein. Further, the product level arm 3405 of FIG. 77 includes guide rollers 3409 that aid in web management, such as described herein.

Other example embodiments of suitable product level sensors for the product dispenser are product level sensors using a pivoting arm or a linear displacement sensor such as the examples described in U.S. application Ser. No. 15/247,019, entitled "Sheet Product Dispenser with Product Level Gauge System", which published as U.S. Publication No. 2017/0057775 on Mar. 2, 2017, and which is assigned to the assignee of the present application and which is hereby incorporated by reference in its entirety.

In some embodiments, while having two product rolls, only one product level sensor may be used to determine which dispensing mechanism to utilize (such as to dispense from the smaller of the two product rolls). In this regard, other sensors can be utilized to determine when dispensing occurs and track the amount of product remaining on the product roll without the product level sensor. For example, for the product roll not being directly monitored by a product level sensor, the amount of product remaining can still be determined using a known starting amount of product and subtracting therefrom the number of dispenses times the sheet length of each dispense. The product level sensor could be utilized to determine the amount of product remaining on the other product roll—thereby enabling determination of which product roll has less product remaining. In similar regard, the tracking and amount remaining estimation could be performed for both product rolls, meaning that no product level sensor was necessary. Further information regarding various ways to estimate an amount of product remaining in a dual product roll dispenser can be found in U.S. Publication No. 2017/0057775 referenced above, which is incorporated herein by reference in its entirety.

In some embodiments, other estimation type routines can be performed to achieve a similar effect as if the dispenser was dispensing from the smaller product roll. For example, the product dispenser may be configured to use a product level sensor to determine if one of the product rolls has less than a predetermined amount of product remaining (e.g., less than 75%). In the instance in which the product roll has less than the predetermined amount, the product dispenser may cause dispensing from that product roll. Since a new product roll should not have less than the predetermined amount (e.g., 75%), the product dispenser would likely be dispensing from the smaller of the two product rolls. If the product roll did not have less than the predetermined amount, then the product dispenser may cause dispensing from the other product roll first. Such a system enables use of only one product level sensor. However, in some embodiments, two product level sensors could be used (e.g., one for each product roll) and a similar threshold check could be performed to determine which product roll to dispense from first.

In some embodiments, the product dispenser (such as through the controller) may be configured to compare the various ratios of rotation of the product rolls to corresponding drive rollers to help determine which product roll is smaller and/or an estimated amount of product remaining on at least one product roll. For example, the product dispenser (such as through the controller) may be configured to detect and compare rotation of the first product roll to rotation of the first drive roller (alternatively, the first motor) of the first dispensing mechanism to form a first rotation ratio (e.g., the time period for a rotation cycle of the first product roll over the time period for a rotation cycle of the first drive roller). Likewise, the product dispenser (such as through the controller) may be configured to detect and compare rotation of the second product roll to rotation of the second drive roller (alternatively, the second motor) of the second dispensing mechanism to form a second rotation ratio (e.g., the time period for a rotation cycle of the first product roll over the time period for a rotation cycle of the first drive roller). By comparing, these ratios, the controller can determine which product roll is smaller (e.g., the smaller of the two ratios indicates a smaller product roll—as less time is required to complete a rotation cycle for a smaller product roll). In some embodiments, the controller may determine the time period of a rotation cycle of each product roll and determine which product roll is smaller due to that product roll completing a rotation cycle in less time.

FIG. 79 shows another product level sensor embodiment that uses a rotation sensor, such as may be used for comparing the ratio of rotations between the product rolls and corresponding drive rollers. Such an example rotation sensor may be configured to count the rotations of the product roll. The illustrated example embodiment provides a product dispenser 3420 with a first rotation sensor 3425 configured to sense rotation of the first product roll 3451 and a second rotation sensor 3435 configured to sense rotation of the second product roll 3456. Additionally, the product dispenser 3420 includes a third rotation sensor 3445 configured to sense rotation of the first drive roller 3423 of the first dispensing mechanism 3421 and a fourth rotation sensor 3455 configured to sense rotation of the second drive roller 3428 of the second dispensing mechanism 3426.

As shown in FIG. 79, the first product roll 3451 is smaller than the second product roll 3456. When the product dispenser 3420 dispenses from the first product roll 3451, the controller may measure the first rotation sensor 3425 (for rotation of the first product roll 3451), and may also measure the third rotation sensor 3445 (for rotation of the first drive roller 3423). Further, when the product dispenser 3420 dispenses from the second product roll 3456, the controller may measure the second rotation sensor 3435 (for rotation of the second product roll 3456), and may also measure the fourth rotation sensor 3455 (for rotation of the second drive roller 3428). Then, for a like number of rotations from the third rotation sensor 3445 (for the first drive roller 3423) and the fourth rotation sensor 3455 (for the second drive roller 3428), the controller may determine whether the first rotation sensor 3425 (for the first product roll 3451) or the second rotation sensor 3435 (for the second product roll 3456) counted more rotations. In FIG. 79, the first rotation sensor 3425 (for the first product roll 3451) will count more rotations than the second rotation sensor 3435 (for the second product roll 3456) because the first product roll 3451 is smaller than the second product roll 3456. In this manner, the product dispenser 3420 (such as through the controller) may determine that the first product roll 3425 is smaller, and the product dispenser 3420 may choose to dispense from the first product roll 3451 first until it is depleted for benefits (increased use of the reserve roll) that have been described herein. Conversely, if the second rotation sensor 3435 (for the second product roll 3456) counts more rotations than the first rotation sensor 3425 (for the first product roll 3451), the product dispenser 3420 may determine that the second product roll 3456 is smaller, and the product dispenser may choose to dispense from the second product roll 3456 first until it is depleted.

In some embodiments, the rotation sensors may be used to determine the size of a product roll. For example, as the product dispenser dispenses from the first drive roller 3423, the product dispenser 3420 may measure the third rotation sensor 3445 (for the first drive roller 3423) and the first rotation sensor 3425 (for the first product roll 3451). The ratio of rotations is proportional to the diameter of the first product roll 3451, and may be used to determine the amount of product remaining on the first product roll 3451 (e.g., the known diameter of the first drive roller may be used with the ratio of rotations to determine the diameter of the first product roll). Similarly, as the product dispenser 3420 dispenses from the second drive roller 3428, the product dispenser may measure the fourth rotation sensor 3455 (for the second drive roller 3428) and the second rotation sensor 3435 (for the second product roll 3456), and use the ratio of rotations (along with the known diameter of the second drive roller 3428) to determine the diameter of the remaining portion of the second product roll 3456 and, thus, the amount of product remaining on the second product roll 3456.

In some embodiments, the ratio of duration of time for a full rotation of the product roll versus the ratio of duration of time for a full rotation of the drive roller can be used to determine the size of the product roll. For example, as the product dispenser dispenses from the first drive roller 3423, the product dispenser 3420 may measure the time it takes to complete a full rotation of the first drive roller 3421 (e.g., by using the third rotation sensor 3445) and the time it takes to complete a full rotation of the first product roll 3451 (e.g., by using the first rotation sensor 3425). Since the diameter of the drive roller is known, the ratio of the time it takes to complete a full rotation of the product roll versus the time it takes to complete a full rotation of the drive roller can be used to determine the diameter of the product roll and, thus, the amount of remaining product on the product roll. The same method can be utilized for determining the amount of product remaining on the second product roll 3456 using the second rotation sensor 3435 and the fourth rotation sensor 3455.

In some embodiments, the product dispenser may include one or more IR sensors configured to determine the amount of product remaining on a product roll. For example, FIG. 80A shows an example embodiment of a product dispenser 3500 with a first IR sensor 3525 configured to measure the amount of product remaining for the first product roll 3551 and a second IR sensor 3535 configured to measure the amount of product remaining for the second product roll 3556. The first IR sensor 3525 is configured to emit an infrared wavelength that reflects off of an external surface 3554 of the first product roll 3451. The reflected infrared wavelength is then sensed by an IR receiver of the first IR sensor 3525. Likewise, the second IR sensor 3535 is configured to emit an infrared wavelength that reflects off of an external surface 3559 of the second product roll 3456. The reflected infrared wavelength is then sensed by an IR receiver of the second IR sensor 3535.

In some embodiments with a web management feature (such as a roll partition, divider, etc.), one or more IR sensors may be positioned on the web management feature and directed toward one or more of the product rolls. For example, with reference to FIG. 80B, an example roll partition 3540 may include a handle 3541 (e.g., for a user to grasp and cause rotation of the roll partition). The roll partition 3540 (or the handle thereof) may define a cross beam 3543 that can be used for logo display and/or reinforcability. Additionally, in some embodiments, with reference to FIG. 80C, one or more IR sensors may be housed within a portion of the roll partition 3540, such as the cross beam 3543. In the depicted embodiment, the one or more IR sensors may be positioned within an installation space 3549. In some embodiments, a single IR sensor may be installed in the installation space 3549 and include one or more emitter and one or more receiver that are oriented to detect product from a product roll (e.g., along either arrow $IRS_1$ or $IRS_2$). In some embodiments, a single IR sensor may include multiple emitters and/or receivers that may be oriented to detect product from both product rolls—such as being oriented toward each arrow $IRS_1$ and $IRS_2$). In some embodiments, two separate IR sensors may be utilized to detect product from both product rolls (each IR sensor being oriented toward a corresponding product roll).

In some embodiments, the controller (such as through the first IR sensor 3525) may be configured to determine the intensity of the reflected IR compared to the emitted IR. The controller may then be configured to determine the size of the first product roll 3551 by comparing the first reflected IR to the first emitted IR. Likewise, the same analysis can be performed with respect to the second product roll 3556. In this manner, the product dispenser may know the size of each product roll. The product dispenser (such as through the controller) may then determine which product roll is smaller and dispense from that product roll first.

In another embodiment, both IR sensors 3225, 3535 may be configured to emit a known intensity of light and measure the reflected intensities of light. The controller may compare which reflected intensity is weaker (from a roll surface that is further away because the roll is smaller) and thereby determine which roll is smaller.

In another embodiment, a first product roll is larger than a second product roll yet the reflected intensity from the first product roll is weaker than the reflected intensity from a second product roll due to factors such as the IR transmitter and/or receiver for the first product roll being mounted further away from the first product roll holders, or mounted at an angle, or is configured to transmit less IR intensity, or other factors. In such a case, the controller can be configured to determine that the weaker reflected intensity for the first product roll is still large enough to compensate for those factors, and the controller may then determine that the second product roll is smaller and should be dispensed from first.

In another embodiment, the IR sensor emits a light beam and measures the amount of time that it takes for the light to reflect off of a product roll and return to an IR detector. The amount of time that the light travels is directly correlated to the distance from the product roll, since the speed of light is known and constant. In this manner, the controller is able to determine the distance to the product roll surface and, thus, the diameter of the product roll. Alternatively, the product level sensor may emit a sound signal and measure the amount of time that it takes for the sound to reflect off of a product roll surface and return to the product level sensor. The amount of time that the sound travels is directly correlated to distance from the roll, since the speed of sound is very consistent in the typical operating temperatures of the dispenser. In this manner, the controller is able to determine the distance to the product roll surface and, thus, the diameter of the roll.

Along the above lines, some embodiments of the present invention contemplate other types of product level sensors for determining the amount of product remaining on a product roll or determining which product roll is smaller (e.g., has less product remaining). FIGS. 81A-81B illustrate example product level sensors that can be used by various embodiments of the present invention.

FIG. 81A illustrates an example rotary product level sensor 3625 that is configured to measure the speed of rotation ($R_{F1}$) of the product roll 3651. This information can be used, for example, in order to determine the size of the product roll or in comparison with rotation of the drive roller for comparison with another product roll (such as described above) to determine which product roll is smaller. FIG. 81B illustrates an example strain measurement product level sensor 3625' that is configured to measure the strain ($F_{F2}$) of the weight change of the product roll 3651' as it dispenses. This information can be used, for example, to determine the size of the product roll or in comparison with the strain associated with dispensing from another product roll (similar to the ratio comparisons for rotation of the product roll and the drive roller as described above) to determine which product roll is smaller.

In some embodiments, both product rolls may be replaced with full product rolls. In such a scenario, either product roll may be dispensed from. In some such embodiments, the product dispenser may default to dispensing from the first product roll (e.g., the top product roll). Alternatively, the product dispenser may default to dispensing from the second product roll (e.g., the bottom product roll). Likewise, a maintainer may replace a partially depleted product roll, leaving behind two full product rolls. In such a scenario, in some embodiments, the product dispenser may be configured to dispense from the older of the product rolls (e.g., the product roll that has been installed the longest). In other embodiments, the controller is configured to dispense, alternately, from both product rolls for a period of time in order to gather enough information to determine which roll is smaller.

Jam Detection

In some embodiments, the controller of the product dispenser may be configured to determine the occurrence of a jam scenario. This may be accomplished in multiple ways. In an example embodiment, the controller determines how many times the motor has been energized to dispense paper and whether or not paper has been detected by the chute sensor. In this regard, if there is expected to be paper in the chute but the chute sensor does not indicate the presence of paper, then the controller may determine that a jam has occurred (e.g., above the chute sensor). In some embodiments, a product level sensor (such as example product level sensors described herein) and/or funnel sensor may be checked to confirm that there is product available for dispensing (making sure the motor isn't running without product). In some embodiments, the controller monitors the motor and/or drive roller rotations to determine if a jam has occurred. For example, if the controller energizes the motor to dispense product yet the motor does not rotate, then the controller may determine that a jam (or other inoperable condition) has occurred. In some embodiments, the controller monitors the position of the product level arm 3415 and rotations of a product level roller 3402 to determine if a jam has occurred. For example, if the position of the product level arm 3415 indicates that there is product on the roll yet the product level roller 3402 is not rotating, then the controller may determine that a jam (or other inoperable condition) has occurred. In the event of a jam scenario, the product dispenser (such as through the controller) may be configured to automatically switch dispensing to the other product roll (which would utilize the other dispensing mechanism that is most likely not jammed). Further, the jam scenario could be communicated to the maintainer, such as through a maintainer user interface, the main user interface, or wirelessly (e.g., a text message, email, etc.).

Auto-Switch Product Roll Dispensing, Out of Paper Scenario

As noted herein, some embodiments of the present invention provide a product dispenser that is configured to dispense from one of two product rolls. In particular, in some embodiments, with two separate dispensing mechanisms, either dispensing mechanism can be used to dispense from the associated product roll. In some embodiments, it is desirable to automatically switch dispensing from one dispensing mechanism for one product roll to the other dispensing mechanism for the other product roll without additional steps required by the user. For example, in some embodiments, a user may initiate the dispense (such as by detection from the activation sensor). The product dispenser may determine that the first product roll is empty (or near empty) and automatically dispense from the second product roll. In this manner, there is seamless transition between dispensing of both product rolls and user demand is realized.

In some embodiments, the controller may be configured to use various information, such as from the funnel sensor, motor operation sensor, and/or product level sensor to determine when one product roll is out-of-paper or nearly out-of-paper. For example, in some embodiments, the controller may be configured to determine the occurrence of an out of paper scenario by determining whether or not paper has been detected by the funnel sensor. In some embodiments, the attempted operation of the motor or actuation of the activation sensor can trigger a check of the corresponding funnel sensor to determine if there is an out of paper scenario. In this regard, if there is no paper detected by the funnel sensor, then the product roll is likely empty. In some embodiments, a product level sensor (such as example product level sensors described herein) may be used to determine whether there is any product remaining, for example by determining whether a roller 3402 is rotating when the associated motor is energized. Further, in some embodiments, a product level sensor can be checked to determine if the product roll is nearly out of paper. When such a determination is made, the controller may automatically switch to dispensing from the other remaining product roll (such as described above). In some embodiments, other indications may cause the controller to switch operation to the other dispensing mechanism and product roll, such as a rotation sensor associated with the motor, drive roller, and/or product roll indicates that the corresponding rotation mechanism is rotating either too quickly or not quickly enough (e.g., depending on the scenario).

User Interface

In some embodiments, the product dispenser may include a user interface (e.g., the user interface 114 shown in FIG. 2). In some embodiments, the user interface may be configured for interaction with the maintainer (e.g., janitor) and/or consumer (e.g., user receiving the dispensed portion of the product). FIG. 82 shows an example user interface 7000.

In some embodiments, the cover must be opened in order to access the user interface and/or other portions of the chassis. Alternatively, in some embodiments, at least a portion of the chassis may be accessible to a user/maintainer without opening the cover. In this regard, in some embodiments, the user interface 7000 (or portions thereof) may be physically accessible, but may be disabled from a user. Further, access could be granted to such features in various ways, such as by opening the cover, entering a code, swiping a badge, etc.

In some embodiments, the user interface may form a part of a chassis that includes, for example, the first and second dispensing mechanism, the first and second chutes, and/or additional components (e.g., the controller, etc.). In some embodiments, the cover may be designed such that the chassis can be replaceable without opening the cover. For example, the chassis could be a "snap-in" module. Such an embodiment may provide for easy maintenance and replacement capabilities.

In some embodiments, the user interface may be configured to enable a maintainer to select one or more options for dispensing the product. For example, with reference to FIG. 82, the user interface 7000 includes four buttons 7010*a-d* that can be selected by the maintainer. In this regard, in some embodiments, the maintainer may open the cover to reveal a portion of the user interface 7000 that enables a maintainer to access and select one or more options. In the depicted embodiment, the maintainer may select (i) whether or not the dispenser should be in on-demand (or command) mode or hang mode using button 7010*a*; (ii) the range of the activation sensor using button 7010*b* (e.g., there are three predetermined range settings to select from); (iii) the desired sheet length for each dispensed portion of the product using button 7010*c* (e.g., there are three predetermined sheet length options); or (iv) the time delay between each dispense using button 7010*d* (e.g., there are three predetermined time delay period options).

In some embodiments, the buttons 7010*a-d* may be tactile buttons that provide tactile feedback to the maintainer upon selection. In other embodiments, the buttons 7010*a-d* may be other forms of buttons, including, for example, capacitive sensor based buttons.

In some embodiments, one or more LEDs may be utilized to provide an indication of the option selected. For example, with reference to FIG. 82, the button 7010*a* for selecting whether or not the dispenser should be in hands-free mode or hang mode is surrounded by an annular LED 7012. Since the options for selecting which dispenser mode are limited to two (hands-free or hang), the annular LED 7012 may be one solid light. In some embodiments, other configurations may be implemented. For example, buttons 7010*b-d* are surrounded by annular rings 7011*a-c* that are each divided into three sections, each corresponding to a different LED (see e.g., LEDs 7013*a-c* for annular ring 7011*b* and button 7010*c*). Depending on the selected option, the corresponding LEDs 7013*a-c* could be illuminated. For example, FIG. 82A illustrates a situation where the maintainer has selected a first predetermined sheet length option using button 7010*c*. In this depicted example, only the first LED 7013*a* is illuminated, with the second and third LED 7013*b-c* not illuminated. FIG. 82B illustrates the situation where the second predetermined sheet length was selected using button 7010*c* and, thus, the first and second LEDs 7013*a-b* are illuminated. FIG. 82C illustrates the situation where the third predetermined sheet length was selected using button 7010*c* and, thus, the first, second, and third LEDs 7013*a-c* are illuminated. The visual indication provided by the sequential illumination of the LEDs 7013*a-c* gives intuitive feedback to the user regarding which option is selected.

Though the above described user interface includes circular buttons and annular LEDs, some embodiments of the present invention contemplate other shapes and placements for the buttons and LEDs.

In some embodiments, the user interface may be configured to enable a user to manually operate the one or more dispensing mechanisms (such as to clear a jam or help in loading a new product roll). With reference to FIG. 82, the user interface 7000 includes two feed buttons 7031, 7036, one for each dispensing mechanism. In this regard, the feed buttons are color coded to aid in recognition of which dispensing mechanism will be operated by pushing of the corresponding button. For example, the funnel cover 7075 of the second dispensing mechanism for the second nip 7061 has a green-ish color. Likewise, the bottom feed button 7031 has an indication space with a green-ish color to denote that it will cause operation of the second dispensing mechanism. In this regard, pushing the other feed button 7036 will cause operation of the first dispensing mechanism.

In some embodiments, such as described herein, the product dispenser (such as through the controller) may be configured to determine the occurrence of a jam situation for each of the dispensing mechanisms. In such a situation, an LED may illuminate in some manner to indicate the jam and the dispensing mechanism in which the jam has occurred. For example, with reference to FIG. 82, the user interface 7000 includes an LED 7032 that corresponds to the feed button 7031 for the second dispensing mechanism and an LED 7037 that corresponds to the feed button 7036 for the first dispensing mechanism. In such embodiments, the controller may determine that a jam occurred in the first dispensing mechanism and, in response, cause the LED 7037 to begin blinking (or other indication) to indicate the jam and the corresponding dispensing mechanism to the user. Moreover, one purpose of the feed button is to enable a user to clear jams by pressing the feed button. Providing a blinking LED on the appropriate feed button leads to intuitive pushing of the feed button to clear the jam.

In some embodiments, the user interface may include a portion designed to provide information to the maintainer and the consumer. For example, the user interface 7000 of FIG. 82 includes a screen 7025. With reference to FIGS. 83A-B, the screen 7025 may display information to the user (e.g., consumer or maintainer). Such information may be displayed using one or more LEDs and/or back lighting. In the depicted embodiment of FIG. 83B, the screen 7025 has caused illumination of a first icon 7026 that indicates a low battery, a second icon 7027 that indicates that the dispenser has been activated, and a third icon 7028 that indicates that a problem has occurred, such as there is a jam, there is a low amount of product remaining, or there is an out of product scenario (e.g., one product roll or both product rolls), though other indications or information may be provided to the user.

In some embodiments, an activation sensor origin 7020 may be positioned proximate the screen 7025 and may be shaped or otherwise designed to draw a user's attention to it to indicate the general space in which they should place their hand to cause initiation of a dispense. In some embodiments, the activation sensor origin 7020 may be shaped and/or designed to enable light from the activation sensor (e.g., IR light) to pass therethrough. Further, in some embodiments, the activation sensor origin 7020 may be shaped and/or designed to separate the pathway of light for the activation sensor from light used to illuminate one or more indicators (e.g., icons 7026, 7027, 7028).

In some embodiments, the user interface may provide an indication to a user that a task or feature has been properly (or in some cases improperly) completed, such as by providing an animation of lights to indicate the completion of the task. For example, with reference to FIGS. 84A-C, the user interface 7000 may perform an animation after proper loading of sheet product occurs in one of the dispensing mechanisms. For example, if a maintainer properly feeds the leading edge of a product roll into the second nip 7061 and through the second dispensing mechanism (e.g., by using the manual feed button or the automatic/assisted loading feature) and that leading edge is detected as being properly loaded (e.g., by a corresponding chute sensor), the user interface 7000 may perform the animation to communicate a proper loading to the maintainer.

FIGS. 84A-C illustrate an example animation. FIG. 84A shows that the animation first comprises illumination of the first annular LED 7012 surrounding the first button 7010*a* and the three sections of the fourth annular LED 7011*c* surrounding the fourth button 7010*d*. FIG. 84B shows that the animation continues second with de-illumination of the first annular LED 7012 surrounding the first button 7010*a* and the three sections of the fourth annular LED 7011*c* surrounding the fourth button 7010*d* along with illumination of the three sections of the second annular LED 7011*a* surrounding the second button 7010*b* and the three sections of the third annular LED 7011*b* surrounding the third button 7010*c*. Finally, FIG. 84C shows that the animation continues third with de-illumination of the three sections of the second annular LED 7011*a* surrounding the second button 7010*b* and the three sections of the third annular LED 7011*b* surrounding the third button 7010*c* and illumination of a center icon 7027 on the screen 7025. In this manner, the animation shows lights illuminating in a pattern that moves toward the center of the user interface 7000. Such an example animation provides an intuitive sense of completion associated therewith, thereby indicating a complete or proper loading.

While the above description details one example animation, some embodiments of the present invention contemplate other example animations and patterns to provide one or more indications to a maintainer or consumer. Along similar lines, though the above example is directed to indicating a proper loading, some embodiments of the present invention contemplate other tasks for which proper completion or improper completion may be indicated to the maintainer or consumer (e.g., a jamming scenario; an out-of-paper scenario; a successful loading of the product roll into the roll holders, among many others).

Battery Management

In some embodiments, the product dispenser (such as through the controller) may be configured to monitor the battery voltage to determine the amount of battery remaining. In this regard, some embodiments of the present invention seek to provide an indication to the user when the battery life of the current batteries are low. Additionally, some embodiments of the present invention seek to utilize the measured battery voltage being used for other features, such as determining information about the motor or other used components (e.g., to confirm proper operation of the motor, change operational parameters of the motor, such as how long the motor needs to run to achieve an assigned sheet length, etc.).

In some embodiments, in order to determine the remaining life of the one or more batteries, the controller of the product dispenser may be configured to monitor the battery voltage being used. In some embodiments, an analog-to-digital conversion may be performed on the battery voltage. In some embodiments, the controller may be configured to utilize a rolling average algorithm to gather the lowest average battery voltage taken during a dispense cycle (e.g., the time period it takes to complete a full dispense). The controller may be configured to then use the lowest average to determine an amount of battery life remaining, so as to account for the "worst case" scenario (though other averages can be utilized, such as highest average, mean average, median average, etc.). Further, the controller may, based on the amount of battery life remaining, calculate the estimated time remaining before a replacement is needed based on a number of factors, including, for example, an estimated number of dispensers over a time period (e.g., hour, day, year, etc.) and/or an estimated number of energy tasks over a time period. Example energy tasks include running the motor(s), checking the product level sensor(s), measuring the battery, checking one or more sensors, among many others (such as those examples described herein). Such estimates may be based on historical data (such as entered during manufacturing) or, in some cases, may be based on observed data specific to at least the current product dispenser.

In some embodiments, the product dispenser (such as through the controller) may be configured to indicate a low battery to a user and/or maintainer, such as through the user interface or the maintainer user interface. For example, the controller may be configured to cause one or more LEDs to illuminate when the battery life is below a predetermined threshold. Additionally or alternatively, other indications may be provided, such as an estimated time remaining until a replacement is needed. While the above example includes providing an indication using an LED, other ways to provide an indication are contemplated, including, for example, sending a message (e.g., text or email) to the maintainer, providing text on the user interface, etc.

Motor Control, Motor Lock

Some embodiments of the present invention seek to provide more efficient operation of the motor and product dispenser as a whole. In this regard, in some embodiments, the product dispenser (such as through the controller) may be configured to control the motor to reduce bleeding of the product from the roll (e.g., a user manually pulling the product through the rollers of the dispensing mechanism). In some embodiments, to prevent bleeding, the controller may be configured to brake the motor. For example, some embodiments of the present invention may short both sides of the motor together, such as to the battery positive. In some embodiments, the controller may be configured to brake the motor for a certain amount of time after each dispense. Additionally or alternatively, the controller may be configured to brake the motor any time the motor is not running.

Gear Ratio

Some embodiments of the present invention seek to increase the efficiency of operation of the motor, such as to increase battery life and reduce overall energy usage. In this regard, the product dispenser includes a gear ratio for operation of the motor of each dispensing mechanism. The gear ratio is the ratio of the size of the gears that transfer rotation of the motor to the drive roller of the dispensing mechanism. In some embodiments, the product dispenser includes a lowered gear ratio. In some embodiments, the lowered gear ratio results in a faster dispense (e.g., less time to achieve a dispense of the product).

In some embodiments, the overall drivetrain is comprised of a plurality of gears which determine the overall gear ratio. The drivetrain may be comprised of at least two gears, but could be any number of gears more than two. To determine the overall gear ratio of the drivetrain, the output gear pitch diameter (or number of teeth) is divided by the input gear pitch diameter (or number of teeth) for each pair of gears in contact. In some embodiments, the drivetrain uses a compound gear to transfer from one gear set to another gear set. A compound gear has two gears on the same shaft, which therefore rotate at the same rotational speed. In some embodiments, the drivetrain may use one or more intermediate gears to transfer speed and torque from the input gear to the output gear. In such an example, the intermediate gears may function only to switch rotation direction and spacing between the input gear and the output gear. To determine the output rotational speed, the input speed is divided by the gear ratio.

As an example, the following scenario is presented: a motor input gear has 16 teeth followed by meshing with a 40 tooth gear; the 40 tooth gear is a compound gear with 20 teeth on the other gear; the 20 tooth gear then meshes with the output gear that has 50 teeth. For this example, the gear ratio is determined by: (40/16)×(50/20)=6.25:1. If the input speed from the motor is 3600 rpm, then the output rotational speed is 3600 rpm/6.25=576 rpm.

In some embodiments, various factors may be used to optimize the efficiency of the drivetrain. Some example factors include: feed roller diameter (determines speed of paper delivery and required torque), resistance to motion (friction from bearings/bushings, applied friction to the paper delivery system and gear shaft and tooth friction) and the motor performance curve (motor torque, rotational speed, efficiency, etc.).

Static Management

Some embodiments of the present invention seek to reduce the effects of static electricity build-up in the product dispenser. In this regard, static electricity can build-up due to the product (e.g., paper) passing across various surfaces within the product dispenser. In some embodiments, the product dispenser may include one or more static electricity paths that provide a pathway from a metal surface within the product dispenser to "ground". In such embodiments, for example, the product dispenser may include a pathway (e.g., a wire) that passes from the product dispenser into an external structure, such as the wall where the product dispenser is mounted. In some embodiments, every metal surface within the product dispenser may include a pathway that is grounded. Additional information regarding static electricity management and corresponding pathways to ground can be found in U.S. Pat. No. 6,871,815, entitled "Static Build Up Control in Electronic Dispensing Systems", filed Sep. 27, 2011; U.S. Pat. No. 7,017,856, entitled "Static Build-Up Control in Dispensing System", filed Mar. 23, 2004; U.S. Pat. No. 7,182,289, entitled "Static Build-Up Control in Dispensing System", filed Feb. 3, 2005; and U.S. Pat. No. 7,387,274, entitled "Static Build-Up Control in Dispensing System", filed Jan. 10, 2006; each of which is assigned to the Assignee of the present invention and is incorporated by reference herein in its entirety.

Lock

In some embodiments, the product dispenser may include a configurable lock for controlling access to the inside of the product dispenser. For example, with reference to FIG. 85A, the product dispenser may be configured to enable a user to open the cover 8012, such as through a lock feature 8090 located on the top 8016 of the product dispenser housing 8014. As shown in the depicted embodiment, a user 8017 may use a key 8095 to open the cover 8012 by inserting the key 8095 in the lock feature 8090. In such a situation, the lock feature 8090 is in the locked configuration.

In some circumstances, the product dispenser may be mounted on a wall and the lock feature 8090 may be difficult to reach and/or see for a user (e.g., the user may have to reach up above their head and over the top 8016 of the dispenser housing 8014 to reach the lock feature 8090). In such a situation, it may be difficult for a user (e.g., maintainer) to align the key 8095 with the lock feature 8090 to open the cover 8012. In this regard, with reference to FIGS. 85B-C, in some embodiments, the lock feature 8090 may define one or more sloped surfaces 8091 that lead a key 8095 (such as through leading the example key's two legs 8096*a-b*) into one or more proper holes 8092*a-b*. The sloped surfaces 8091 may form a "vortex" that help guide the key 8095 (e.g., through gravity and/or a pressure force causing the key to run down the slope of the surface) into the proper alignment to enable easy opening of the cover 8012. In the depicted embodiment, the legs 8096*a-b* of the key 8095 may fit within the corresponding holes 8092*a-b* of the lock feature 8090 and contact a latch 8082. By pushing further down on the latch 8082, one or more openings 8083 may be released from corresponding engagement structures of the cover 8012 to release and open the cover 8012. While the above described example includes a key with two legs, any shape key or number of legs may be used by various embodiments in forming a key/lock interaction that encourages the key into proper alignment to enable easy opening of the cover.

In some embodiments, the lock feature 8090 may be configurable to enable installation of a permanent button 8070. This changes the lock feature 8090 into an unlocked configuration (although the latch 8072 may still be engaged to keep the cover closed). For example, with reference to FIGS. 85D-E, a user (e.g., maintainer) may install a button 8070 into the lock feature 8090 such that a user only need push down on the button 8070 to open the cover 8012. In this regard, the button 8070 may define two legs 8071*a-b* that each include an outward projection 8072. The legs 8071*a-b* may be designed to flex inwardly as a tapered section of the outward projection 8072 passes into the holes 8092*a-b* of the lock feature 8090. Once past the holes 8092*a-b* of the lock feature 8090, the legs 8071*a-b* will extend outwardly and the outward projection 8072 will hold the button 8070 in the lock feature 8090. Further, the legs 8071*a-b* will extend into the dispenser housing toward the latch 8082. By pushing down on the button 8070, the legs 8071*a-b* will engage the latch 8082 to release and open the cover 8012 (e.g., in a similar manner to that shown in FIG. 85C with the legs 8096*a-b* of the key 8095).

In some embodiments, the button 8070 may be removable to reset the lock feature 8090 to the locked configuration. For example, with reference to FIG. 85F, the key 8095 may be used from inside the product dispenser to push the button 8070 out of engagement with the lock feature 8090. In the depicted embodiment, the legs of the key 8095 have passed through corresponding holes 8084 in the latch 8082 to contact and remove the legs of the button 8070 from engagement with the lock feature 8090.

In some embodiments, the button 8070 may be used to replace the lock feature 8090. For example, with reference to FIG. 85E, the lock feature 8090 may be removed (e.g., in a similar manner to that shown in FIG. 85F with the legs 8096*a-b* of the key 8095), and the button 8070 may be inserted in the remaining space. In some such embodiments, the button 8070 may have a bottom surface that engages the latch 8082 when pushed by the user. Additionally, in some embodiments, the bottom surface of the button 8070 may have a cylindrical contour to allow the button to rest in a predominantly parallel manner to the dispenser housing 8014.

Example System Architecture

A schematic representation of components of an example product dispenser system 100 according to various embodiments described herein is shown in FIG. 2. It should be appreciated that the illustration in FIG. 2 is for purposes of description and that the relative size and placement of the respective components may differ. The product dispenser system 100, which includes a product dispenser 105 (e.g., a sheet product dispenser), includes components and systems that are utilized in various embodiments described herein.

The product dispenser 105 may include many different components and/or systems (such as shown in FIG. 2), including, for example, a controller 110, a roll partition 140, a first dispensing mechanism 121, a second dispensing mechanism 126, a first funnel sensor 141, a second funnel sensor 146, a first chute sensor 142, a second chute sensor 147, a first tear bar mechanism 124, a second tear bar mechanism 129, a memory 112, a communication interface 113, one or more user interfaces 114, a power system 116, an activation sensor 120, one or more product sensors (e.g., product level sensors) 118, and other system(s)/sensor(s) 115. Though shown in FIG. 2 as being a component of the product dispenser 105, such components are not required to be part of the product dispenser 105 according to various embodiments herein. For example, product dispensers of various embodiments described herein may include different components, but still function according to the desired embodiment. For example, some embodiments only include one product roll (as opposed to the two shown in FIG. 2) and, thus, the components may only include one dispensing mechanism, one chute sensor, one funnel sensor, and one tear bar mechanism. Similarly, some embodiments may employ a transfer mechanism (as known in the art) to enable transfer between product rolls for dispensing from a single dispensing mechanism. Along these lines, the depicted embodiment of FIG. 2 is provided for explanatory purposes and is not meant to be limiting.

As will be described in more detail herein, the controller 110 provides logic and control functionality used during operation of the product dispenser 105. Alternatively, the functionality of the controller 110 may be distributed to several controllers that each provides more limited functionality to discrete portions of the operation of product dispenser 105.

The product dispenser 105 may be configured to hold two full product rolls. For example, the depicted product dispenser 105 houses a first product roll 151, such as may be received by a first set of roll holders that are attached to a base of the product dispenser 105. Additionally, the product dispenser 105 houses a second product roll 156, such as may be received by a second set of roll holders. In the depicted embodiment, the second product roll 156 is received within roll holders that are attached to a roll partition 140.

The roll partition 140 may be designed, in some embodiments, to hold a product roll (e.g., product roll 156). Additionally, the roll partition 140 may be movably (e.g., pivotably) attached to the base and/or cover of the product dispenser 105, thereby enabling movement of the roll partition between a closed position and an open position. In some embodiments, the roll partition 140 may be configured to help separate or manage the web paths of the first product roll 151 and the second product roll 156.

The activation sensor 120 may be configured to sense/receive user input (such as a user's hand or portion thereof) indicating a desire to cause the product dispenser 105 to dispense a portion of product (e.g., a portion of sheet from the first or second product roll). The activation sensor 120 may be any type of sensor or feature capable of receiving user input to begin dispensing, including for example, a capacitive sensor, a light sensor, an IR sensor, a mechanical lever or button, etc. The activation sensor 120 may be in communication with the controller 110 such that the controller 110 can determine when to cause dispensing of the product.

The first and second dispensing mechanism 121, 126 may each be configured to cause dispensing of a portion of the product, such as a portion (or length) of the roll of product (e.g., the first or second product roll). Depending on the configuration, the dispensing mechanisms 121, 126 may each comprise a motor (e.g., first motor 122 or second motor 127, respectively) that drives one or more drive rollers (e.g., first roller(s) 123 or second roller(s) 128, respectively). In each dispensing mechanism, a portion of the product roll may be sandwiched (e.g., in frictional contact) between the drive roller and one or more pinch rollers such that operation/rotation of the drive roller causes dispensing of a portion of the product roll. The first and second dispensing mechanism motors 122, 127 may be in communication with the controller 110 such that the controller 110 may control operation of the motors 122, 127.

The first and second funnel sensors 141, 146 may each be positioned within or relative to the funnels for the corresponding first and second dispensing mechanisms 121, 126 and configured to sense the presence (or absence) of product within the corresponding funnels. For example, the first funnel sensor 141 may be positioned to sense for product within the funnel leading into the first dispensing mechanism 121. In some embodiments, the first and second funnel sensors 141, 146 may be configured to utilize IR sensing capabilities to sense the presence of the product in the funnel. In some embodiments, however, other types of sensors may be utilized (e.g., capacitive sensors, light sensors, mechanical sensors, etc.). The first and second funnel sensors 141, 146 may be in communication with the controller 110 such that the controller 110 may determine when product is present or absent within each funnel.

The first and second chute sensors 142, 147 may each be positioned within or relative to the chutes for the corresponding first and second dispensing mechanisms 121, 126 and configured to sense the presence (or absence) of product within the corresponding chutes. For example, the first chute sensor 142 may be positioned to sense for product within the chute extending from the first dispensing mechanism 121 (e.g., where the product is dispensed). In some embodiments, the first and second chute sensors 142, 147 may be configured to utilize IR sensing capabilities to sense the presence of the product in the chute(s). In some embodiments, however, other types of sensors may be utilized (e.g., capacitive sensors, light sensors, mechanical sensors, etc.). The first and second chute sensors 142, 147 may be in communication with the controller 110 such that the controller 110 may determine when product is present or absent within each chute.

The first and second tear mechanisms 124, 129 may each be configured to enable tearing of the dispensed portion of the product roll. In this regard, the first and second tear mechanisms 124, 129 may each comprise a tear bar or other feature that can enable a user to provide a force to tear off the portion of the product roll. For example, the first and second tear mechanisms 124, 129 may include a serrated edge that cuts into the sheet when the user pulls the dispensed product. The separated portion of the product from the product roll may then be used and discarded as necessary by the user. Alternatively, the first and second tear mechanisms 124, 129 may be configured to perform a tear or partial tear prior to interaction with the user such that the user simply pulls on the pre-torn portion of the product roll to complete dispensing of the portion of the product. In some embodiments, the first and second tear mechanisms 124, 129 may be configured to detect the occurrence of tearing of the product. For example, the serrated edge of a blade of the first and second tear mechanisms 124, 129 may be configured to sense and/or move in response to tearing occurring. In some embodiments, other types of tear mechanisms that can sense tearing of the product can be utilized. In this regard, the first and second tear mechanisms 124, 129 may be in communication with the controller 110 such that the controller 110 may determine when product is torn (such as during a dispense).

The product sensor(s) 118 (e.g., product level sensor(s)) is configured to sense product data (e.g., from the first and/or second product roll). In some embodiments, the product data may correspond to dispensing from at least one of the first product roll or the second product roll (e.g., how much product is being dispensed, when product is being dispensed, which product roll is dispensing occurring from, etc.). Additionally or alternatively, the product data may correspond to an amount of product remaining for at least one of the first product roll or the second product roll (e.g., a remaining size of the product roll, an amount of the product roll remaining, etc.). The product sensor 118 may be in communication with the controller 110 such that the controller 110 may receive the product data and perform one or more determinations regarding the product data (e.g., if one or more of the product rolls are substantially depleted, which product roll is dispensing, if there is leftover product in an exit chute, if there is a product jam, among others). Depending on the configuration of the product dispenser 105 and/or the desired information/product data, one or more product sensors 118 may be configured to sense data from the first product roll 151, the second product roll 156, and/or other components of the product dispenser 105 (e.g., the first and second tear mechanisms 124, 129, the first and second dispensing mechanisms 121, 126, etc.).

The controller 110 is a suitable electronic device capable of executing dispenser functionality via hardware and/or software control, with the preferred embodiment accepting data and instructions, executing the instructions to process the data, and presenting the results. Controller 110 may accept instructions through the user interface 114, or through other means such as but not limited to the activation sensor 120, other sensors, voice activation means, manually-operable selection and control means, radiated wavelength and electronic or electrical transfer. Therefore, the controller 110 can be, but is not limited to, a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

The controller 110 may be operably coupled with one or more components of the product dispenser 105. Such operable coupling may include, but is not limited to, solid-core wiring, twisted pair wiring, coaxial cable, fiber optic cable, mechanical, wireless, radio, and infrared. Controller 110 may be configured to provide one or more operating signals to these components and to receive data from these components. Such communication can occur using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The controller 110 may include one or more processors coupled to a memory device 112. Controller 110 may optionally be connected to one or more input/output (I/O) controllers or data interface devices (not shown). The memory 112 may be any form of memory such as an EPROM (Erasable Programmable Read Only Memory) chip, a flash memory chip, a disk drive, or the like. As such, the memory 112 may store various data, protocols, instructions, computer program code, operational parameters, etc. In this regard, controller 110 may include operation control methods embodied in application code. These methods are embodied in computer instructions written to be executed by one or more processors, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 110 may be configured to execute computer program code instructions to perform aspects of various embodiments of the present invention described herein. For example, the controller 110 may be configured to determine an instance in which one of the product rolls is substantially depleted. In such a regard, in some embodiments, the controller 110 may be configured to switch between operation of the first and second dispensing mechanisms 121, 126 to ensure constant ability to dispense product—such as described in various example embodiments herein.

The user interface 114 may be configured to provide information and/or indications to a user. In some embodiments, the user interface 114 may comprise one or more light emitting diodes (LEDs) to indicate such information (e.g., low battery, dispensing is occurring, low product amount, transfer complete, etc.). In some embodiments, the user interface 114 may include a screen to display such information. In some embodiments, the user interface 114 may include an interface on the exterior of the product dispenser 105 such as for an end consumer. Additionally or alternatively, the user interface 114 (including a second user interface) may be configured to provide information or indications to a maintainer (e.g., maintenance personnel), such as internally of the cover of the product dispenser 105.

In some embodiments, the user interface 114 may be configured to receive user input such as through a keypad, touchscreen, buttons, or other input device. The user interface 114 may be in communication with the controller 110 such that the controller 110 can operate the user interface 114 and/or receive instructions or information from the user interface 114. In some embodiments, the user interface 114 may include an interface on the exterior of the product dispenser 105 such as for an end consumer. Additionally or alternatively, the user interface 114 (including a second user interface) may be internal of the cover of the product dispenser 105, such as for a maintainer (e.g., maintenance personnel).

The communication interface 113 may be configured to enable connection to external systems (e.g., an external network 102). In this manner, the controller 110 may retrieve data and/or instructions from or transmit data and/or instructions to a remote, external server via the external network 102 in addition to or as an alternative to the memory 112.

In an example embodiment, the electrical energy (e.g., power 116) for operating the product dispenser 105 may be provided by a battery, which may be comprised of one or more batteries arranged in series or in parallel to provide the desired energy. For example, the battery may comprise four 1.5-volt "D" cell batteries. Additionally or alternatively, the power 116 may be supplied by an external power source, such as an alternating current ("AC") power source or a solar power source, or any other alternative power source as may be appropriate for an application. The AC power source may be any conventional power source, such as a 120V, 60 Hz wall outlets for example.

The other sensor(s)/system(s) 115 may be any other type of sensors or systems that are usable in various embodiments of the present invention. Some example additional sensors or systems include a position sensor, a time sensor, a cover opening or closing sensor, among many others.

As indicated herein, some embodiments of the present invention may be utilized with other types of product dispensers (such as mechanical product dispensers). Additional information regarding non-automated (mechanical) product dispensers, including components and functionality thereof, can be found in U.S. Pat. Nos. 7,270,292 and 5,441,189, both of which are assigned to the owner of the present invention and incorporated by reference in their entireties.

Example Flowchart(s)

Embodiments of the present invention provide methods, apparatuses and computer program products for controlling and operating product dispensers according to various embodiments described herein. Various examples of the operations performed in accordance with embodiments of the present invention will now be provided with reference to FIGS. 86-90.

FIG. 86 illustrates a flowchart according to an example method for controlling operation of a product dispenser to provide for automatic or assisted feeding according to an example embodiment 4000. The operations illustrated in and described with respect to FIG. 86 may, for example, be performed by, with the assistance of, and/or under the control of one or more of the controller 110, memory 112, communication interface 113, user interface 114, product sensor 118, first or second dispensing mechanism 121/126, first or second funnel sensor 141/146, first or second chute sensor 142/147, first or second tear mechanism 124/129, activation sensor 120, and/or other sensor(s)/system(s) 115 of the product dispenser 105.

Operation 4002 may comprise receiving an indication from a funnel sensor that a leading edge of a product is proximate the dispensing nip of a dispensing mechanism. The controller 110, memory 112, communication interface 113, and/or first or second funnel sensor 141/146 may, for example, provide means for performing operation 4002. Operation 4004 may comprise causing operation of the motor for the drive roller of the dispensing nip. The controller 110, memory 112, communication interface 113, and/or first or second dispensing mechanism 121/126 may, for example, provide means for performing operation 4004. Operation 4006 may comprise receiving an indication from a chute sensor that a leading edge of a product is within the chute. The controller 110, memory 112, communication interface 113, and/or first or second chute sensor 142/147 may, for example, provide means for performing operation 4006. Operation 4008 may comprise causing operation of the motor to cease to end the automatic or assisted feeding operation to load the product roll into the dispensing mechanism. The controller 110, memory 112, communication interface 113, and/or first or second dispensing mechanism 121/126 may, for example, provide means for performing operation 4008.

FIG. 87 illustrates a flowchart according to an example method for controlling operation of a product dispenser to provide for dispensing product according to a desired sheet length according to an example embodiment 4100. The operations illustrated in and described with respect to FIG. 87 may, for example, be performed by, with the assistance of, and/or under the control of one or more of the controller 110, memory 112, communication interface 113, user interface 114, product sensor 118, first or second dispensing mechanism 121/126, first or second funnel sensor 141/146, first or second chute sensor 142/147, first or second tear mechanism 124/129, activation sensor 120, and/or other sensor(s)/system(s) 115 of the product dispenser 105.

Operation 4102 may comprise receiving a request to dispense the product. The controller 110, memory 112, communication interface 113, and/or activation sensor 120 may, for example, provide means for performing operation 4102. Operation 4104 may comprise causing operation of the motor to rotate the drive roller to begin a dispense. The controller 110, memory 112, communication interface 113, and/or first or second dispensing mechanism 121/126 may, for example, provide means for performing operation 4104. Operation 4106 may comprise counting motor rotations during operation. The controller 110, memory 112, communication interface 113, and/or other sensor(s)/system(s) 115 may, for example, provide means for performing operation 4106. Operation 4108 may comprise causing operation of the motor to cease when a certain number of motor rotations have occurred to dispense a desired sheet length of the product. The controller 110, memory 112, communication interface 113, and/or first or second dispensing mechanism 121/126 may, for example, provide means for performing operation 4108.

FIG. 88 illustrates a flowchart according to an example method for controlling operation of a product dispenser to provide for dispensing product from the smaller product roll according to an example embodiment 4200. The operations illustrated in and described with respect to FIG. 88 may, for example, be performed by, with the assistance of, and/or under the control of one or more of the controller 110, memory 112, communication interface 113, user interface 114, product sensor 118, first or second dispensing mechanism 121/126, first or second funnel sensor 141/146, first or second chute sensor 142/147, first or second tear mechanism 124/129, activation sensor 120, and/or other sensor(s)/system(s) 115 of the product dispenser 105.

Operation 4202 may comprise receiving a request to dispense the product. The controller 110, memory 112, communication interface 113, and/or activation sensor 120 may, for example, provide means for performing operation 4202. Operation 4204 may comprise determining an amount of fuel (e.g., product) remaining for a first product roll. The controller 110, memory 112, communication interface 113, and/or product sensor 118 may, for example, provide means for performing operation 4204. Operation 4206 may comprise determining an amount of fuel remaining for a second product roll. The controller 110, memory 112, communication interface 113, and/or product sensor 118 may, for example, provide means for performing operation 4206. Operation 4208 may comprise causing dispensing to occur from the product roll with the lesser amount of fuel remaining. The controller 110, memory 112, communication interface 113, and/or first or second dispensing mechanism 121/126 may, for example, provide means for performing operation 4208.

FIG. 89 illustrates a flowchart according to an example method for controlling operation of a product dispenser to provide for dispensing product from the smaller product roll according to an example embodiment 4300. The operations illustrated in and described with respect to FIG. 89 may, for example, be performed by, with the assistance of, and/or under the control of one or more of the controller 110, memory 112, communication interface 113, user interface 114, product sensor 118, first or second dispensing mechanism 121/126, first or second funnel sensor 141/146, first or second chute sensor 142/147, first or second tear mechanism 124/129, activation sensor 120, and/or other sensor(s)/system(s) 115 of the product dispenser 105.

Operation 4302 may comprise determining a time period for a rotation cycle of a first product roll. The controller 110, memory 112, communication interface 113, product sensor 118 and/or other sensor(s)/system(s) 115 may, for example, provide means for performing operation 4302. Operation 4304 may comprise determining a time period for a rotation cycle of a drive roller associated with the first product roll. The controller 110, memory 112, communication interface 113, product sensor 118 and/or other sensor(s)/system(s) 115 may, for example, provide means for performing operation 4304. Operation 4306 may comprise determining a time period for a rotation cycle of a second product roll. The controller 110, memory 112, communication interface 113, product sensor 118 and/or other sensor(s)/system(s) 115 may, for example, provide means for performing operation 4306. Operation 4308 may comprise determining a time period for a rotation cycle of a drive roller associated with the second product roll. The controller 110, memory 112, communication interface 113, product sensor 118 and/or other sensor(s)/system(s) 115 may, for example, provide means for performing operation 4308. Operation 4310 may comprise comparing a first ratio of the rotation cycle time period for the first product roll over the rotation cycle time period for the drive roller associated with the first product roll with a second ratio of the rotation cycle time period for the second product roll over the rotation cycle time period for the drive roller associated with the second product roll. The controller 110, memory 112, and/or communication interface 113 may, for example, provide means for performing operation 4310.

Operation 4312 may comprise receiving a request to dispense the product. The controller 110, memory 112, communication interface 113, and/or activation sensor 120 may, for example, provide means for performing operation 4312. Operation 4314 may comprise causing dispensing to occur from the product roll associated with the smaller ratio. The controller 110, memory 112, communication interface 113, and/or first or second dispensing mechanism 121/126 may, for example, provide means for performing operation 4314.

FIG. 90 illustrates a flowchart according to an example method for controlling operation of a product dispenser to provide for dispensing product from the next product roll according to an example embodiment 4400. The operations illustrated in and described with respect to FIG. 90 may, for example, be performed by, with the assistance of, and/or under the control of one or more of the controller 110, memory 112, communication interface 113, user interface 114, product sensor 118, first or second dispensing mechanism 121/126, first or second funnel sensor 141/146, first or second chute sensor 142/147, first or second tear mechanism 124/129, activation sensor 120, and/or other sensor(s)/system(s) 115 of the product dispenser 105.

Operation 4402 may comprise receiving a request to dispense the product. The controller 110, memory 112, communication interface 113, and/or activation sensor 120 may, for example, provide means for performing operation 4402. Operation 4404 may comprise receiving an indication from a first funnel sensor associated with a first product roll that no product is present within the funnel. The controller 110, memory 112, communication interface 113, and/or first or second funnel sensor 141/146 may, for example, provide means for performing operation 4404. Operation 4406 may comprise causing dispensing to occur from a second product roll in response to receiving the indication. The controller 110, memory 112, communication interface 113, and/or first or second dispensing mechanism 121/126 may, for example, provide means for performing operation 4406.

FIGS. 86-90 illustrate flowcharts of a system, method, and computer program product according to various example embodiments described herein. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 112 and executed by, for example, the controller 110. As will be appreciated, any such computer program product may be loaded onto a computer or other programmable apparatus, such that the computer program product including the instructions which execute on the computer or other programmable apparatus creates means for implementing the functions specified in the flowcharts block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowcharts block(s).

Associated systems and methods for manufacturing example product dispensers described herein are also contemplated by some embodiments of the present invention.

Conclusion

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A sheet product dispenser comprising:

at least one roll holder to support a product roll;

a chute to direct a portion of sheet product being dispensed from the product roll;

a dispensing mechanism comprising a drive roller and defining a nip, wherein the dispensing mechanism receives the sheet product of the product roll through the nip and causes dispensing of the portion of the sheet product through the chute such that the sheet product extends along a dispensing pathway from the product roll through the nip and out of the chute;

a funnel sensor positioned along the dispensing pathway upstream of the nip to sense the presence of sheet product; and a controller to:

receive an indication from the funnel sensor upon detection of the sheet product upstream of the nip and prior to entering the nip; and cause operation of the drive roller to aid in loading of the leading edge of the sheet product into the nip.

2. The sheet product dispenser of claim 1 further comprising a chute sensor positioned within the chute to sense the presence of the sheet product of the product roll within the chute, wherein the controller:

receives an indication from the chute sensor that sheet product is present in the chute; and causes operation of the drive roller to cease such that the leading edge of the sheet product is positioned past the nip along the dispensing pathway.

3. The sheet product dispenser of claim 2 further comprising an activation sensor to sense user input, and wherein the controller:

receives an indication from the activation sensor of the user input;

determines that the sheet product is present upstream of the nip and not present in the chute; and causes a notification to be provided to the user indicating that a jam has occurred.

4. The sheet product dispenser of claim 3, wherein the controller causes operation of the drive roller to attempt to cause a dispense prior to determining that the sheet product is present upstream of the nip and not present in the chute.

5. The sheet product dispenser of claim 2 further comprising:

an activation sensor to sense user input;

at least one second roller holder to support a second product roll;

a second dispensing mechanism comprising a second drive roller and defining a second nip, wherein the second dispensing mechanism receives second sheet product of the second product roll through the second nip and causes dispensing of a portion of the second sheet product; and wherein the controller:

receives an indication from the activation sensor of the user input;

determines that the sheet product is present upstream of the nip and not present in the chute; and causes operation of the second drive roller to cause dispensing of the second sheet product.

6. The sheet product dispenser of claim 5, wherein the controller causes operation of the drive roller to attempt to cause a dispense prior to determining that the sheet product is present upstream of the nip and not present in the chute.

7. The sheet product dispenser of claim 2, wherein the chute sensor is an infrared sensor.

8. The sheet product dispenser of claim 2 further comprising a light pipe extending from the chute sensor to a printed circuit board within the dispensing mechanism, wherein the printed circuit board includes control circuitry for the controller.

9. The sheet product dispenser of claim 1, wherein the funnel sensor senses the presence of the leading edge of the sheet product when the leading edge comes within a threshold distance of the nip.

10. The sheet product dispenser of claim 1, wherein the controller, upon receiving the indication from the funnel sensor that sheet product is present upstream of the nip, causes operation of the drive roller to aid in loading of the leading edge of the sheet product through the nip by causing an operation speed of the drive roller to ramp up slowly over a period of time.

11. The sheet product dispenser of claim 1, wherein the funnel sensor comprises an infrared sensor that emits light extending along the nip such that the light is parallel to a longitudinal axis of the drive roller.

12. The sheet product dispenser of claim 1, wherein the funnel sensor comprises an infrared sensor that emits light across a width of the nip.

13. The sheet product dispenser of claim 12 further comprises a light pipe that redirects a single transmission of light coming from across the width of the nip so as to recross the width of the nip to form at least two possible break beams for sensing the presence of the sheet product attempting to enter the nip.

14. The sheet product dispenser of claim 13, wherein the light pipe redirects and breaks up the single transmission of light so as to recross the width of the nip at two different positions along the nip to thereby form three possible break beams for sensing the presence of the sheet product attempting to enter the nip.

15. A sheet product dispenser comprising:

at least one roll holder to support a roll of sheet product;

a dispensing mechanism to dispense a portion of the sheet product therethrough;

a funnel sensor to detect the presence of a leading edge of the sheet product adjacent and upstream of the dispensing mechanism; and a controller to:

receive an indication that the funnel sensor detected the presence of the leading edge of the sheet product adjacent and upstream of the dispensing mechanism and prior to the sheet product entering a nip of the dispensing mechanism; and cause operation of the dispensing mechanism to aid in loading the leading edge of the sheet product into the dispensing mechanism.

16. The sheet product dispenser of claim 15 further comprising a chute and a chute sensor to detect the presence of the sheet product within the chute, and wherein the controller causes operation of the dispensing mechanism to discontinue in response to receiving an indication that the chute sensor detected the presence of the sheet product in the chute.

17. The sheet product dispenser of claim 15, wherein the funnel sensor detects the presence of the leading edge of the sheet product when the leading edge comes within a threshold distance of the dispensing mechanism.

18. The sheet product dispenser of claim 15, wherein the controller, upon receiving the indication from the funnel sensor that the funnel sensor detected the presence of the leading edge of the sheet product adjacent the dispensing mechanism, causes operation of the dispensing mechanism to aid in loading of the leading edge of the sheet product into the dispensing mechanism by causing an operation speed of the dispensing mechanism to ramp up slowly over a period of time.

19. The sheet product dispenser of claim 15, wherein the funnel sensor comprises an infrared sensor that emits light across the dispensing mechanism.

20. The sheet product dispenser of claim 19 further comprising a light pipe that redirects a single transmission of light coming from across the width of the dispensing mechanism so as to recross the width of the nip to form at least two possible break beams for sensing the presence of the sheet product attempting to enter the dispensing mechanism.

21. A sheet product dispenser comprising:

a first roll holder to support a first product roll;

a second roll holder to support a second product roll;

a first dispensing mechanism to dispense first sheet product of the first product roll therethrough;

a second dispensing mechanism to dispense second sheet product of the second product roll therethrough;

a first funnel sensor positioned upstream of the first dispensing mechanism so as to sense a leading edge of the first sheet product;

a second funnel sensor positioned upstream of the second dispensing mechanism so as to sense a leading edge of the second sheet product; and a controller to:

receive an indication from the first funnel sensor upon detection of the leading edge of the first sheet product upstream of the first dispensing mechanism and, in response thereto, cause operation of the first dispensing mechanism to aid in loading of the leading edge of the first sheet product through the first dispensing mechanism; or receive an indication from the second funnel sensor upon detection of the leading edge of the second sheet product upstream of the second dispensing mechanism and, in response thereto, cause operation of the second dispensing mechanism to aid in loading of the leading edge of the second sheet product through the second dispensing mechanism.

* * * * *